US010527329B2

(12) United States Patent
Oshitani et al.

(10) Patent No.: US 10,527,329 B2
(45) Date of Patent: Jan. 7, 2020

(54) EJECTOR-TYPE REFRIGERATION CYCLE DEVICE

(75) Inventors: Hiroshi Oshitani, Toyota (JP); Kenichi Fujiwara, Kariya (JP); Haruyuki Nishijima, Obu (JP); Etsuhisa Yamada, Kariya (JP); Tooru Ikemoto, Chiryu (JP); Youhei Nagano, Iwakura (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 1565 days.

(21) Appl. No.: 12/867,025

(22) PCT Filed: Apr. 16, 2009

(86) PCT No.: PCT/JP2009/001767
§ 371 (c)(1),
(2), (4) Date: Aug. 10, 2010

(87) PCT Pub. No.: WO2009/128271
PCT Pub. Date: Oct. 22, 2009

(65) Prior Publication Data

US 2011/0005268 A1 Jan. 13, 2011

(30) Foreign Application Priority Data

Apr. 18, 2008 (JP) ..... 2008-108676
Oct. 6, 2008 (JP) ..... 2008-259501
(Continued)

(51) Int. Cl.
*F25B 1/06* (2006.01)
*F25B 41/00* (2006.01)
(Continued)

(52) U.S. Cl.
CPC ..... *F25B 41/00* (2013.01); *F25B 1/10* (2013.01); *F25B 40/00* (2013.01); *F25B 2341/0012* (2013.01)

(58) Field of Classification Search
CPC ..... F25B 41/00; F25B 5/04; F25B 2341/001; F25B 2341/0011; F25B 2341/0013; F25B 2341/0012; F25B 1/10; F25B 6/04
(Continued)

(56) References Cited

U.S. PATENT DOCUMENTS 6,584,794 B2 7/2003 Takeuchi et al.
6,675,609 B2 * 1/2004 Takeuchi ..... F25B 1/08 62/500
(Continued)

FOREIGN PATENT DOCUMENTS

JP 06058638 A 3/1994
JP 10-205898 8/1998
(Continued)

OTHER PUBLICATIONS

Office Action (second) dated Aug. 10, 2012 in corresponding Chinese Application No. 200980106234.1 with English translation.
(Continued)

*Primary Examiner* — Frantz F Jules
*Assistant Examiner* — Martha Tadesse
(74) *Attorney, Agent, or Firm* — Harness, Dickey & Pierce, P.L.C.

(57) ABSTRACT

In an ejector-type refrigeration cycle device provided with a first compression mechanism and a second compression mechanism, a refrigerant outlet of a suction side evaporator is coupled to a refrigerant suction port of the ejector, and a second compression mechanism is provided between the suction side evaporator and the refrigerant suction port of the ejector. Thus, even in an operation condition in which
(Continued)

suction capacity of the ejector is decreased in accordance with a decrease of the flow amount of a drive flow of the ejector, the suction capacity of the ejector can be supplemented by the operation of the second compression mechanism. Accordingly, even when a variation in the flow amount of the drive flow is caused, the ejector-type refrigeration cycle device can be stably operated.

27 Claims, 67 Drawing Sheets

(30) Foreign Application Priority Data

| | | |
|---|---|---|
| Oct. 6, 2008 | (JP) | 2008-259502 |
| Oct. 6, 2008 | (JP) | 2008-259503 |
| Oct. 6, 2008 | (JP) | 2008-259504 |
| Dec. 9, 2008 | (JP) | 2008-312958 |
| Dec. 9, 2008 | (JP) | 2008-312959 |

(51) Int. Cl.
*F25B 1/10* (2006.01)
*F25B 40/00* (2006.01)

(58) Field of Classification Search
USPC ..... 62/500, 515, 504, 512, 222, 225, 227, 62/217, 486
See application file for complete search history.

(56) References Cited

U.S. PATENT DOCUMENTS

| | | | | |
|---|---|---|---|---|
| 6,945,074 | B2 * | 9/2005 | Sato | F25B 6/00 62/228.5 |
| 7,367,202 | B2 * | 5/2008 | Yamada | F25B 41/00 62/170 |
| 7,513,128 | B2 * | 4/2009 | Yamada | F25B 5/00 62/500 |
| 7,690,218 | B2 | 4/2010 | Ikegami et al. | |
| 7,987,685 | B2 * | 8/2011 | Oshitani | F25B 41/00 62/500 |
| 2001/0025499 | A1 | 10/2001 | Takeuchi et al. | |
| 2002/0124592 | A1 | 9/2002 | Takeuchi et al. | |
| 2002/0184903 | A1 | 12/2002 | Takeuchi et al. | |
| 2003/0140651 | A1 | 7/2003 | Takeuchi et al. | |
| 2005/0028552 | A1 * | 2/2005 | Nishijima | F25B 31/004 62/500 |
| 2005/0178150 | A1 | 8/2005 | Oshitani et al. | |
| 2005/0268644 | A1 | 12/2005 | Oshitani et al. | |
| 2006/0254308 | A1 * | 11/2006 | Yokoyama | B60H 1/3205 62/500 |
| 2007/0028630 | A1 * | 2/2007 | Yamada | F25B 5/00 62/170 |
| 2007/0039349 | A1 * | 2/2007 | Yamada | F25B 41/00 62/500 |
| 2007/0039350 | A1 * | 2/2007 | Takeuchi | F25B 5/00 62/500 |
| 2007/0119207 | A1 * | 5/2007 | Oshitani | F25B 5/00 62/500 |
| 2007/0163293 | A1 * | 7/2007 | Ikegami | F25B 41/00 62/500 |
| 2008/0000263 | A1 | 1/2008 | Oomura et al. | |
| 2008/0087040 | A1 | 4/2008 | Oshitani et al. | |
| 2008/0098757 | A1 * | 5/2008 | Takeuchi | F25B 41/00 62/217 |
| 2010/0139315 | A1 | 6/2010 | Ikegami et al. | |

FOREIGN PATENT DOCUMENTS

| | | | | | |
|---|---|---|---|---|---|
| JP | 10-205898 | A | | 8/1998 | |
| JP | 10205898 | A | * | 8/1998 | |
| JP | 10205898 | A | * | 8/1998 | |
| JP | 2002-318019 | A | | 10/2002 | |
| JP | 3322263 | B | | 10/2002 | |
| JP | 2002-327967 | A | | 11/2002 | |
| JP | 2003-083622 | | | 3/2003 | |
| JP | 2004-205154 | | | 7/2004 | |
| JP | 2004-212025 | | | 7/2004 | |
| JP | 2004-251558 | | | 9/2004 | |
| JP | 2004-251558 | A | | 9/2004 | |
| JP | 2005-233513 | | | 9/2005 | |
| JP | 2005-300067 | | | 10/2005 | |
| JP | 2005-300067 | A | | 10/2005 | |
| JP | 2005-308380 | A | | 11/2005 | |
| JP | 3931899 | B | | 11/2005 | |
| JP | 2006-017444 | A | | 1/2006 | |
| JP | 2006-097930 | | | 4/2006 | |
| JP | 2006-118726 | | | 5/2006 | |
| JP | 2006-234225 | A | | 9/2006 | |
| JP | 2006-292351 | | | 10/2006 | |
| JP | 2006-292351 | A | | 10/2006 | |
| JP | 2007-078340 | | | 3/2007 | |
| JP | 2007-078340 | A | | 3/2007 | |
| JP | 2007057186 | A | * | 3/2007 | |
| JP | 2007057186 | A | * | 3/2007 | F25B 41/00 |
| JP | 2007-212121 | | | 8/2007 | |
| JP | 2007-212121 | A | | 8/2007 | |
| JP | 2008-008599 | A | | 1/2008 | |
| JP | 2008-045774 | | | 2/2008 | |
| JP | 2008-045774 | A | | 2/2008 | |
| JP | 2008-107055 | A | | 5/2008 | |

OTHER PUBLICATIONS

Office action dated Mar. 5, 2013 in corresponding Japanese Application No. 2011-278503.
Office action dated Oct. 25, 2011 in corresponding JP Application No. 2008-259503.
Search and Examination Report dated Dec. 12, 2012 in corresponding Singapore Application No. 201005721-4.
Office action dated Dec. 13, 2011 in corresponding Japanese Application No. 2009-2322.
Office action dated Dec. 13, 2011 in corresponding Japanese Application No. 2008-300785.
Office Action dated Jun. 9, 2011 from Intellectual Property Office of Singapore in the corresponding Singapore Patent Application No. 201005721-4.
Examination Report dated Sep. 24, 2013 in the corresponding JP Application No. 2011-278503 with English translation thereof.

* cited by examiner

EJECTOR-TYPE REFRIGERATION CYCLE DEVICE

CROSS REFERENCE TO RELATED APPLICATION

This application is based on Japanese Patent Applications No. 2008-108676 filed on Apr. 18, 2008, No. 2008-259501 filed on Oct. 6, 2008, No. 2008-259502 filed on Oct. 6, 2008, No. 2008-259503 filed on Oct. 6, 2008, No. 2008-259504 filed on Oct. 6, 2008, No. 2008-312958 filed on Dec. 9, 2008, and No. 2008-312959 filed on Dec. 9, 2008, the contents of which are incorporated herein by reference in its entirety.

FIELD OF THE INVENTION

The present invention relates to an ejector-type refrigeration cycle device, which has an ejector.

BACKGROUND OF THE INVENTION

Conventionally, an ejector-type refrigeration cycle device having an ejector, provided with functions of a refrigerant decompression means and a refrigerant circulating means, is known. For example, Patent Documents 1-3 describe regarding an ejector-type refrigeration cycle devices, in which refrigerant discharged from a compressor is cooled by performing heat exchange with outside air in a radiator, and the cooled high-pressure refrigerant is decompressed in a nozzle portion of an ejector.

For example, in the ejector-type refrigerant cycle device of Patent Document 1, a gas-liquid separator is arranged at a downstream side of a diffuser portion of an ejector to separate low-pressure refrigerant into gas refrigerant and liquid refrigerant. Furthermore, a gas refrigerant outlet of the gas-liquid separator is connected to a refrigerant suction port of the compressor, a liquid refrigerant outlet of the gas-liquid separator is connected to a refrigerant inlet of a suction side evaporator, and a refrigerant outlet of the suction side evaporator is connected to a refrigerant suction port of the ejector.

Furthermore, in an ejector-type refrigeration cycle device of Patent Document 2, a branch portion is provided at an upstream side of a nozzle portion of an ejector to branch a flow of the refrigerant flowing out of a radiator. Furthermore, the branch portion is provided, such that one refrigerant branched at the branch portion flows toward the nozzle portion of the ejector, and the other refrigerant branched at the branch portion flows toward a refrigerant suction port of the ejector.

In addition, a discharge side evaporator is arranged at a downstream side of the diffuser portion of the ejector to evaporate the refrigerant flowing out of the diffuser portion of the ejector. A fixed throttle for decompressing and expanding the refrigerant and the suction side evaporator are arranged between the branch portion and the refrigerant suction port of the ejector so as to obtain cooling capacity in both the discharge side evaporator and the suction side evaporator.

In an ejector-type refrigeration cycle device of Patent Document 3, a branch portion is provided at a downstream side of a diffuser portion of an ejector to branch a flow of the refrigerant flowing out of the diffuser portion. Furthermore, the branch portion is provided, such that one refrigerant branched at the branch portion flows into the discharge side evaporator, and the other refrigerant branched at the branch portion flows toward a refrigerant suction port of the ejector via the suction side evaporator. Thereby, cooling capacity can be obtained in both the discharge side evaporator and the suction side evaporator.

In the ejector used for this-kind ejector-type refrigeration cycle device, high-pressure refrigerant is decompressed and expanded in the nozzle portion of the ejector to be jetted, and the refrigerant downstream of the suction side evaporator is drawn therein from the refrigerant suction port by a pressure decrease of the jet refrigerant, thereby recovering the loss of the kinetic energy in the decompression and expansion of the nozzle portion.

By converting the recovered kinetic energy (hereinafter, referred to as "recovery energy" to the pressure energy in the diffuser portion of the ejector, the pressure of the suction refrigerant of the compressor can be increased, thereby reducing the drive power of the compressor and improving the coefficiency of performance (COP) in the ejector-type refrigeration cycle device.

DOCUMENT OF PRIOR ART

Patent Document

[Patent document 1] JP Patent No. 3322263
[Patent document 2] JP Patent No. 3931899
[Patent document 3] JP 2008-107055A However, in the ejector-type refrigeration cycle device of these kinds, the suction capacity of the ejector is decreased in accordance with a decrease of the flow amount of the refrigerant (drive flow) passing through the nozzle portion, thereby reducing the recovery energy amount. Thus, the COP improvement may be decreased in accordance with the decrease in the flow amount of the drive flow in the ejector.

For example, in the ejector-type refrigeration cycle device of Patent Document 1, if the pressure of the high pressure refrigerant is decreased in accordance with a decrease in the outside air temperature, a pressure difference between high pressure refrigerant and low pressure refrigerant is reduced, thereby decreasing the flow amount of the drive flow in the ejector.

If a decrease in the flow amount of the drive flow is caused, the suction capacity of the ejector is decreased, and thereby not only the recovery energy amount is reduced but also it is difficult to supply the liquid refrigerant from the gas-liquid separator to the evaporator. Thus, the cooling capacity obtained in the cycle is reduced. As a result, the COP improvement may be greatly decreased in accordance with the decrease in the flow amount of the drive flow.

When the suction capacity of the ejector is decreased and it is difficult to supply the refrigerant to the evaporator, it is difficult for low-pressure refrigerant to have heat-absorbing action, thereby causing a problem of breakdown in the cycle.

The detail will be described with FIG. 118. FIG. 118 is a Mollier diagram showing a refrigerant state of the ejector-type refrigeration cycle device of Patent Document 1. In addition, the solid line of FIG. 118 shows the state of the refrigerant at the time of normal operation, and the chain line of FIG. 18 shows the state of the refrigerant at the time of the above-described breakdown arising in the cycle.

As shown in FIG. 118, if a pressure difference between the high pressure refrigerant and low pressure refrigerant is reduced (white arrow X40 of FIG. 118), the suction capacity of the ejector will decrease. Thus, if the refrigerant is not supplied to the evaporator, the low pressure refrigerant does not have a heat-absorbing action in the evaporator (white arrow Y40 of FIG. 118).

Therefore, as in the chain line of FIG. 118, the heat quantity of the refrigerant radiated at the radiator corresponds to the compression work amount of the compressor. As a result, heat quantity cannot be moved from a low pressure side to a high pressure side, thereby breaking the cycle.

On the other hand, in the ejector-type refrigeration cycle device of the Patent Document 2, the refrigerant passage from the branch portion to the refrigerant suction port of the ejector through the fixed throttle and the suction side evaporator is made in parallel connection with the nozzle portion of the ejector. Therefore, by using the refrigerant suction and discharge capacity of the compressor, the refrigerant flowing into the suction side evaporator can be introduced to the refrigerant suction port of the ejector.

Thus, even when the pressure difference between the high pressure refrigerant and the low pressure refrigerant is reduced thereby reducing the flow amount of the drive flow and reducing the recovery energy amount of the ejector, the refrigerant can be supplied to the suction side evaporator and the discharge side evaporator by the operation of the compressor.

Thus, it can prevent a cycle breakdown described in the ejector-type refrigeration cycle device of Patent Document 1. However, in accordance with the flow amount decrease of the drive flow, the pressurizing amount in the diffuser portion of the ejector is decreased, and thereby it cannot avoid about COP decrease.

In the ejector-type refrigeration cycle device of Patent Document 3, refrigerant flows in this order of the compressor→the radiator→the ejector→the discharge side evaporator→the compressor, to be circulated in a cycle. In this case, even when the pressure difference between the high pressure refrigerant and the low pressure refrigerant is reduced thereby reducing the suction capacity of the ejector, the refrigerant can be supplied to the discharge side evaporator by the operation of the compressor.

Thus, it can prevent a cycle breakdown described in the ejector-type refrigeration cycle device of Patent Document 1. However, in accordance with the flow amount decrease of the drive flow, the pressurizing amount in the diffuser portion of the ejector is decreased, and thereby it cannot avoid about COP decrease. Furthermore, the COP is also decreased because the refrigerant cannot be supplied to the suction side evaporator.

That is, in the ejector-type refrigeration cycle device using the ejector as a refrigerant decompression means, if a variation in the flow amount of the drive flow is caused, it may be difficult to stably operate the cycle while having a high COP.

SUMMARY OF THE INVENTION

The present invention is made in view of the above matters, and it is an object of the present invention to stably operate an ejector-type refrigeration cycle device even when a variation in a flow amount of a drive flow is caused in an ejector.

According to a first example of the present invention, an ejector-type refrigeration cycle device includes: a first compression mechanism (11*a*) configured to compress and discharge refrigerant; a radiator (12) configured to cool high-pressure refrigerant discharged from the first compression mechanism (11*a*); an ejector (13) including a nozzle portion (13*a*) adapted to decompress and expand the refrigerant flowing out of the radiator (12), a refrigerant suction port (13*b*) adapted to draw the refrigerant by a high-speed flow of the refrigerant jetted from the nozzle portion (13*a*), and a diffuser portion (13*d*) adapted to pressurize mix-refrigerant of the jet refrigerant and the refrigerant drawn from the refrigerant suction port (13*b*); a suction side evaporator (16) configured to evaporate the refrigerant and to cause the evaporated refrigerant to flow toward the refrigerant suction port (13*b*) of the ejector (13); and a second compression mechanism (21*a*) configured to draw the refrigerant flowing out of the suction side evaporator (16), to compress the drawn refrigerant and to discharge the compressed refrigerant.

Because the second compression mechanism (21*a*) is provided, even in an operation condition in which suction capacity of the ejector (13) is decreased in accordance with a decrease of the flow amount of a drive flow of the ejector (13), the suction capacity of the ejector (13) can be supplemented by the operation of the second compression mechanism (21*a*). Accordingly, the ejector-type refrigeration cycle device can be stably operated, regardless of the variation of the flow amount of the drive flow.

That is, because the suction capacity of the ejector (13) is supplemented by the second compression mechanism (21*a*), it can restrict the density of the refrigerant, supplied from the diffuser portion (13*d*) to the first compression mechanism (11*a*), from being reduced. Thus, it can restrict a decrease of the refrigerant flow amount discharged from the first compression mechanism (11*a*).

As a result, even in an operation condition in which a pressure difference between a high pressure refrigerant and a low pressure refrigerant is easy to be reduced, a decrease in the flow amount of the drive flow of the ejector (13) can be restricted, and thereby the ejector-type refrigeration cycle device can be stably operated.

Furthermore, the refrigerant pressure is increased by the pressurizing action in the first and second compression mechanisms (11*a*, 21*a*) and in the diffuser portion (13*d*) of the ejector (13). Thus, as compared with a case where the refrigerant is pressurized by a single compression mechanism, the driving power of the first and second compression mechanisms (11*a*, 21*a*) is reduced, thereby improving the COR Furthermore, by the pressurizing action of the diffuser portion (13*d*), the suction pressure of the first compression mechanism (11*a*) can be increased, thereby reducing the driving power in the first compression mechanism (11*a*). In addition, because the pressure difference between the suction pressure and the discharge pressure in the respective first and second compression mechanisms (11*a*, 21*a*) can be reduced, the compression efficiency in the respective first and second compression mechanisms (11*a*, 21*a*) can be improved.

Therefore, in a refrigeration cycle device in which the pressure difference between the high pressure refrigerant and the low pressure refrigerant is large, for example, in a refrigeration cycle device in which the refrigerant evaporation temperature of the suction side evaporator (16) is reduced to a very low temperature (e.g., −30° C.–−10° C.), the COP of the refrigeration cycle device can be improved.

For example, in the ejector-type refrigeration cycle device, a discharge-side gas-liquid separator (24) may be provided to separate the refrigerant flowing out of the diffuser portion (13*d*) of the ejector (13) into gas refrigerant and liquid refrigerant. In this case, a liquid refrigerant outlet of the discharge-side gas-liquid separator (24) may be connected to a refrigerant inlet side of the suction side evaporator (16), and a gas refrigerant outlet of the discharge-side gas-liquid separator (24) may be connected to the refrigerant suction side of the first compression mechanism (11*a*).

Thus, even in an operation condition in which suction capacity of the ejector (13) is decreased in accordance with a decrease of the flow amount of the drive flow of the ejector (13), the liquid refrigerant can be supplied from the discharge-side gas-liquid separator (24) to the suction side evaporator (16) by the operation of the second compression mechanism (21*a*). Accordingly, the ejector-type refrigeration cycle device can be accurately stably operated.

Furthermore, the saturated gas refrigerant can be drawn into the first compression mechanism (11*a*) from the gas refrigerant outlet of the discharge-side gas-liquid separator (24). Thus, as compared with a case where gas refrigerant having a super-heat degree is drawn into the first compression mechanism (11*a*), the compression operation amount of the first compression mechanism (11*a*), when the refrigerant is compressed in iso-entropy, can be reduced, thereby improving the COR Furthermore, an inner heat exchanger (30, 31, 32) may be provided to perform heat exchange between the refrigerant flowing out of the radiator (12) and a low-pressure side refrigerant in a cycle.

For example, the low-pressure side refrigerant in the cycle may be the refrigerant to be drawn into the first compression mechanism (11*a*), or may be the refrigerant to be drawn into the second compression mechanism (21*a*), or may be the refrigerant inside the discharge-side gas-liquid separator (24).

Thus, the enthalpy difference (cooling capacity) between the enthalpies of the refrigerant at the refrigerant inlet side and the refrigerant outlet side can be enlarged in the suction side evaporator (16), thereby further improving the COP.

In the ejector-type refrigeration cycle device, a high-pressure side decompression means (17) may be arranged in a refrigerant passage from a refrigerant outlet side of the radiator (12) to a refrigerant inlet side of the nozzle portion (13*a*), for decompressing and expanding the refrigerant flowing out of the radiator (12).

Accordingly, by the action of the high-pressure side decompression means (17), the refrigerant to flow into the nozzle portion (13*a*) can be decompressed to a gas-liquid two-phase state. Thus, it is compared with a case where the liquid refrigerant flows into the nozzle portion (13*a*), boiling of the refrigerant in the nozzle portion (13*a*) can be facilitated, thereby improving the nozzle efficiency.

As a result, a pressure increasing amount is increased in the diffuser portion (13*d*), thereby further improving the COP. Here, nozzle efficiency is an energy conversion efficiency in the nozzle portion (13*a*), when the pressure energy of the refrigerant is converted to the kinetic energy of the refrigerant.

In addition, because the high-pressure side decompression means (17) is configured by a variable throttle mechanism, the refrigerant flow amount flowing into the nozzle portion (13*a*) of the ejector (13) can be varied in accordance with a load variation in the cycle. As a result, even if load fluctuation arises, the refrigerant cycle can be stably operated while having a high COP.

The high-pressure side decompression means (17) may be an expansion unit, in which the volume is expanded so as to decompress the refrigerant, and the pressure energy of the refrigerant is converted to the mechanical energy. In this case, the mechanical energy output from the expansion unit can be effectively used, so that the energy efficiency in the entire ejector-type refrigeration cycle device can be improved.

For example, the radiator (12) may include a condensation portion (12*b*) provided to condense the refrigerant, a gas-liquid separation portion (12*c*) provided to separate the refrigerant flowing out of the condensation portion (12*b*) into gas refrigerant and liquid refrigerant, and a super-cooling portion (12*d*) provided to super-cool the liquid refrigerant flowing out of the gas-liquid separation portion (12*c*).

Thus, the enthalpy difference (cooling capacity) between the enthalpies of the refrigerant at the refrigerant inlet side and the refrigerant outlet side can be enlarged in the suction side evaporator (16), thereby further improving the COP.

At this time, the enthalpy of the refrigerant at the refrigerant inlet side of the suction side evaporator (16) can be reduced, and thereby the enthalpy of the refrigerant drawn into the first and second compression mechanisms (11*a*, 21*a*) is not increased. Thus, it can restrict a density reduce in the refrigerant drawn into the first and second compression mechanisms (11*a*, 21*a*). Therefore, it can prevent a decrease in the refrigerant flow amount discharged from the first and second compression mechanisms (11*a*, 21*a*), thereby surely improving the COP.

The ejector-type refrigeration cycle device may include a first discharge capacity changing means (11*b*) for changing a refrigerant discharge capacity of the first compression mechanism (11*a*), and a second discharge capacity changing means (21*b*) for changing a refrigerant discharge capacity of the second compression mechanism (21*a*). In this case, the first discharge capacity changing means (11*b*) and the second discharge capacity changing means (21*b*) may be configured to respectively independently change the refrigerant discharge capacities of the first compression mechanism (11*a*) and the second compression mechanism (21*a*).

Thus, the refrigerant discharge capacity of the first compression mechanism (11*a*) and the refrigerant discharge capacity of the second compression mechanism (21*a*) can be independently adjusted, and thereby the first and second compression mechanisms (11*a*, 21*a*) can be operated with a high compression efficiency.

The first and second compression mechanisms (11*a*) and (21*a*) may be accommodated in the same housing, and may be constituted integrally. As a result, the size of the first and second compression mechanisms (11*a*, 21*a*) can be made small, thereby reducing the size of the entire ejector-type refrigeration cycle device.

In the ejector-type refrigeration cycle device, a discharge side evaporator (14) may be provided to evaporate the refrigerant flowing out of the diffuser portion (13*d*).

Thus, cooling capacity can be obtained not only in the suction side evaporator (16) but also in the discharge side evaporator (14). Furthermore, the refrigerant evaporation pressure in the suction side evaporator (16) is a pressure corresponding to the suction action of the jet refrigerant, and the refrigerant pressure in the discharge side evaporator (14) is a pressure pressurized in the diffuser portion (13*d*). That is, the refrigerant evaporation temperatures are different from each other in the suction side evaporator (16) and the discharge side evaporator (14).

The first compression mechanism (11*a*) may compress the refrigerant to be equal to or higher than the critical pressure of the refrigerant, or to be lower than the critical pressure.

According to a second example of the present invention, an ejector-type refrigeration cycle device includes: a first compression mechanism (11*a*) configured to compress and discharge refrigerant; a radiator (12) configured to cool high-pressure refrigerant discharged from the first compression mechanism (11*a*); a branch portion (18) provided to branch a flow of the refrigerant flowing out of the radiator (12); an ejector (13) including a nozzle portion (13*a*) adapted to decompress and expand the refrigerant of one stream branched at the branch portion (18), a refrigerant suction port (13*b*) adapted to draw the refrigerant by a high-speed flow of the refrigerant jetted from the nozzle portion (13*a*), and a diffuser portion (13*d*) adapted to pressurize mix-refrigerant of the jet refrigerant and the refrigerant drawn from the refrigerant suction port (13*b*); a suction side decompression means (19, 20) for decompressing and expanding the refrigerant of the other stream branched at the branch portion (18); a suction side evaporator (16) configured to evaporate the refrigerant decompressed by the suction side decompression means (19, 20) and to cause the evaporated refrigerant to flow toward the refrigerant suction port (13*b*) of the ejector (13); and a second compression mechanism (21*a*) configured to draw the refrigerant flowing out of the suction side evaporator (16), to compress the drawn refrigerant and to discharge the compressed refrigerant.

Because the second compression mechanism (21*a*) is provided, even in an operation condition in which suction capacity of the ejector (13) is decreased in accordance with a decrease of the flow amount of a drive flow of the ejector (13), the suction capacity of the ejector (13) can be supplemented by the operation of the second compression mechanism (21*a*).

Furthermore, the refrigerant pressure is increased by the pressurizing action in the first and second compression mechanisms (11*a*, 21*a*) and in the diffuser portion (13*d*) of the ejector (13). Thus, as compared with a case where the refrigerant is pressurized by a single compression mechanism, the driving power of the first and second compression mechanisms (11*a*, 21*a*) is reduced thereby improving the COP.

Furthermore, by the pressurizing action of the diffuser portion (13*d*), the suction pressure of the first compression mechanism (11*a*) can be increased, thereby reducing the driving power in the first compression mechanism (11*a*). In addition, because the pressure difference between the suction pressure and the discharge pressure in the respective first and second compression mechanisms (11*a*, 21*a*) can be reduced, the compression efficiency in the respective first and second compression mechanisms (11*a*, 21*a*) can be improved.

As a result, even when a variation in the flow amount of the drive flow is caused thereby reducing the pressurizing capacity of the diffuser portion (13*d*), the ejector-type refrigeration cycle device can be stably operated with a high COP.

Therefore, in a refrigeration cycle device in which the pressure difference between the high pressure refrigerant and the low pressure refrigerant is large, for example, in a refrigeration cycle device in which the refrigerant evaporation temperature of the suction side evaporator 16 is reduced to a very low temperature (e.g., −30° C.–−10° C.), the effect of the present invention is extremely effective.

For example, in the ejector-type refrigeration cycle device, a discharge side evaporator (14) may be provided to evaporate the refrigerant flowing out of the diffuser portion (13*d*).

Thus, cooling capacity can be obtained not only in the suction side evaporator (16) but also in the discharge side evaporator (14). Furthermore, the refrigerant evaporation pressure in the suction side evaporator (16) is a pressure corresponding to the suction action of the jet refrigerant, and the refrigerant pressure in the discharge side evaporator (14) is a pressure pressurized in the diffuser portion (13*d*). Therefore, the refrigerant evaporation temperatures are different in the suction side evaporator (16) and the discharge side evaporator (14).

In the ejector-type refrigeration cycle device, a high-pressure side decompression means (17, 27) may be arranged in a refrigerant passage from a refrigerant outlet side of the radiator (12) to a refrigerant inlet side of the nozzle portion (13*a*), for decompressing and expanding the refrigerant flowing out of the radiator (12).

Accordingly, by the action of the high-pressure side decompression means (17, 27), the refrigerant to flow into the nozzle portion (13*a*) can be decompressed to a gas-liquid two-phase state. Thus, it is compared with a case where the liquid refrigerant flows into the nozzle portion (13*a*), boiling of the refrigerant in the nozzle portion (13*a*) can be facilitated, thereby improving the nozzle efficiency.

As a result, a pressure increasing amount is increased in the diffuser portion (13*d*), thereby further improving the COP. Here, nozzle efficiency is an energy conversion efficiency in the nozzle portion (13*a*), when the pressure energy of the refrigerant is converted to the kinetic energy of the refrigerant.

In addition, because the high-pressure side decompression means (17, 27) is configured by a variable throttle mechanism, the refrigerant flow amount flowing into the nozzle portion (13*a*) of the ejector (13) can be varied in accordance with a load variation in the cycle. As a result, even if load fluctuation arises, the refrigerant cycle can be stably operated while having a high COP.

The high-pressure side decompression means (17, 27) may be arranged in a refrigerant passage from a refrigerant outlet side of the radiator (12) to a refrigerant inlet side of the branch portion (18), or may be arranged in a refrigerant passage from a refrigerant outlet side of the branch portion (18) to a refrigerant inlet side of the nozzle portion (13*a*).

Furthermore, in the ejector-type refrigeration cycle device, an inner heat exchanger (30, 31, 32) may be provided to perform heat exchange between the refrigerant flowing out of the radiator (12) and a low-pressure side refrigerant in a cycle. Thus, the enthalpy difference (cooling capacity) between the enthalpies of the refrigerant at the refrigerant inlet side and the refrigerant outlet side can be enlarged in the suction side evaporator (16), thereby further improving the COP.

In this case, the refrigerant flowing out of the radiator (12) is the refrigerant in a refrigerant passage from a refrigerant outlet side of the radiator (12) to a refrigerant inlet side of the branch portion (18). Alternatively, the refrigerant flowing out of the radiator (12) is the refrigerant in a refrigerant passage from a refrigerant outlet side of the branch portion (18) to a refrigerant inlet side of the suction side decompression means (19, 20).

Furthermore, an inner heat exchanger (34, 35) may be provided to perform heat exchange between the refrigerant in a decompression and expansion stage of the suction side decompression means (19) and a low-pressure side refrigerant in a cycle. Thus, the enthalpy difference (cooling capacity) between the enthalpies of the refrigerant at the refrigerant inlet side and the refrigerant outlet side can be enlarged in the suction side evaporator (16), thereby further improving the COP.

For example, the low-pressure side refrigerant in the cycle may be the refrigerant to be drawn into the first compression mechanism (11*a*), or may be the refrigerant to be drawn into the second compression mechanism (21*a*).

Furthermore, the radiator (12) may include a condensation portion (12*b*) provided to condense the refrigerant, a gas-liquid separation portion (12*c*) provided to separate the refrigerant flowing out of the condensation portion (12*b*) into gas refrigerant and liquid refrigerant, and a super-cooling portion (12*d*) provided to super-cool the liquid refrigerant flowing out of the gas-liquid separation portion (12*c*).

In this case, because a low enthalpy refrigerant super-cooled in the super-cooling portion (12*d*) flows into the suction side evaporator (16), the enthalpy difference (cooling capacity) between the enthalpies of the refrigerant at the refrigerant inlet side and the refrigerant outlet side can be enlarged in the suction side evaporator (16), thereby further improving the COP.

At this time, the enthalpy of the refrigerant at the refrigerant inlet side of the suction side evaporator (16) can be reduced, and thereby the enthalpy of the refrigerant drawn into the first and second compression mechanisms (11*a*, 21*a*) is not increased. Thus, it can reduce a density reduce in the refrigerant drawn into the first and second compression mechanisms (11*a*, 21*a*). Thus, it can prevent a decrease in the refrigerant flow amount discharged from the first and second compression mechanisms (11*a*, 21*a*), thereby surely improving the COP.

Furthermore, the ejector-type refrigerant cycle device may be provided with a supplementary radiator (12*e*) that is arranged at a refrigerant downstream side of the branch portion (18) to cool the refrigerant flowing toward the suction side decompression means (19, 20).

In this case, because a low enthalpy refrigerant cooled at both the radiator (12) and the auxiliary radiator (12*e*) flows into the suction side evaporator (16), the enthalpy difference (cooling capacity) between the enthalpies of the refrigerant at the refrigerant inlet side and the refrigerant outlet side can be enlarged in the suction side evaporator (16), thereby further improving the COP.

Because the refrigerant flowing into the nozzle portion (13*a*) of the ejector (13) is cooled in the auxiliary radiator (12*e*), the enthalpy can be reduced with respect to the refrigerant flowing into the suction side decompression means (19, 20). Therefore, the recovery energy in the nozzle portion (13*a*) can be increased, and the COP can be further improved.

According to a third example of the present invention, an ejector-type refrigeration cycle device includes: a first compression mechanism (11*a*) configured to compress and discharge refrigerant; a radiator (12) configured to cool high-pressure refrigerant discharged from the first compression mechanism (11*a*); an ejector (13) including a nozzle portion (13*a*) adapted to decompress and expand the refrigerant flowing out of the radiator (12), a refrigerant suction port (13*b*) adapted to draw the refrigerant by a high-speed flow of the refrigerant jetted from the nozzle portion (13*a*), and a diffuser portion (13*d*) adapted to pressurize mix-refrigerant of the jet refrigerant and the refrigerant drawn from the refrigerant suction port (13*b*); a branch portion (18) provided to branch a flow of the refrigerant flowing out of the diffuser portion (13*d*) of the ejector (13); a discharge side evaporator (14) configured to evaporate the refrigerant branched at the branch portion (18) and to cause the evaporated refrigerant to flow toward a refrigerant suction side of the first compression mechanism (11*a*); and a suction side decompression means (19) for decompressing and expanding the refrigerant of the other stream branched at the branch portion (18); a suction side evaporator (16) configured to evaporate the refrigerant decompressed by the suction side decompression means (19) and to cause the evaporated refrigerant to flow toward the refrigerant suction port (13*b*) of the ejector (13); and a second compression mechanism (21*a*) configured to draw the refrigerant flowing out of the suction side evaporator (16), to compress the drawn refrigerant and to discharge the compressed refrigerant.

Because the second compression mechanism (21*a*) is provided, even in an operation condition in which suction capacity of the ejector (13) is decreased in accordance with a decrease of the flow amount of a drive flow of the ejector (13), the suction capacity of the ejector (13) can be supplemented by the operation of the second compression mechanism (21*a*).

Furthermore, the refrigerant pressure is increased by the pressurizing action in the first and second compression mechanisms (11*a*, 21*a*) and in the diffuser portion (13*d*) of the ejector (13). Thus, as compared with a case where the refrigerant is pressurized by a single compression mechanism, the driving power of the first and second compression mechanisms (11*a*, 21*a*) is reduced thereby improving the COP.

Furthermore, by the pressurizing action of the diffuser portion (13*d*), the suction pressure of the first compression mechanism (11*a*) can be increased, thereby reducing the driving power in the first compression mechanism (11*a*). In addition, because the pressure difference between the suction pressure and the discharge pressure in the respective first and second compression mechanisms (11*a*, 21*a*) can be reduced, the compression efficiency in the respective first and second compression mechanisms (11*a*, 21*a*) can be improved.

As a result, even when a variation in the flow amount of the drive flow is caused thereby reducing the pressurizing capacity of the diffuser portion (13*d*), the ejector-type refrigeration cycle device can be stably operated with a high COP.

Therefore, in a refrigeration cycle device in which the pressure difference between the high pressure refrigerant and the low pressure refrigerant is large, for example, in a refrigeration cycle device in which the refrigerant evaporation temperature of the suction side evaporator (16) is reduced to a very low temperature (e.g., −30° C.--10° C.), the effect of the present invention is extremely effective.

Furthermore, the refrigerant evaporation pressure (refrigerant evaporation temperature) in the suction side evaporator (16) is a pressure corresponding to the suction action of the jet refrigerant, and the refrigerant pressure in the discharge side evaporator (14) is a pressure pressurized in the diffuser portion (13*d*). Therefore, the refrigerant evaporation temperatures are different in the suction side evaporator (16) and the discharge side evaporator (14).

For example, in the ejector-type refrigeration cycle device, a high-pressure side decompression means (17) may be arranged in a refrigerant passage from a refrigerant outlet side of the radiator (12) to a refrigerant inlet side of the nozzle portion (13*a*), for decompressing and expanding the refrigerant flowing out of the radiator (12).

Accordingly, by the action of the high-pressure side decompression means (17), the refrigerant to flow into the nozzle portion (13*a*) can be decompressed to a gas-liquid two-phase state. Thus, it is compared with a case where the liquid refrigerant flows into the nozzle portion (13*a*), boiling of the refrigerant in the nozzle portion (13*a*) can be facilitated, thereby improving the nozzle efficiency.

As a result, a pressure increasing amount is increased in the diffuser portion (13*d*), thereby further improving the COP. Here, nozzle efficiency is an energy conversion efficiency in the nozzle portion (13*a*), when the pressure energy of the refrigerant is converted to the kinetic energy of the refrigerant.

In addition, because the high-pressure side decompression means (17) is configured by a variable throttle mechanism, the refrigerant flow amount flowing into the nozzle portion (13*a*) of the ejector (13) can be varied in accordance with a load variation in the cycle. As a result, even if load fluctuation arises, the ejector-type refrigeration cycle device can be operated while having a high COP.

According to a fourth example of the present invention, an ejector-type refrigeration cycle device includes: a first compression mechanism (11*a*) configured to compress and discharge refrigerant; a radiator (12) configured to cool high-pressure refrigerant discharged from the first compression mechanism (11*a*); an ejector (13) including a nozzle portion (13*a*) adapted to decompress and expand the refrigerant flowing out of the radiator (12), a refrigerant suction port (13*b*) adapted to draw the refrigerant by a high-speed flow of the refrigerant jetted from the nozzle portion (13*a*), and a diffuser portion (13*d*) adapted to pressurize mix-refrigerant of the jet refrigerant and the refrigerant drawn from the refrigerant suction port (13*b*); a discharge side evaporator (14) configured to evaporate the refrigerant flowing out of the diffuser portion (13) and to cause the evaporated refrigerant to flow toward a refrigerant suction side of the first compression mechanism (11*a*); a first branch portion (18) configured to be capable of branching a flow of the refrigerant flowing out of the radiator (12); a first suction-side decompression means (19) for decompressing and expanding the refrigerant branched at the first branch portion (18); a second branch portion (28) configured to be capable of branching a flow of the refrigerant flowing out of the diffuser portion (13*d*); a second suction-side decompression means (29) for decompressing and expanding the refrigerant branched at the second branch portion (28); a suction side evaporator (16) configured to evaporate at least one refrigerant of the refrigerant flowing out of the first suction-side decompression means (19) and the refrigerant flowing out of the second suction-side decompression means (29), and to cause the evaporated refrigerant to flow toward the refrigerant suction port (13*b*) of the ejector (13); and a second compression mechanism (21*a*) configured to draw the refrigerant flowing out of the suction side evaporator (16), to compress the drawn refrigerant and to discharge the compressed refrigerant.

Thus, it is possible to branch the flow of the refrigerant only at the first branch portion (18), thereby supplying the refrigerant flowing out of the first suction side decompressing means (19) to the suction side evaporator (16). Furthermore, it is possible to branch the flow of the refrigerant only at the second branch portion (28), thereby supplying the refrigerant flowing out of the second suction side decompressing means (29) to the suction side evaporator (16).

Furthermore, it is also possible to branch the flow of the refrigerant at both the first and second branch portion (18, 28), thereby supplying the refrigerant flowing out of the first and second suction side decompressing means (19, 29) to the suction side evaporator (16). In this case, the refrigerant flow amount supplied to the suction side evaporator (16) can be easily increased, as compared with a cycle structure in which the refrigerant flowing out of any one of the first electrical expansion valve (19) and the second electrical expansion valve (29) is supplied to the suction side evaporator (16).

Because the second compression mechanism (21*a*) is provided, even when any cycle configuration is switched, the suction capacity of the ejector (13) can be supplemented by the operation of the second compression mechanism (21*a*). Thus, even in an operation condition in which suction capacity of the ejector (13) is decreased in accordance with a decrease of the flow amount of a drive flow of the ejector (13), the refrigerant can be surely supplied to the suction side evaporator (16).

Furthermore, the refrigerant pressure is increased by the pressurizing action in the first and second compression mechanisms (11*a*, 21*a*) and in the diffuser portion (13*d*) of the ejector (13). Thus, as compared with a case where the refrigerant is pressurized by a single compression mechanism, the driving power of the first and second compression mechanisms (11*a*, 21*a*) is reduced thereby improving the COP.

Furthermore, by the pressurizing action of the diffuser portion (13*d*), the suction pressure of the first compression mechanism (11*a*) can be increased, thereby reducing the driving power in the first compression mechanism (11*a*). In addition, because the pressure difference between the suction pressure and the discharge pressure in the respective first and second compression mechanisms (11*a*, 21*a*) can be reduced, the compression efficiency in the respective first and second compression mechanisms (11*a*, 21*a*) can be improved.

As a result, even when a variation in the flow amount of the drive flow is caused thereby reducing the pressurizing capacity of the diffuser portion (13*d*), the ejector-type refrigeration cycle device can be stably operated with a high COP.

Therefore, in a refrigeration cycle device in which the pressure difference between the high pressure refrigerant and the low pressure refrigerant is necessary to be maintained large, for example, in a refrigeration cycle device in which the refrigerant evaporation temperature of the suction side evaporator 16 is reduced to a very low temperature (e.g., −30° C.-−10° C.), the effect of the present invention is extremely effective.

According to a fourth example of the present invention, an ejector-type refrigeration cycle device includes: a first compression mechanism (11*a*) configured to compress and discharge refrigerant; a branch portion (38) configured to branch a flow of high-pressure refrigerant discharged from the first compression mechanism (11*a*); a first radiator (121) provided to cool the refrigerant of one stream branched at the branch portion (38); an ejector (13) including a nozzle portion (13*a*) adapted to decompress and expand the refrigerant flowing out of the first radiator (12), a refrigerant suction port (13*b*) adapted to draw the refrigerant by a high-speed flow of the refrigerant jetted from the nozzle portion (13*a*), and a diffuser portion (13*d*) adapted to pressurize mix-refrigerant of the jet refrigerant and the refrigerant drawn from the refrigerant suction port (13*b*); a second radiator (121) provided to cool the refrigerant of the other stream branched at the branch portion (38); a suction-side decompression means (39) for decompressing and expanding the refrigerant flowing out of the second radiator (122); a suction side evaporator (16) configured to evaporate the refrigerant decompressed by the suction side decompression means (39) and to cause the evaporated refrigerant to flow toward the refrigerant suction port (13*b*) of the ejector (13); and a second compression mechanism (21*a*) configured to draw the refrigerant flowing out of the suction side evaporator (16), to compress the drawn refrigerant and to discharge the compressed refrigerant.

Thus, the heat exchange capacity (heat radiation performance) of the first radiator (121) and the heat exchange capacity (heat radiation performance) of the second radiator (122) can be changed independently. For example, the heat exchange capacity of the second radiator (122) and the heat exchange capacity (heat absorbing performance) of the suction side evaporator (16) can be easily suited. Therefore, it is easy to stabilize the operation of the cycle.

Furthermore, in the present embodiment, because the first radiator (121) is used such that the heat exchanging capacity of the first radiator (121) is reduced than that of the second radiator (122), it can prevent the enthalpy of the refrigerant flowing to the nozzle portion (13*a*) of the ejector (13) from being unnecessary reduced. Therefore, the recovery energy in the nozzle portion (13*a*) can be increased, and the COP can be further improved.

Because the second compression mechanism (21*a*) is provided, the suction capacity of the ejector (13) can be supplemented by the operation of the second compression mechanism (21*a*). Thus, similarly to the invention of the first example, even when a variation in the flow amount of the drive flow is caused in the ejector (13) thereby reducing the pressurizing capacity of the diffuser portion (13*d*), the ejector-type refrigeration cycle device can be stably operated with a high COP.

According to a sixth example of the present invention, an ejector-type refrigeration cycle device includes: a first compression mechanism (11*a*) configured to compress and discharge refrigerant; a radiator (12) configured to cool high-pressure refrigerant discharged from the first compression mechanism (11*a*); first and second heat exchangers (51, 52) configured to perform heat exchange between the refrigerant and a fluid to be heat-exchanged; an ejector (13) including a nozzle portion (13*a*) adapted to decompress and expand the refrigerant flowing out of the radiator (12), a refrigerant suction port (13*b*) adapted to draw the refrigerant by a high-speed flow of the refrigerant jetted from the nozzle portion (13*a*), and a diffuser portion (13*d*) adapted to pressurize mix-refrigerant of the jet refrigerant and the refrigerant drawn from the refrigerant suction port (13*b*); a discharge-side gas-liquid separator (55) provided to separate the refrigerant flowing out of the diffuser portion (13*d*) of the ejector (13) into gas refrigerant and liquid refrigerant, a second compression mechanism (21*a*) configured to compress the refrigerant and to discharge the compressed refrigerant toward the refrigerant suction port (13*b*); and a passage switching means (53, 54) for switching a refrigerant passage to set a first operation mode or a second operation mode. Furthermore, in the first operation mode, the passage switching means (53, 54) switches the refrigerant passage, such that the refrigerant discharged from the first compression mechanism (11*a*) flows in this order of the radiator (12)→the first heat exchanger (51)→the nozzle portion (13*a*), and at the same time, the liquid refrigerant flowing out of the discharge-side gas-liquid separator (55) flows in this order of the second heat exchanger (52)→the second compression mechanism (21*a*)→the refrigerant suction port (13*d*). On the other hand, in the second operation mode, the passage switching means (53, 54) switches the refrigerant passage, such that the refrigerant discharged from the first compression mechanism (11*a*) flows in this order of the radiator (12)→the second heat exchanger (52)→the nozzle portion (13*a*), and at the same time, the liquid refrigerant flowing out of the discharge-side gas-liquid separator (55) flows in this order of the first heat exchanger (51)→the second compression mechanism (21*a*)→the refrigerant suction port (13*d*).

Thus, in the first operation mode, it is possible to cool a fluid to be heat-exchanged by the second heat exchanger (52), while defrosting of the first heat exchanger (51) can be performed by supplying the refrigerant downstream of the radiator (12) to the first heat exchanger (51). On the other hand, in the second operation mode, it is possible to cool a fluid to be heat-exchanged by the first heat exchanger (51), while defrosting of the second heat exchanger (52) can be performed by supplying the refrigerant downstream of the radiator (12) to the second heat exchanger (52).

Because the first operation mode and the second operation mode can be alternatively switched, even when any one of the first and second heat exchangers (51, 52) is defrosted, the other one of the first and second heat exchangers (51, 52) can be used to cool the fluid to be heat exchanged.

Because the second compression mechanism (21*a*) is provided, the suction capacity of the ejector (13) can be supplemented by the operation of the second compression mechanism (21*a*) even in any operation mode. Thus, similarly to the invention of the first example, even when a variation in the flow amount of the drive flow is caused thereby reducing the pressurizing capacity of the diffuser portion (13*d*), the ejector-type refrigeration cycle device can be stably operated with a high COP.

DETAILED DESCRIPTION OF EMBODIMENTS (1st Embodiment)

Figure 1:
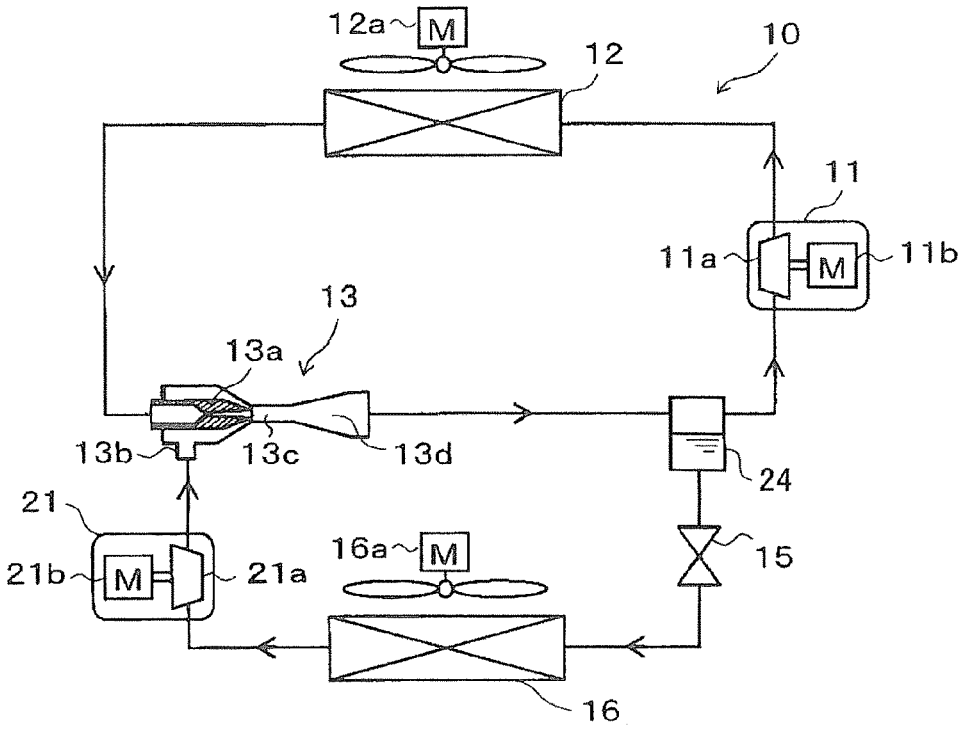
FIG. 1 is an entire schematic diagram of an ejector-type refrigeration cycle device of 1st embodiment.

In the present embodiment, an ejector-type refrigeration cycle device of the present invention used for a refrigerator will be described with reference to FIGS. 1 and 2. The refrigerator is for cooling a refrigerating interior room that is a space to be cooled, to an extremely low temperature such as in a range between −30° C. and −10° C. FIG. 1 is an entire schematic diagram of the ejector-type refrigeration cycle device 10 of the present embodiment.

In the ejector-type refrigeration cycle device 10, a first compressor 11 is configured to draw refrigerant, to compress the drawn refrigerant, and to discharge the compressed refrigerant. For example, the first compressor 11 is an electrical compressor in which a first compression mechanism 11*a* having a fixed displacement is driven by a first electrical motor 11*b*. As the first compression mechanism 11*a*, various compression mechanisms such as a scroll type compression mechanism, a vane type compression mechanism and the like can be used, for example.

The operation (e.g., rotational speed) of the first electrical motor 11*b* is controlled by using control signals output from a control device described later. As the first electrical motor 11*b*, an AC motor or a DC motor may be used. By controlling the rotational speed of the first electrical motor 11*b*, the refrigerant discharge capacity of the first compression mechanism 11*a* can be changed. Thus, in the present embodiment, the first electrical motor 11*b* can be used as a first discharge capacity changing means for changing the discharge capacity of the refrigerant of the first compression mechanism 11*a*.

A refrigerant radiator 12 is disposed on a refrigerant discharge side of the first compressor 11. The radiator 12 exchanges heat between high-pressure refrigerant discharged from the first compressor 11 and outside air (i.e., air outside the room) blown by a cooling fan 12*a* to cool the high-pressure refrigerant. The rotation speed of the cooling fan 12*a* is controlled by a control voltage output from the control device so as to control an air blowing amount from the cooling fan 12*a*.

In the present embodiment, a flon-based refrigerant is used as the refrigerant for a refrigerant cycle of the ejector-type refrigeration cycle device 10 to form a vapor-compression subcritical refrigerant cycle in which a refrigerant pressure on the high-pressure side does not exceed the critical pressure of the refrigerant. Thus, the radiator 12 serves as a condenser for cooling and condensing the refrigerant.

A receiver (i.e., liquid receiver) may be provided at a refrigerant outlet side of the radiator 12, to be used as a high-pressure side gas-liquid separator in which the refrigerant flowing out of the radiator 12 is separated into gas refrigerant and liquid refrigerant, and liquid refrigerant is stored as surplus refrigerant. Furthermore, the saturated liquid refrigerant separated in the receiver is introduced to a downstream side.

The ejector 13 is connected to the refrigerant outlet side of the radiator 12. The ejector 13 is used as a refrigerant decompression means for decompressing and expanding the refrigerant, and as a refrigerant circulation means for circulating the refrigerant by the suction action of a high-speed refrigerant flow jetted from a nozzle portion 13*a*.

The refrigerant passage sectional area of the nozzle portion 13*a* is throttled so that high pressure refrigerant flowing out of the radiator 12 is decompressed and expanded in the nozzle portion 13*a* in iso-entropy. The refrigerant suction port 13*b* is provided to communicate with a space in the ejector 13, where a refrigerant jet port of the nozzle portion 13*a* is provided, so as to draw the refrigerant discharged from a second compressor 21.

A mixing portion 13*c* is provided in the ejector 13 on a downstream side of the nozzle portion 13*a* and the refrigerant suction port 13*b* in the refrigerant flow, so as to mix the high-velocity refrigerant flow jetted from the nozzle portion 13*a* with the suction refrigerant drawn from the refrigerant suction port 13*b*. A diffuser portion 13*d* is provided in the ejector 13 downstream of the mixing portion 13*c* in a refrigerant flow so as to increase the refrigerant pressure in the diffuser portion 13*d*.

The diffuser portion 13*d* is formed in such a shape to gradually increase the passage sectional area of the refrigerant, and has an effect of reducing the velocity of the refrigerant flow so as to increase the refrigerant pressure. That is, the diffuser portion 13*d* has an effect of converting the speed energy of the refrigerant to the pressure energy of the refrigerant. An accumulator 24 is connected to an outlet side of the diffuser portion 13*d*.

The accumulator 24 is a discharge-side gas-liquid separator, in which the refrigerant flowing out of the diffuser portion 13*d* of the ejector 13 is separated into gas refrigerant and liquid refrigerant, and surplus liquid refrigerant in the cycle is stored therein. A refrigerant suction port of the first compressor 11 is connected to a gas-refrigerant outlet of the accumulator 24, and a suction side evaporator 16 is connected to a liquid-refrigerant outlet of the accumulator 24 via a fixed throttle 15.

The fixed throttle 15 is a low-pressure side decompression means adapted to decompress and expand the liquid refrigerant flowing out of the accumulator 24. As the fixed throttle 15, a capillary tube, an orifice or the like can be used.

The suction side evaporator 16 is configured to perform heat exchange between low-pressure refrigerant decompressed and expanded at the fixed throttle 15 and inside air of a room blown by the blower fan 16*a*, and is used as a heat-absorbing heat exchanger in which low-pressure refrigerant is evaporated so as to exert heat-absorbing action. Thus, in the present embodiment, inside air of the room is a fluid to be heat exchanged. The blower fan 16*a* is an electrical blower, in which rotation speed (air blowing amount) of the blower fan 16*a* is controlled by a control voltage output from the control device.

A refrigerant suction port of the second compressor 21 is connected to a refrigerant outlet side of the suction side evaporator 16. The basic structure of the second compressor 21 is similar to that of the first compressor 11. Thus, the second compressor 21 is an electrical compressor, in which a fixed-displacement type second compression mechanism 21*a* is driven by a second electrical motor 21*b*. The second electrical motor 21*b* of the present embodiment is used as a second discharge capacity changing means for changing a refrigerant discharge capacity of the second compression mechanism 21*a*.

The refrigerant suction port 13*b* of the ejector 13 is connected to a refrigerant discharge port of the second compressor 21.

The control device (not shown) is constructed of a generally-known microcomputer including CPU, ROM and RAM and the like, and its circumferential circuits. The control device performs various calculations and processes based on a control program stored in the ROM, and controls operation of various electrical actuators 11b, 12*b*, 16*a*, 21*a* or the like.

The control device includes a function portion as the first discharge-capacity control means which controls the operation of the first electrical motor 11*b* that is a first discharge capacity changing means, and a function portion as the second discharge-capacity control means which controls the operation of the second electrical motor 21*b* that is a second discharge capacity changing means. The first discharge-capacity control means and the second discharge-capacity control means may be configured by different control devices, respectively.

Into the control device, detection values from a sensor group (not shown) including an outside air sensor for detecting an outside air temperature (i.e., temperature outside the room of the refrigerator), an inside temperature sensor for detecting an interior temperature of the room of the refrigerator, and various operation signals from an operation panel (not shown) in which an operation switch for operating the refrigerator and the like are provided are input.

Next, operation of the present embodiment with the above structure will be described based on the Mollier diagram shown in FIG. 2. When the operation switch of the operation panel is turned on, the control device causes the first and second electrical motors 11*b*, 21*b*, the cooling fan 12*a*, and the blower fan 16*a* to be operated. Thus, the first compressor 11 draws refrigerant, compresses the drawn refrigerant, and discharges the compressed refrigerant. The state of the refrigerant at this time is point a2 of FIG. 2.

Figure 2:
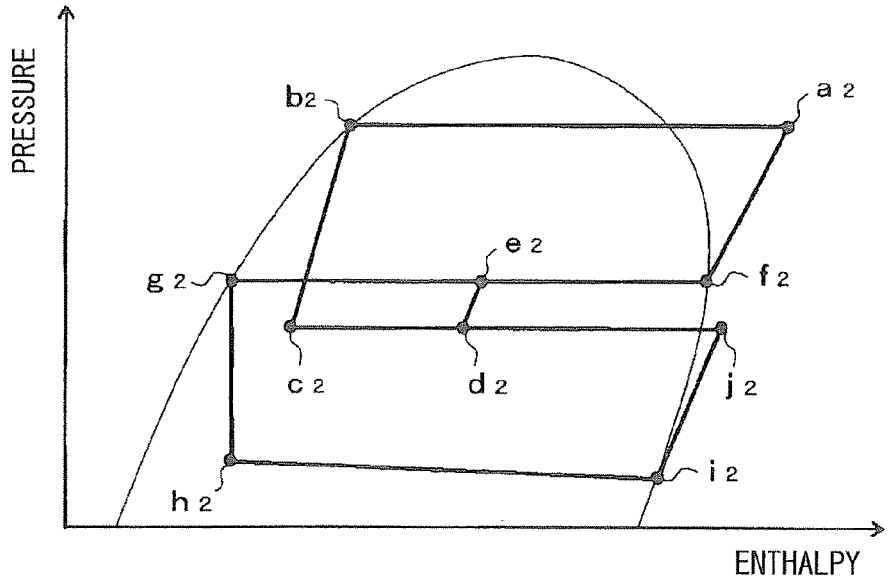
FIG. 2 is a Mollier diagram showing a refrigerant state of the ejector-type refrigeration cycle device of the 1st embodiment.

High-temperature and high-pressure refrigerant discharged from the first compressor 11 flows into the radiator 12, and is heat-exchanged with the blown air (outside air) blown by the cooling fan 12*a* to be radiated and condensed (point a2→point b2 in FIG. 2). The refrigerant radiated at the radiator 12 flows into the nozzle portion 13*a* of the ejector 13, and is decompressed and expanded in the nozzle portion 13*a* in iso-entropy (point b2→point c2 in FIG. 2).

In the decompression and expansion of the nozzle portion 13*a*, the pressure energy of the refrigerant is converted to the speed energy of the refrigerant, and the refrigerant is jetted with a high speed from a refrigerant jet port of the nozzle portion 13*a*.

Thus, the refrigerant discharged from the second compressor 21 is drawn into the ejector 13 from the refrigerant suction port 13*b* of the ejector 13, by the refrigerant suction action of the jet refrigerant.

Furthermore, the jet refrigerant jetted from the nozzle portion 13*a* and the suction refrigerant drawn from the refrigerant suction port 13*b* are mixed in the mixing portion 13*c* of the ejector 13, and flows into the diffuser portion 13*d* of the ejector 13 (point c2→point d2, point j2→point d2 in FIG. 2). That is, passage sectional area is enlarged in the diffuser portion 13*d* as toward downstream so that the speed energy of the refrigerant is converted to the pressure energy thereof, thereby increasing the pressure of the refrigerant (point d2→point e2 in FIG. 2).

Next, the refrigerant flowing out of the diffuser portion 13*d* is separated into gas refrigerant and liquid refrigerant (point e2→point f2, point e2→point g2 in FIG. 2). The gas refrigerant flowing out of the gas refrigerant outlet of the accumulator 24 is drawn into the first compressor 11, and is compressed again (point f2→point a2 in FIG. 2).

On the other hand, liquid refrigerant flowing out of the liquid refrigerant outlet of the accumulator 24 is further decompressed and expanded in iso-enthalpy in the fixed throttle 15, thereby reducing the refrigerant pressure (point g2→point h2 in FIG. 2). The refrigerant decompressed and expanded at the fixed throttle 15 flows into the suction side evaporator 16, and is evaporated by absorbing heat from air inside of the room of the refrigerator, blown by the blower fan 16*a* (point h2→point i2 in FIG. 2). Thus, the air blown into the inside of the room of the refrigerator is cooled.

The gas refrigerant flowing out of the suction side evaporator 16 is drawn into the second compressor 21, and is compressed (point i2→point j2 in FIG. 2). At this time, the control device controls operation of the first and second electrical motors 11*b*, 21*b* such that COP in the entire cycle of the ejector-type refrigeration cycle device is approached approximately to the maximum value. Specifically, pressure increasing amounts in the first and second compression mechanisms 11*a*, 21*a* are controlled to be approximately equal, in order to improve the compression efficiency in the first and second compression mechanisms 11*a*, 21*a*.

When an increase amount of the enthalpy of the refrigerant is ΔH1 in a case where the refrigerant is compressed in iso-entropy in the first and second compressors 11, 21, and when an actual increase amount of the enthalpy of the refrigerant accurately pressurized in the first and second compressors 11, 21 is ΔH2, the compression efficiency is a ratio of ΔH1 to ΔH2.

For example, when the rotation speed or the pressure increasing amount of the first and second compressors 11, 21 is increased, the temperature of the refrigerant is increased by fraction heat of the refrigerant, thereby increasing the actual increase amount ΔH2 of the enthalpy. In this case, the compression efficiency is decreased in the first and second compressors 11, 21.

The refrigerant flowing out of the second compressor 21 is drawn into the ejector 13 from the refrigerant suction port 13*b* (point j2→point d2 in FIG. 2).

The ejector-type refrigeration cycle device 10 of the present embodiment is operated above, and thereby the following excellent effects can be obtained.

The ejector-type refrigeration cycle device 10 of the present embodiment is provided with a second compressor 21 (second compression mechanism 21*a*). Therefore, for example, even in an operation condition in which a pressure difference between a high-pressure refrigerant and a low pressure refrigerant is decreased thereby decreasing the flow amount of the drive flow of the ejector 13, that is, even in an operation condition in which the suction capacity of the ejector 13 is decreased, the suction capacity of the ejector 13 can be supplemented by the operation of the second compression mechanism 21*a*.

By the operation of the second compression mechanism 21*a*, the liquid refrigerant can be surely supplied from the accumulator 24 to the suction side evaporator 16, thereby obtaining heat absorbing action in the suction side evaporator 16. Furthermore, by the operation of the second compression mechanism 21*a*, it can restrict a decrease in the density of the refrigerant to be drawn into the first compression mechanism 11*a* from the gas refrigerant outlet of the accumulator 24. As a result, a decrease in the flow amount of the drive flow of the ejector 13 can be restricted, and thereby the ejector-type refrigeration cycle device can be stably operated.

Furthermore, the refrigerant pressure is increased by the pressurizing action in the first and second compression mechanisms 11*a*, 21*a* and in the diffuser portion 13*d* of the ejector 13. Thus, as compared with a case where the refrigerant is pressurized by a single compression mechanism, the driving power of the first and second compression mechanisms 11*a*, 21*a* is reduced thereby improving the COP.

Because the suction pressure of the first compression mechanism 11*a* can be increased by the pressurizing action of the diffuser portion 13*d*, the driving power of the first compression mechanism 11*a* can be reduced. Furthermore, the pressure difference between the suction pressure and the discharge pressure in the respective first and second compression mechanisms 11*a*, 21*a* can be reduced as compared with a case where the refrigerant is pressurized by the single compression mechanism. Thus, the compression efficiency in the respective first and second compression mechanisms 11*a*, 21*a* can be improved.

The refrigerant discharge capacities of the first and second compression mechanisms 11*a*, 21*a* can be respectively independently changed by the first and second electrical motors 11*b*, 21*b*. Thus, the COP can be effectively improved in the entire cycle of the ejector-type refrigeration cycle device 10.

Furthermore, the saturated gas refrigerant can be drawn into the first compression mechanism 11*a* from the gas refrigerant outlet of the accumulator 24. Thus, as compared with a case where gas refrigerant having a super-heat degree is drawn into the first compression mechanism 11*a*, the compression operation amount of the first compression mechanism 11*a*, when the refrigerant is compressed in iso-entropy, can be reduced.

Therefore, in a refrigeration cycle device in which the pressure difference between the high pressure refrigerant and the low pressure refrigerant is large, for example, in a refrigeration cycle device in which the refrigerant evaporation temperature of the suction side evaporator 16 is reduced to a very low temperature such as −30° C.-−10° C., the COP of the refrigeration cycle device can be improved.

(2nd Embodiment)

Figure 3:
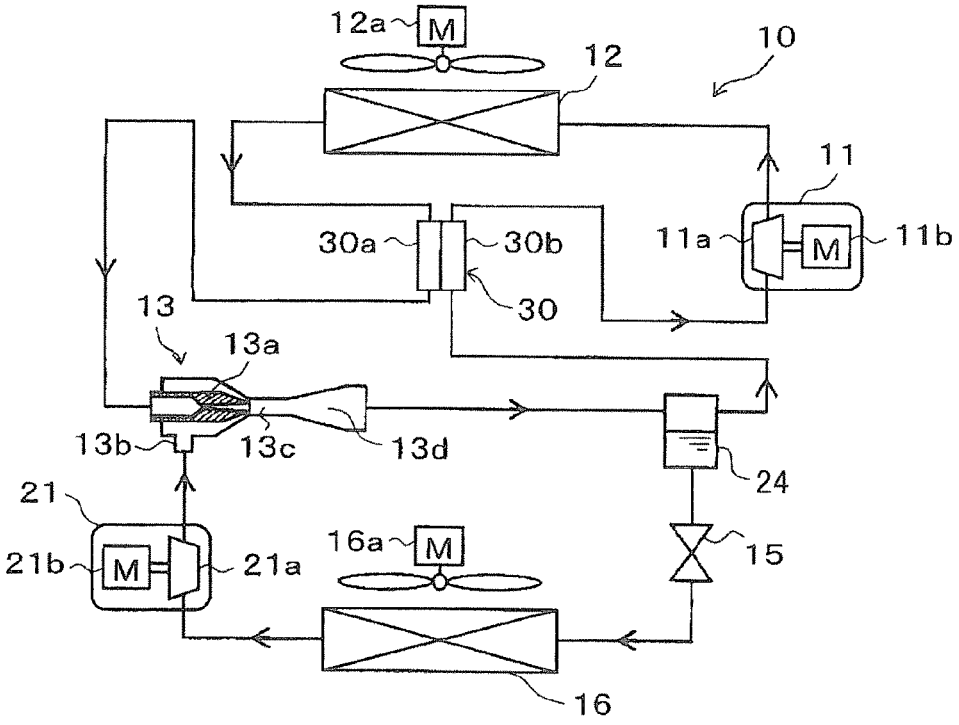
FIG. 3 is an entire schematic diagram of an ejector-type refrigeration cycle device of 2nd embodiment.

In the present embodiment, as in the entire schematic diagram of FIG. 3, an inner heat exchanger 30, in which the refrigerant flowing out of the radiator 12 and a low-pressure side refrigerant in the cycle are heat exchanged, is added with respect to the ejector-type refrigeration cycle device 10 of the 1st embodiment. In FIG. 3, parts similar to or corresponding to those of the first embodiment are indicated by the same reference numbers. This is the same also in the following drawings.

The inner heat exchanger 30 is for performing heat exchange between refrigerant flowing through a high-pressure side refrigerant passage 30*a* from a refrigerant outlet side of the radiator 12, and refrigerant flowing through a low-pressure side refrigerant passage 30*b* and being drawn to the first compression mechanism 11*a*. Thus, the low-pressure side refrigerant in the cycle of the present embodiment is the refrigerant to be drawn into the first compression mechanism 11*a*.

As a special structure of the inner heat exchanger 30, a double-pipe heat exchange structure may be used, in which an inner pipe forming the low-pressure side refrigerant passage 30*b* is provided inside of an outer pipe forming the high-pressure side refrigerant passage 30*a*. The high-pressure side refrigerant passage 30*a* may be provided as the inner pipe, and the low-pressure side refrigerant passage 30*b* may be provided as the outer pipe.

Furthermore, refrigerant pipes for defining the high-pressure side refrigerant passage 30*a* and the low-pressure side refrigerant passage 30*b* maybe bonded by brazing to have a heat exchange structure. Other configurations are similar to those of the 1st embodiment.

Figure 4:
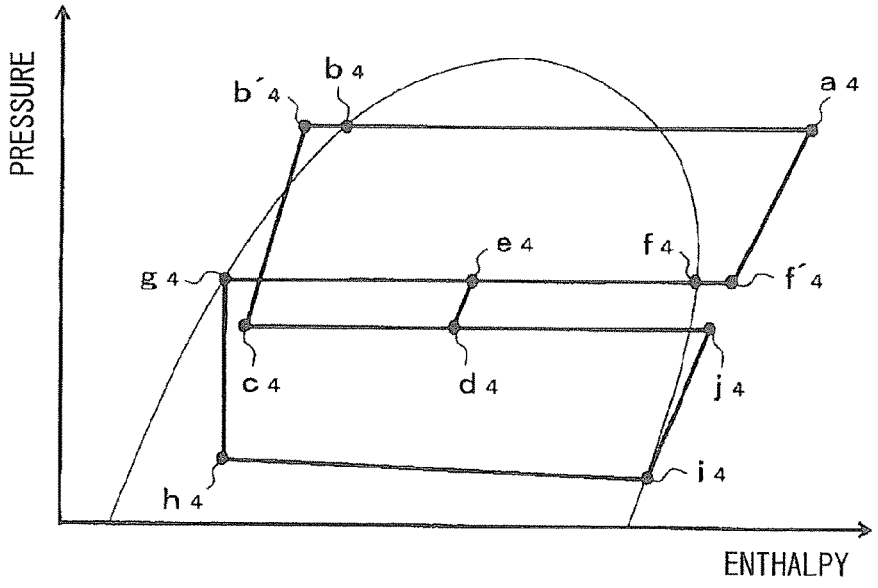
FIG. 4 is a Mollier diagram showing a refrigerant state of the ejector-type refrigeration cycle device of the 2nd embodiment.

Next, the operation of the present embodiment will be described with reference to the Mollier diagram of FIG. 4. Regarding the signs indicating the refrigerant states in FIG. 4, the same refrigerant states as in FIG. 2 are indicated by using the same alphabets, but the additional signs behind the alphabets are only changed based on the figure numbers. The same is adapted for the Mollier diagrams in the following embodiments.

When the ejector-type refrigeration cycle device 10 of the present embodiment is operated, by the operation of the inner heat exchanger 30, the enthalpy of the suction side refrigerant of the first compression mechanism 11*a* is increased (point f4 point→f'4 in FIG. 4), and the enthalpy of the refrigerant flowing out of the radiator 12 is decreased (point b4→point b'4 in FIG. 4), with respect to the 1st embodiment. Other operation is similar to that of the 1st embodiment.

Thus, the dryness of the jet refrigerant jetted from the nozzle portion 13*a* is reduced thereby reducing the flow speed of the jet refrigerant. Thus, the pressure of the refrigerant flowing out of the diffuser portion 13*d* of the ejector 13 can be reduced. Therefore, the enthalpy of the refrigerant in the accumulator 24 can be decreased, and the enthalpy of the liquid refrigerant which flows into the suction side evaporator 16 from the accumulator 24 can also be decreased.

Thus, in the present embodiment, the same effects as in the 1st embodiment can be obtained. In addition, in the present embodiment, the enthalpy difference between the enthalpy of the inlet side refrigerant of the suction side evaporator 16, and the enthalpy of the outlet side refrigerant of the suction side evaporator 16 can be enlarged, thereby increasing the cooling capacity obtained in the ejector-type refrigeration cycle device 10. As a result, the COP can be improved further.

(3rd Embodiment)

Figure 5:
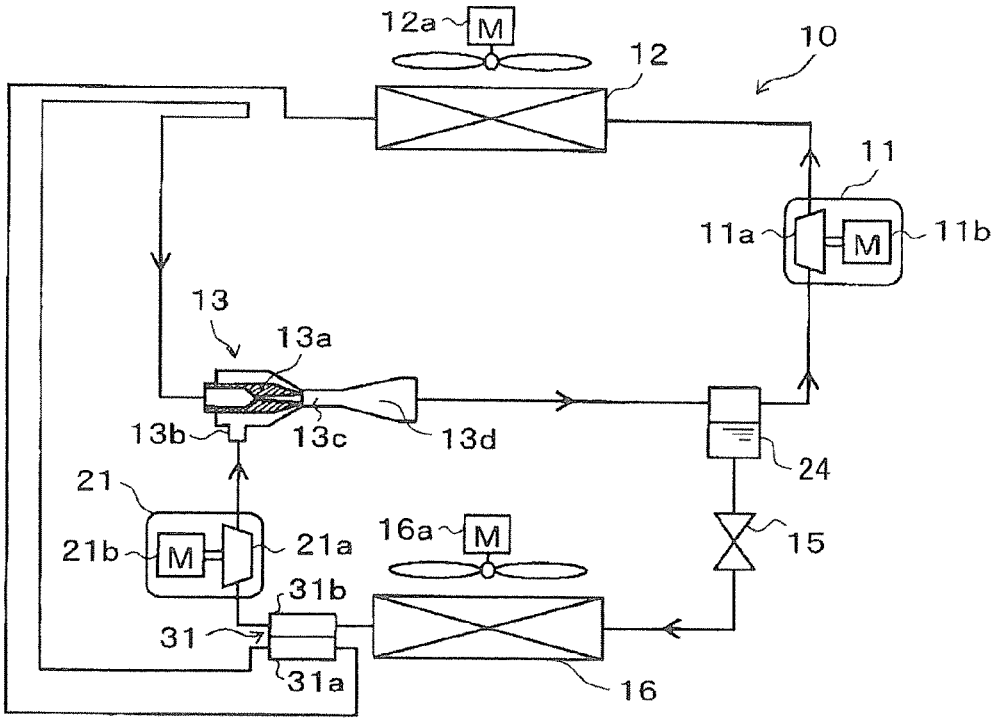
FIG. 5 is an entire schematic diagram of an ejector-type refrigeration cycle device of 3rd embodiment.

In the present embodiment, as in the entire schematic diagram of FIG. 5, an inner heat exchanger 31 is added with respect to the ejector-type refrigeration cycle device 10 of the 1st embodiment. The basic structure of the inner heat exchanger 31 is similar to the inner heat exchanger 30 of the second embodiment.

The inner heat exchanger 31 is for performing heat exchange between refrigerant flowing through a high-pressure side refrigerant passage 31*a* from the refrigerant outlet side of the radiator 12, and refrigerant flowing through the low-pressure side refrigerant passage 31*b* and being drawn to the second compression mechanism 21*a*. Thus, the low-pressure side refrigerant in the cycle of the present embodiment is the refrigerant to be drawn into the second compression mechanism 21*a*. Other configurations in the present embodiment are similar to those of the 1st embodiment.

Figure 6:
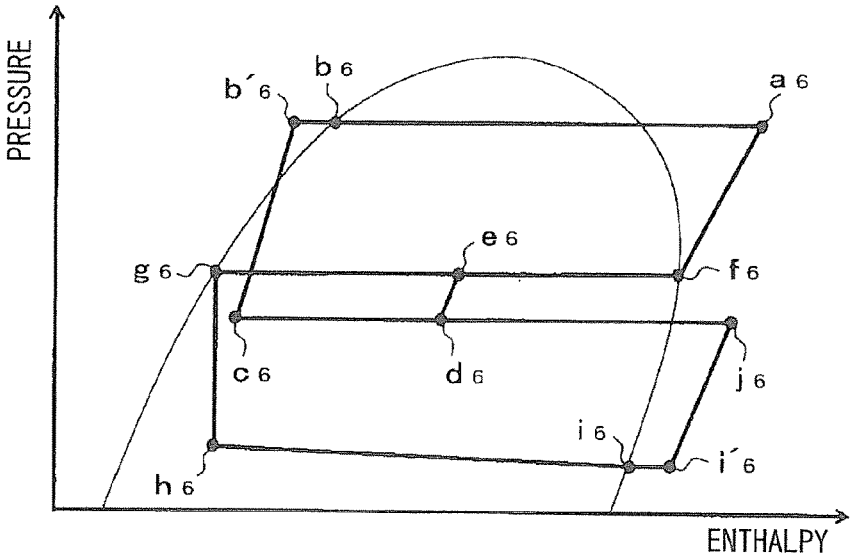
FIG. 6 is a Mollier diagram showing a refrigerant state of the ejector-type refrigeration cycle device of the 3rd embodiment.

Next, the operation of the present embodiment will be described with reference to the Mollier diagram of FIG. 6. When the ejector-type refrigeration cycle device 10 of the present embodiment is operated, the enthalpy of the suction side refrigerant of the second compression mechanism 21*a* is increased (point i6→point i'6 in FIG. 6), and the enthalpy of the refrigerant flowing out of the radiator 12 is decreased (point b6→point b'6 in FIG. 6), by the operation of the inner heat exchanger 31, with respect to the 1st embodiment. Other operation is similar to that of the 1st embodiment.

Therefore, in the ejector-type refrigeration cycle device 10 of the present embodiment, the enthalpy of the liquid refrigerant flowing into the suction side evaporator 16 from the accumulator 24 can be decreased, similarly to the second embodiment.

In the inner heat exchanger 31 of the present embodiment, heat exchange is performed between the refrigerant at the refrigerant outlet side of the radiator 12 and the refrigerant at the refrigerant suction side of the second compression mechanism 21*a*. Thus, the refrigerant flowing toward the nozzle portion 13*a* of the ejector 13 is cooled by the inner heat exchanger 31, and the refrigerant to be drawn to the second compression mechanism 21*a* is heated by the inner heat exchanger 31.

After the jet refrigerant to be jetted from the nozzle portion 13*a* and the suction refrigerant to be drawn from the refrigerant suction port 13*b* perform heat exchange at a position upstream of the nozzle portion 13*a* and the second compressor 21, it will be mixed in the mixed portion 13*c* of the ejector 13. Therefore, the enthalpy of mixed refrigerant may be difficult to be reduced, and the enthalpy of the refrigerant flowing into the accumulator 24 may be difficult to be reduced, as compared with a case (e.g., first embodiment) where the inner heat exchanger 31 is not provided.

According to the ejector-type refrigeration cycle device 10 of the present embodiment, because the flow amount of the suction refrigerant can be made smaller than the flow amount of the jet refrigerant. Thus, the flow speed of the jet refrigerant of the nozzle portion 13*a* can be decreased, and thereby the pressure of the refrigerant flowing out of the diffuser portion 13*d* can be sufficiently reduced. Therefore, the enthalpy of the refrigerant flowing into the accumulator 24 can be decreased.

As a result, the same effects as in the 1st embodiment can be obtained. In addition, in the present embodiment, the enthalpy difference between the enthalpy of the inlet side refrigerant of the suction side evaporator 16, and the enthalpy of the outlet side refrigerant of the suction side evaporator 16 can be enlarged, thereby increasing the cooling capacity obtained in the ejector-type refrigeration cycle device 10.

(4th Embodiment)

Figure 7:
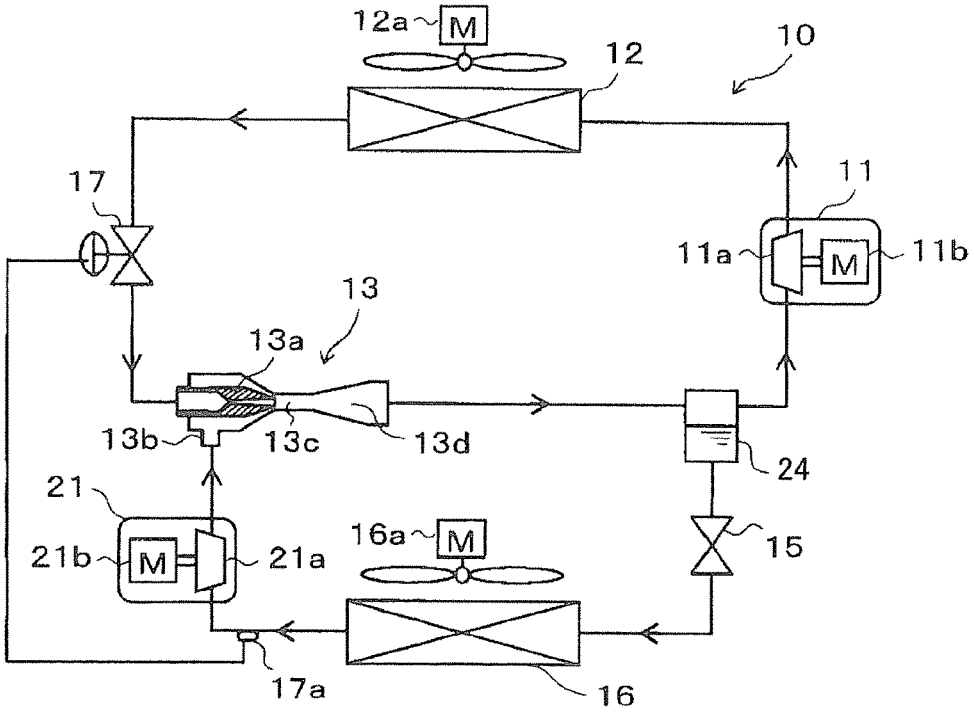
FIG. 7 is an entire schematic diagram of an ejector-type refrigeration cycle device of 4th embodiment.

In the present embodiment, as shown in the entire schematic diagram of FIG. 7, a thermal expansion valve 17 is added with respect to the ejector-type refrigeration cycle device of the first embodiment. The thermal expansion valve 17 is a high-pressure side decompression means, which is arranged in a refrigerant passage from the refrigerant outlet side of the radiator 12 to an upstream side of the nozzle portion 13*a,* to decompress and expand high-pressure refrigerant passing through the refrigerant passage.

The thermal expansion valve 17 has a temperature sensing portion 17*a* arranged in a refrigerant passage at a refrigerant outlet side of the suction side evaporator 16. The thermal expansion valve 17 is a variable throttle mechanism, in which a super-heat degree of the refrigerant at the refrigerant outlet side of the suction side evaporator 16 is detected based on temperature and pressure of the refrigerant at the refrigerant outlet side of the suction side evaporator 16, and its valve-open degree (refrigerant flow amount) is adjusted by using a mechanical mechanism so that the super-heat degree of the refrigerant at the refrigerant outlet side of the suction side evaporator 16 is approached to a predetermined value. Other configurations in the present embodiment are similar to those of the 1st embodiment.

Figure 8:
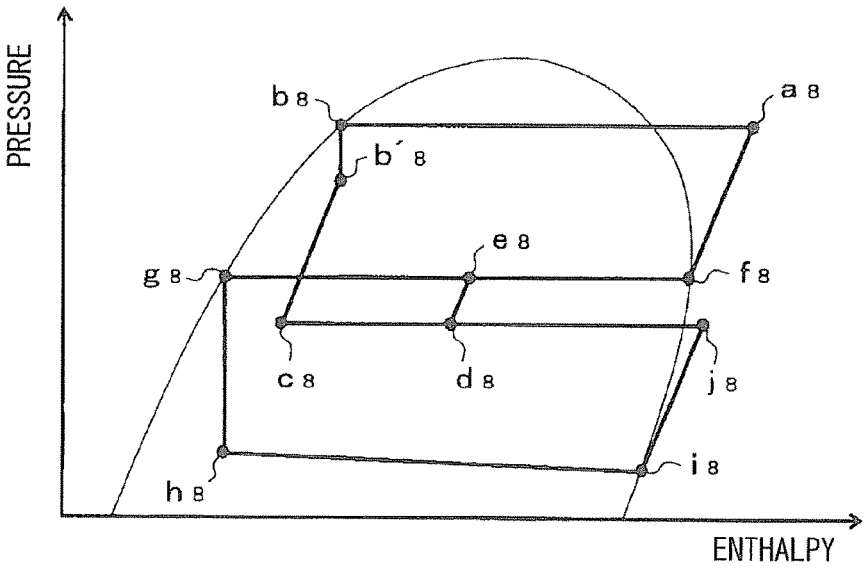
FIG. 8 is a Mollier diagram showing a refrigerant state of the ejector-type refrigeration cycle device of the 4th embodiment.

Next, the operation of the present embodiment will be described with reference to the Mollier diagram of FIG. 8. When the ejector-type refrigeration cycle device 10 of the present embodiment is operated, the refrigerant radiated at the radiator 12 flows into the thermal expansion valve 17, and is decompressed and expanded in iso-enthalpy to become in a gas-liquid two-phase state (point b8→point b'8 in FIG. 8). At this time, the valve open degree of the thermal expansion valve 17 is adjusted so that a super heat degree of the refrigerant at the refrigerant outlet side of the suction side evaporator 16 becomes a predetermined value.

A middle-pressure refrigerant decompressed and expanded by the thermal expansion valve 17 is decompressed and expanded in iso-entropy in the nozzle portion 13*a* of the ejector 13 similarly to the first embodiment, and is mixed with the refrigerant drawn from the refrigerant suction port 13*b* of the ejector 13. Then, the mixed refrigerant flowing out of the ejector 13 flows into the accumulator 24. Furthermore, the gas refrigerant separated from the liquid refrigerant at the accumulator 24 is drawn into the first compressor 11, and is compressed again (point c8→point d8→point e8→point f8→point a8 in FIG. 8).

On the other hand, the liquid refrigerant separated from the gas refrigerant at the accumulator 24 is decompressed at the fixed throttle 15 in iso-enthalpy. The decompressed refrigerant flowing from the fixed throttle 15 absorbs heat from air to be blown into the room in the suction side evaporator 16, and then is drawn into the second compressor 21. Furthermore, the refrigerant flowing out of the second compressor 21 is drawn into the ejector 13 from the refrigerant suction port 13*b* (point g8→point h8→point i8→point j8→point d8 in FIG. 8).

Therefore, in the ejector-type refrigeration cycle device 10 of the present embodiment, the same effects as in the 1st embodiment can be obtained. In addition, in the present embodiment, because the thermal expansion valve 17 that is a variable throttle mechanism is used as the high-pressure side decompression means, the refrigerant flow amount flowing into the nozzle portion 13*a* of the ejector 13 can be varied in accordance with a load variation in the refrigerant cycle. As a result, even if load fluctuation arises, the refrigerant cycle can be stably operated while having a high COP.

At this time, the valve open degree of the thermal expansion valve 17 is adjusted so that the super heat degree of the refrigerant at the refrigerant outlet side of the suction side evaporator 16 becomes a predetermined value. Therefore, it can prevent liquid refrigerant from being compressed in the second compressor 21.

Furthermore, in the present embodiment, because the refrigerant decompressed and expanded at the thermal expansion valve 17 becomes in the gas-liquid two-phase sate (point b8' in FIG. 8), the refrigerant of the gas-liquid two-phase sate can flows into the nozzle portion 13*a* of the ejector 13.

Thus, it is compared with a case where the liquid refrigerant flows into the nozzle portion 13*a,* boiling of the refrigerant in the nozzle portion 13*a* can be facilitated, thereby improving the nozzle efficiency. Thus, a recovery energy amount in the ejector 13 is increased, and a pressure increasing amount is increased in the diffuser portion 13*d,* thereby improving the COP.

Furthermore, it is compared with the case where the liquid refrigerant flows into the nozzle portion 13*a,* the refrigerant passage area of the nozzle portion 13*a* can be enlarged, and thereby the processing of the nozzle portion 13*a* can be made easy. As a result, the product cost of the ejector 13 can be decreased, thereby reducing the product cost in the entire of the ejector-type refrigeration cycle device 10.

(5th Embodiment)

Figure 9:
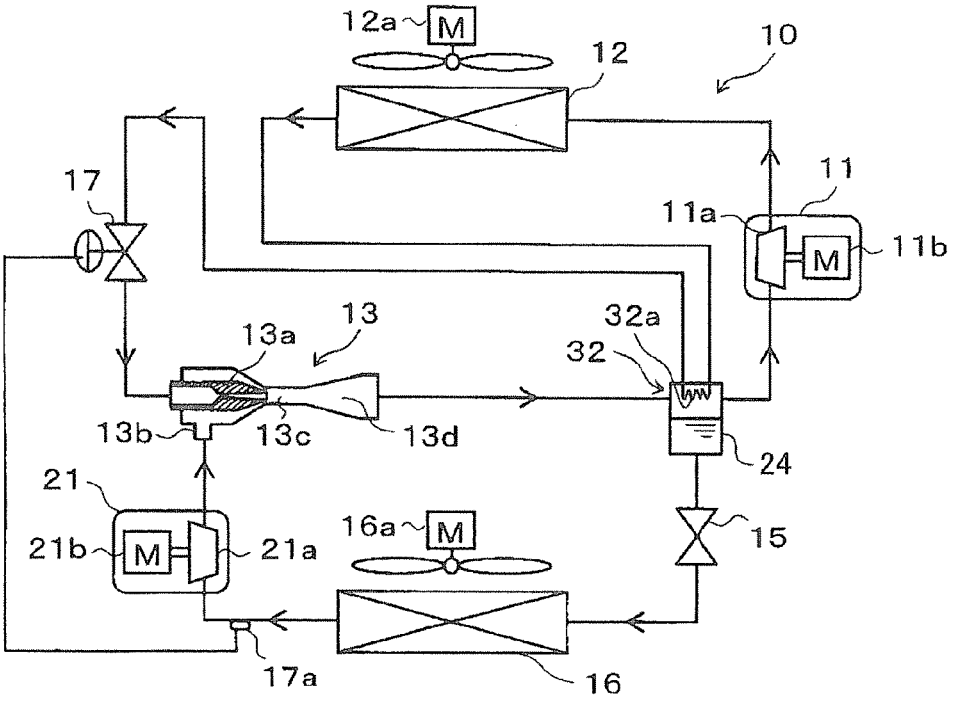
FIG. 9 is an entire schematic diagram of an ejector-type refrigeration cycle device of 5th embodiment.

In the present embodiment, as in the entire schematic diagram of FIG. 9, an inner heat exchanger 32 is added with respect to the ejector-type refrigeration cycle device 10 of the 4th embodiment. This inner heat exchanger 32 performs heat exchange between the refrigerant at the refrigerant outlet side of the radiator 12 and the gas refrigerant in the accumulator 24. Thus, the low-pressure side refrigerant in the cycle of the present embodiment is the gas refrigerant in the accumulator 24.

Specifically, the inner heat exchanger 32 is configured to have a high pressure pipe 32*a* that is arranged in a space within the accumulator 24 (i.e., upper side space in the accumulator 24), in which the gas refrigerant is stored, so that the refrigerant at the refrigerant outlet side of the radiator 12 flows through the high pressure pipe 32*a*. Therefore, the inner heat exchanger 32 of the embodiment is constituted integrally with the accumulator 24.

In the present embodiment, the high pressure pipe 32*a* of the inner heat exchanger 32 is configured to pass through the upper side space within the accumulator 24. Thus, it is compared with a case where the high pressure pipe 32*a* passes through the space (i.e., the lower side space in the accumulator 24) in which the liquid refrigerant is stored within the accumulator 24, an unnecessary boiling of the liquid refrigerant in the accumulator 24 can be prevented.

Of course, if the boiling does not pose a problem, the high pressure pipe 32*a* of the inner heat exchanger 32 may be configured to pass through the space in which the liquid refrigerant is stored within the accumulator 24. Other configurations in the present embodiment are similar to those of the 4th embodiment.

Next, the operation of the present embodiment will be described with reference to the Mollier diagram of FIG. 10. When the ejector-type refrigeration cycle device 10 of the present embodiment is operated, the enthalpy of the suction side refrigerant of the first compression mechanism 11*a* is increased (point f10→point f'10 in FIG. 10), and the enthalpy of the refrigerant flowing out of the radiator 12 is decreased (point b10→point b'10 in FIG. 10), by the operation of the inner heat exchanger 32.

Figure 10:
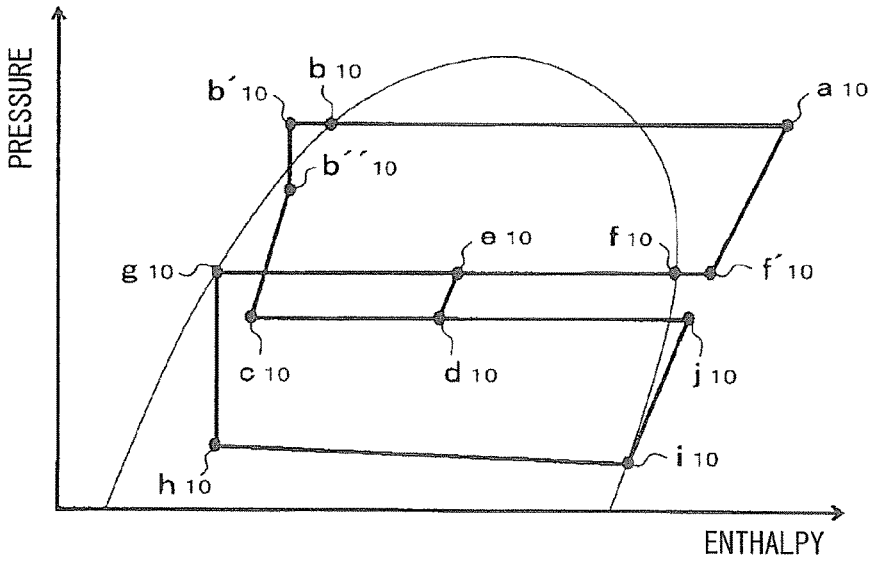
FIG. 10 is a Mollier diagram showing a refrigerant state of the ejector-type refrigeration cycle device of the 5th embodiment.

Furthermore, the refrigerant flowing out of the high pressure pipe 32*a* of the inner heat exchanger 32 flows into the thermal expansion valve 17 similarly to the fourth embodiment, and is decompressed and expanded in isoenthalpy to become in a gas-liquid two-phase state (point b'10→point b"10 in FIG. 10). Other operation is similar to that of the 1st embodiment.

Therefore, the enthalpy difference between the enthalpy of the refrigerant at the refrigerant inlet side of the suction side evaporator 16 and the enthalpy of the refrigerant at the refrigerant outlet side of the suction side evaporator 16 can be enlarged by the action of the inner heat exchanger 32. Furthermore, the nozzle efficiency in the nozzle portion 13*a* of the ejector 13 can be improved similarly to the 4th embodiment, by the operation of the thermal expansion valve 17.

As a result, the same effects as in the 1st embodiment can be obtained. In addition, similarly to the 2nd embodiment, cooling capacity obtained in the ejector-type refrigeration cycle device 10 can be increased. Furthermore, similarly to the fourth embodiment, a pressure increasing amount is increased in the diffuser portion 13*d*, thereby further improving the COP in the cycle.

(6th Embodiment)

Figure 11:
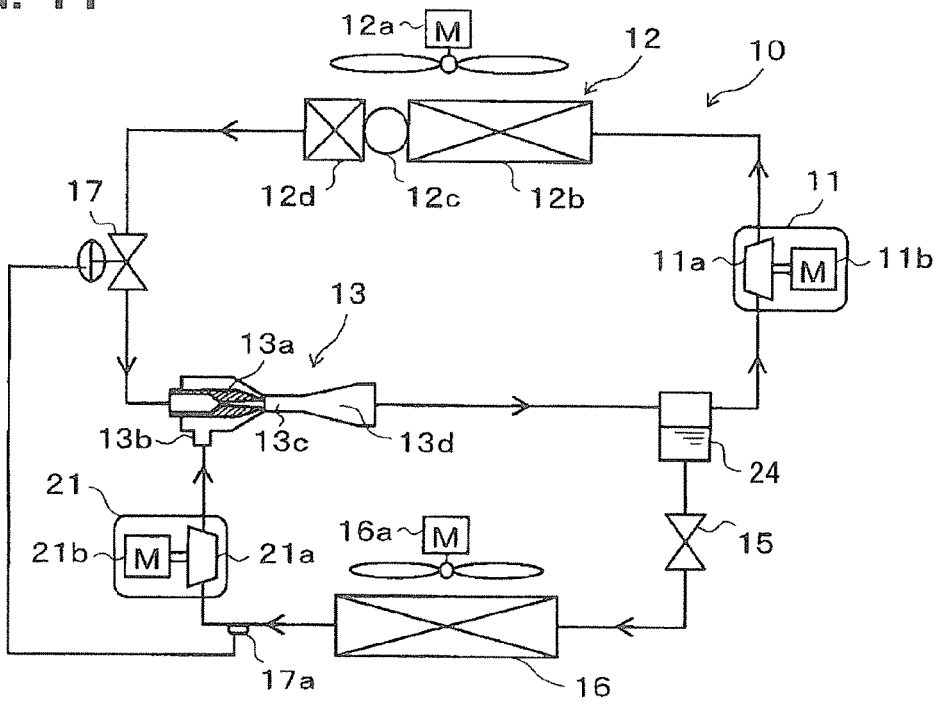
FIG. 11 is an entire schematic diagram of an ejector-type refrigeration cycle device of 6th embodiment.

In the present embodiment, as in the entire schematic diagram of FIG. 11, a structure of the radiator 12 is changed with respect to the ejector-type refrigeration cycle device 10 of the 4th embodiment.

Specifically, the radiator 12 of the present embodiment is configured as a sub-cool type condenser, which includes a condensation portion 12*b*, a gas-liquid separation portion 12*c* (receiver portion) and a super-cooling portion 12*d*. The condensation portion 12*b* condenses the refrigerant, the gas-liquid separation portion 12*c* separates the refrigerant flowing out of the condensation portion 12*b* into gas refrigerant and liquid refrigerant, and the super-cooling portion 12*d* super-cools the liquid refrigerant flowing out of the gas-liquid separation portion 12*c*. Other configurations in the present embodiment are similar to those of the 4th embodiment.

Next, the operation of the present embodiment will be described with reference to the Mollier diagram of FIG. 12. When the ejector-type refrigeration cycle device 10 of the present embodiment is operated, the refrigerant condensed in the condensation portion 12*b* of the radiator 12 is separated into gas refrigerant and liquid refrigerant in the gas-liquid separation portion 12*c* (point b12 in FIG. 12). Furthermore, the saturated liquid refrigerant separated in the gas-liquid separation portion 12*c* is super-cooled in the supercooling portion 12*d* (point b12→point b'12 in FIG. 12). Other operation is similar to that of the 4th embodiment.

Thus, the dryness of the jet refrigerant jetted from the nozzle portion 13*a* is reduced thereby reducing the flow speed of the jet refrigerant. Thus, the pressure of the refrigerant flowing out of the diffuser portion 13*d* of the ejector 13 can be reduced. Therefore, the enthalpy of the refrigerant in the accumulator 24 can be decreased, and the enthalpy of the liquid refrigerant which flows into the suction side evaporator 16 from the accumulator 24 can also be decreased.

As a result, in the present embodiment, the enthalpy difference between the enthalpy of the refrigerant at the refrigerant inlet side of the suction side evaporator 16, and the enthalpy of the refrigerant at the refrigerant outlet side of the suction side evaporator 16 can be enlarged, thereby increasing the cooling capacity obtained in the ejector-type refrigeration cycle device 10.

Figure 12:
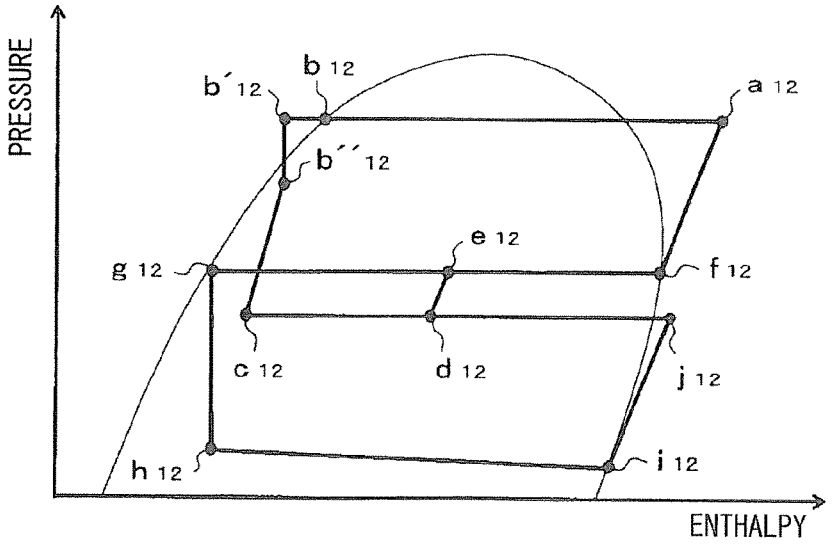
FIG. 12 is a Mollier diagram showing a refrigerant state of the ejector-type refrigeration cycle device of the 6th embodiment.

At this time, unlike a case where the inner heat exchanger 31 (refer to FIGS. 5 and 6) of the third embodiment is used, it can prevent the enthalpy of the suction side refrigerant (i.e., low-pressure side refrigerant in the cycle) of the second compression mechanism 21*a* from being unnecessary increased (point i12 in FIG. 12). Thus, it can prevent the density of the suction refrigerant of the second compression mechanism 21*a* from being lowered, and thereby it is possible to reduce the refrigerant evaporation pressure (refrigerant evaporation temperature) in the suction side evaporator 16, with respect to the third embodiment.

Furthermore, the refrigerant flowing out of the super-cooling portion 12*d* of the radiator 12 is decompressed and expanded by the thermal expansion valve 17 to a gas-liquid two-phase state (point b'12→point b"12 in FIG. 12). Thus, similarly to the 4th embodiment, the nozzle efficiency of the ejector 13 can be improved.

As a result, not only the same effects as in the 1st embodiment can be obtained, but also the cooling capacity obtained in the ejector-type refrigeration cycle device 10 can be increased. In addition, similarly to the 4th embodiment, a pressure increasing amount is increased in the diffuser portion 13*d*, thereby further improving the COP in the cycle.

(7th Embodiment)

Figure 13:
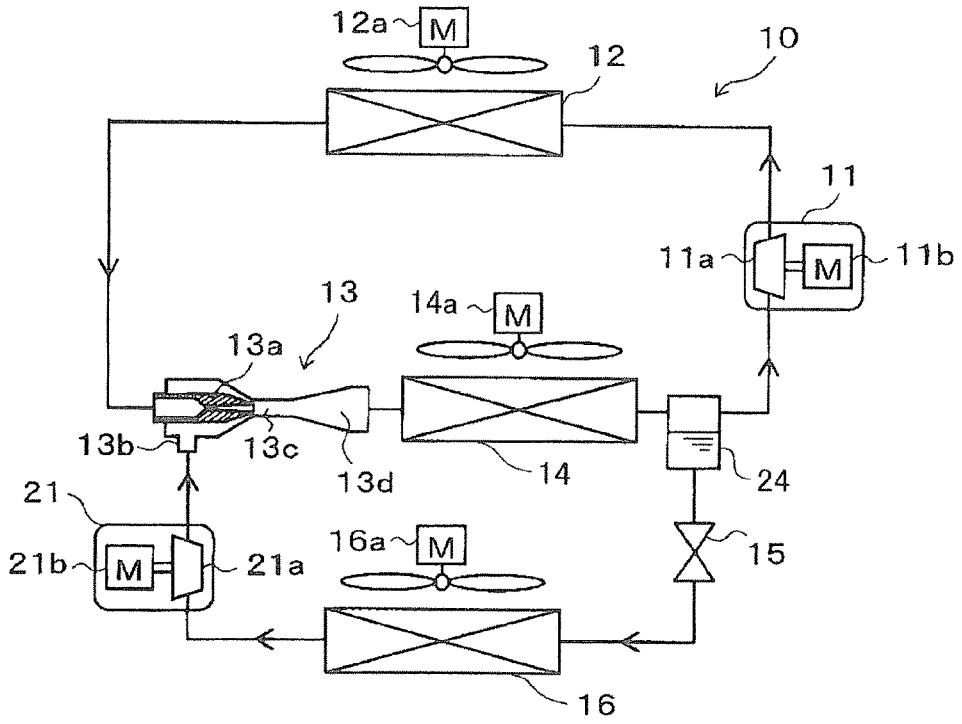
FIG. 13 is an entire schematic diagram of an ejector-type refrigeration cycle device of 7th embodiment.
Figure 14:
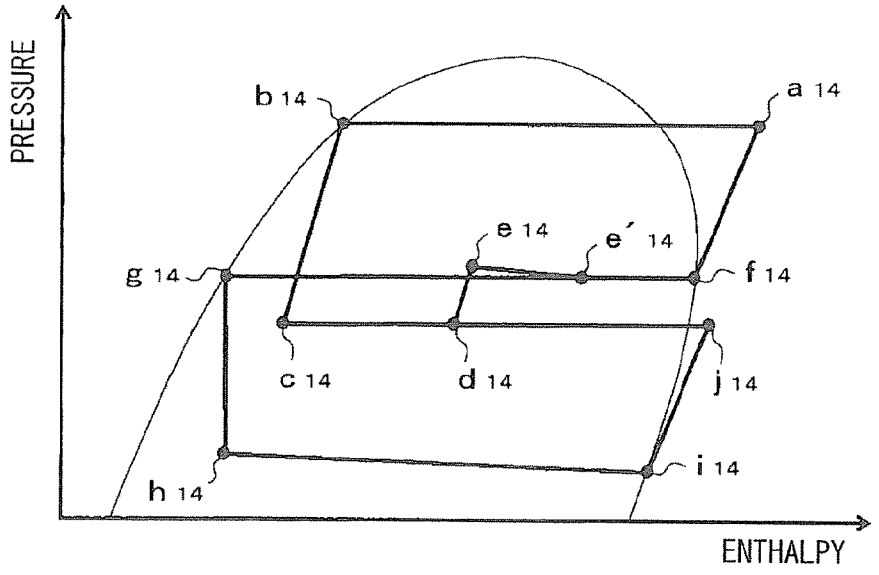
FIG. 14 is a Mollier diagram showing a refrigerant state of the ejector-type refrigeration cycle device of the 7th embodiment.

In the present embodiment, as in the entire schematic diagram of FIG. 13 and the Mollier diagram of FIG. 14, a discharge side evaporator 14 is arranged at a downstream side of the diffuser portion 13*d* of the ejector 13 and at an upstream side of the accumulator 24, with respect to the ejector-type refrigeration cycle device 10 of the first embodiment.

The basic structure of the discharge side evaporator 14 is similar to that of the suction side evaporator 16. The discharge side evaporator 14 is a heat-absorbing heat exchanger, in which refrigerant flowing out the ejector 13 is evaporated by heat-exchanging with air blown by a blower fan 14*a*, so as to provide heat-absorbing action.

Thus, in the present embodiment, air blown by the blower fan 14*a* is also a fluid to be heat exchanged. The blower fan 14*a* is an electrical blower, in which rotation speed (air blowing amount) of the blower fan 14*a* is controlled by a control voltage output from the control device. Other configurations in the present embodiment are similar to those of the 1st embodiment.

When the ejector-type refrigeration cycle device of the present embodiment is operated, it operates similarly to the first embodiment, and effects similar to the first embodiment can be obtained. As in the Mollier diagram of FIG. 14, the refrigerant is evaporated at the discharge side evaporator 14 in the refrigerant state from point e14 to point e'14, thereby obtaining heat absorbing action. Therefore, air blown by the blower fan 14*a* can also be cooled by the discharge side evaporator 14.

The refrigerant is evaporated in the discharge side evaporator 14 at a temperature higher than the refrigerant evaporation temperature of the suction side evaporator 16. That is, in the suction side evaporator 16 and the discharge side evaporator 14, refrigerant evaporates with a different temperature zone. Thus, in the present embodiment, air in the room of the refrigerator, where food, a drink, etc. are saved at a low temperature (0° C.-10° C.), can be also cooled with the blower fan 14*a*, for example, while the same effects as in the 1st embodiment can be obtained.

Of course, the discharge side evaporator 14 may be added to any ejector-type refrigeration cycle device 10 of the 2nd-6th embodiments.

(8th Embodiment)

Figure 15:
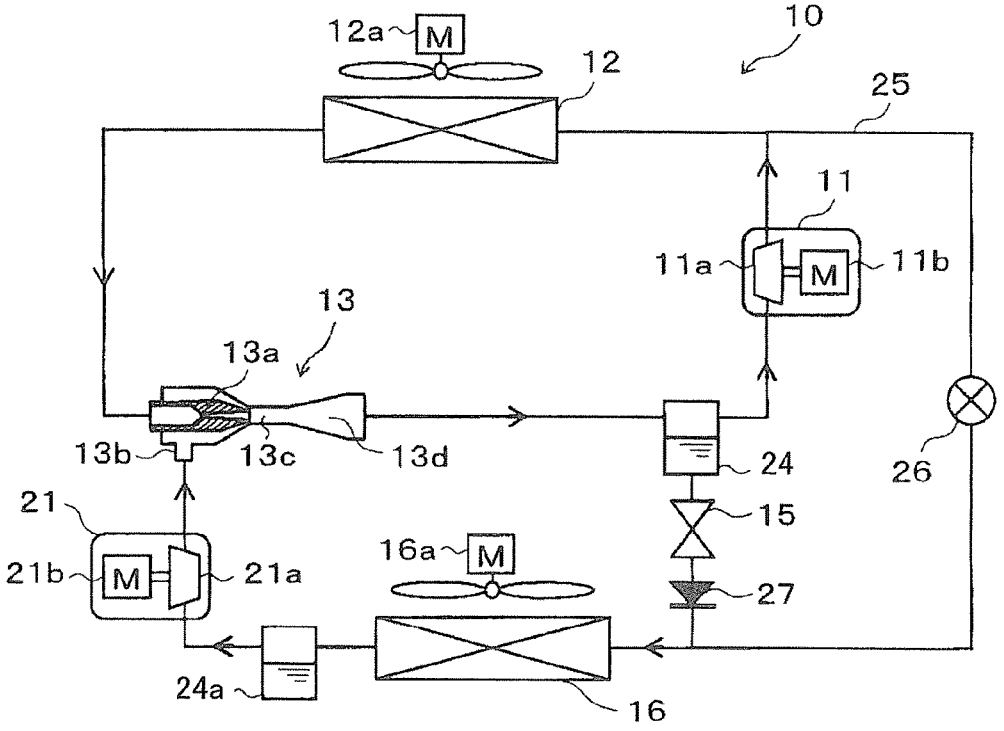
FIG. 15 is an entire schematic diagram of an ejector-type refrigeration cycle device of 8th embodiment.

In the present embodiment, as in the entire schematic diagram of FIG. 15, a bypass passage 25, an opening/closing valve 26, a check valve 27 and a gas-liquid separator 24*a* are added with respect to the ejector-type refrigeration cycle device 10 of the 1st embodiment.

The bypass passage 25 is a refrigerant passage through which high-pressure refrigerant discharged from the first compression mechanism 11*a* is directly introduced to the suction side evaporator 16 while bypassing the radiator 12. The bypass passage 25 is configured by a refrigerant pipe connected to a portion between the first compression mechanism 11*a* and the radiator 12, and connected to a portion between the fixed throttle 15 and the suction side evaporator 16. The opening/closing valve 26 is an opening/closing means for opening and closing the bypass passage 25. For example, the opening/closing valve 26 is an electromagnetic valve in which an opening or closing operation is controlled by a control signal output from the control device.

The check valve 27 is arranged in a passage from the accumulator 24 to the suction side evaporator 16, at a position between the fixed throttle 15 and a connection portion connected to bypass passage 25, so as to allow only a flow of the refrigerant from the fixed throttle 15 toward the suction side evaporator 16. That is, the check valve 27 prevents the refrigerant flowing from the bypass passage 25 toward the suction side evaporator 16, from being introduced to the accumulator 24 (fixed throttle 15). The gas-liquid separator 24*a* is a suction-side gas-liquid separator, in which the refrigerant flowing out of the suction side evaporator 16 is separated into gas refrigerant and liquid refrigerant, and surplus liquid refrigerant in the cycle is stored therein.

When the ejector-type refrigeration cycle device 10 of the present embodiment is operated in a case where the control device closes the opening/closing valve 26, the ejector-type refrigeration cycle device 10 is operated similarly to the 1st embodiment, and thereby it is possible to obtain the effects similar to the 1st embodiment.

Furthermore, in the present embodiment, with respect to the ejector-type refrigeration cycle device 10 of the 1st embodiment, the bypass passage 25, the opening/closing valve 26 for opening and closing the bypass passage 25, the check valve 27 for preventing the refrigerant flowing in the bypass passage 25 from flowing to the accumulator 24 (discharge-side gas-liquid separator) are provided. The high-pressure refrigerant discharged from the first compression mechanism 11*a* is introduced to the suction side evaporator 16 via the bypass passage 25 while bypassing the radiator 12. Thus, when frost is caused on the suction side evaporator 16, the control device causes the opening/closing valve 26 to be opened. Therefore, high-temperature refrigerant discharged from the first compressor 11 directly flows into the suction side evaporator 16 via the bypass passage 25, thereby defrosting the suction side evaporator 16.

Furthermore, the suction-side gas-liquid separator 24*a* is arranged between the suction side evaporator 16 and the second compression mechanism 21*a* to separate the refrigerant into gas refrigerant and liquid refrigerant. A gas refrigerant outlet of the suction-side gas-liquid separator 24*a* is connected to the refrigerant suction side of the second compression mechanism 21*a*. Thus, even when the high-pressure refrigerant discharged from the first compression mechanism 11*a* is condensed in the defrosting, because only gas refrigerant separated at the suction-side gas-liquid separator 24*a* can be supplied to the second compression mechanism 21*a*, thereby preventing a liquid refrigerant compression in the second compression mechanism 21*a*.

(9th Embodiment)

Figure 16:
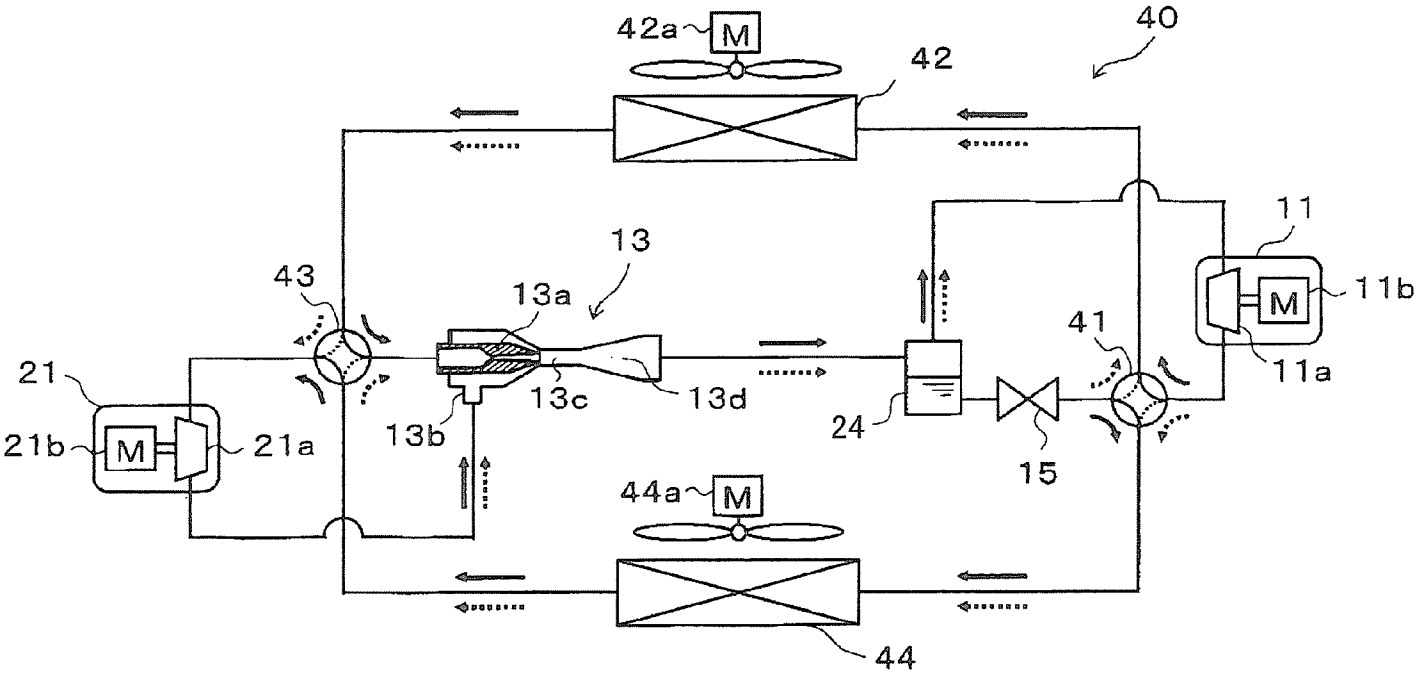
FIG. 16 is an entire schematic diagram of an ejector-type refrigeration cycle device of 9th embodiment.

Next, 9th embodiment of the present invention will be described with reference to FIG. 16. In the present embodiment, the ejector-type refrigeration cycle device of the present invention is applied to an air-conditioner for indoor air-conditioning. FIG. 16 is an entire schematic diagram of an ejector-type refrigeration cycle device 40 of the present embodiment.

The ejector-type refrigeration cycle device 40 is configured to be capable of switching between a cooling operation mode for cooling air (fluid to be heat-exchanged) to be blown into the room, and a heating operation mode for heating air to be blown into a room. The solid line arrows in FIG. 16 show the flow of the refrigerant in the cooling operation mode, and the chain line arrows in FIG. 16 show the flow of the refrigerant in the heating operation mode.

The ejector-type refrigeration cycle device 40 of the present embodiment is provided with a first electrical four-way valve 41 that is connected to a refrigerant discharge side of the first compression mechanism 11*a*. The first electrical four-way valve 41 is a refrigerant passage switching means, in which its operation is controlled by a control signal output from the control device.

Specifically, the first electrical four-way valve 41 is configured to switch between a refrigerant passage (i.e., the circuit shown by the solid line arrows in FIG. 16) in which the refrigerant discharge side of the first compressor 11 and an exterior heat exchanger 42 are connected, and at the same time, a liquid refrigerant outlet side (the side of the fixed throttle 15) of the accumulator 24 and a using-side heat exchanger 44 are connected; and a refrigerant passage (i.e., the circuit shown by the chain line arrows in FIG. 16) in which the refrigerant discharge side of the first compressor 11 and the using-side heat exchanger 44 are connected, and at the same time, the liquid refrigerant outlet side (the side of the fixed throttle 15) of the accumulator 24 and the exterior heat exchanger 42 are connected.

As in the refrigerant passage shown by the solid line arrows of FIG. 16, in the cooling operation mode, the refrigerant discharge side of the first compressor 11 is connected to the exterior heat exchanger 42 via the first electrical four-way valve 41. The exterior heat exchanger 42 is a heat exchanger in which the refrigerant passing therein is heat-exchanged with outside air blown by a blower fan 42*a*. The blower fan 42*a* is an electrical blower, in which rotation speed (air blowing amount) of the blower fan 42*a* is controlled by a control voltage output from the control device.

Furthermore, a second electrical four-way valve 43 is connected to the refrigerant outlet side of the exterior heat exchanger 42 in the cooling operation mode. The second electrical four-way valve 43 is a refrigerant passage switching means, in which its operation is controlled by a control signal output from the control device. The basic structure of the second electrical four-way valve 43 is similar to that of the first electrical four-way valve 41.

Specifically, the second electrical four-way valve 43 is configured to switch between a refrigerant passage (i.e., the circuit shown by the solid line arrows in FIG. 16) in which the exterior heat exchanger 42 and an inlet side of the nozzle portion 13*a* of the ejector 13 are connected, and at the same time, the using-side heat exchanger 44 and the refrigerant suction side of the second compressor 21 are connected; and a refrigerant passage (i.e., the circuit shown by the chain line arrows in FIG. 16) in which the exterior heat exchanger 42 and the refrigerant suction side of the second compressor 21 are connected, and at the same time, the using-side heat exchanger 44 and the inlet side of the nozzle portion 13*a* of the ejector 13 are connected.

The using-side heat exchanger 44 is a heat exchanger in which the refrigerant passing therein is heat-exchanged with inside air (i.e., the fluid to be heat-exchanged) blown by a blower fan 44*a*. The blower fan 44*a* is an electrical blower, in which rotation speed (air blowing amount) of the blower fan 44*a* is controlled by a control voltage output from the control device.

In the present embodiment, the fixed throttle 15 is arranged between the liquid-refrigerant outlet side of the accumulator 24 and the first electrical four-way valve 41. Other configurations in the present embodiment are similar to those of the 1st embodiment.

Next, the operation of the present embodiment with the above configuration will be described with reference to FIG. 16. The ejector-type refrigeration cycle device 40 of the present embodiment is configured to be capable of switching between the cooling operation mode for cooling air to be blown into a room, and the heating operation mode for heating air to be blown into the room.

(a) Cooling Operation Mode

The cooling operation mode is performed in the ejector-type refrigeration cycle device 40, when the cooling operation mode is selected by an operation switch of an operation panel.

In the cooling operation mode, the control device causes the first and second electrical motors 11*b*, 21*b* and the blower fans 42*a*, 44*a* to be operated. In addition, the control device causes the first electrical four-way valve 41 to be switched such that the refrigerant discharge side of the first compressor 11 and the exterior heat exchanger 42 are connected, and at the same time, the liquid refrigerant outlet side of the accumulator 24 and the using-side heat exchanger 44 are connected; and causes the second electrical four-way valve 43 to be to switched such that the exterior heat exchanger 42 and an inlet side of the nozzle portion 13*a* of the ejector 13 are connected and at the same time, the using-side heat exchanger 44 and the refrigerant suction side of the second compressor 21 are connected.

Thus, as shown in the solid line arrows of FIG. 16, refrigerant circulates in this order of the first compressor 11 (→the first electrical four-way valve 41)→the exterior heat exchanger 42 (→the second electrical four-way valve 43)→the nozzle portion 13*a* of the ejector 13→the gas-refrigerant outlet of the accumulator 24→first compressor 11. At the same time, refrigerant circulates in this order of the liquid refrigerant outlet of the accumulator 24→the fixed throttle 15 (→first electrical four-way valve 41)→the using-side heat exchanger 44 (→the second electrical four-way valve 43)→the second compressor 21→the refrigerant suction port 13*b* of the ejector 13→the accumulator 24.

Thus, the refrigerant compressed by the first compression mechanism 11*a* is cooled in the exterior heat exchanger 42 by heat exchange with outside air blown by the blower fan 42*a*. Then, the refrigerant from the exterior heat exchanger 42 is decompressed and expanded in iso-entropy by the nozzle portion 13*a* of the ejector 13, and is jetted from the nozzle portion 13*a* of the ejector 13. Thus, the refrigerant discharged from the second compression mechanism 21*a* is drawn into the ejector 13 from the refrigerant suction port 13*b* of the ejector 13, by the refrigerant suction action of the jet refrigerant.

Furthermore, the jet refrigerant jetted from the nozzle portion 13*a* and the suction refrigerant drawn from the refrigerant suction port 13*b* are mixed in the mixing portion 13*c* of the ejector 13, and is pressurized in the diffuser portion 13*d* of the ejector 13. The refrigerant flowing out of the diffuser portion 13*d* is separated into gas refrigerant and liquid refrigerant in the accumulator 24, and the gas refrigerant flowing out of the gas refrigerant outlet of the accumulator 24 is drawn into the first compression mechanism 11*a* to be compressed again.

On the other hand, liquid refrigerant flowing out of the liquid refrigerant outlet of the accumulator 24 is further decompressed and expanded in iso-enthalpy at the fixed throttle 15. The refrigerant from the fixed throttle 15 flows into the using-side heat exchanger 44 via the first electrical four-way valve 41, and is evaporated by absorbing heat from air inside the room blown by the air blowing fan 44*a*. Thus, the air blown into the interior of the room is cooled.

The gas refrigerant flowing out of the using-side heat exchanger 44 is drawn into the second compression mechanism 21*a*, and is compressed. At this time, the control device controls operation of the first and second electrical motors 11*b*, 21*b* such that COP in the entire cycle of the ejector-type refrigeration cycle device 40 is approached approximately to the maximum value, similarly to the first embodiment.

That is, in the cooling operation mode of the present embodiment, the refrigerant passage is switched, such that the refrigerant discharged from the first compression mechanism 11*a* is cooled in the exterior heat exchanger 42, and the refrigerant is evaporated in the using-side heat exchanger 44.

More specifically, in the cooling operation mode, the exterior heat exchanger 42 is adapted similarly to the radiator 12 of the first embodiment, so that the refrigerant heat-radiated at the exterior heat exchanger 42 flows into the nozzle portion 13*a* of the ejector 13. At the same time, the using-side heat exchanger 44 is adapted similarly to the suction side evaporator 16 of the first embodiment, so that the liquid refrigerant separated at the accumulator 24 is evaporated in the using-side heat exchanger 44 and flows toward the refrigerant suction side of the second compression mechanism 21*a*.

Thus, in the cooling operation mode of the present embodiment, air blown into the room can be cooled. At this time, similarly to the first embodiment, a decrease in the flow amount of the drive flow of the ejector 13 can be limited by the operation of the second compression mechanism 21*a*, and thereby the ejector-type refrigeration cycle device 40 can be stably operated while improving the COR (b) Heating Operation Mode The heating operation mode is performed in the ejector-type refrigeration cycle device, when the heating operation mode is selected by an operation switch of an operation panel.

In the heating operation mode, the control device causes the first and second electrical motors 11*b*, 21*b* and the blower fans 42*a*, 44*a* to be operated. In addition, the control device causes the first electrical four-way valve 41 to be switched such that the refrigerant discharge side of the first compressor 11 and the using-side heat exchanger 44 are connected, and at the same time, the liquid refrigerant outlet side of the accumulator 24 and the exterior heat exchanger 42 are connected; and causes the second electrical four-way valve 43 to be switched such that the exterior heat exchanger 42 and the refrigerant suction side of the second compressor 21 are connected and at the same time, the using-side heat exchanger 44 and the inlet side of the nozzle portion 13*a* of the ejector 13 are connected.

Thus, as shown in the chain line arrows of FIG. 16, refrigerant circulates in this order of the first compressor 11 (→the first electrical four-way valve 41)→the using-side heat exchanger 44 (→the second electrical four-way valve 43)→the nozzle portion 13*a* of the ejector 13→the gas-refrigerant outlet of the accumulator 24→first compressor 11. At the same time, refrigerant circulates in this order of the liquid refrigerant outlet of the accumulator 24→the fixed throttle 15 (→the first electrical four-way valve 41)→the exterior heat exchanger 42 (→the second electrical four-way valve 43)→the second compressor 21→the refrigerant suction port 13*b* of the ejector 13→the accumulator 24.

Thus, the refrigerant compressed by the first compression mechanism 11*a* is heated in the using-side heat exchanger 44 by heat exchange with air blown to the room by the blower fan 44*a*. Thus, the air blown into the interior of the room is heated. Then, the refrigerant cooled in the using-side heat exchanger 44 is decompressed and expanded in iso-entropy by the nozzle portion 13*a* of the ejector 13, and is jetted from the nozzle portion 13*a* of the ejector 13. Thus, the refrigerant discharged from the second compression mechanism 21*a* is drawn into the ejector 13 from the refrigerant suction port 13*b* of the ejector 13, by the refrigerant suction action of the jet refrigerant.

Furthermore, the jet refrigerant jetted from the nozzle portion 13*a* and the suction refrigerant drawn from the refrigerant suction port 13*b* are mixed in the mixing portion 13*c* of the ejector 13, and is pressurized in the diffuser portion 13*d* of the ejector 13. The refrigerant flowing out of the diffuser portion 13*d* is separated into gas refrigerant and liquid refrigerant in the accumulator 24, and the gas refrigerant flowing out of the gas refrigerant outlet of the accumulator 24 is drawn into the first compression mechanism 11*a* to be compressed again.

On the other hand, liquid refrigerant flowing out of the liquid refrigerant outlet of the accumulator 24 is further decompressed and expanded in iso-enthalpy at the fixed throttle 15. The refrigerant from the fixed throttle 15 flows into the exterior heat exchanger 42 via the first electrical four-way valve 41, and is evaporated by absorbing heat from outside air blown by the air blowing fan 42*a*.

The gas refrigerant flowing out of the exterior heat exchanger 42 is drawn into the second compression mechanism 21*a*, and is discharged toward the refrigerant suction port 13*b*. At this time, the control device controls operation of the first and second electrical motors 11*b*, 21*b* such that COP in the entire cycle of the ejector-type refrigeration cycle device is approached approximately to the maximum value, similarly to the first embodiment.

That is, in the heating operation mode of the present embodiment, the refrigerant passage is switched, such that the refrigerant discharged from the first compressor 11 is radiated in the using-side heat exchanger 44, and the refrigerant is evaporated in the exterior heat exchanger 42.

More specifically, the using-side heat exchanger 44 is adapted similarly to the radiator 12 of the first embodiment, so that the refrigerant radiated in the using-side heat exchanger 44 flows into the nozzle portion 13*a* of the ejector 13. At the same time, the exterior heat exchanger 42 is adapted similarly to the suction side evaporator 16 of the first embodiment, so that the liquid refrigerant separated at the accumulator 24 is evaporated in the exterior heat exchanger 42 and flows toward the refrigerant suction side of the second compression mechanism 21*a*.

Thus, in the heating operation mode of the present embodiment, air blown into the room can be heated. At this time, similarly to the first embodiment, a decrease in the flow amount of the drive flow of the ejector 13 can be restricted by the operation of the second compression mechanism 21*a*, and thereby the ejector-type refrigeration cycle device can be stably operated while improving the COP.

More specifically, the present embodiment is provided with refrigerant passage switching means (41, 43) for switching between the refrigerant passage of the cooling operation mode for cooling the fluid to be heat exchanged, and the refrigerant passage of the heating operation mode for heating the fluid to be heat exchanged. In at least one operation mode between the cooling operation mode and the heating operation mode, refrigerant radiated at the using-side heat exchanger 44 or the interior heat exchanger 42 is decompressed and expanded in the nozzle portion 13*a*, and the refrigerant is drawn from the refrigerant suction port 13*b* by the high-speed flow of the refrigerant jetted from the nozzle portion 13*a*. Furthermore, the jet refrigerant jetted from the nozzle portion 13*a* and the suction refrigerant drawn from the refrigerant suction port 13*b* are mixed, and is pressurized in the diffuser portion 13*d* of the ejector 13. Furthermore, the second compression mechanism 21*a* is provided to draw the refrigerant evaporated in the using-side heat exchanger 44 or the exterior heat exchanger 42, to compress the refrigerant to be discharged toward the refrigerant suction port 13*b* of the ejector 13, in at least one of the cooling operation mode and the heating operation mode. Furthermore, in the cooling operation mode of the present embodiment, the refrigerant passage is switched by the refrigerant passage switching means (41, 43), such that the refrigerant discharged from the first compression mechanism 11*a* is radiated in the exterior heat exchanger 42, and the refrigerant is evaporated in the using-side heat exchanger 44. In the heating operation mode of the present embodiment, the refrigerant passage is switched, such that the refrigerant discharged from the first compression mechanism 11*a* is radiated in the using-side heat exchanger 44, and the refrigerant is evaporated in the exterior heat exchanger 42. Therefore, even in an operation condition in which the suction capacity of the ejector 13 is decreased in accordance with a decrease of the flow amount of the drive flow of the ejector 13 in at least one operation mode of the cooling operation mode and the heating operation mode, the suction capacity of the ejector 13 can be supplemented by the operation of the second compression mechanism 21*a*.

Furthermore, the discharge-side gas-liquid separator 24 is provided to separate the refrigerant flowing out of the diffuser portion 13*d* into gas refrigerant and the liquid refrigerant, and the gas-refrigerant outlet of the discharge-side gas-liquid separator 24 is connected to the suction side of the first compression mechanism 11*a*. In the cooling operation mode, the refrigerant passage switching means 41, 43 switch the refrigerant passages, such that the refrigerant radiated at the exterior heat exchanger 42 flows into the nozzle portion 13*a*, and at the same time, the liquid refrigerant separated at the discharge-side gas-liquid separator 24 is evaporated in the using-side heat exchanger 44 thereby causing the evaporated refrigerant to flow toward the refrigerant suction side of the second compression mechanism 21*a*. In the heating operation mode, the refrigerant passage switching means 41, 43 switch the refrigerant passages, such that the refrigerant radiated at the using-side heat exchanger 44 flows into the nozzle portion 13*a*, and at the same time, the liquid refrigerant separated at the discharge-side gas-liquid separator 24 is evaporated in the exterior heat exchanger 42 thereby causing the evaporated refrigerant to flow toward the refrigerant suction side of the second compression mechanism 21*a*. Therefore, even in an operation condition in which the suction capacity of the ejector 13 is decreased in accordance with a decrease of the flow amount of the drive flow of the ejector 13 in any one operation mode of the cooling operation mode and the heating operation mode, the suction capacity of the ejector 13 can be supplemented by the operation of the second compression mechanism 21*a*.

As a result, even in any operation mode between the cooling operation mode and the heating operation mode, the ejector-type refrigeration cycle device can be stably operated regardless of a variation in the flow amount of the drive flow.

(10th Embodiment)

Figure 17:
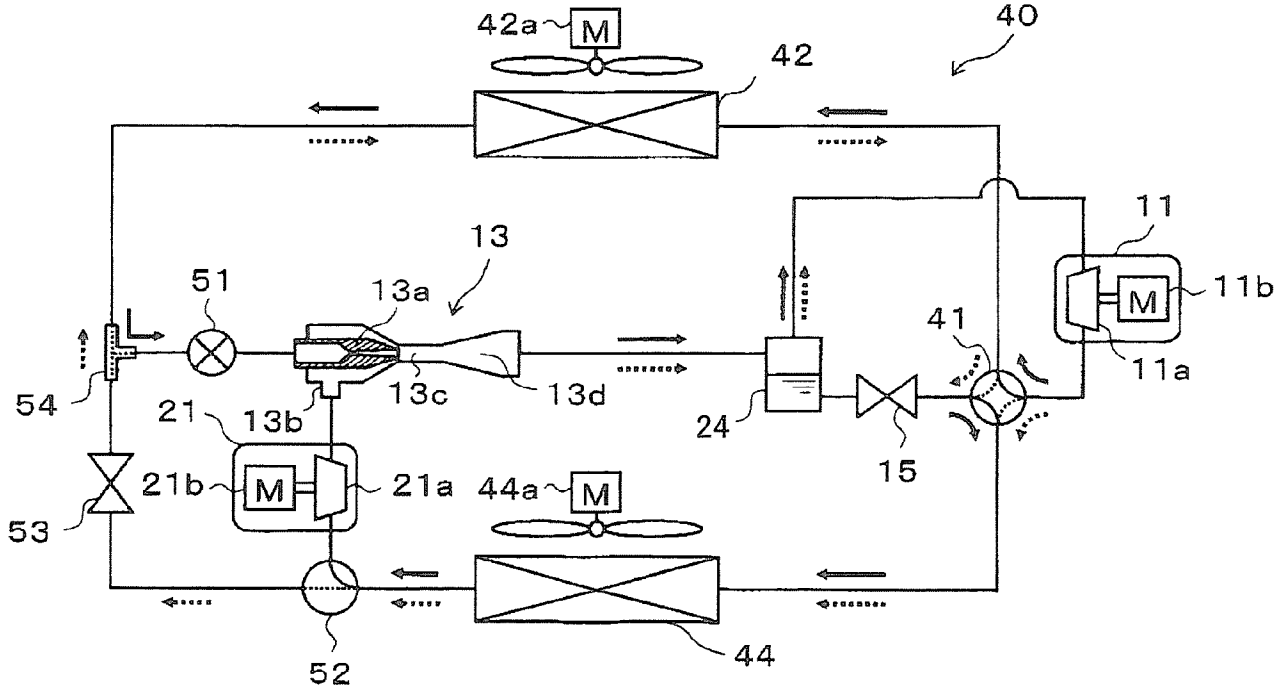
FIG. 17 is an entire schematic diagram of an ejector-type refrigeration cycle device of 10th embodiment.

In the present embodiment, as shown in FIG. 17, the second electrical four-way valve 43 is removed from the ejector-type refrigeration cycle device 40 of the 9th embodiment. In the present embodiment, as a refrigerant passage switching means, an opening/closing valve 51 and an electrical three-way valve 52 are provided. Furthermore, a second fixed throttle 53 is provided as a decompression means for decompressing and expending the refrigerant in the heating operation mode.

FIG. 17 is an entire schematic diagram of an ejector-type refrigerant cycle device 40 of the present embodiment. The solid line arrows in FIG. 17 show the flow of the refrigerant in the cooling operation mode, and the chain line arrows in FIG. 17 show the flow of the refrigerant in the heating operation mode. In the present embodiment, the fixed throttle 15 is used as a first fixed throttle 15, in order to clearly indicate the different from the second fixed throttle 53.

In the ejector-type refrigeration cycle device 40 of the present embodiment, as in the refrigerant passage shown by the solid line arrows of FIG. 17, one refrigerant flow port of a three-way joint 54 having three refrigerant flow ports is connected to the refrigerant outlet side of the exterior heat exchanger 42 in the cooling operation mode. The three-way joint 54 may be configured by bonding pipes having different pipe diameters or the same pipe diameter, or may be configured by a metal block or a resin block having the same passage diameter or different passage diameters.

Another one of the three refrigerant flow ports of the three-way valve 54 is connected to the inlet side of the nozzle portion 13*a* of the ejector 13 via the opening/closing valve 51. The opening/closing valve 51 is an electromagnetic valve, in which its operation is controlled by a control signal output from the control device. The other one of the three refrigerant flow ports of the three-way valve 54 is connected to the electrical three-way valve 52 via the second fixed throttle 53.

The basic structure of the second fixed throttle 53 is similar to the first fixed throttle 15. Furthermore, the operation of the electrical three-way valve 52 is controlled by a control signal output from the control device, thereby switching between a refrigerant passage (i.e., the circuit shown by the solid line arrows in Fig, 17) connecting the using-side heat exchanger 44 and the suction port side of the second compressor 21, and a refrigerant passage (i.e., the circuit shown by the chain line arrows in FIG. 17) connecting the using-side heat exchanger 44 and the second fixed throttle 53.

Thus, in the present embodiment, the refrigerant flow switching means is configured by the opening/closing valve 51 and the electrical three-way valve 53, together with the first electrical four-way valve 41. Other configurations in the present embodiment are similar to those of the 9th embodiment.

Next, the operation of the present embodiment with the above configuration will be described. This ejector-type refrigeration cycle device 40 of the present embodiment is configured to be capable of switching between the cooling operation mode for cooling air to be blown into a room, and a heating operation mode for heating air to be blown into the room.

(a) Cooling Operation Mode

The cooling operation mode of the ejector-type refrigeration cycle device 40 is performed when the cooling operation mode is selected by an operation switch of an operation panel.

In the cooling operation mode, the control device causes the first and second electrical motors 11*b*, 21*b* and the blower fans 42*a*, 44*a* to be operated. Furthermore, in the cooling operation mode, the first electrical four-way valve 41 is switched, such that the refrigerant discharge side of the first compressor 11 and the exterior heat exchanger 42 are connected, and at the same time, the liquid refrigerant outlet side of the accumulator 24 is connected to the using-side heat exchanger 44. At the same time, in the cooling operation mode, the electrical three-way valve 52 is switched such that the using-side heat exchanger 44 is connected to the refrigerant suction side of the second compressor 21, and the opening/closing valve 51 is opened.

Thus, as shown in the solid arrows of FIG. 17, refrigerant circulates in this order of the first compressor 11 (→the first electrical four-way valve 41)→the exterior heat exchanger 42 (→the three-way joint 54→the opening/closing valve 51)→the nozzle portion 13*a* of the ejector 13→the gas-refrigerant outlet of the accumulator 24→the first compressor 11. At the same time, refrigerant circulates in this order of the liquid refrigerant outlet of the accumulator 24→the first fixed throttle 15 (→first electrical four-way valve 41)→the using-side heat exchanger 44 (→the electrical three-way valve 52)→the second compressor 21→the refrigerant suction port 13*b* of the ejector 13→the accumulator 24.

Thus, in the cooling operation mode of the present embodiment, the refrigerant passage is switched, such that the refrigerant discharged from the first compression mechanism 11*a* is radiated in the exterior heat exchanger 42, and the refrigerant is evaporated in the using-side heat exchanger 44, similarly to the cooling operation mode of the 9th embodiment.

More specifically, in the cooling operation mode, the exterior heat exchanger 42 is adapted similarly to the radiator 12 of the first embodiment, so that the refrigerant heat-radiated at the exterior heat exchanger 42 flows into the nozzle portion 13*a* of the ejector 13. At the same time, the using-side heat exchanger 44 is adapted similarly to the suction side evaporator 16 of the first embodiment, so that the liquid refrigerant separated at the accumulator 24 is evaporated in the using-side heat exchanger 44, and then flows toward the refrigerant suction side of the second compression mechanism 21*a*.

Thus, in the cooling operation mode of the present embodiment, air to be blown into the room can be cooled similarly to the 9th embodiment.

(b) Heating Operation Mode

The heating operation mode is performed in the ejector-type refrigeration cycle device 40 when the heating operation mode is selected by an operation switch of an operation panel.

In the heating operation mode, the control device causes the first and second electrical motors 11*b*, 21*b* and the blower fans 42*a*, 44*a* to be operated. Furthermore, in the heating operation mode, the first electrical four-way valve 41 is switched, such that the refrigerant discharge side of the first compressor 11 and the using-side heat exchanger 44 are connected, and at the same time, the liquid refrigerant outlet side of the accumulator 24 is connected to the exterior heat exchanger 42. At the same time, in the heating operation mode, the electrical three-way valve 52 is switched such that the using-side heat exchanger 44 is connected to the second fixed throttle 53, and the opening/closing valve 51 is opened.

Thus, as shown in the chain line arrows of FIG. 17, refrigerant circulates in this order of the first compressor 11 (→the first electrical four-way valve 41)→the using-side heat exchanger 44 (→the electrical three-way valve 52)→the second fixed throttle 53 (→the three-way joint 54)→the exterior heat exchanger 42 (→the first electrical four-way valve 41)→the first fixed throttle 15→the accumulator 24→the first compressor 11.

Thus, in the heating operation mode of the present embodiment, the refrigerant passage is switched, such that the refrigerant discharged from the first compressor 11 is radiated in the using-side heat exchanger 44, and the refrigerant is evaporated in the exterior heat exchanger 42.

In the heating operation mode, the refrigerant passage is switched, such that the refrigerant radiated at the using-side heat exchanger 44 flows into the second fixed throttle 53, and at the same time, the refrigerant evaporated in the exterior heat exchanger 42 flows into the accumulator 24. Thus, in the heating operation mode of the present embodiment, air to be blown into the room can be heated.

Thus, in the cooling operation mode of the ejector-type refrigeration cycle device 40 of the present embodiment, a decrease in the flow amount of the drive flow of the ejector 13 can be restricted by the operation of the second compression mechanism 21*a*, and thereby the ejector-type refrigeration cycle device 40 can be stably operated while improving the COP.

More specifically, in the present embodiment, the refrigerant passage switching means (41, 51, 52), the ejector 13 and the second compression mechanism 21*a* are provided similarly to the 9th embodiment. Therefore, even in an operation condition in which the suction capacity of the ejector 13 is decreased in accordance with a decrease of the flow amount of the drive flow of the ejector 13 in at least one operation mode of the cooling operation mode and the heating operation mode, the suction capacity of the ejector 13 can be supplemented by the operation of the second compression mechanism 21*a*.

More specifically, the discharge-side gas-liquid separator 24 is provided such that the refrigerant flowing out of the diffuser portion 13*d* of the ejector 13 is separated into gas refrigerant and liquid refrigerant. Furthermore, the second fixed throttle 53 as a decompression means is provided to decompress and expand the refrigerant in the heating operation mode, and the gas-refrigerant outlet of the discharge-side gas-liquid separator 24 is connected to the suction side of the first compression mechanism 11*a*. In the cooling operation mode, the refrigerant passage switching means (41, 51, 52) switch the refrigerant passages, such that the refrigerant radiated at the exterior heat exchanger 42 flows into the nozzle portion 13*a*, and at the same time, the liquid refrigerant separated at the discharge-side gas-liquid separator 24 is evaporated in the using-side heat exchanger 44 thereby causing the evaporated refrigerant to flow toward the refrigerant suction side of the second compression mechanism 21*a*. In the heating operation mode, the refrigerant radiated in the using-side heat exchanger 44 flows into the decompression means 53. At the same time, in the heating operation mode, liquid refrigerant decompressed at the decompression means 53 is evaporated in the exterior heat exchanger 42, and is introduced into the discharge-side gas-liquid separator 24. Therefore, even in an operation condition in which the suction capacity of the ejector 13 is decreased in accordance with a decrease of the flow amount of the drive flow of the ejector 13 in the cooling operation mode, the suction capacity of the ejector 13 can be supplemented by the operation of the second compression mechanism 21*a*.

As a result, in the cooling operation mode, the ejector-type refrigeration cycle device can be stably operated regardless of a variation in the flow amount of the drive flow.

(11th Embodiment)

Figure 18:
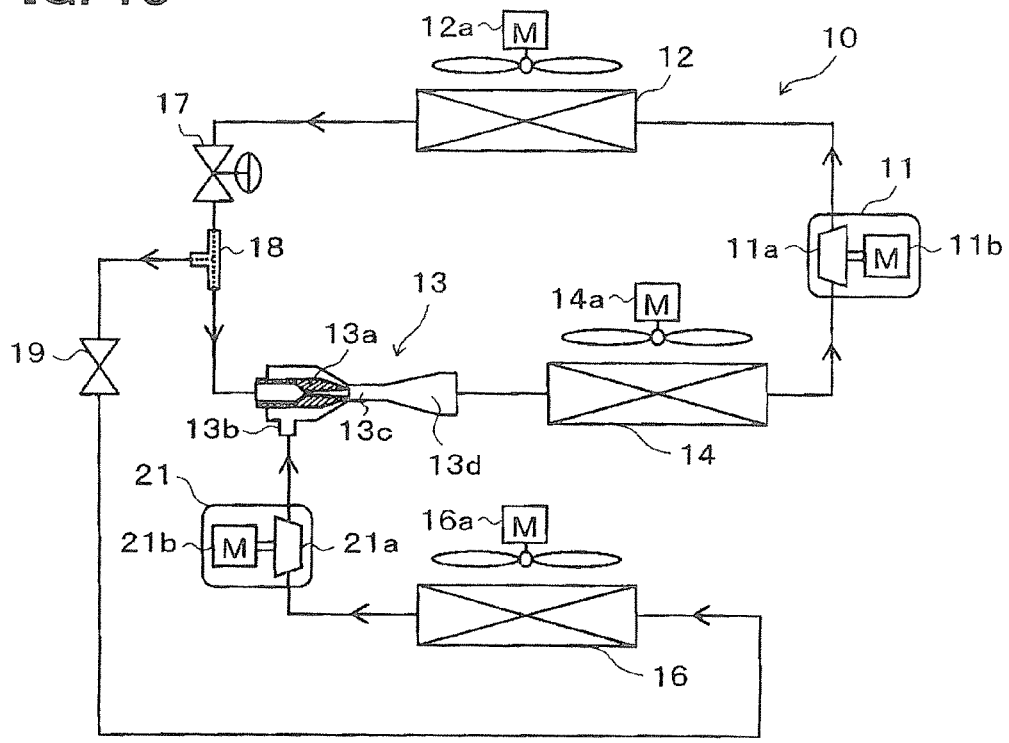
FIG. 18 is an entire schematic diagram of an ejector-type refrigeration cycle device of 11th embodiment.

An ejector-type refrigeration cycle device 10 of the present invention used for a freezing/refrigeration device will be described with reference to FIGS. 18 and 19. The freezing/refrigeration device is for cooling a refrigerating room that is a space to be cooled, to a low temperature such as in a range between 0° C. and 10° C., and is for cooling a freezing room that is another space to be cooled, to an extremely low temperature such as in a range between −30° C. and −10° C. FIG. 18 is an entire schematic diagram of the ejector-type refrigeration cycle device 10 of the present embodiment.

In the ejector-type refrigeration cycle device 10, the first compressor 11 is configured to draw refrigerant, to compress the drawn refrigerant, and to discharge the compressed refrigerant. For example, the first compressor 11 is an electrical compressor in which the first compression mechanism 11*a* having a fixed displacement is driven by the first electrical motor 11*b*. As the first compression mechanism 11*a*, various compression mechanisms such as a scroll type compression mechanism, a vane type compression mechanism and the like can be used, for example.

The operation (e.g., rotational speed) of the first electrical motor 11*b* is controlled by using control signals output from a control device described later. As the first electrical motor 11*b*, an AC motor or a DC motor may be used. By controlling the rotational speed of the first electrical motor 11*b*, the refrigerant discharge capacity of the first compression mechanism 11*a* can be changed. Thus, in the present embodiment, the first electrical motor 11*b* can be used as a first discharge capacity changing means for changing the discharge capacity of the refrigerant of the first compression mechanism 11*a*.

The refrigerant radiator 12 is disposed on the refrigerant discharge side of the first compressor 11. The radiator 12 exchanges heat between high-pressure refrigerant discharged from the first compressor 11 and outside air (i.e., air outside the room) blown by the cooling fan 12*a* to cool the high-pressure refrigerant. The rotation speed of the cooling fan 12*a* is controlled by a control voltage output from the control device so as to control an air blowing amount blown from the cooling fan 12*a*.

In the present embodiment, a flon-based refrigerant is used as the refrigerant for a refrigerant cycle of the ejector-type refrigeration cycle device 10 to form a vapor-compression subcritical refrigerant cycle in which a refrigerant pressure on the high-pressure side does not exceed the critical pressure of the refrigerant. Thus, the radiator 12 serves as a condenser for cooling and condensing the refrigerant. Furthermore, a refrigerator oil having a solubility with respect to the liquid refrigerant is mixed to the refrigerant in order to lubricate the first compression mechanism 11*a* and the second compression mechanism 21*a*, so that the refrigerator oil is circulated in the refrigerant cycle together with the refrigerant.

A receiver (i.e., liquid receiver) may be provided at a refrigerant outlet side of the radiator 12, to be used as a high-pressure side gas-liquid separator in which the refrigerant flowing out of the radiator 12 is separated into gas refrigerant and liquid refrigerant, and liquid refrigerant is stored therein as surplus refrigerant. Furthermore, the saturated liquid refrigerant separated from the receiver is introduced to a downstream side.

The thermal expansion valve 17 is connected to a refrigerant outlet side of the radiator 12, as a high-pressure side decompression means for decompressing and expanding high-pressure refrigerant flowing out of the radiator 12. More specifically, in the present embodiment, the thermal expansion valve 17 is arranged in a refrigerant passage from the refrigerant outlet side of the radiator 12 to a refrigerant inlet of a branch portion described later.

The thermal expansion valve 17 has a temperature sensing portion (not shown) that is arranged in a refrigerant passage at a refrigerant outlet side of a discharge side evaporator 14. The thermal expansion valve 17 is a variable throttle mechanism, in which a super-heat degree of the refrigerant at the refrigerant outlet side of the discharge side evaporator 14 is detected based on temperature and pressure of the refrigerant at the refrigerant outlet side of the discharge side evaporator 14, and the valve-open degree (refrigerant flow amount) of the thermal expansion valve 17 is adjusted by using a mechanical mechanism so that the super-heat degree of the refrigerant at the refrigerant outlet side of the discharge side evaporator 14 is approached to a predetermined value.

A branch portion 18 is connected to a refrigerant outlet side of the thermal expansion valve 17, to branch a middle-pressure refrigerant flowing out of the thermal expansion valve 17. For example, the branch portion 18 is a three-way joint member having three ports that are used as one refrigerant inlet and two refrigerant outlets. The three-way joint member used as the branch portion 18 may be configured by bonding pipes having different pipe diameters, or may be configured by providing plural refrigerant passages in a metal block member or a resin block member.

One of the two refrigerant outlets of the branch portion 18 is connected to the inlet side of the nozzle portion 13*a* of the ejector 13, and the other one of the two refrigerant outlets of the branch portion 18 is connected to the refrigerant suction port 13*b* of the ejector 13. The ejector 13 is used as a refrigerant decompression means for decompressing and expanding the refrigerant, and as a refrigerant circulation means for circulating the refrigerant by the suction action of a high-speed refrigerant flow jetted from the nozzle portion 13*a*.

The refrigerant passage sectional area of the nozzle portion 13*a* is throttled so that middle pressure refrigerant flowing out of the one refrigerant outlet of the branch portion 18 is decompressed and expanded in iso-entropy in the nozzle portion 13*a*. The refrigerant suction port 13*b* is provided to communicate with a space in the ejector 13, where the refrigerant jet port of the nozzle portion 13*a* is provided, so as to draw the refrigerant discharged from the second compressor 21 described latter.

The mixing portion 13*c* is provided in the ejector 13 on a downstream side of the nozzle portion 13*a* and the refrigerant suction port 13*b* in the refrigerant flow, so as to mix the high-velocity refrigerant flow jetted from the nozzle portion 13*a* with the suction refrigerant drawn from the refrigerant suction port 13*b*. The diffuser portion 13*d* is provided in the ejector 13 downstream of the mixing portion 13*c* in a refrigerant flow so as to increase the refrigerant pressure in the diffuser portion 13*d*.

The diffuser portion 13*d* is formed in such a shape to gradually increase the passage sectional area of the refrigerant, and has an effect of reducing the velocity of the refrigerant flow so as to increase the refrigerant pressure. That is, the diffuser portion 13*d* has an effect of converting the speed energy of the refrigerant to the pressure energy of the refrigerant. The discharge side evaporator 14 is connected to the outlet side of the diffuser portion 13*d*.

The discharge side evaporator 14 is a heat-absorbing heat exchanger, in which refrigerant flowing out of the diffuser portion 13*d* of the ejector 13 is evaporated by heat-exchanging with air inside the refrigerating room, blown by a blower fan 14*a*, so as to provide heat-absorbing action. Thus, a fluid to be heat-exchanged with the refrigerant in the discharge side evaporator 14 is the air in the refrigerating room of the freezing/refrigerating device.

The blower fan 14*a* is an electrical blower, in which rotation speed (air blowing amount) of the blower fan 14*a* is controlled by a control voltage output from the control device. A refrigerant suction port of the first compressor 11 is connected to a refrigerant outlet side of the discharge side evaporator 14.

Furthermore, the suction side evaporator 16 is connected to the other one of the refrigerant outlets of the branch portion 18 via a fixed throttle 19. The fixed throttle 19 is a suction side decompression means adapted to decompress and expand the middle-pressure refrigerant flowing out of the branch portion 18. As the fixed throttle 19, a capillary tube, an orifice or the like can be used.

The suction side evaporator 16 is configured to perform heat exchange between low-pressure refrigerant decompressed and expanded at the fixed throttle 19 and interior air of the freezing room blown by the blower fan 16*a*, and is used as a heat-absorbing heat exchanger in which low-pressure refrigerant is evaporated so as to exert heat-absorbing action. Thus, a fluid to be heat-exchanged with the refrigerant in the suction side evaporator 16 is the air in the refrigerating room. The blower fan 16*a* is an electrical blower, in which rotation speed (air blowing amount) of the blower fan 16*a* is controlled by a control voltage output from the control device.

A refrigerant suction port of the second compressor 21 is connected to a refrigerant outlet side of the suction side evaporator 16. The basic structure of the second compressor 21 is similar to that of the first compressor 11. Thus, the second compressor 21 is an electrical compressor, in which a fixed-displacement type second compression mechanism 21*a* is driven by a second electrical motor 21*b*. The second electrical motor 21*b* of the present embodiment is used as a second discharge capacity changing means for changing a refrigerant discharge capacity of the second compression mechanism 21*a*.

The refrigerant suction port 13*b* of the ejector 13 is connected to a refrigerant discharge port of the second compressor 21.

The control device (not shown) is constructed of a generally-known microcomputer including CPU, ROM and RAM and the like, and its circumferential circuits. The control device performs various calculations and processes based on a control program stored in the ROM, and controls operation of various electrical actuators 11*b*, 12*b*, 14*a*, 16*a*, 21*a* or the like.

The control device includes a function portion as the first discharge-capacity control means which controls the operation of the first electrical motor 11*b* that is a first discharge capacity changing means, and a function portion as the second discharge-capacity control means which controls the operation of the second electrical motor 21*b* that is a second discharge capacity changing means. The first discharge-capacity control means and the second discharge-capacity control means may be configured by different control devices, respectively.

Into the control device, detection values from a sensor group (not shown) including an outside air temperature sensor for detecting an outside air temperature, an inside temperature sensor for detecting a temperature of the refrigerating room and an interior temperature of the freezing room, and various operation signals from an operation panel (not shown) in which an operation switch for operating the refrigerator and the like are provided are input.

Next, operation of the present embodiment with the above structure will be described based on the Mollier diagram shown in FIG. 19. When the operation switch of the operation panel is turned on, the control device causes the first and second electrical motors 11*b*, 21*b*, the cooling fan 12*a*, the blower fans 14*a*, 16*a* to be operated. Thus, the first compressor 11 draws refrigerant, compresses the drawn refrigerant, and discharges the compressed refrigerant. The state of the refrigerant at this time is point a2 of FIG. 19.

Figure 19:
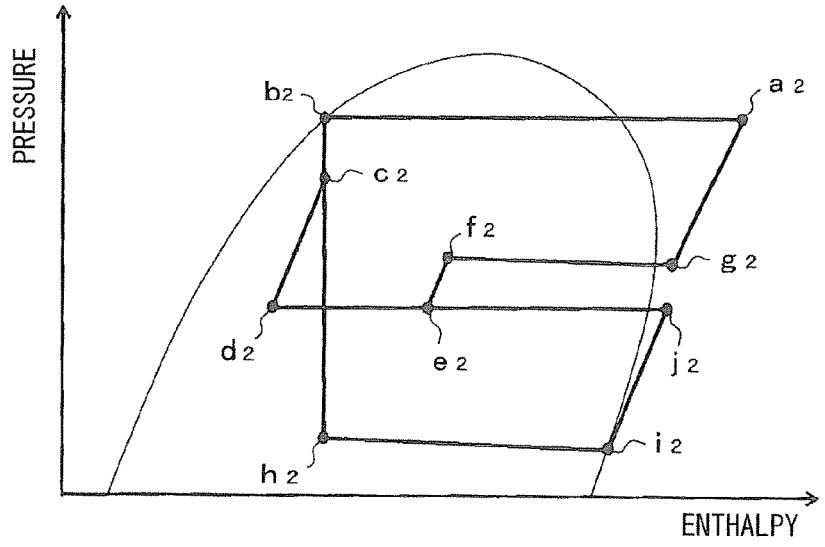
FIG. 19 is a Mollier diagram showing a refrigerant state of the ejector-type refrigeration cycle device of the 11th embodiment.

High-temperature and high-pressure refrigerant discharged from the first compressor 11 flows into the radiator 12, and is heat-exchanged with the blown air (outside air) blown by the cooling fan 12*a* to be radiated and condensed (point a2→point b2 in FIG. 19).

Furthermore, the refrigerant flowing out of the radiator 12 flows into the thermal expansion valve 17, and is decompressed and expanded in iso-enthalpy to become in a gas-liquid two-phase state (point b2→point c2 in FIG. 19).

At this time, the valve open degree of the thermal expansion valve 17 is adjusted so that a super heat degree (point g2 in FIG. 19) of the refrigerant at the refrigerant outlet side of the discharge side evaporator 14 becomes a predetermined value. The middle-pressure refrigerant flowing out of the thermal expansion valve 17 flows into the branch portion 18, and is branched by the branch portion 18 into a flow of the refrigerant flowing into the nozzle portion 13*a* of the ejector 13 and a flow of the refrigerant flowing into the refrigerant suction port 13*b* of the ejector 13.

In the present embodiment, the flow amount characteristics (pressure loss characteristics) of the nozzle portion 13*a* and the fixed throttle 19 are determined, such that a flow ratio Gnoz/Ge can be set at an optimal ratio at which a high COP can be obtained in the entire cycle. Here, the flow ratio Gnoz/Ge is a ratio of a refrigerant flow amount Gnoz flowing to the nozzle portion 13*a* to a refrigerant flow amount Ge flowing toward the refrigerant suction port 13*b*.

The refrigerant flowing into the nozzle portion 13*a* of the ejector 13 from the branch portion 18 is decompressed and expanded by the nozzle portion 13*a* in iso-entropy (point c2→point d2). In the decompression and expansion of the nozzle portion 13*a*, the pressure energy of the refrigerant is converted to the speed energy of the refrigerant, and the refrigerant is jetted with a high speed from the refrigerant jet port of the nozzle portion 13*a*. Thus, the refrigerant discharged from the second compressor 21 is drawn into the ejector 13 from the refrigerant suction port 13*b* of the ejector 13, by the refrigerant suction action of the jet refrigerant.

Furthermore, the jet refrigerant jetted from the nozzle portion 13*a* and the suction refrigerant drawn from the refrigerant suction port 13*b* are mixed in the mixing portion 13*c* of the ejector 13, and flows into the diffuser portion 13*d* of the ejector 13 (point d2→point e2, point j2→point e2 in FIG. 19). That is, passage sectional area is enlarged in the diffuser portion 13*d* as toward downstream so that the speed energy of the refrigerant is converted to the pressure energy thereof, thereby increasing the pressure of the refrigerant (point e2→point f2 in FIG. 19).

The refrigerant flowing out of the diffuser portion 13*c* flows into the discharge side evaporator 14, and is evaporated by absorbing heat from air inside of the refrigerating room, blown by the blower fan 14*a* (point f2→point g2 in FIG. 19). Thus, the air blown into the interior of the refrigerating room is cooled. The gas refrigerant flowing out of the discharge side evaporator 14 is drawn into the first compressor 11, and is compressed again (point g2→point a2 in FIG. 19).

On the other hand, middle-pressure refrigerant flowing from the branch portion 18 toward the side of the refrigerant suction port 13*b* is decompressed and expanded in iso-enthalpy at the fixed throttle 19, thereby reducing the refrigerant pressure (point c2→point h2 in FIG. 19). The refrigerant decompressed and expanded at the fixed throttle 19 flows into the suction side evaporator 16, and is evaporated by absorbing heat from air inside of the freezing room, blown by the blower fan 16*a* (point h2→point i2 in FIG. 19). Thus, the air blown into the interior of the freezing room is cooled.

The gas refrigerant flowing out of the suction side evaporator 16 is drawn into the second compressor 21, and is compressed (point i2→point j2 in FIG. 19). At this time, the control device controls operation of the first and second electrical motors 11*b*, 21*b* such that COP in the entire cycle of the ejector-type refrigeration cycle device is approached approximately to the maximum value. Specifically, pressure increasing amounts in the first and second compression mechanisms 11*a*, 21*a* are controlled to be approximately equal, in order to improve the compression efficiency in both the first and second compression mechanisms 11*a*, 21*a*.

When an increase amount of the enthalpy of the refrigerant is ΔH1 in a case where the refrigerant is compressed in iso-entropy in the first and second compressors 11, 21, and when an increase amount of the enthalpy of the refrigerant actually pressurized in the first and second compressors 11, 21 is ΔH2, the compression efficiency is a ratio of ΔH1 to ΔH2.

For example, when the rotation speed or the pressure increasing amount of the first and second compressors 11, 21 is increased, the temperature of the refrigerant is increased by fraction heat of the refrigerant, thereby increasing the actual increase amount ΔH2 of the enthalpy. In this case, the compression efficiency is decreased in the first and second compressors 11, 21.

The refrigerant flowing out of the second compressor 21 is drawn into the ejector 13 from the refrigerant suction port 13*b* (point j2→point e2 in FIG. 19).

The ejector-type refrigeration cycle device 10 of the present embodiment is operated above, and thereby the following excellent effects can be obtained.

(A) Because the flow of the refrigerant is branched in the branch portion 18 such that the flow amount ratio Ge/Gnoz becomes in an optimal flow amount ratio, the refrigerant can be suitably supplied to both the discharge side evaporator 14 and the suction side evaporator 16. Thus, cooling action can be exerted in both the discharge side evaporator 14 and the suction side evaporator 16, at the same time.

At this time, the refrigerant evaporation pressure of the discharge side evaporator 14 becomes in a pressure pressurized by the second compressor 21 and the diffuser portion 13*d*. On the other hand, the refrigerant evaporation pressure of the suction side evaporator 16 is a pressure immediately after being decompressed by the fixed throttle 19.

Thus, the refrigerant evaporation pressure (refrigerant evaporation temperature) of the suction side evaporator 16 can be made lower than the refrigerant evaporation pressure (the refrigerant evaporation temperature) of the discharge side evaporator 14. As a result, the discharge side evaporator 14 can be adapted for cooling the refrigerating room having a low temperature, and the suction side evaporator 16 can be adapted for cooling the freezing room having an extremely low temperature.

(B) In the present embodiment, the second compressor 21 (second compression mechanism 21*a*) is provided. Therefore, for example, even in an operation condition in which a pressure difference between a high-pressure refrigerant and a low pressure refrigerant is decreased thereby decreasing the flow amount of the drive flow of the ejector 13, that is, even in an operation condition in which the suction capacity of the ejector 13 is decreased, the suction capacity of the ejector 13 can be supplemented by the operation of the second compression mechanism 21*a*.

Furthermore, the refrigerant pressure is increased by the pressurizing action in the first and second compression mechanisms 11*a*, 21*a* and in the diffuser portion 13*d* of the ejector 13. Thus, as compared with a case where the refrigerant is pressurized by a single compression mechanism, the driving power of the first and second compression mechanisms 11*a*, 21*a* is reduced thereby improving the COP.

Furthermore, by the pressurizing action of the diffuser portion 13*d*, the suction pressure of the first compression mechanism 11*a* can be increased, thereby reducing the driving power in the first compression mechanism 11*a*. In addition, because the pressure difference between the suction pressure and the discharge pressure in the respective first and second compression mechanisms 11*a*, 21*a* can be reduced, the compression efficiency in the respective first and second compression mechanisms 11*a*, 21*a* can be improved.

In the present embodiment, the refrigerant discharge capacities of the first and second compression mechanisms 11*a*, 21*a* can be respectively independently changed by the first and second electrical motors 11*b*, 21*b*. Thus, the compression efficiency in the first and second compression mechanisms 11*a*, 21*a* can be effectively improved.

As a result, even when a variation in the flow amount of the drive flow is caused thereby reducing the pressurizing capacity of the diffuser portion 13*d*, the ejector-type refrigeration cycle device can be stably operated with a high COP.

Therefore, in a refrigeration cycle device in which the pressure difference between the high pressure refrigerant and the low pressure refrigerant is large, for example, in a refrigeration cycle device in which the refrigerant evaporation temperature of the suction side evaporator 16 is reduced to a very low temperature such as −30° C.-−10° C., the effect of the present invention is extremely effective.

(C) In the ejector-type refrigeration cycle device 10 of the present embodiment, refrigerant flows in this order of the first compressor 11→the radiator 12→the branch portion 18→the ejector 13→the discharge side evaporator 14→the first compressor 11. At the same time, refrigerant flows in this order of the first compressor 11→the radiator 12→the branch portion 18→the fixed throttle 19→the second compressor 16→the ejector 13→the discharge side evaporator 14→the first compressor 11.

That is, because the flow of the refrigerant passing through the evaporator such as the discharge side evaporator 14 and the suction side evaporator 16 becomes in circular, even when a lubrication oil (refrigerator oil) for the first and second compressors 11, 21 is mixed in the refrigerant, it can prevent the oil from staying in the discharge side evaporator 14 and in the suction side evaporator 16.

(D) As compared with the ejector-type refrigeration cycle device of the patent document 1, an accumulator as a discharge-side gas-liquid separator can be removed from the suction side of the first compressor 11. Thus, the product cost in the entire of the ejector-type refrigeration cycle device 10 can be reduced.

(E) In addition, in the present embodiment, because the thermal expansion valve 17 that is a variable throttle mechanism is used as the high-pressure side decompression means, the refrigerant flow amount flowing into the nozzle portion 13*a* of the ejector 13 can be varied in accordance with a load variation in the refrigerant cycle. As a result, even if load fluctuation arises, the refrigerant cycle can be stably operated while having a high COP.

(F) Because the refrigerant decompressed by the thermal expansion valve 17 is in the gas-liquid two-phase state (point c2 in FIG. 19), gas-liquid two-phase refrigerant can flow into the nozzle portion 13*a* of the ejector 13.

Thus, it is compared with a case where the liquid refrigerant flows into the nozzle portion 13*a*, boiling of the refrigerant in the nozzle portion 13*a* can be facilitated, thereby improving the nozzle efficiency. Thus, a recovery energy amount is increased, and a pressure increasing amount is increased in the diffuser portion 13*d*, thereby improving the COP.

Furthermore, it is compared with the case where the liquid refrigerant flows into the nozzle portion 13*a*, the refrigerant passage area of the nozzle portion 13*a* can be enlarged, and thereby the processing of the nozzle portion 13*a* can be made easy. As a result, the product cost of the ejector 13 can be decreased, thereby reducing the product cost in the entire of the ejector-type refrigeration cycle device 10.

(12th Embodiment)

Figure 20:
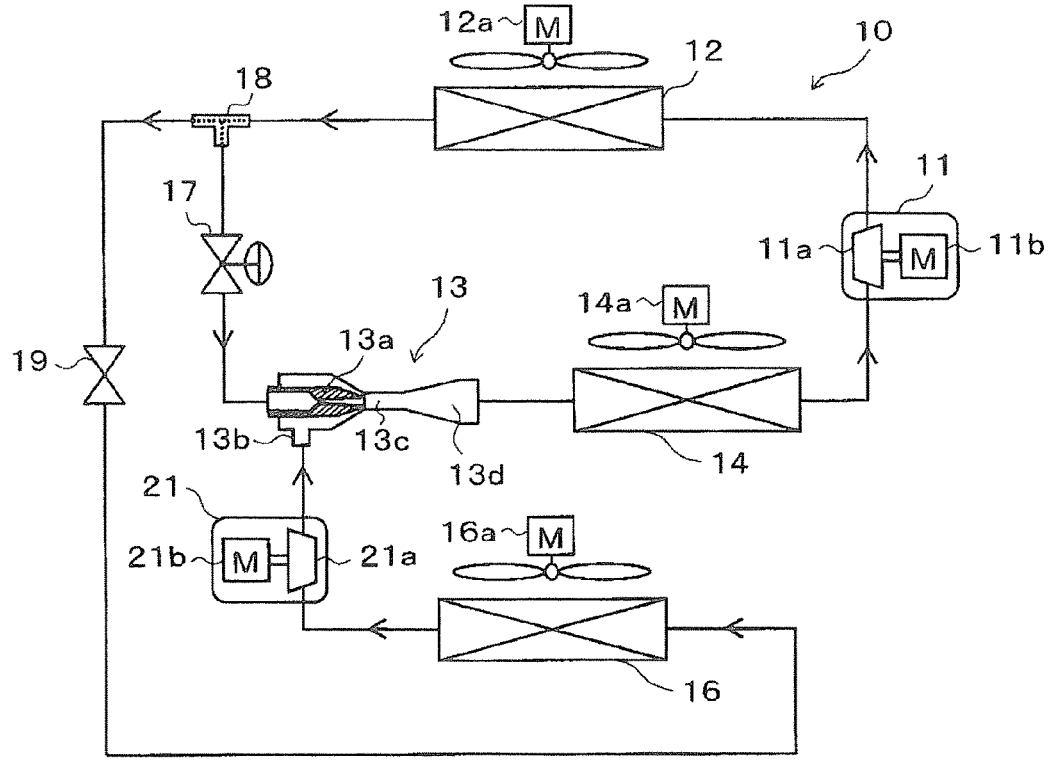
FIG. 20 is an entire schematic diagram of an ejector-type refrigeration cycle device of 12th embodiment.

In the present embodiment, as in the entire schematic diagram of FIG. 20, the arrangement of the thermal expansion valve 17 of the 11th embodiment is changed. That is, in the present embodiment, the thermal expansion valve 17 is arranged in a refrigerant passage from the outlet side of the branch portion 18 to the inlet side of the nozzle portion 13*a*. In FIG. 20, parts similar to or corresponding to those of the 11th embodiment are indicated by the same reference numbers. This is the same also in the following drawings. Other configurations in the present embodiment are similar to those of the 11th embodiment.

Next, the operation of the ejector-type refrigeration cycle device 10 of the present embodiment will be described with reference to the Mollier diagram of FIG. 21. Regarding the signs indicating the refrigerant states in FIG. 21, the same refrigerant states as in FIG. 19 are indicated by using the same alphabets, but the additional signs behind the alphabets are only changed. The same is adapted for the Mollier diagrams in the following embodiments.

Figure 21:
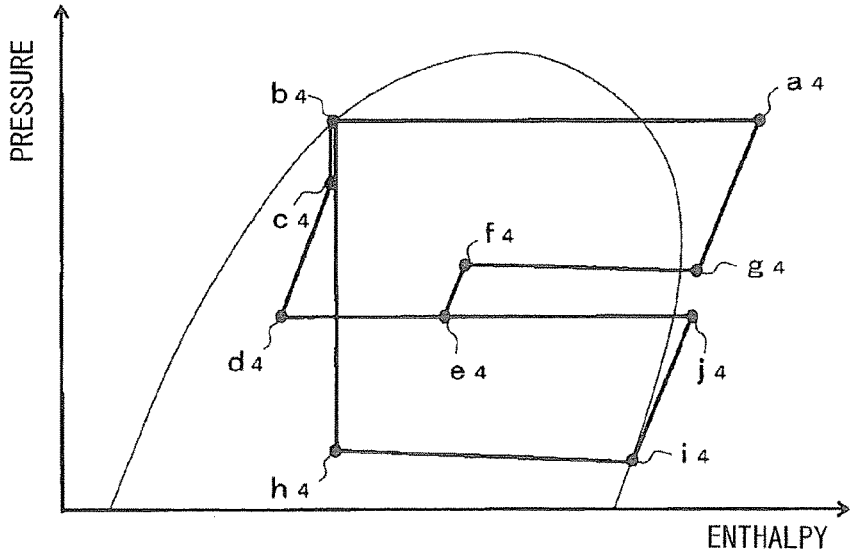
FIG. 21 is a Mollier diagram showing a refrigerant state of the ejector-type refrigeration cycle device of the 12th embodiment.

When the ejector-type refrigeration cycle device 10 of the present embodiment is operated, refrigerant flowing out of the radiator 12 flows into the branch portion 18, and is branched by the branch portion 18 into a flow of the refrigerant flowing into the nozzle portion 13*a* of the ejector 13 and a flow of the refrigerant flowing into the refrigerant suction port 13*b* of the ejector 13 (point b4 in FIG. 21).

Furthermore, the high-pressure refrigerant flowing from the branch portion 18 toward the side of the nozzle portion 13*a* is decompressed and expanded in the thermal expansion valve 17 in iso-enthalpy to become in a gas-liquid two-phase state (point b4→c4 in FIG. 21). The refrigerant flowing out of the thermal expansion valve 17 is decompressed and expanded by the nozzle portion 13*a* in iso-entropy (point c4→point d4 in FIG. 21).

On the other hand, high-pressure refrigerant flowing from the branch portion 18 toward the side of the refrigerant suction port 13*b* is decompressed and expanded in iso-enthalpy at the fixed throttle 19, thereby reducing the refrigerant pressure (point b4→point h4 in FIG. 21). Other operation is similar to that of the 11th embodiment. Thus, even in the structure of the present embodiment, the same effects as in (A) to (F) of the 11th embodiment can be obtained.

Furthermore, in the present embodiment, refrigerant having an extremely low dryness or liquid refrigerant can be branched in the branch portion 18. It is easy for the refrigerant flowing out of the two refrigerant outlets of the branch portion 18 to be in a homogeneous state, as compared with a case where a flow of gas-liquid two-phase refrigerant is branched in an ununiform state between the gas refrigerant and the liquid refrigerant.

Thus, the flow amount ratio Ge/Gnoz of the refrigerant branched at the branch portion 18 can be approached to an optimal flow amount ratio, thereby further improving the COP.

(13th Embodiment)

Figure 22:
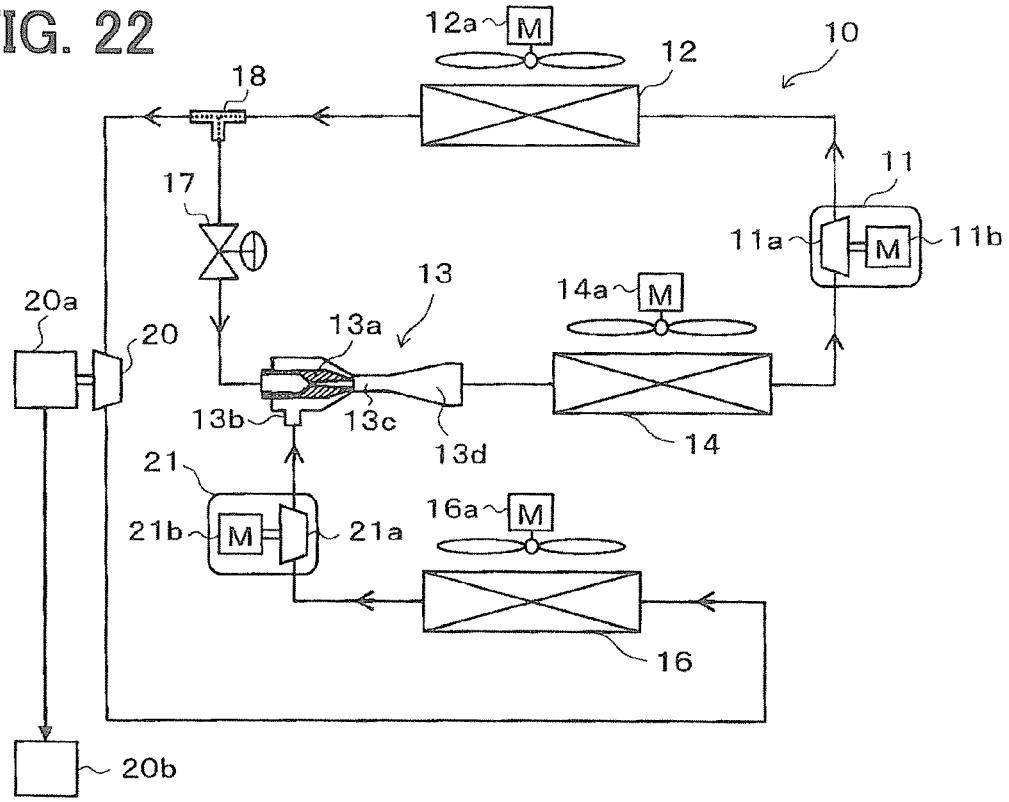
FIG. 22 is an entire schematic diagram of an ejector-type refrigeration cycle device of 13th embodiment.

In the present embodiment, as in the entire schematic diagram of FIG. 22, the fixed throttle 19 of the 12th embodiment is removed, but an expansion unit 20 is provided instead of the fixed throttle 19. The expansion unit 20 is used as a suction side decompression means in which the volume is expanded so as to decompress the refrigerant, and converts the pressure energy of the refrigerant to the mechanical energy thereof.

In the present embodiment, a scroll-type displacement variable compression mechanism is used as the expansion unit 20. Another-type displacement variable compression mechanism such as a vane type and a rolling piston type may be used. In the expansion unit 20, when the refrigerant reversely flows with respect to the refrigerant flow in a case where the displacement variable compression mechanism is used as the compression mechanism, the rotation shaft is rotated so as to output the mechanical energy (rotation energy) while refrigerant is decompressed by expending the volume.

A rotation shaft of a generator 20*a* is directly connected to the rotation shaft of the expansion unit 20. The generator 20*a* outputs electrical energy by converting mechanical energy output from the expansion unit 20 to the electrical energy. Furthermore, the electrical energy output from generator 20*a* is stored in a battery 20*b*. Other configurations and operation of the present embodiment are similar to those of the 12th embodiment.

Therefore, when the ejector-type refrigeration cycle device 10 of the present embodiment is operated, not only the same effects as in (A) to (F) of the 11th embodiment can be obtained, but also energy efficiency can be improved in the entire ejector-type refrigeration cycle device 10.

That is, in the present embodiment, the energy loss, generated while the refrigerant is decompressed and expanded in iso-enthalpy in the fixed throttle 19 of the 12th embodiment, can be recovered by the expansion unit 20. Furthermore, by converting the recovered mechanical energy to the electrical energy, the loss energy can be effectively used. As a result, the energy efficiency can be improved in the entire of the ejector-type refrigeration cycle device 10.

The electrical energy stored in the battery 20*b* may be supplied to various electrical actuators 11*b*, 21*b*, 12*a*, 14*a*, 16*a* of the ejector-type refrigeration cycle device 10, or may be supplied to an exterior electrical load other than the cycle components.

The mechanical energy recovered in the expansion unit 20 may be directly used as the mechanical energy without being converted to the electrical energy. For example, the rotation shaft of the expansion unit 20 can be connected to the rotation shafts of the first and second compression mechanisms 11*a*, 21*a*, and the recovered mechanical energy can be used as a supplemental power source of the first and second compression mechanisms 11*a*, 21*a*. In this case, the COP of the ejector-type refrigeration cycle device can be improved.

The mechanical energy recovered in the expansion unit 20 may be used as a driving source of an exterior machine. For example, a flywheel may be used as the exterior machine. In this case, the mechanical energy recovered in the expansion unit 20 can be stored as a kinetic energy. Moreover, a spring device (spiral spring) may be used as an exterior machine. In this case, the mechanical energy recovered in the expansion unit 20 can be stored as an elastic energy.

(14th Embodiment)

Figure 23:
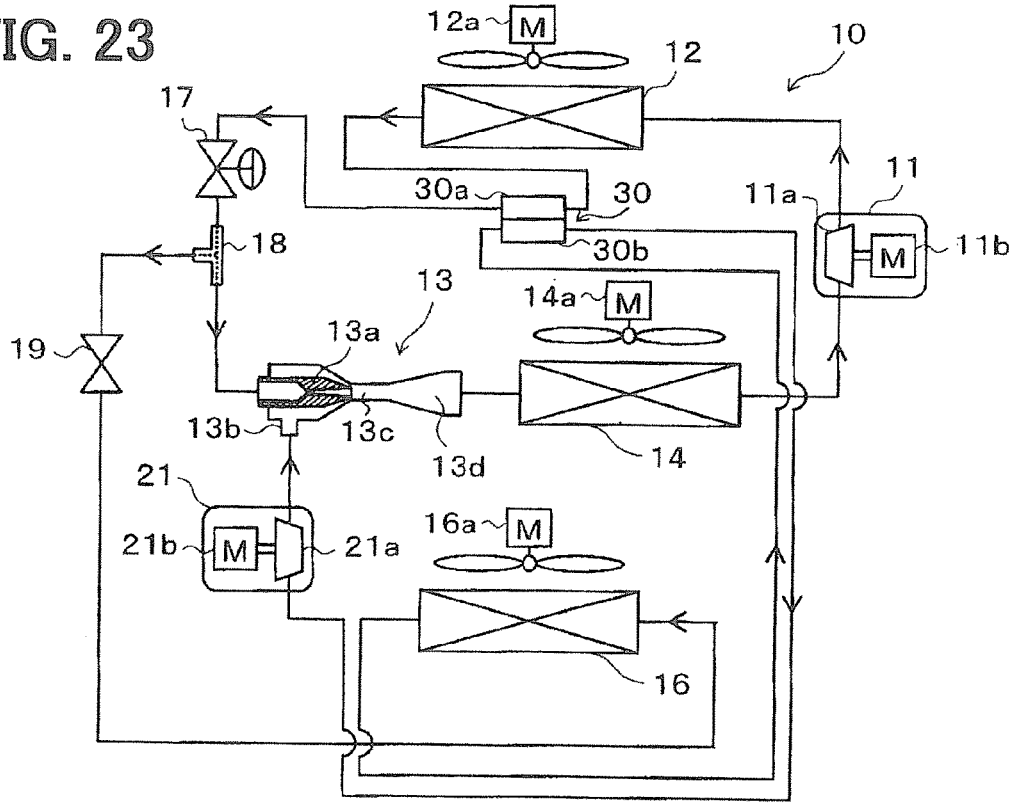
FIG. 23 is an entire schematic diagram of an ejector-type refrigeration cycle device of 14th embodiment.

In the present embodiment, as in the entire schematic diagram of FIG. 23, an inner heat exchanger 30, in which the refrigerant flowing out of the radiator 12 and a low-pressure side refrigerant in the cycle are heat exchanged, is added with respect to the ejector-type refrigeration cycle device 10 of the 11th embodiment.

The inner heat exchanger 30 is for performing heat exchange between refrigerant flowing through a high-pressure side refrigerant passage 30*a* from a refrigerant outlet side of the radiator 12, and a low-pressure side refrigerant flowing through a low-pressure side refrigerant passage 30*b*. More specifically, in the present embodiment, the refrigerant flowing out of the radiator 12 is the refrigerant passing through a refrigerant passage from the refrigerant outlet side of the radiator 12 toward the inlet port of the branch portion 18. In contrast, the low-pressure side refrigerant in the cycle of the present embodiment is the refrigerant to be drawn into the second compression mechanism 21*a*.

As a special structure of the inner heat exchanger 30, a double-pipe heat exchange structure may be used, in which an inner pipe forming the low-pressure side refrigerant passage 30*b* is provided inside of an outer pipe forming the high-pressure side refrigerant passage 30*a*. The high-pressure side refrigerant passage 30*a* may be provided as the inner pipe, and the low-pressure side refrigerant passage 30*b* may be provided as the outer pipe.

Furthermore, refrigerant pipes for defining the high-pressure side refrigerant passage 30*a* and the low-pressure side refrigerant passage 30*b* maybe bonded by brazing to have a heat exchange structure. Other configurations in the present embodiment are similar to those of the 11th embodiment.

Figure 24:
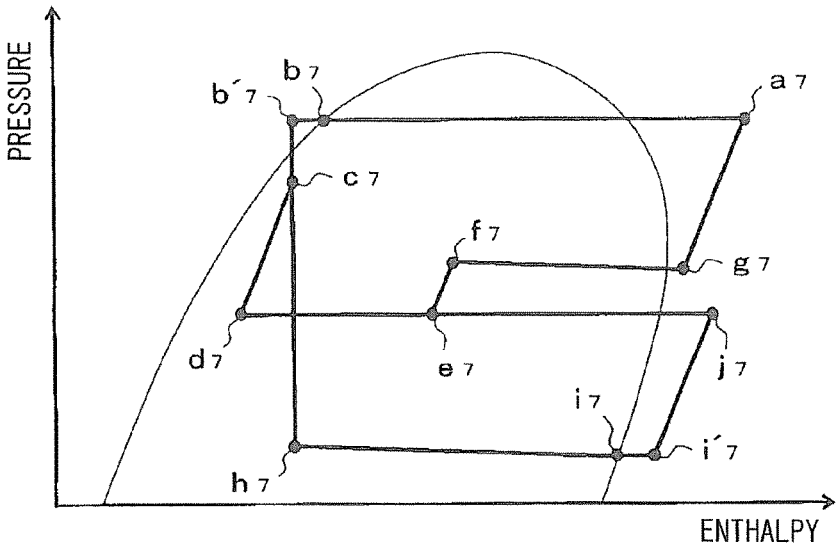
FIG. 24 is a Mollier diagram showing a refrigerant state of the ejector-type refrigeration cycle device of the 14th embodiment.

Next, the operation of the ejector-type refrigeration cycle device 10 of the present embodiment will be described with reference to the Mollier diagram of FIG. 24. When the ejector-type refrigeration cycle device 10 of the present embodiment is operated, the enthalpy of the suction side refrigerant of the second compression mechanism 21*a* is increased (point i7→point i'7 in FIG. 24), and the enthalpy of the refrigerant flowing into the thermal expansion valve 17 is decreased (point b7→point b'7 in FIG. 24), by the operation of the inner heat exchanger 31.

Therefore, in the ejector-type refrigeration cycle device 10 of the present embodiment, the enthalpy of the refrigerant flowing into the discharge side evaporator 14 and the suction side evaporator 16 can be decreased. Other operation is similar to that of the 11th embodiment.

Thus, even in the structure of the present embodiment, the same effects as in (A) to (F) of the 11th embodiment can be obtained. Furthermore, the enthalpy difference between the enthalpies of the refrigerant at the refrigerant inlet side and the refrigerant outlet side can be enlarged in the discharge side evaporator 14 and in the suction side evaporator 16, thereby further improving the COP.

(15th Embodiment)

Figure 25:
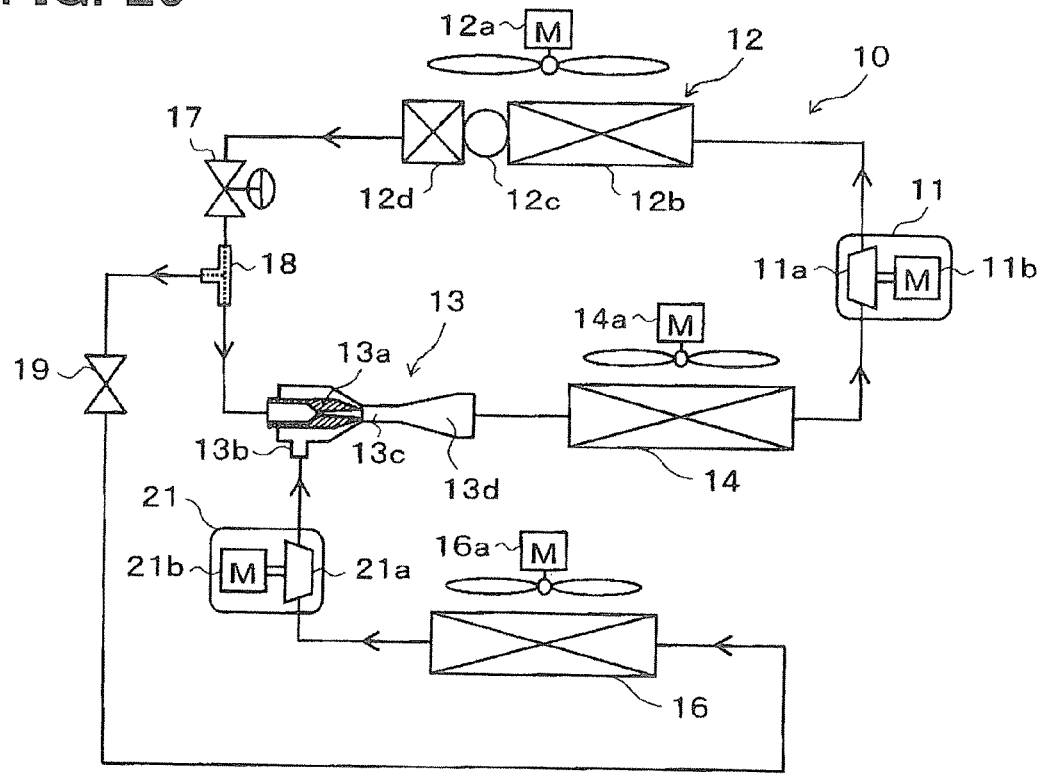
FIG. 25 is an entire schematic diagram of an ejector-type refrigeration cycle device of 15th embodiment.

In the present embodiment, as in the entire schematic diagram of FIG. 25, a structure of the radiator 12 is changed with respect to the ejector-type refrigeration cycle device 10 of the 11th embodiment.

Specifically, the radiator 12 of the present embodiment is configured as a sub-cool type condenser, which includes a condensation portion 12*b*, a gas-liquid separation portion 12*c* (receiver portion) and a super-cooling portion 12*d*. The condensation portion 12*b* condenses the refrigerant, the gas-liquid separation portion 12*c* separates the refrigerant flowing out of the condensation portion 12*b* into gas refrigerant and liquid refrigerant, and the super-cooling portion 12*d* super-cools the liquid refrigerant flowing out of the gas-liquid separation portion 12*c*. Other configurations in the present embodiment are similar to those of the 11th embodiment.

Figure 26:
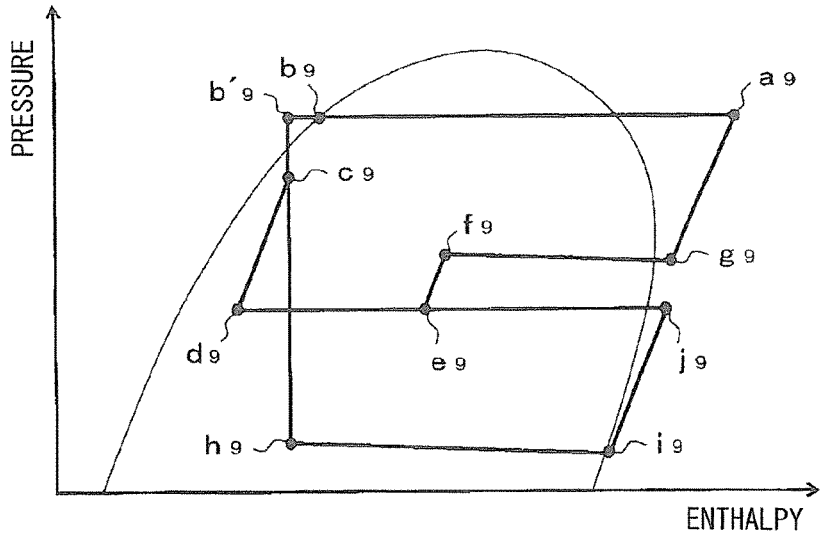
FIG. 26 is a Mollier diagram showing a refrigerant state of the ejector-type refrigeration cycle device of the 15th embodiment.

When the ejector-type refrigeration cycle device 10 of the present embodiment is operated, the refrigerant condensed in the condensation portion 12*b* of the radiator 12 is separated into gas refrigerant and liquid refrigerant in the gas-liquid separation portion 12*c*, as in the Mollier diagram of FIG. 26. Furthermore, the saturated liquid refrigerant separated in the gas-liquid separation portion 12*c* is super-cooled in the supercooling portion 12*d* (point b9→point b'9 in FIG. 26).

Therefore, in the ejector-type refrigeration cycle device 10 of the present embodiment, the enthalpy of the refrigerant flowing into the discharge side evaporator 14 and the suction side evaporator 16 can be decreased. Other operation is similar to that of the 11th embodiment.

Thus, even in the structure of the present embodiment, the same effects as in (A) to (F) of the 11th embodiment can be obtained. Furthermore, the enthalpy difference between the enthalpies of the refrigerant at the refrigerant inlet side and the refrigerant outlet side can be enlarged in the discharge side evaporator 14 and in the suction side evaporator 16, thereby increasing the cooling capacity.

At this time, it can prevent the enthalpy of the suction side refrigerant (Le., low-pressure side refrigerant in the cycle) of the second compression mechanism 21*a* from being unnecessary increased (point i9 in FIG. 26), unlike a case where the inner heat exchanger 30 of the 14th embodiment is used. Thus, it can prevent the density of the suction refrigerant of the second compression mechanism 21*a* from being lowered, and thereby it is possible to reduce the refrigerant evaporation pressure (refrigerant evaporation temperature) in the suction side evaporator 16, with respect to the 14th embodiment.

(16th Embodiment)

Figure 27:
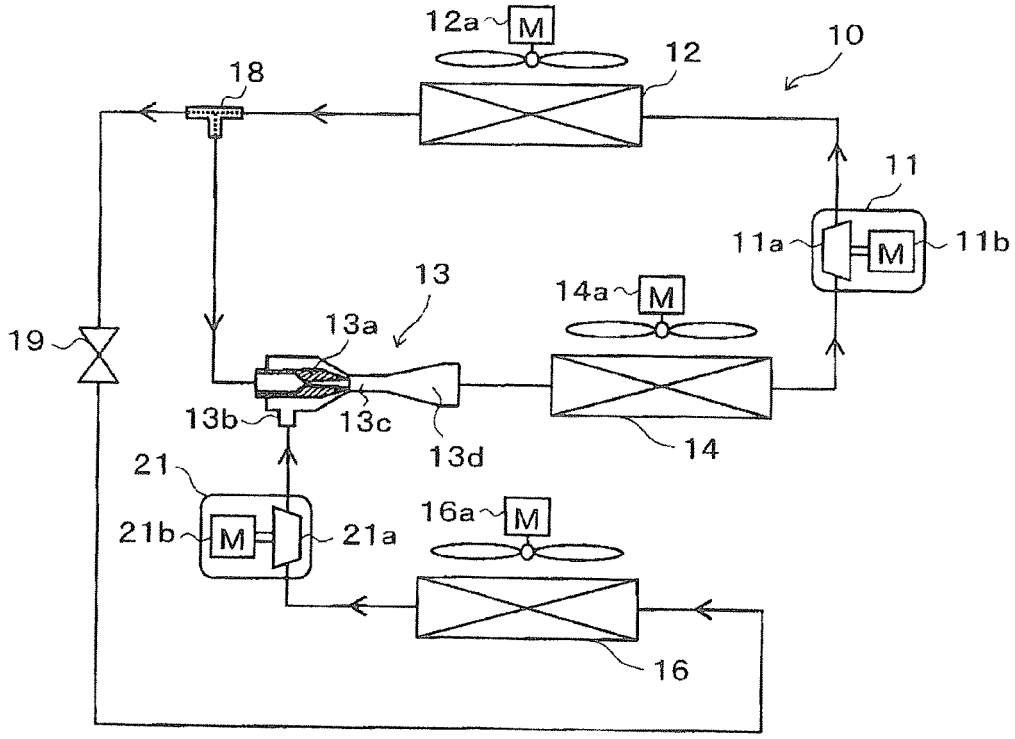
FIG. 27 is an entire schematic diagram of an ejector-type refrigeration cycle device of 16th embodiment.

In the above respective embodiments, a flon-based refrigerant is used as the refrigerant for a refrigerant cycle of the ejector-type refrigeration cycle device 10 to form a vapor-compression subcritical refrigerant cycle. In the present embodiment, carbon dioxide is used as the refrigerant for a refrigerant cycle of the ejector-type refrigeration cycle device 10 to form a vapor-compression super-critical refrigerant cycle in which a refrigerant pressure discharged from the first compressor 11 exceeds the critical pressure of the refrigerant. In the present embodiment, as in the entire schematic diagram of FIG. 27, the thermal expansion valve 17 is removed from the ejector-type refrigeration cycle device 10 of the 11th embodiment. Other configurations in the present embodiment are similar to those of the 11th embodiment.

Next, the operation of the ejector-type refrigeration cycle device 10 of the present embodiment will be described with reference to the Mollier diagram of FIG. 28. When the ejector-type refrigeration cycle device 10 of the present embodiment is operated, the refrigerant discharged from the first compressor 21 is cooled in the radiator 12. At this time, the refrigerant passing through the radiator 12 is cooled in a super-critical state without being condensed (point a11→point b11 of FIG. 28).

Figure 28:
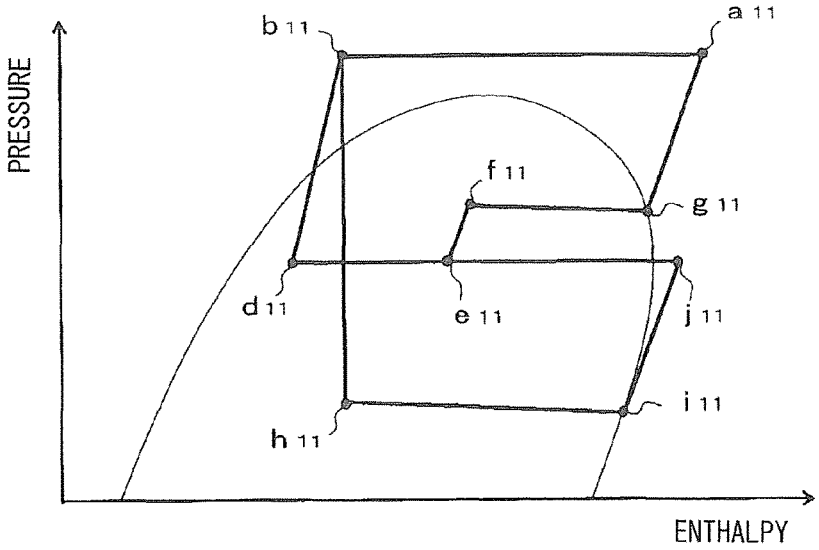
FIG. 28 is a Mollier diagram showing a refrigerant state of the ejector-type refrigeration cycle device of the 16th embodiment.

The refrigerant flowing out of the radiator 12 flows into the branch portion 18, and is branched by the branch portion 18 into a flow of the refrigerant flowing toward the nozzle portion 13*a* of the ejector 13 and a flow of the refrigerant flowing toward the fixed throttle 19 (point bll of FIG. 28). The super-critical high-pressure refrigerant flowing into the nozzle portion 13*a* of the ejector 13 from the branch portion 18 is decompressed and expanded by the nozzle portion 13*a* in iso-entropy (point b11→point d11 in FIG. 28).

On the other hand, the super-critical high-pressure refrigerant flowing from the branch portion 18 toward the side of the refrigerant suction port 13*b* is decompressed and expanded in iso-enthalpy at the fixed throttle 19, thereby reducing the refrigerant pressure (point b11→point h11 in FIG. 28). Other operation is similar to that of the 11th embodiment. Thus, even in the structure of the present embodiment, the same effects as in (A) to (D) of the 11th embodiment can be obtained.

Furthermore, in the super-critical refrigerant cycle, the high-pressure side refrigerant pressure becomes higher than that in the sub-critical refrigerant cycle. Therefore, the pressure difference between the high pressure side and the low pressure side in the cycle can be enlarged (point b11→point d11 of FIG. 28), thereby increasing the decompression amount in the nozzle portion 13*a* of the ejector 13. Furthermore, the enthalpy difference (i.e., recovery energy amount) between the enthalpies of the refrigerant at the refrigerant inlet side of the nozzle portion 13*a* and the refrigerant at the refrigerant outlet side of the nozzle portion 13*a* can be enlarged, thereby further improving the COP.

(17th Embodiment)

Figure 29:
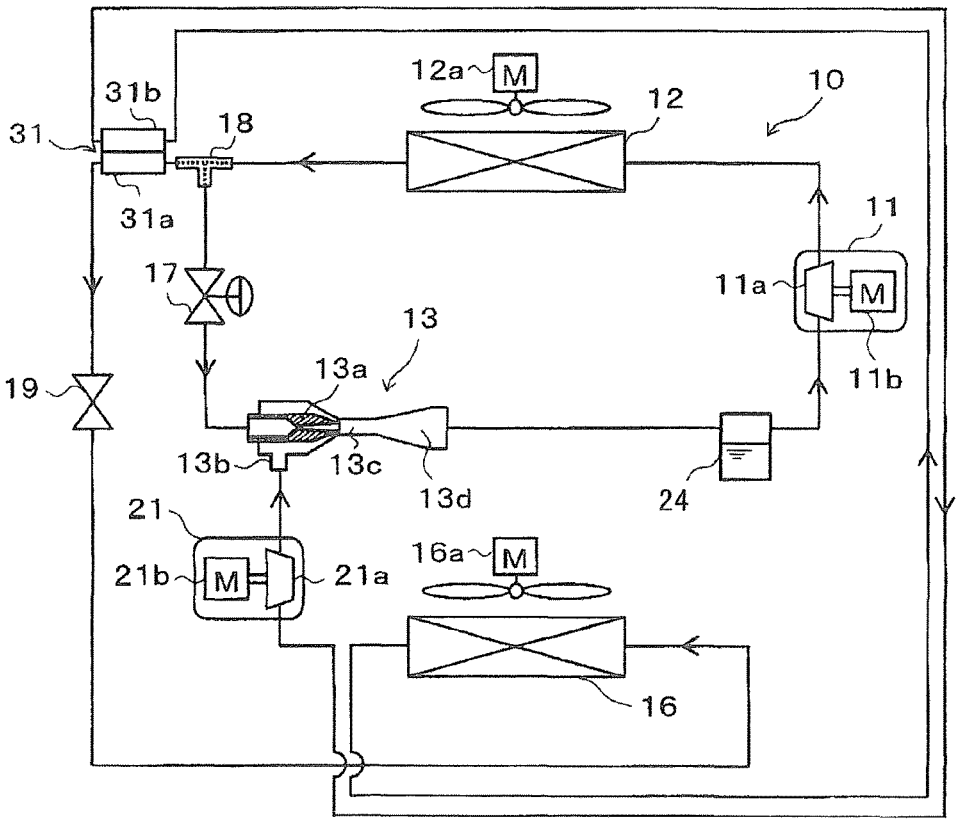
FIG. 29 is an entire schematic diagram of an ejector-type refrigeration cycle device of 17th embodiment.

In the present embodiment, as in the entire schematic diagram of FIG. 29, the discharge side evaporator 14 and the blower fan 14*a* are removed, with respect to the ejector-type refrigeration cycle device 10 of the 12th embodiment. Furthermore, in the present embodiment, an accumulator 24 is added at the outlet side of the diffuser portion 13*d* of the ejector 13, and an inner heat exchanger 31 is added, with respect to the ejector-type refrigeration cycle device 10 of the 12th embodiment.

The accumulator 24 is a discharge-side gas-liquid separator, in which the refrigerant flowing out of the diffuser portion 13*d* of the ejector 13 is separated into gas refrigerant and liquid refrigerant, and surplus liquid refrigerant in the cycle is stored therein. A refrigerant suction port of the first compressor 11 is connected to a gas-refrigerant outlet side of the accumulator 24.

The inner heat exchanger 31 is for performing heat exchange between refrigerant flowing through a high-pressure side refrigerant passage 31*a* from a refrigerant outlet side of the radiator 12, and a low-pressure side refrigerant flowing through a low-pressure side refrigerant passage 31*b*. The basic structure of the inner heat exchanger 31 is similar to the inner heat exchanger 30 of the 14th embodiment.

More specifically, in the present embodiment, the refrigerant flowing out of the radiator 12 is the refrigerant passing through a refrigerant passage from the refrigerant outlet side of the branch portion 18 to the refrigerant inlet side of the fixed throttle 19. In contrast, the low-pressure side refrigerant in the cycle of the present embodiment is the refrigerant to be drawn into the second compression mechanism 21*a*. Other configurations in the present embodiment are similar to those of the 12th embodiment.

Next, operation of the ejector-type refrigeration cycle device 10 of the present embodiment will be described with reference to the Mollier diagram of FIG. 30. When the ejector-type refrigeration cycle device 10 of the present embodiment is operated, refrigerant flowing out of the radiator 12 flows into the branch portion 18, and is branched by the branch portion 18 into a flow of the refrigerant flowing into the nozzle portion 13*a* of the ejector 13 and a flow of the refrigerant flowing into the refrigerant suction port 13*b* of the ejector 13 (point b13 in FIG. 30).

Figure 30:
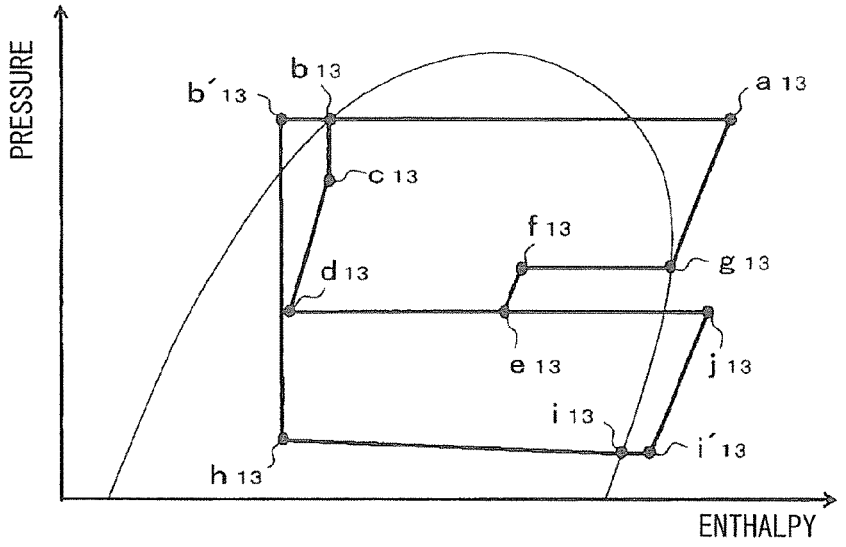
FIG. 30 is a Mollier diagram showing a refrigerant state of the ejector-type refrigeration cycle device of the 17th embodiment.

Furthermore, the high-pressure refrigerant flowing from the branch portion 18 toward the side of the nozzle portion 13*a* flows in this order of the thermal expansion valve 17→the nozzle portion 13*a* of the ejector 13→the diffuser portion 13*d* of the ejector 13 (point c13→point d13→point e13→point f13 in FIG. 30). The refrigerant flowing out of the diffuser portion 13*d* is separated into gas refrigerant and liquid refrigerant in the accumulator 24, and the separated gas refrigerant flowing out of the gas refrigerant outlet of the accumulator 24 is drawn into the first compressor 11 to be compressed again (point f13→point g13→point a13 in FIG. 30).

On the other hand, high-pressure refrigerant flowing from the branch portion 18 toward the side of the refrigerant suction port 13*b* reduces its enthalpy in the inner heat exchanger 31 (point b13→point b'13 in FIG. 30). Furthermore, the refrigerant flowing out of the high-pressure side refrigerant passage 31*a* of the inner heat exchanger 31 flows in this order of the fixed throttle 19→the suction side evaporator 16 (point b'13→point h13 in FIG. 30) similarly to the 12th embodiment.

Furthermore, the refrigerant flowing out of the suction side evaporator 16 increases its enthalpy in the inner heat exchanger 31 (point i13→point i'13 in FIG. 30). Furthermore, the refrigerant flowing out of the low-pressure side refrigerant passage 31*b* of the inner heat exchanger 31 is drawn into the second compressor 21, is compressed in the second compressor 21, and is drawn from the refrigerant suction port 13*b* of the ejector 13 (point i'13→point j13→point e13 in FIG. 30).

Thus, when the ejector-type refrigeration cycle device 10 of the present embodiment is operated, cooling action can be obtained in the suction side evaporator 16, and thereby the same effects as in (B) to (F) of the 11th embodiment can be obtained. Furthermore, improvement in the COP can be obtained similarly to the 12th embodiment and 14th embodiment.

More specifically, in the present embodiment, the high-pressure refrigerant flowing in a refrigerant passage from the refrigerant outlet side of the branch portion 18 to the inlet side of the fixed throttle 19 is heat-exchanged with a low-pressure refrigerant to be drawn to the second compression mechanism 21*a*. Therefore, it can prevent the enthalpy of the refrigerant flowing from the branch portion 18 to the nozzle portion 13*a* from being unnecessary reduced.

Therefore, further improvement in the COP can be obtained. Because the enthalpy of the refrigerant flowing to the nozzle portion 13*a* is not reduced unnecessary, the recovery energy amount in the nozzle portion 13*a* can be increased.

The detail will be described. The tilt of the iso-enthalpy line becomes more smooth in accordance with an increase of the enthalpy of the refrigerant flowing into the nozzle portion 13*a*. Therefore, in a case where the refrigerant is expanded in iso-entropy by an equal pressure in the nozzle portion 13*a*, the difference (i.e., recovery energy amount) between the enthalpy of the inlet side refrigerant of the nozzle portion 13*a* and the enthalpy of the outlet side refrigerant of the nozzle portion 13*a* becomes larger as the enthalpy of the inlet side refrigerant of the nozzle portion 13*a* becomes higher.

Thus, the recovery energy amount in the nozzle portion 13*a* can be increased in accordance with increase of the enthalpy of the refrigerant flowing into the nozzle portion 13*a*. Thus, in accordance with an increase of the recovery energy amount, a pressure increasing amount in the diffuser portion 13*d* can be increased, thereby further improving the COP.

Furthermore, because the accumulator 24 is arranged at the refrigerant suction side of the first compressor 11, it can prevent the problem of the liquid compression in the first compressor 11.

(18th Embodiment)

Figure 31:
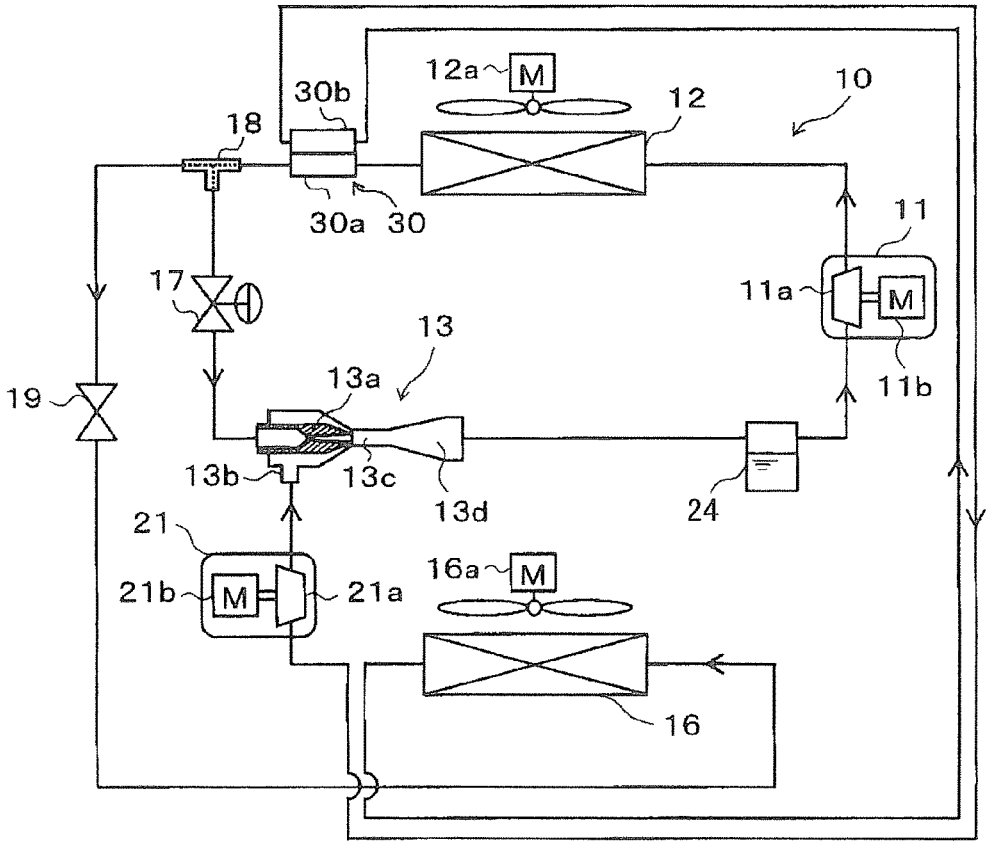
FIG. 31 is an entire schematic diagram of an ejector-type refrigeration cycle device of 18th embodiment.

In the present embodiment, as in the entire schematic diagram of FIG. 31, the inner heat exchanger 31 of the 17th embodiment is changed to the inner heat exchanger 30 that is similar to that in the 14th embodiment. More specifically, in the present embodiment, the high-pressure refrigerant flowing in a refrigerant passage from the refrigerant outlet side of the radiator 12 to the inlet side of the branch passage 18 is heat-exchanged with a low-pressure refrigerant to be drawn to the second compression mechanism 21*a*. Other configurations in the present embodiment are similar to those of the 17th embodiment.

Figure 32:
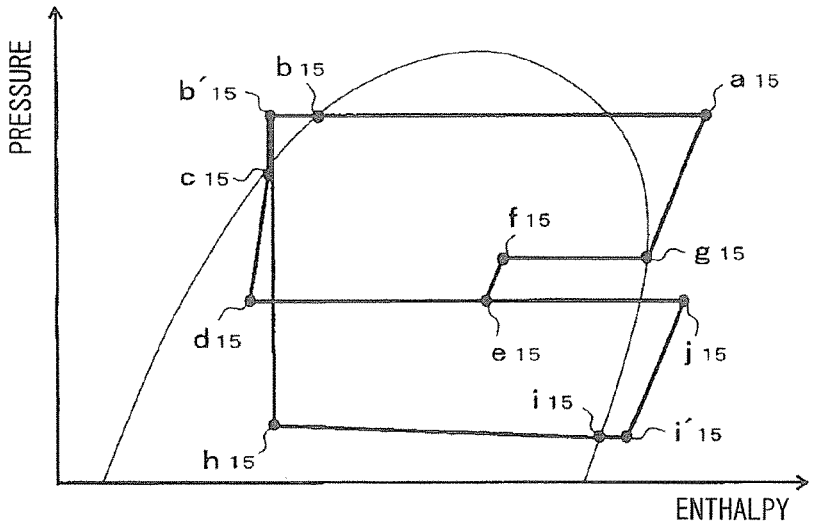
FIG. 32 is a Mollier diagram showing a refrigerant state of the ejector-type refrigeration cycle device of the 18th embodiment.

When the ejector-type refrigeration cycle device 10 of the present embodiment is operated, the enthalpy of the suction side refrigerant of the second compression mechanism 21*a* is increased (point i15→point i'15 in FIG. 32), and the enthalpy of the refrigerant flowing into the branch portion 18 is decreased (point b15→b'15 in FIG. 32), by the operation of the inner heat exchanger 30, as in the Mollier diagram of FIG. 32. Other operation is similar to that of the 17th embodiment.

Thus, in the structure of the present embodiment, the enthalpy of the refrigerant flowing into the nozzle portion 13*a* may be unnecessary reduced, and thereby the COP improvement may be reduced. However, similarly to the 17th embodiment, cooling action can exist in the suction side evaporator 16, and thereby the same effects as in (B), (C), (E), (F) in the 11th embodiment can be obtained. Furthermore, improvement in the COP can be also obtained similarly to the 12th embodiment and 14th embodiment.

(19th Embodiment)

Figure 33:
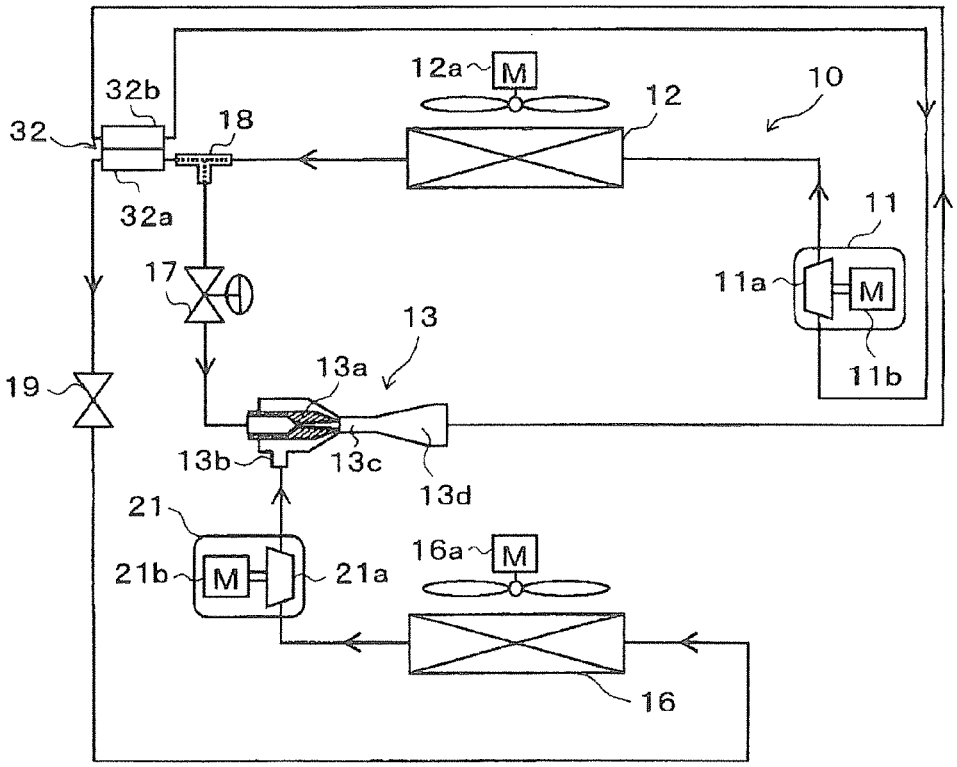
FIG. 33 is an entire schematic diagram of an ejector-type refrigeration cycle device of 19th embodiment.

In the present embodiment, as in the entire schematic diagram of FIG. 33, the accumulator 24 and the inner heat exchanger 31 are removed, and an inner heat exchanger 32 is added with respect to the ejector-type refrigeration cycle device 10 of the 17th embodiment. The basic structure of the inner heat exchanger 32 is similar to the inner heat exchanger 30 of the 14th embodiment. The inner heat exchanger 32 is for performing heat exchange between refrigerant flowing through a high-pressure side refrigerant passage 32*a* from a refrigerant outlet side of the radiator 12, and a low-pressure side refrigerant flowing through a low-pressure side refrigerant passage 32*b*.

More specifically, in the present embodiment, the refrigerant flowing out of the radiator 12 is the refrigerant passing through a refrigerant passage from the refrigerant outlet side of the branch portion 18 to the refrigerant inlet side of the fixed throttle 19. In contrast, the low-pressure side refrigerant in the cycle of the present embodiment is the refrigerant to be drawn into the first compression mechanism 11*a*. Other configurations in the present embodiment are similar to those of the 17th embodiment.

Next, operation of the ejector-type refrigeration cycle device 10 of the present embodiment will be described with reference to the Moldier diagram of FIG. 34. When the ejector-type refrigeration cycle device 10 of the present embodiment is operated, refrigerant flowing out of the radiator 12 flows into the branch portion 18, and is branched by the branch portion 18 into a flow of the refrigerant flowing into the nozzle portion 13*a* of the ejector 13 and a flow of the refrigerant flowing into the refrigerant suction port 13*b* of the ejector 13 (point b17 in FIG. 34), similarly to the 17th embodiment.

Furthermore, the high-pressure refrigerant flowing from the branch portion 18 toward the side of the nozzle portion 13*a* flows in this order of the thermal expansion valve 17→the nozzle portion 13*a* of the ejector 13→the diffuser portion 13*d* of the ejector 13 (point c17→point d17→point e17→point f17 in FIG. 34), similarly to 17th embodiment. On the other hand, the refrigerant flowing out of the diffuser portion 13*d* increases its enthalpy in the inner heat exchanger 32, and is drawn into the first compression mechanism 11*a* (point g17→point g'17 in FIG. 34).

Figure 34:
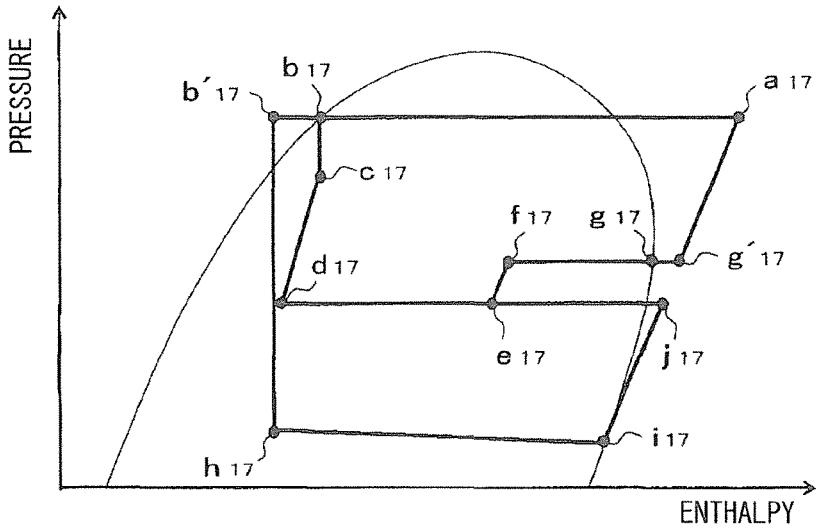
FIG. 34 is a Mollier diagram showing a refrigerant state of the ejector-type refrigeration cycle device of the 19th embodiment.

On the other hand, high-pressure refrigerant flowing from the branch portion 18 toward the side of the refrigerant suction port 13*b* reduces its enthalpy in the inner heat exchanger 32 (point b17→point b'17 in FIG. 34). Furthermore, the refrigerant flowing out of the high-pressure side refrigerant passage 32*a* of the inner heat exchanger 32 flows in this order of the fixed throttle 19→the suction side evaporator 16→the second compressor 21→the refrigerant suction port 13*b* of the ejector 13 (point b'17→point h17→point i17→point j17→point e17 in FIG. 34).

Thus, when the ejector-type refrigeration cycle device 10 of the present embodiment is operated, cooling action can be obtained in the suction side evaporator 16, and thereby the same effects as in (B) to (F) of the 11th embodiment can be obtained. Furthermore, in the present embodiment, the COP can be improved similarly to the 12th embodiment and the 14th embodiment. In addition, similarly to 17th embodiment, the enthalpy of the refrigerant flowing into the nozzle portion 13*a* is not unnecessary reduced, and thereby the COP improvement can be obtained.

(20th Embodiment)

Figure 35:
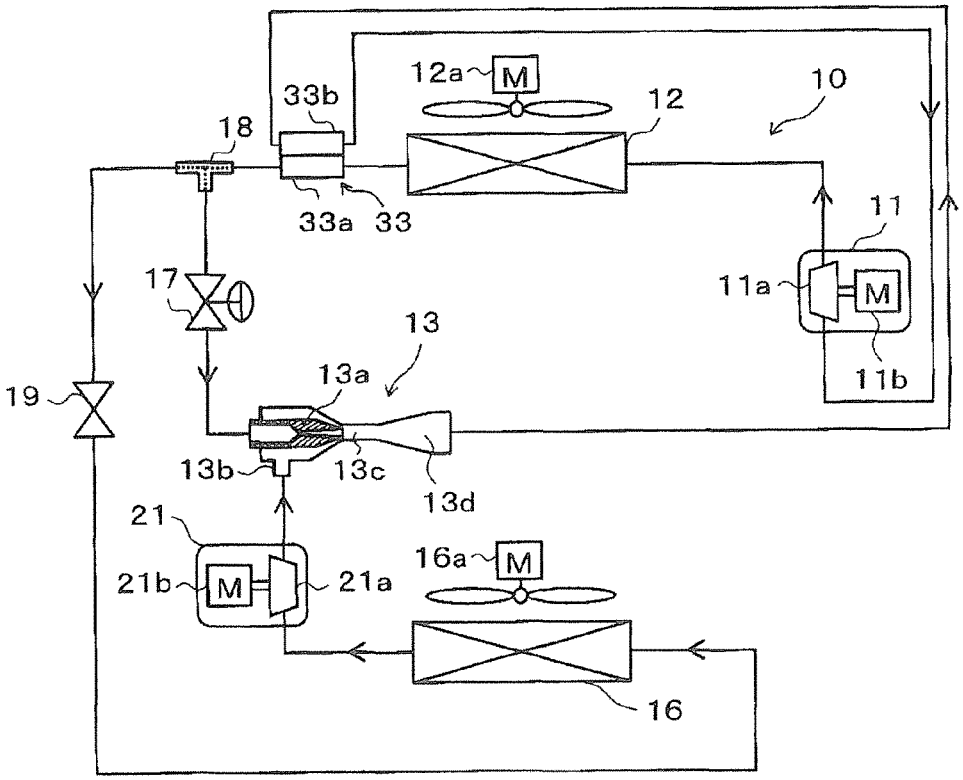
FIG. 35 is an entire schematic diagram of an ejector-type refrigeration cycle device of 20th embodiment.

In the present embodiment, as in the entire schematic diagram of FIG. 35, the inner heat exchanger 32 is removed, and an inner heat exchanger 33 is added with respect to the ejector-type refrigeration cycle device 10 of the 19th embodiment. The basic structure of the inner heat exchanger 33 is similar to the inner heat exchanger 30 of the 14th embodiment. The inner heat exchanger 33 is for performing heat exchange between refrigerant flowing through a high-pressure side refrigerant passage 33*a* from a refrigerant outlet side of the radiator 12, and a low-pressure side refrigerant flowing through a low-pressure side refrigerant passage 33*b*.

More specifically, in the present embodiment, the refrigerant flowing out of the radiator 12 is the refrigerant passing through a refrigerant passage from the refrigerant outlet side toward the inlet port of the branch portion 18. In contrast, the low-pressure side refrigerant in the cycle of the present embodiment is the refrigerant to be drawn into the first compression mechanism 11*a*. Other configurations in the present embodiment are similar to those of the 19th embodiment.

Figure 36:
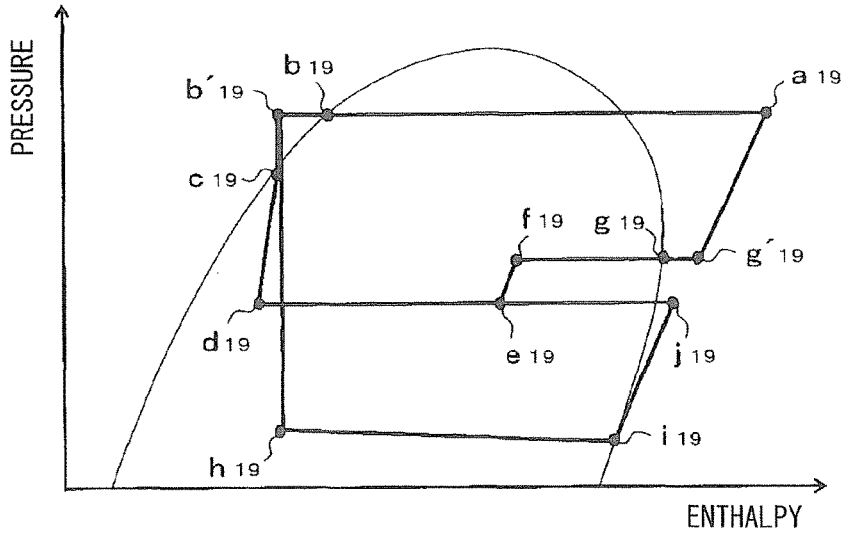
FIG. 36 is a Mollier diagram showing a refrigerant state of the ejector-type refrigeration cycle device of the 20th embodiment.

When the ejector-type refrigeration cycle device 10 of the present embodiment is operated, the enthalpy of the suction side refrigerant of the first compression mechanism 11*a* is increased (point g19→point g'19 in FIG. 36), and the enthalpy of the refrigerant flowing into the branch portion 18 is decreased (point b19→point b'19 in FIG. 36), by the operation of the inner heat exchanger 33, as in the Mollier diagram of FIG. 36. Other operation is similar to that of the 19th embodiment.

Thus, in the structure of the present embodiment, the enthalpy of the refrigerant flowing into the nozzle portion 13*a* may be unnecessary reduced, and thereby the COP improvement may be reduced with respect to 19th embodiment. However, similarly to the 19th embodiment, cooling action can exist in the suction side evaporator 16, and thereby the same effects as in (B), (C), (E), (F) in the 11th embodiment can be obtained. Furthermore, improvement in the COP can be also obtained similarly to the 12th embodiment and 14th embodiment.

(21st Embodiment)

Figure 37:
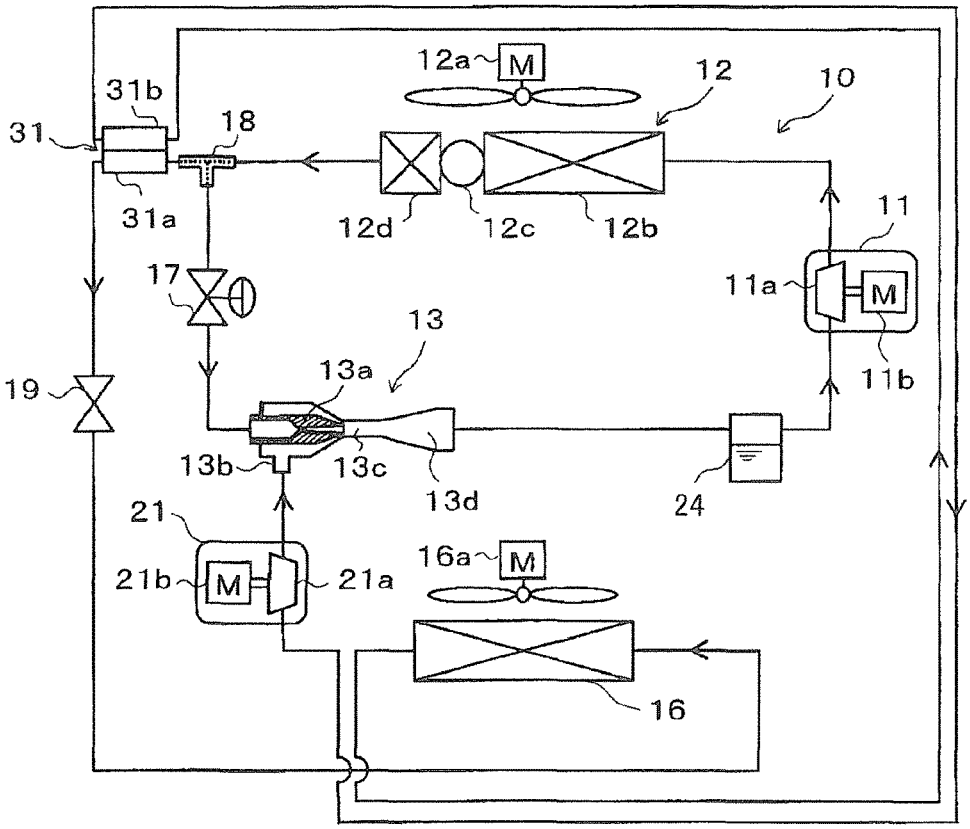
FIG. 37 is an entire schematic diagram of an ejector-type refrigeration cycle device of 21st embodiment.

In the present embodiment, as in the entire schematic diagram of FIG. 37, the radiator 12 is configured as a sub-cool type condenser similar to that in the 15th embodiment, with respect to the 17th embodiment. Other configurations in the present embodiment are similar to those of the 17th embodiment.

Figure 38:
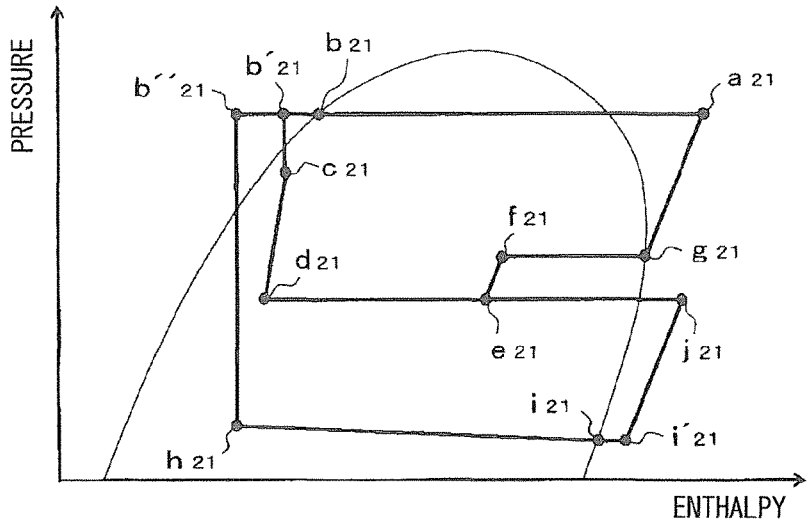
FIG. 38 is a Mollier diagram showing a refrigerant state of the ejector-type refrigeration cycle device of the 21st embodiment.

When the ejector-type refrigeration cycle device 10 of the present embodiment is operated, the refrigerant condensed in the condensation portion 12*b* of the radiator 12 is separated into gas refrigerant and liquid refrigerant in the gas-liquid separation portion 12*c*, as in the Mollier diagram of FIG. 38. Furthermore, the separated saturated liquid refrigerant is super-cooled in the supercooling portion 12*d* (point b21→point b'21 in FIG. 38).

Furthermore, the enthalpy of the suction side refrigerant of the second compression mechanism 21*a* is increased (point i21→point i'21 in FIG. 38), and the enthalpy of the refrigerant flowing into the fixed throttle 19 is decreased (point b'21→point b"21 in FIG. 38), by the operation of the inner heat exchanger 31. Therefore, the enthalpy of the refrigerant flowing into the suction side evaporator 16 can be effectively decreased. Other operation is similar to that of the 17th embodiment.

Thus, even in the structure of the present embodiment, the effects similarly to the 17th embodiment can be effectively obtained. In addition, similarly to the 15th embodiment, it is possible to reduce the refrigerant evaporation pressure (refrigerant evaporation temperature) in the suction side evaporator 16.

(22nd Embodiment)

Figure 39:
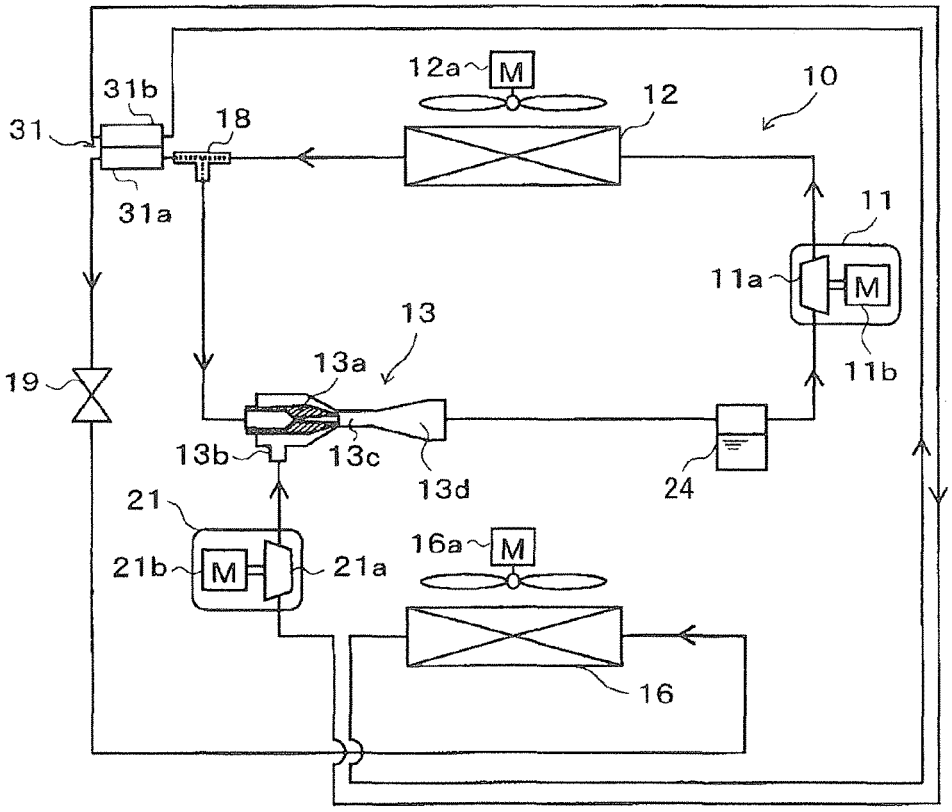
FIG. 39 is an entire schematic diagram of an ejector-type refrigeration cycle device of 22nd embodiment.

In the present embodiment, as in the entire schematic diagram of FIG. 39, the thermal expansion valve 17 is removed with respect to the 17th embodiment, and carbon dioxide is used as the refrigerant similarly to the 16th embodiment thereby configuring a super-critical refrigerant cycle. Other configurations in the present embodiment are similar to those of the 17th embodiment.

Figure 40:
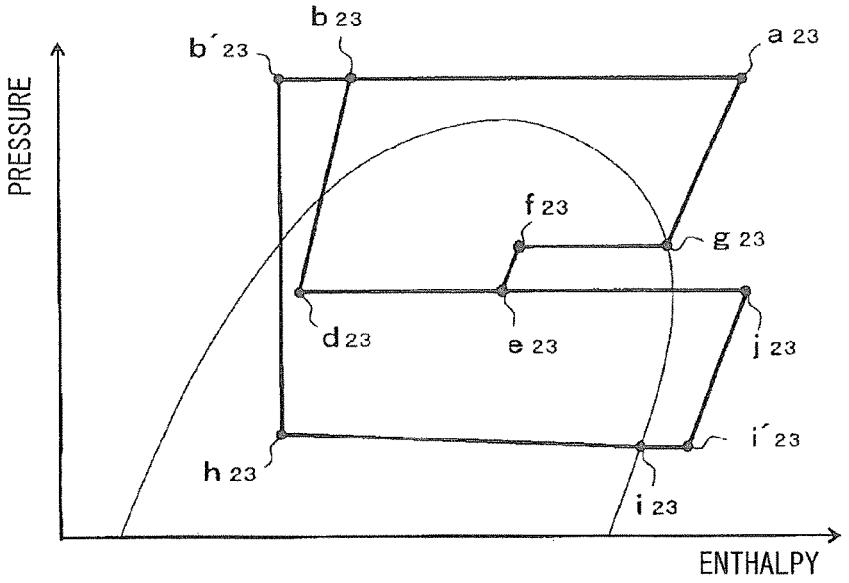
FIG. 40 is a Mollier diagram showing a refrigerant state of the ejector-type refrigeration cycle device of the 22nd embodiment.

When the ejector-type refrigeration cycle device 10 of the present embodiment is operated, the refrigerant discharged from the first compressor 21 is cooled in the radiator 12 as in the Mollier diagram of FIG. 40. At this time, the refrigerant passing through the radiator 12 is cooled in a super-critical state without being condensed (point a23→point b23 of FIG. 40). A branch portion 18 is connected to a refrigerant outlet side of the radiator 12, to branch a high-pressure refrigerant flowing out of the radiator 12.

The super-critical high-pressure refrigerant flowing into the nozzle portion 13*a* of the ejector 13 from the branch portion 18 is decompressed and expanded by the nozzle portion 13*a* in iso-entropy (point b23→point d23 in FIG. 40). On the other hand, the super-critical high-pressure refrigerant flowing from the branch portion 18 toward the side of the refrigerant suction port 13*b* is cooled in the inner heat exchanger 31, and then is decompressed and expanded in iso-enthalpy at the fixed throttle 19, thereby reducing the refrigerant pressure (point b23→point b'23→point h23 in FIG. 23). Other operation is similar to that of the 17th embodiment.

However, even in the structure of the present embodiment, cooling action can exist in the suction side evaporator 16, and thereby the same effects as in (B), (C) in the 11th embodiment can be obtained. Furthermore, improvement in the COP can be obtained similarly to the 12th embodiment, 14th embodiment and 16th embodiment.

(23rd Embodiment)

Figure 41:
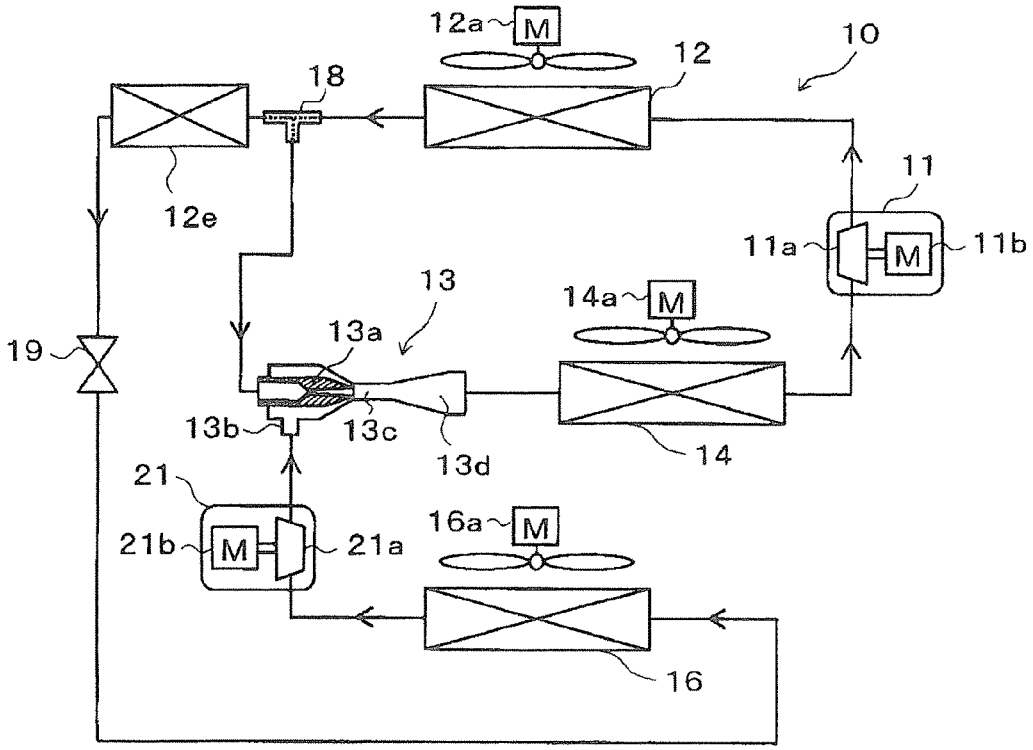
FIG. 41 is an entire schematic diagram of an ejector-type refrigeration cycle device of 23rd embodiment.

In the present embodiment, as in the entire schematic diagram of FIG. 41, the thermal expansion valve 17 is removed and an auxiliary radiator 12*e* is added with respect to the ejector-type refrigeration cycle device 10 of the 11th embodiment. In the present embodiment, the auxiliary radiator 12*e* is arranged downstream of the branch portion 18 so as to further cool the refrigerant flowing into the fixed throttle 19.

The auxiliary radiator 12*e* is a heat-radiation heat exchanger that exchanges heat between high-pressure refrigerant flowing out of the radiator 12 and outside air (i.e., air outside the room) blown by the cooling fan 12*a* to further cool the high-pressure refrigerant. Thus, heat exchange area can be relatively reduced in the radiator 12 of the present embodiment, thereby reducing heat exchanging capacity in the radiator 12, with respect to the above-described respective embodiments.

In FIG. 41, although the cooling fan 12*a* is arranged near the radiator 12 for clearly indicating in the diagram, the cooling fan 12*a* is arranged to also blow outside air to the auxiliary radiator 12*e*. Alternatively, outside air of the room may be blown to the radiator 12 and the auxiliary radiator 12*e*, respectively independently from blower fans.

Next, operation of the ejector-type refrigeration cycle device 10 of the present embodiment will be described with reference to the Monier diagram of FIG. 42. When the ejector-type refrigeration cycle device 10 of the present embodiment is operated, high-temperature and high-pressure gas refrigerant discharged from the first compressor 21 is cooled in the radiator 12 to be in a gas-liquid two-phase state (point a25→point b25 in FIG. 42). Thus, the heat exchanging capacity of the radiator 12 can be reduced, with respect to the above-described respective embodiments.

Figure 42:
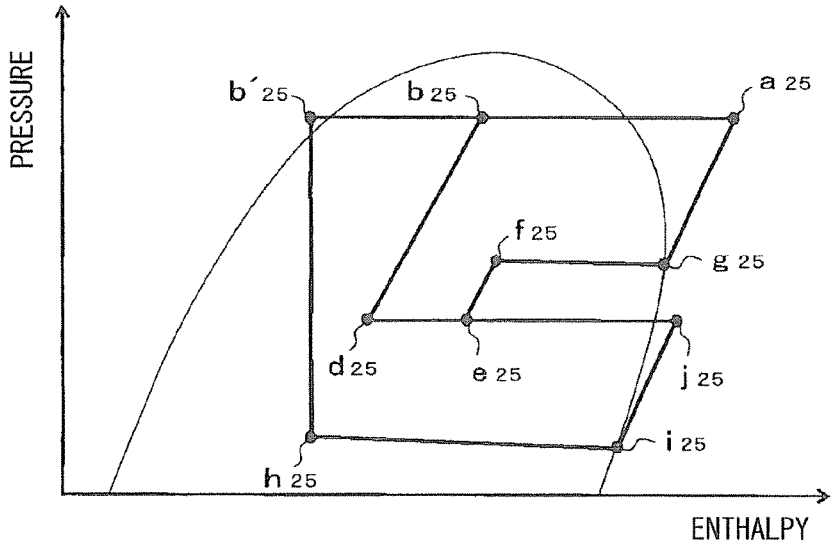
FIG. 42 is a Mollier diagram showing a refrigerant state of the ejector-type refrigeration cycle device of the 23rd embodiment.

The high-pressure refrigerant flowing out of the radiator 12 flows into the branch portion 18, and is branched by the branch portion 18 into a flow of the refrigerant flowing toward the nozzle portion 13*a* of the ejector 13 and a flow of the refrigerant flowing toward the refrigerant suction port 13*b* of the ejector 13 (point b25 in FIG. 42). The refrigerant flowing into the nozzle portion 13*a* of the ejector 13 from the branch portion 18 flows in this order of the ejector 13→the discharge side evaporator 14, and is compressed in the first compressor 11 (point b25→point d25→point e25→point f25→point g25→point a25 in FIG. 42).

On the other hand, high-pressure refrigerant flowing from the branch portion 18 toward the side of the refrigerant suction port 13*b* is further cooled in the auxiliary radiator 12*e* to become in the liquid state (point b25→point b'25 in FIG. 42). Furthermore, the refrigerant flowing out of the auxiliary radiator 12*e* flows in this order of the fixed throttle 19→the suction side evaporator 16, is compressed in the second compressor 21, and is drawn into the ejector 13 from the refrigerant suction port 13*b* (point b'25→point h25→point i25→point j25→point e25 in FIG. 42).

Thus, even in the structure of the present embodiment, the same effects as in (A) to (D) of the 11th embodiment can be obtained. Therefore, in the present embodiment, because the heat exchanging capacity of the radiator 12 is reduced, it can prevent the enthalpy of the refrigerant flowing to the nozzle portion 13*a* from being unnecessary reduced. Thus, similarly to the 17th embodiment, the enthalpy of the refrigerant flowing into the nozzle portion 13*a* is not unnecessary reduced, and thereby the COP improvement can be obtained.

Therefore, the enthalpy of the refrigerant flowing into the suction side evaporator 16 can be decreased by the action of the auxiliary radiator 12*e*. Thus, the enthalpy difference between the enthalpies of the refrigerant at the refrigerant inlet side and the refrigerant outlet side can be enlarged in the suction side evaporator 16, thereby further improving the COP.

(24th Embodiment)

Figure 43:
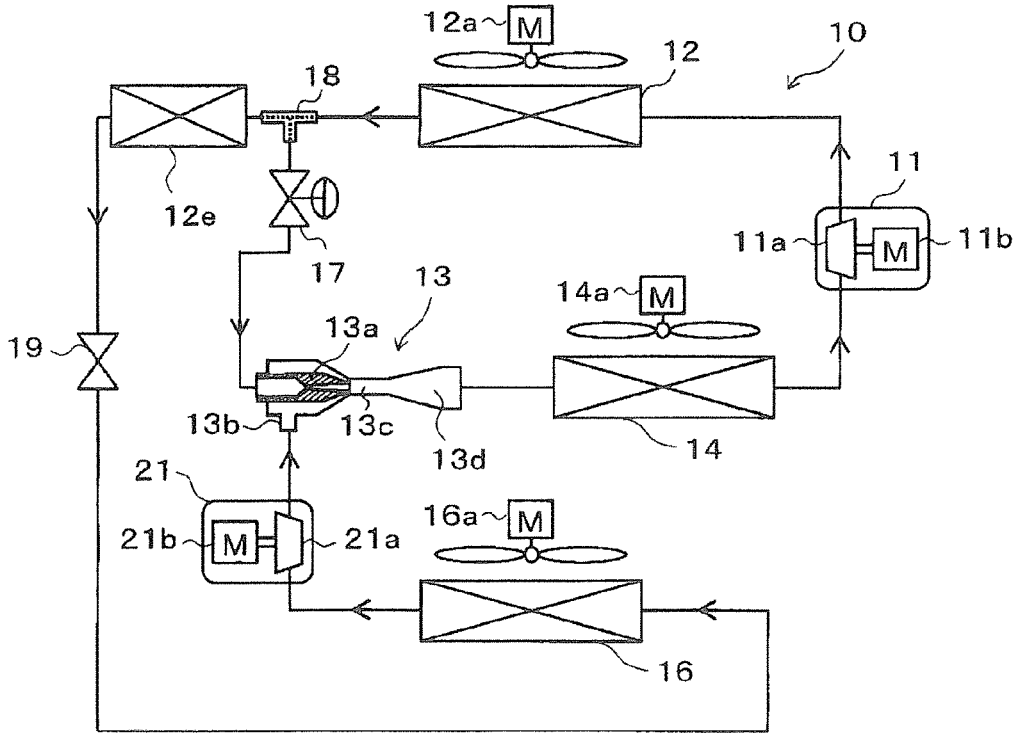
FIG. 43 is an entire schematic diagram of an ejector-type refrigeration cycle device of 24th embodiment.

In the present embodiment, as in the entire schematic diagram of FIG. 43, the thermal expansion valve 17 is added in a refrigerant passage from the outlet side of the branch portion 18 to the inlet side of the nozzle portion 13*a*, with respect to the ejector-type refrigeration cycle device 10 of the 23rd embodiment. Other configurations in the present embodiment are similar to those of the 23rd embodiment.

Figure 44:
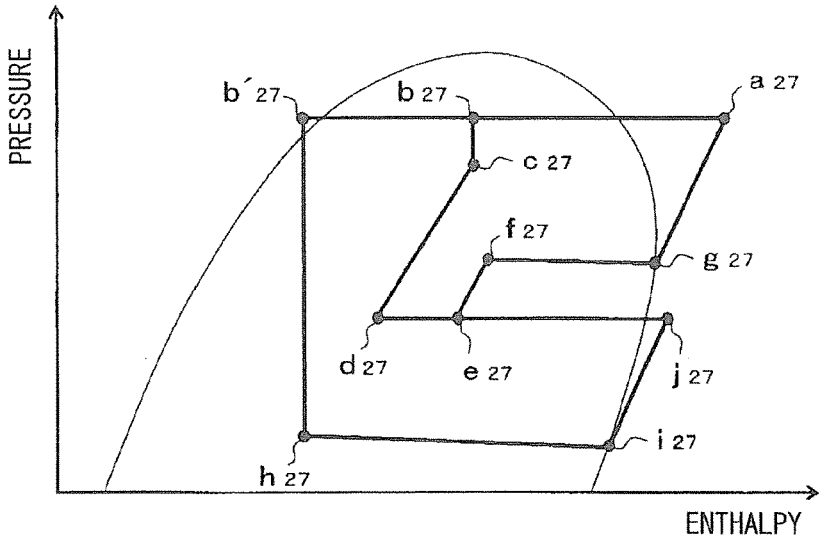
FIG. 44 is a Mollier diagram showing a refrigerant state of the ejector-type refrigeration cycle device of the 24th embodiment.

When the ejector-type refrigeration cycle device 10 of the present embodiment is operated, refrigerant flowing out of the branch portion 18 toward the side of the nozzle portion 13*a* of the ejector 13 is decompressed and expanded in iso-enthalpy by the thermal expansion valve 17 as in the Mollier diagram of FIG. 44 (point b27→point c27 in FIG. 44), Other operation is similar to that of the 23rd embodiment.

However, even in the structure of the present embodiment, the effects similar to the 23rd embodiment can be obtained, and the same effects as in (E), (F) in the 11th embodiment can be also obtained.

(25th Embodiment)

Figure 45:
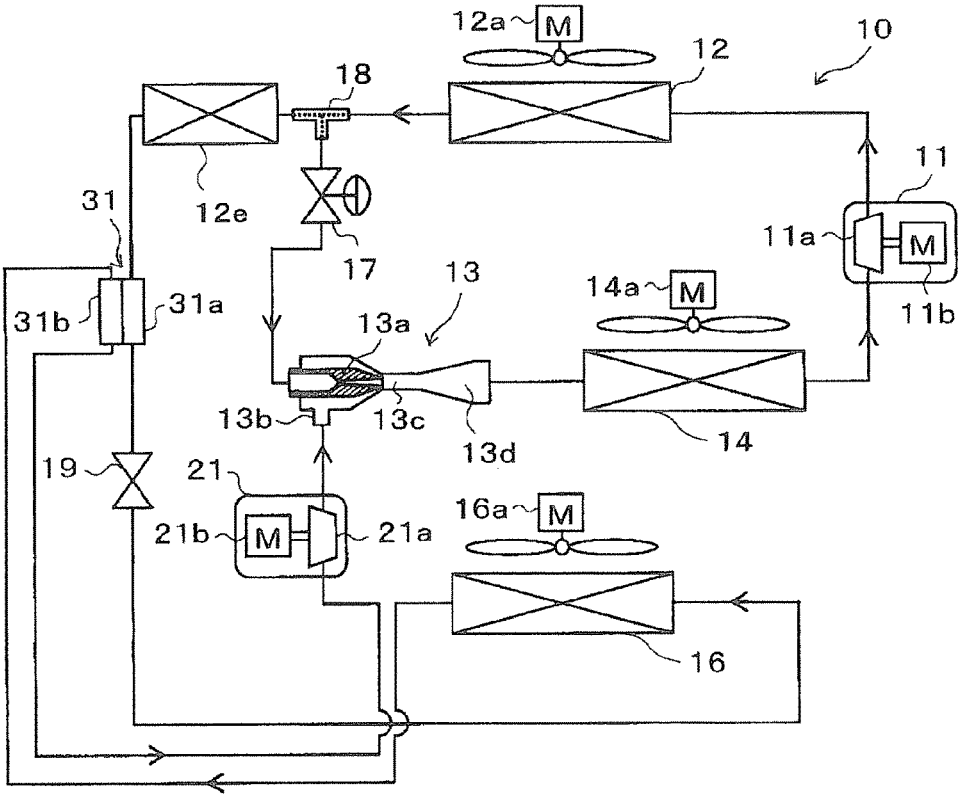
FIG. 45 is an entire schematic diagram of an ejector-type refrigeration cycle device of 25th embodiment.

In the present embodiment, as in the entire schematic diagram of FIG. 45, an inner heat exchanger 31 similar to the 17th embodiment is added with respect to the ejector-type refrigeration cycle device 10 of the 24th embodiment. The inner heat exchanger 31 is adapted to perform heat exchange between the refrigerant flowing in a refrigerant passage from the refrigerant outlet side of the auxiliary radiator 12*e* to the inlet side of the fixed throttle 19, and the refrigerant to be drawn to the second compression mechanism 21*a*.

Figure 46:
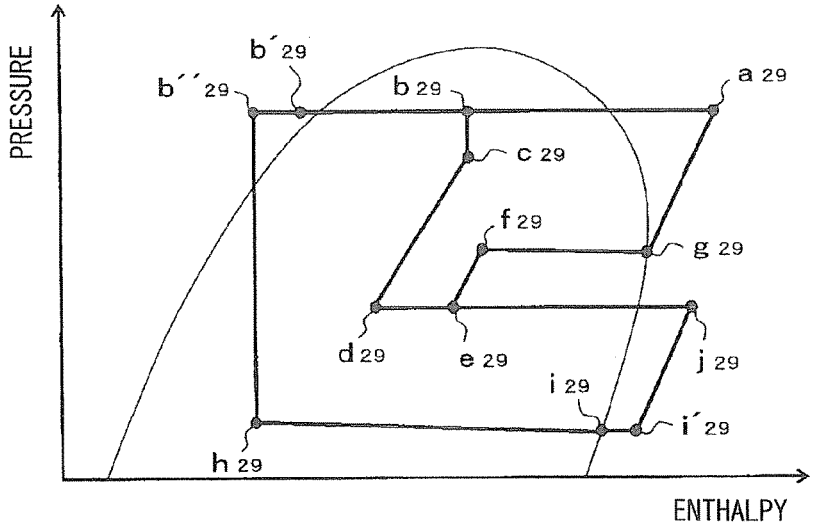
FIG. 46 is a Mollier diagram showing a refrigerant state of the ejector-type refrigeration cycle device of the 25th embodiment.

When the ejector-type refrigeration cycle device 10 of the present embodiment is operated, the enthalpy of the suction side refrigerant of the second compression mechanism 21*a* is increased (point i29→point i'29 in FIG. 46), and the enthalpy of the refrigerant flowing out of the auxiliary radiator 12*e* is decreased (point b'29→point b"29 in FIG. 46), by the operation of the inner heat exchanger 31, as in the Mollier diagram of FIG. 46. Other operation is similar to that of the 24th embodiment.

Thus, even in the structure of the present embodiment, the same effects as in the 24th embodiment can be obtained. Furthermore, improvement in the COP, due to the inner heat exchanger 31, can be obtained similarly to 17th embodiment.

(26th Embodiment)

Figure 47:
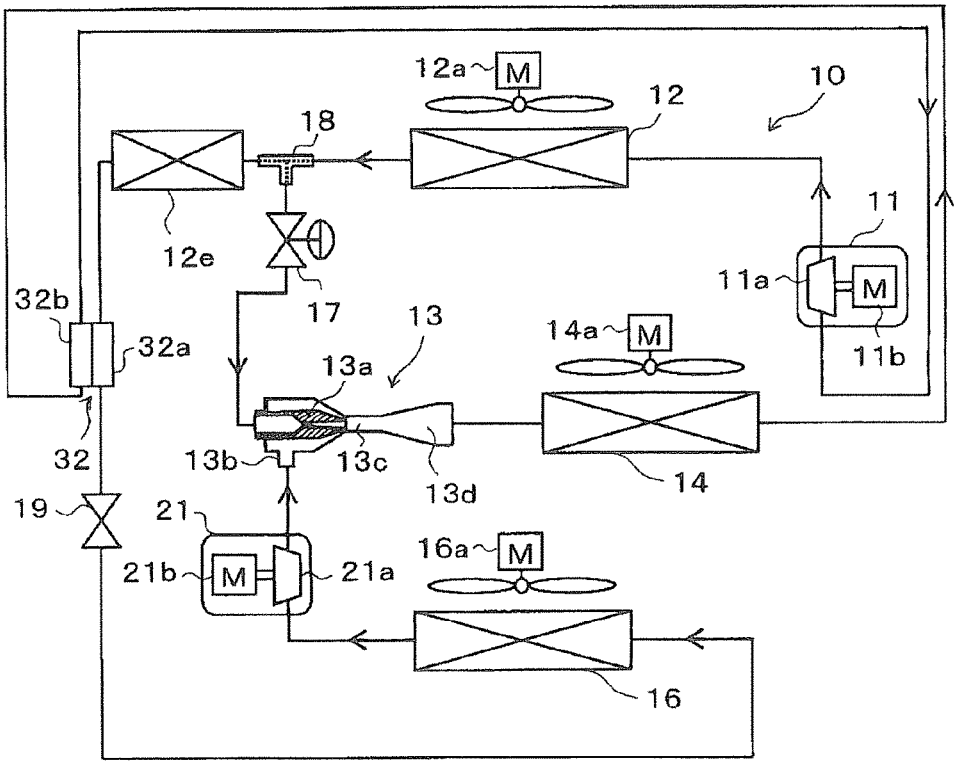
FIG. 47 is an entire schematic diagram of an ejector-type refrigeration cycle device of 26th embodiment.

In the present embodiment, as in the entire schematic diagram of FIG. 47, an inner heat exchanger 32 similar to the 19th embodiment is added with respect to the ejector-type refrigeration cycle device 10 of the 24th embodiment. The inner heat exchanger 32 of the present embodiment is adapted to perform heat exchange between the refrigerant flowing in a refrigerant passage from the refrigerant outlet side of the auxiliary radiator 12*e* to the inlet side of the fixed throttle 19, and the refrigerant to be drawn to the first compression mechanism 11*a*.

Figure 48:
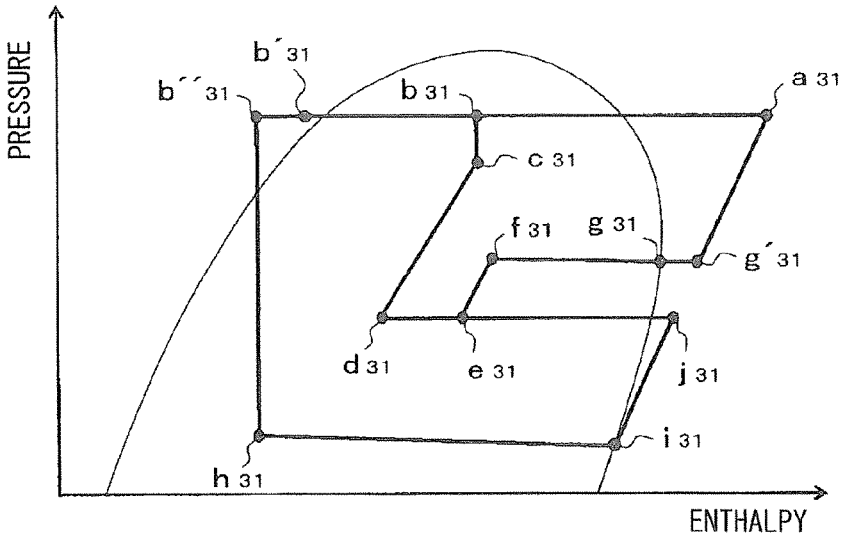
FIG. 48 is a Mollier diagram showing a refrigerant state of the ejector-type refrigeration cycle device of the 26th embodiment.

When the ejector-type refrigeration cycle device 10 of the present embodiment is operated, the enthalpy of the suction side refrigerant of the first compression mechanism 11*a* is increased (point g31→point g'31 in FIG. 48), and the enthalpy of the refrigerant flowing out of the auxiliary radiator 12*e* is decreased (point b'31→point b"31 in FIG. 48), by the operation of the inner heat exchanger 32, as in the Mollier diagram of FIG. 48. Other operation is similar to that of the 24th embodiment.

Thus, even in the structure of the present embodiment, the same effects as in the 24th embodiment can be obtained. Furthermore, improvement in the COP, due to the inner heat exchanger 32, can be obtained similarly to 19th embodiment.

(27th Embodiment)

Figure 49:
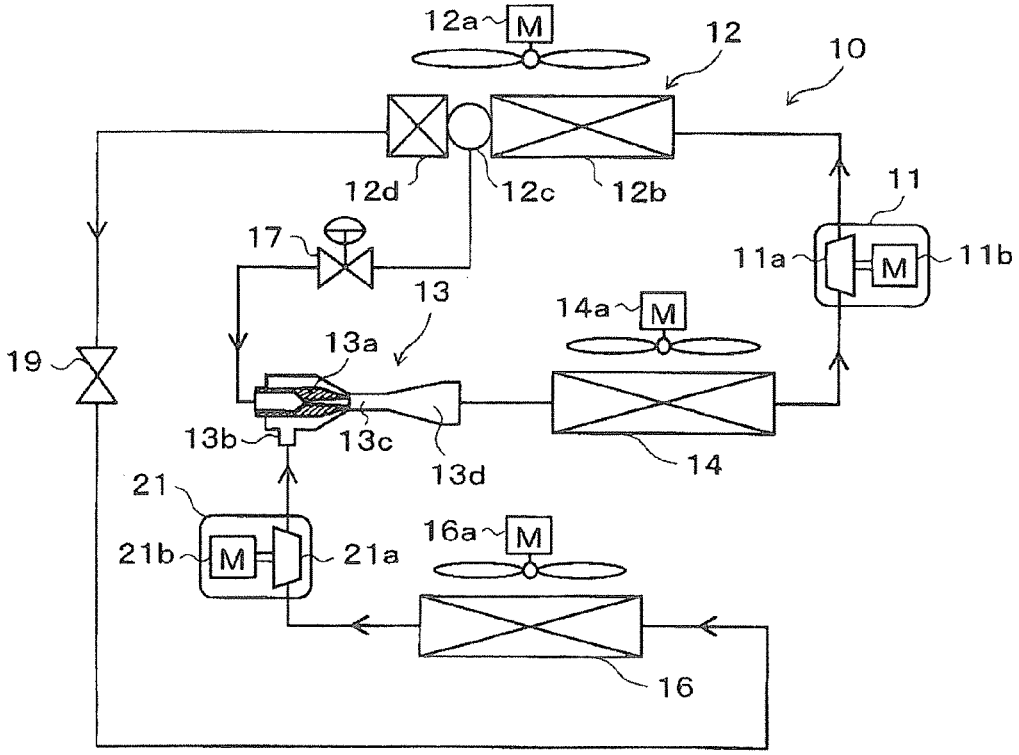
FIG. 49 is an entire schematic diagram of an ejector-type refrigeration cycle device of 27th embodiment.

In the present embodiment, as in the entire schematic diagram of FIG. 49, the radiator 12 is configured as a sub-cool type condenser similar to that in the 15th embodiment, with respect to the 17th embodiment. Thus, a cycle structure approximately similar to the 23rd embodiment can be obtained.

In the present embodiment, the branch portion 18 is removed, and two liquid refrigerant outlets are provided in the gas-liquid separation portion 12*c* of the radiator 12 to cause the liquid refrigerant to flow out. The saturated liquid refrigerant flows out of one of the liquid refrigerant outlets of the gas-liquid separation portion 12*c* to the super-cooling portion 12*d* similarly to the 15th embodiment, and the saturated liquid refrigerant flows out of the other one of the liquid refrigerant outlets of the gas-liquid separation portion 12*c* of the radiator 12 toward the nozzle portion 13*a* of the ejector 13. That is, a branch portion for branching the flow of the refrigerant is configured by the gas-liquid separation portion 12*c* in the present embodiment.

Thus, the condensation portion 12*b* and the super-cooling portion 12*d* of the radiator 12 can be functioned similarly to the radiator 12 and the auxiliary radiator 12*e* of the 23rd embodiment, respectively. When the ejector-type refrigeration cycle device 10 of the present embodiment is operated, it is operated approximately similarly to the 23rd embodiment as in the Mollier diagram of FIG. 50.

Figure 50:
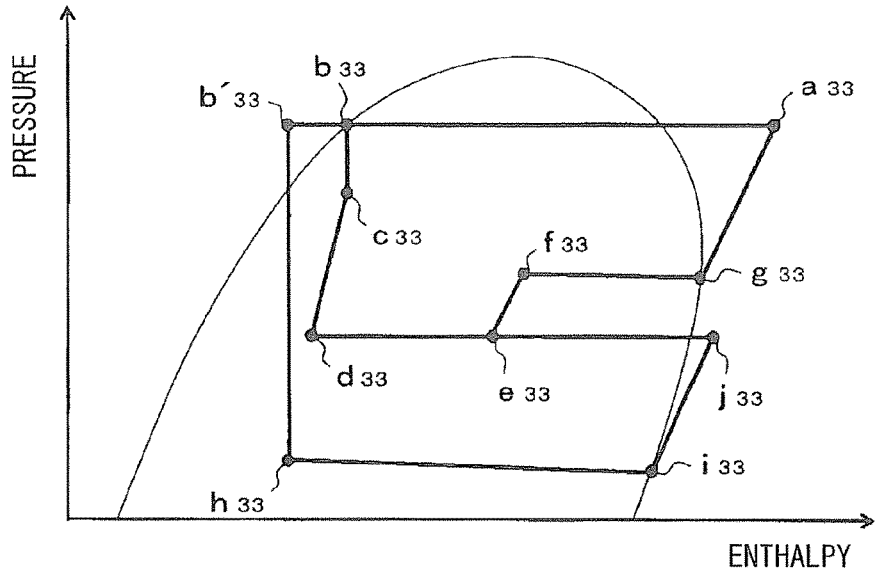
FIG. 50 is a Mollier diagram showing a refrigerant state of the ejector-type refrigeration cycle device of the 27th embodiment.

In the structure of the present embodiment, because the branch portion is configured by the gas-liquid separation portion 12*c*, the saturated liquid refrigerant can be decompressed and expanded at the nozzle portion 13*a* in isoentropy (point b33→point d33 in FIG. 50). Thus, the enthalpy of the refrigerant flowing into the nozzle portion 13*a* may be unnecessary reduced, and thereby the COP improvement may be decreased. However, in the present embodiment, the effects similar to the 23rd embodiment can be obtained. Furthermore, the same effects as in (E) and (F) of the 11th embodiment can be obtained.

(28th Embodiment)

In the present embodiment, in the ejector-type refrigeration cycle device 10 of the 23rd embodiment, carbon dioxide is used as the refrigerant similarly to the 16th embodiment thereby configuring a super-critical refrigerant cycle. Thus, the entire structure of the ejector-type refrigeration cycle device 10 of the present embodiment is similar to FIG. 41 of the 23rd embodiment.

Next, operation of the ejector-type refrigeration cycle device 10 of the present embodiment will be described with reference to the Mollier diagram of FIG. 51. When the ejector-type refrigeration cycle device 10 of the present embodiment is operated, the refrigerant discharged from the first compressor 21 is cooled in the radiator 12. At this time, the refrigerant passing through the radiator 12 is cooled in a super-critical state without being condensed (point a34→point b34 of FIG. 51). The branch portion 18 is connected to a refrigerant outlet side of the radiator 12, to branch a high-pressure refrigerant flowing out of the radiator 12.

Figure 51:
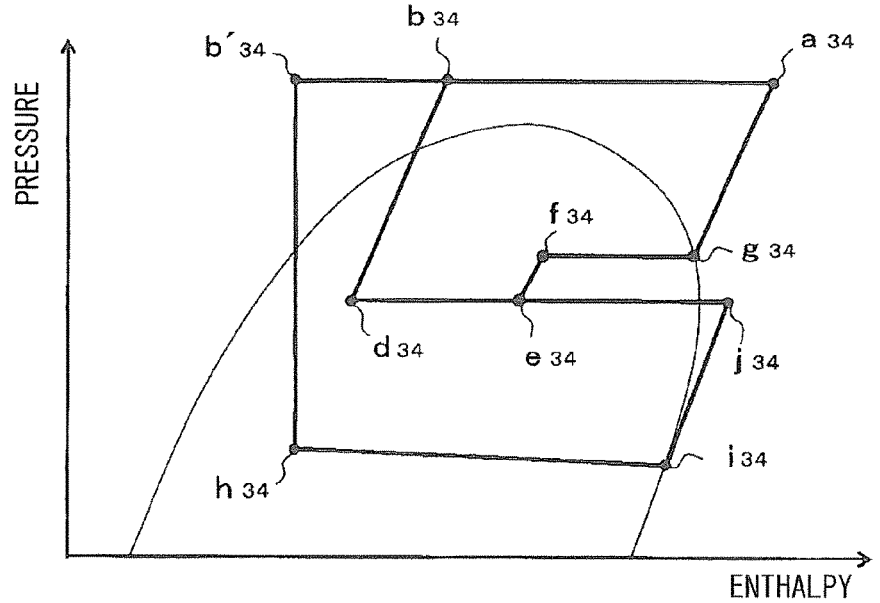
FIG. 51 is a Mollier diagram showing a refrigerant state of the ejector-type refrigeration cycle device of 28th embodiment.

The super-critical high-pressure refrigerant flowing into the nozzle portion 13*a* of the ejector 13 from the branch portion 18 is decompressed and expanded by the nozzle portion 13*a* in iso-entropy (point b34→point d34 in FIG. 51). On the other hand, the super-critical high-pressure refrigerant flowing from the branch portion 18 toward the side of the refrigerant suction port 13*b* is cooled in the auxiliary radiator 12*e*, and then is decompressed and expanded in iso-enthalpy at the fixed throttle 19, thereby reducing the refrigerant pressure (point b34→point b'34→point h34 in FIG. 51). Other operation is similar to that of the 23rd embodiment.

Thus, even in the structure of the present embodiment, the same effects as in the 23rd embodiment can be obtained. Furthermore, improvement in the COP can be obtained similarly to the 16th embodiment.

(29th Embodiment)

Figure 52:
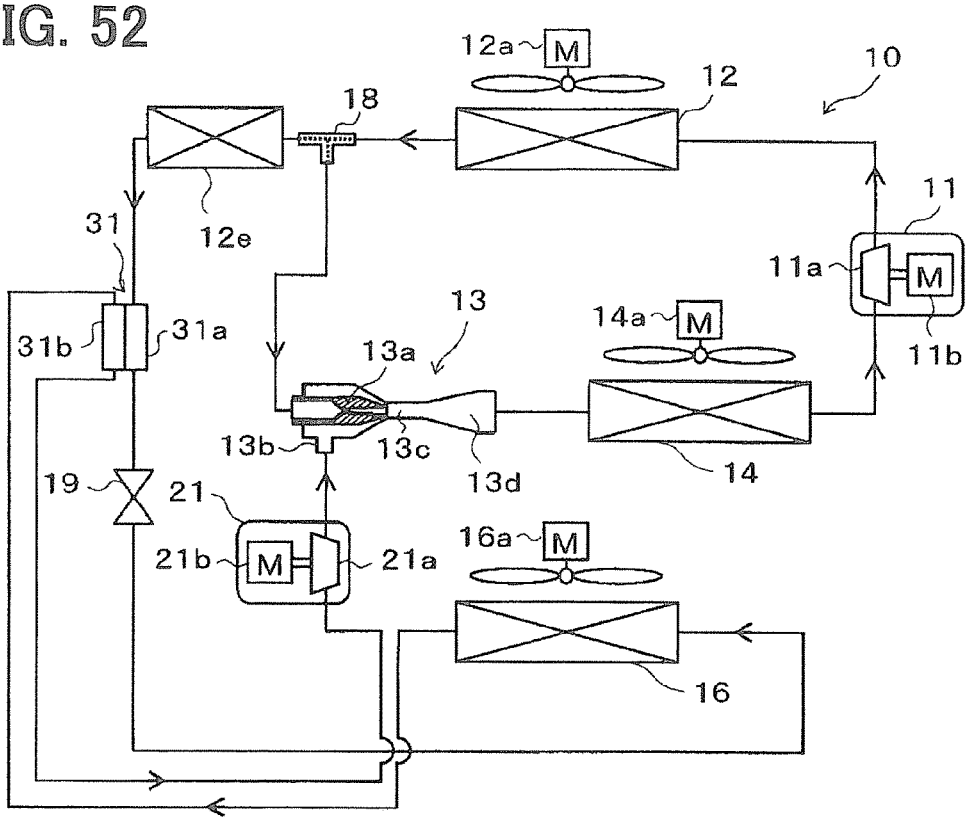
FIG. 52 is an entire schematic diagram of an ejector-type refrigeration cycle device of 29th embodiment.

In the present embodiment, as in the entire schematic diagram of FIG. 52, an inner heat exchanger 31 similar to the 17th embodiment is added with respect to the ejector-type refrigeration cycle device 10 of the 28th embodiment. The inner heat exchanger 31 is adapted to perform heat exchange between the refrigerant flowing in a refrigerant passage from the refrigerant outlet side of the auxiliary radiator 12*e* to the inlet side of the fixed throttle 19, and the refrigerant to be drawn to the second compression mechanism 21*a*.

Figure 53:
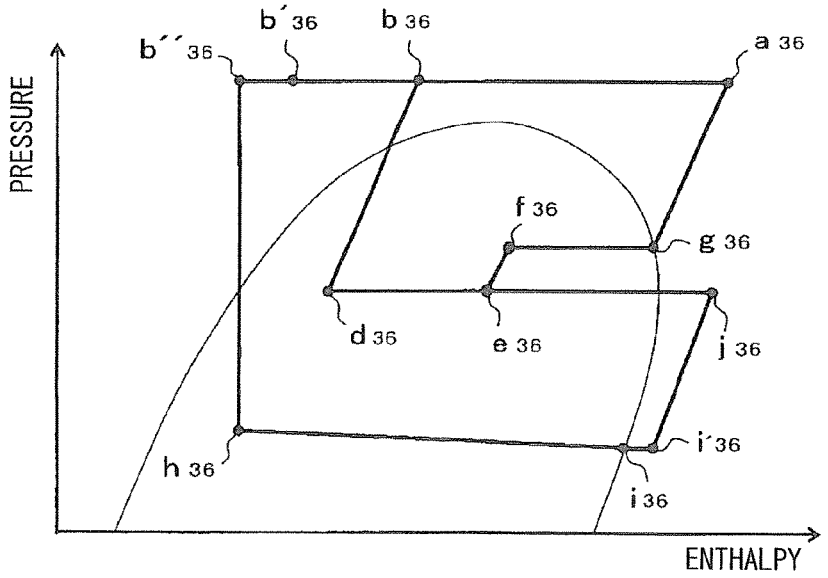
FIG. 53 is a Mollier diagram showing a refrigerant state of the ejector-type refrigeration cycle device of the 29th embodiment.

When the ejector-type refrigeration cycle device 10 of the present embodiment is operated, the enthalpy of the suction side refrigerant of the second compression mechanism 21*a* is increased (point i36→point i'36 in FIG. 53), and the enthalpy of the refrigerant flowing out of the auxiliary radiator 12*e* is decreased (point b'36→point b"36 in FIG. 53), by the operation of the inner heat exchanger 31, as in the Mollier diagram of FIG. 53. Other operation is similar to that of the 28th embodiment.

Thus, even in the structure of the present embodiment, the same effects as in the 28th embodiment can be obtained. Furthermore, improvement in the COP, due to the inner heat exchanger 31, can be obtained similarly to 17th embodiment.

(30th Embodiment)

Figure 54:
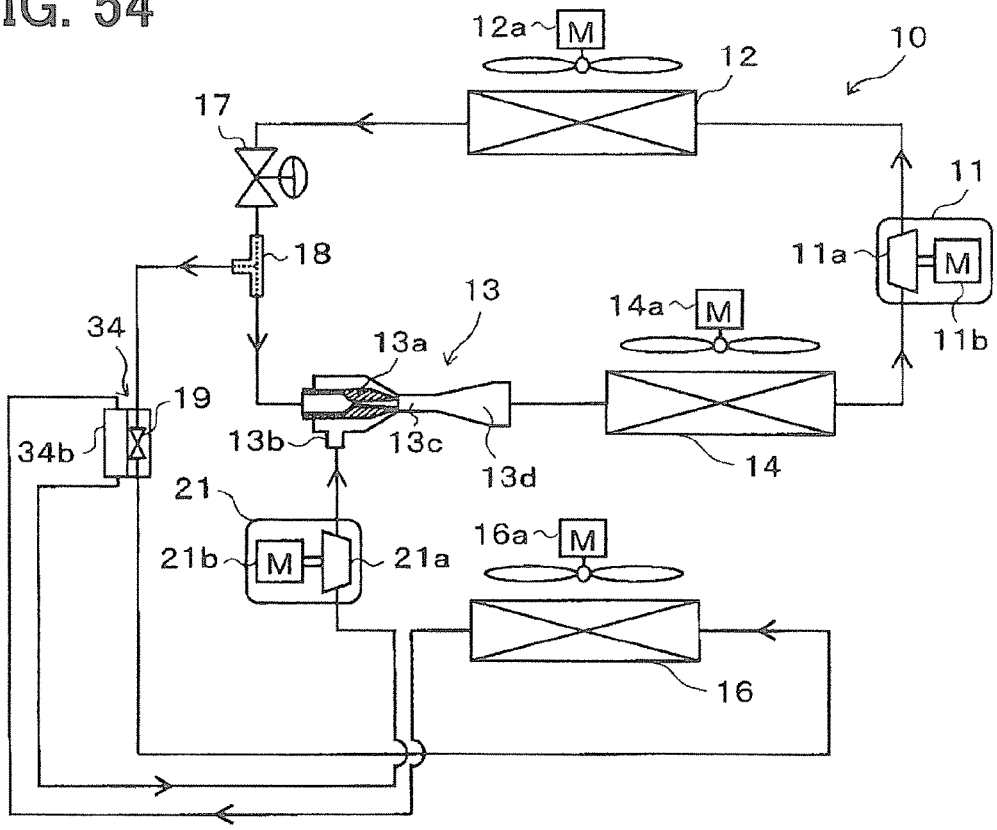
FIG. 54 is an entire schematic diagram of an ejector-type refrigeration cycle device of 30th embodiment.

In the present embodiment, as in the entire schematic diagram of FIG. 54, an inner heat exchanger 34 is added with respect to the ejector-type refrigeration cycle device 10 of the 11th embodiment. The inner heat exchanger 34 is for performing heat exchange between refrigerant in a decompression and expansion stage, passing through the fixed throttle 19 in a high-pressure side refrigerant passage, and refrigerant flowing through a low-pressure side refrigerant passage 34*b* to be drawn to the second compression mechanism 21*a*.

As a special structure of the inner heat exchanger 34, a double-pipe heat exchange structure may be used, in which the fixed throttle 19 configured by a capillary tube is provided inside of an outer pipe forming the low-pressure side refrigerant passage 34*b*. A refrigerant pipe for defining the fixed throttle 19 and the low-pressure side refrigerant passage 34*b* maybe bonded by brazing to have a heat exchange structure. Other configurations in the present embodiment are similar to those of the 11th embodiment.

Figure 55:
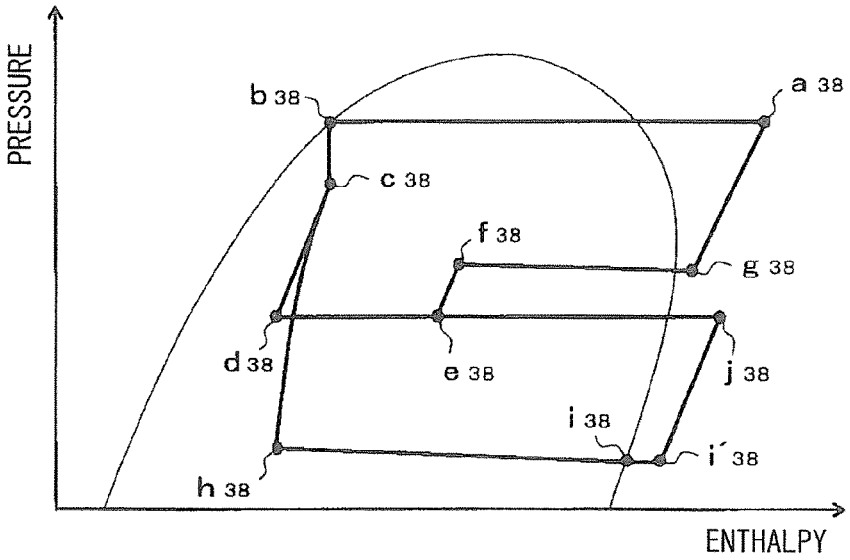
FIG. 55 is a Mollier diagram showing a refrigerant state of the ejector-type refrigeration cycle device of the 30th embodiment.

Next, operation of the ejector-type refrigeration cycle device 10 of the present embodiment will be described with reference to the Mollier diagram of FIG. 55. When the ejector-type refrigeration cycle device 10 of the present embodiment is operated, the enthalpy of the suction side refrigerant of the second compression mechanism 21*a* is increased (point i38→point i'38 in FIG. 55), and the enthalpy of the refrigerant of the decompression and expansion stage in the fixed throttle 19 is decreased (point b38→point h38 in FIG. 55), by the operation of the inner heat exchanger 34.

That is, the refrigerant passing through the fixed throttle 19 is cooled to a temperature of the suction refrigerant of the second compression mechanism 21*a* while being decompressed and expanded in the fixed throttle 19, and thereby the enthalpy of the refrigerant can be reduced. Therefore, in the ejector-type refrigeration cycle device 10 of the present embodiment, the enthalpy of the refrigerant flowing into the discharge side evaporator 14 and the suction side evaporator 16 can be decreased. Other operation is similar to that of the 11th embodiment.

Thus, even in the structure of the present embodiment, the same effects as in (A) to (F) of the 11th embodiment can be obtained. Furthermore, by the operation of the inner heat exchanger 34, the enthalpy difference between the enthalpies of the refrigerant at the refrigerant inlet side and the refrigerant outlet side can be enlarged in the discharge side evaporator 14 and in the suction side evaporator 16, thereby further improving the COP.

(31st Embodiment)

Figure 56:
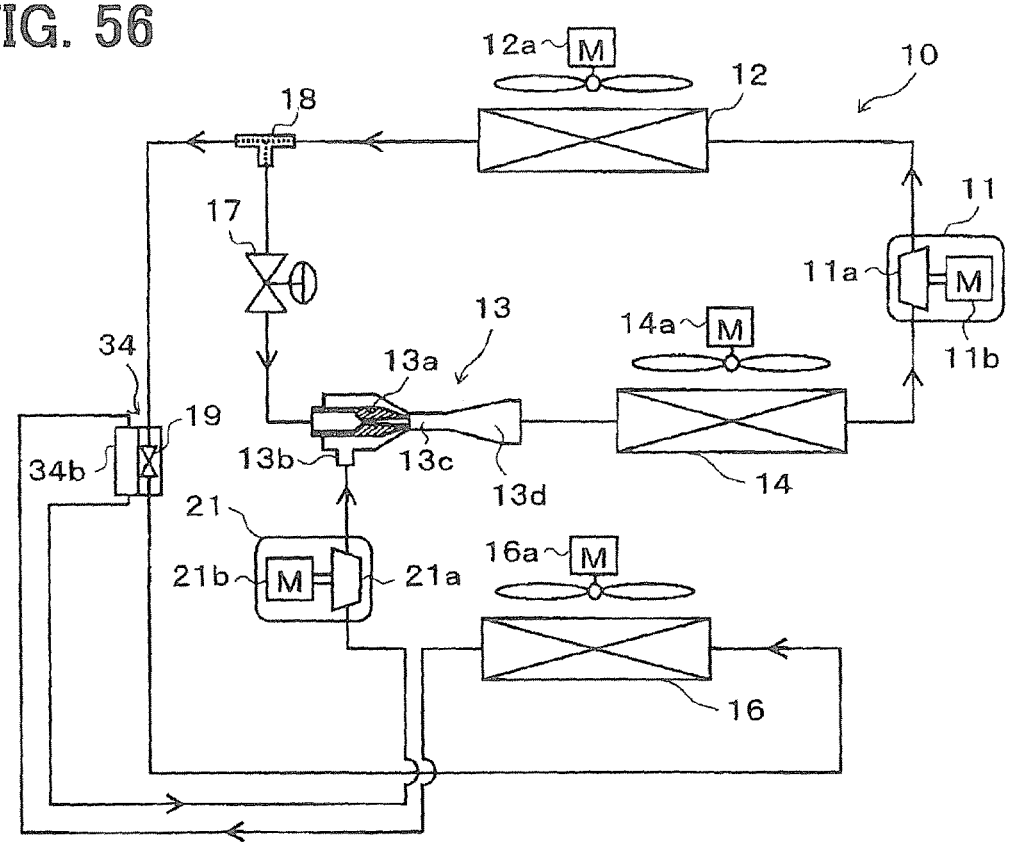
FIG. 56 is an entire schematic diagram of an ejector-type refrigeration cycle device of 31st embodiment.

In the present embodiment, as in the entire schematic diagram of FIG. 56, an inner heat exchanger 34 is added with respect to the ejector-type refrigeration cycle device 10 of the 12th embodiment. Other configurations in the present embodiment are similar to those of the 12th embodiment.

Figure 57:
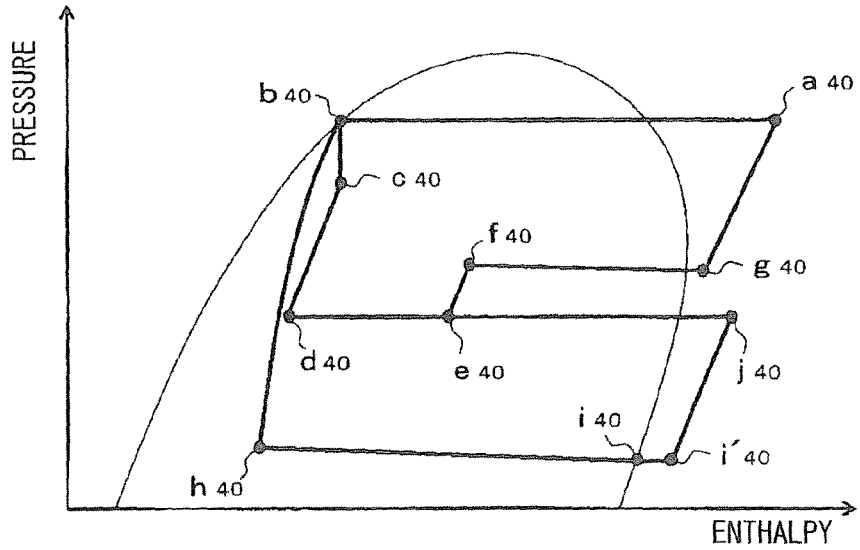
FIG. 57 is a Mollier diagram showing a refrigerant state of the ejector-type refrigeration cycle device of the 31st embodiment.

When the ejector-type refrigeration cycle device 10 of the present embodiment is operated, as in the Mollier diagram of FIG. 57, the enthalpy of the suction side refrigerant of the second compression mechanism 21*a* is increased (point i40→point i'40 in FIG. 57), and the enthalpy of the refrigerant of the decompression and expansion stage in the fixed throttle 19 is decreased (point b40→h40 in FIG. 57), by the operation of the inner heat exchanger 34.

Therefore, in the ejector-type refrigeration cycle device 10 of the present embodiment, the enthalpy of the refrigerant flowing into the discharge side evaporator 14 and the suction side evaporator 16 can be decreased with respect to the 12th embodiment. Other operation is similar to that of the 12th embodiment. Thus, even in the structure of the present embodiment, the same effects as in the 30th embodiment can be obtained. Furthermore, improvement in the COP can be obtained similarly to the 12th embodiment.

(32nd Embodiment)

Figure 58:
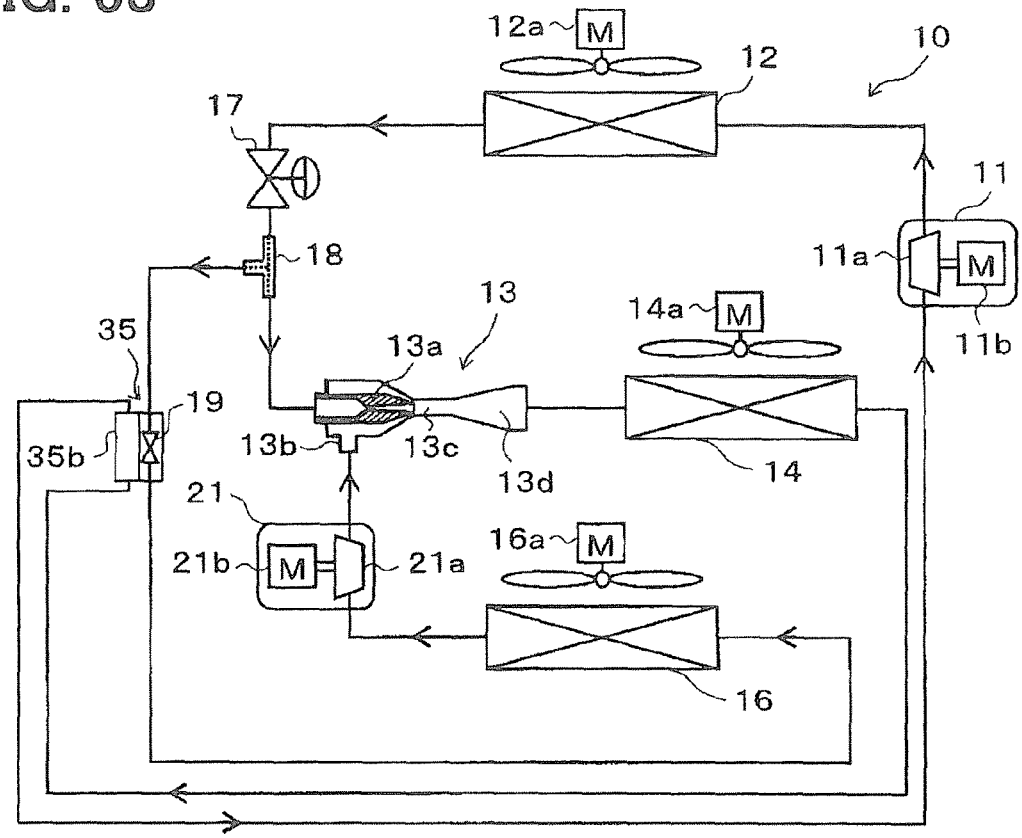
FIG. 58 is an entire schematic diagram of an ejector-type refrigeration cycle device of 32nd embodiment.

In the present embodiment, as in the entire schematic diagram of FIG. 58, an inner heat exchanger 35 is added with respect to the ejector-type refrigeration cycle device 10 of the 11th embodiment.

The inner heat exchanger 35 is for performing heat exchange between refrigerant in a decompression and expansion stage, passing through the fixed throttle 19 as a high-pressure side refrigerant passage, and refrigerant flowing through a low-pressure side refrigerant passage 35*b* to be drawn to the first compression mechanism 11*a*. The basic structure of the inner heat exchanger 35 is similar to the inner heat exchanger 34 of the 30th embodiment. Other configurations in the present embodiment are similar to those of the 11th embodiment.

Next, operation of the ejector-type refrigeration cycle device 10 of the present embodiment will be described with reference to the Mollier diagram of FIG. 59. When the ejector-type refrigeration cycle device 10 of the present embodiment is operated, the enthalpy of the suction side refrigerant of the first compression mechanism 11*a* is increased (point g42→point g'48 in FIG. 59), and the enthalpy of the refrigerant of the decompression and expansion stage in the fixed throttle 19 is decreased (point c42→point h'42→point h42 in FIG. 59), by the operation of the inner heat exchanger 35, That is, the refrigerant passing through the fixed throttle 19 is cooled to a temperature of the suction refrigerant of the first compression mechanism 11*a* while being decompressed and expanded in the fixed throttle 19, and thereby the enthalpy of the refrigerant can be reduced. Therefore, in the ejector-type refrigeration cycle device 10 of the present embodiment, the enthalpy of the refrigerant flowing into the discharge side evaporator 14 and the suction side evaporator 16 can be decreased with respect to the 12th embodiment.

Figure 59:
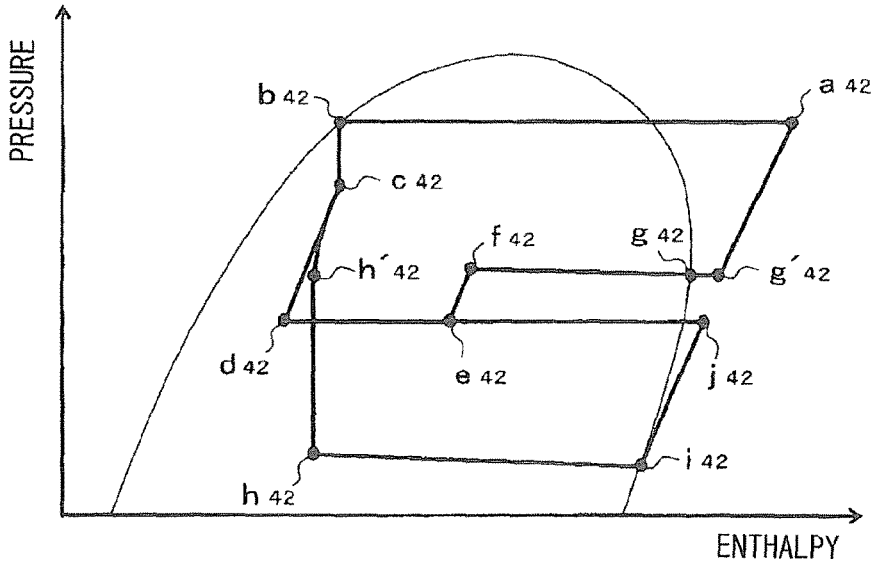
FIG. 59 is a Mollier diagram showing a refrigerant state of the ejector-type refrigeration cycle device of the 32nd embodiment.

In the stage of point h'42→point h42 in FIG. 59, the refrigerant passing through the fixed throttle 19 is decompressed and expanded in iso-enthalpy. The reason is follows. That is, when the refrigerant passing through the fixed throttle 19 reaches the point h'42, the refrigerant is cooled to a temperature corresponding to the suction refrigerant of the first compression mechanism 11*a*, and thereafter heat exchange is not performed in the inner heat exchanger 35. Other operation is similar to that of the 11th embodiment.

Thus, even in the structure of the present embodiment, the same effects as in (A) to (F) of the 11th embodiment can be obtained. Furthermore, by the operation of the inner heat exchanger 35, the enthalpy difference between the enthalpies of the refrigerant at the refrigerant inlet side and the refrigerant outlet side can be enlarged in the discharge side evaporator 14 and in the suction side evaporator 16, thereby further improving the COP.

(33rd Embodiment)

Figure 60:
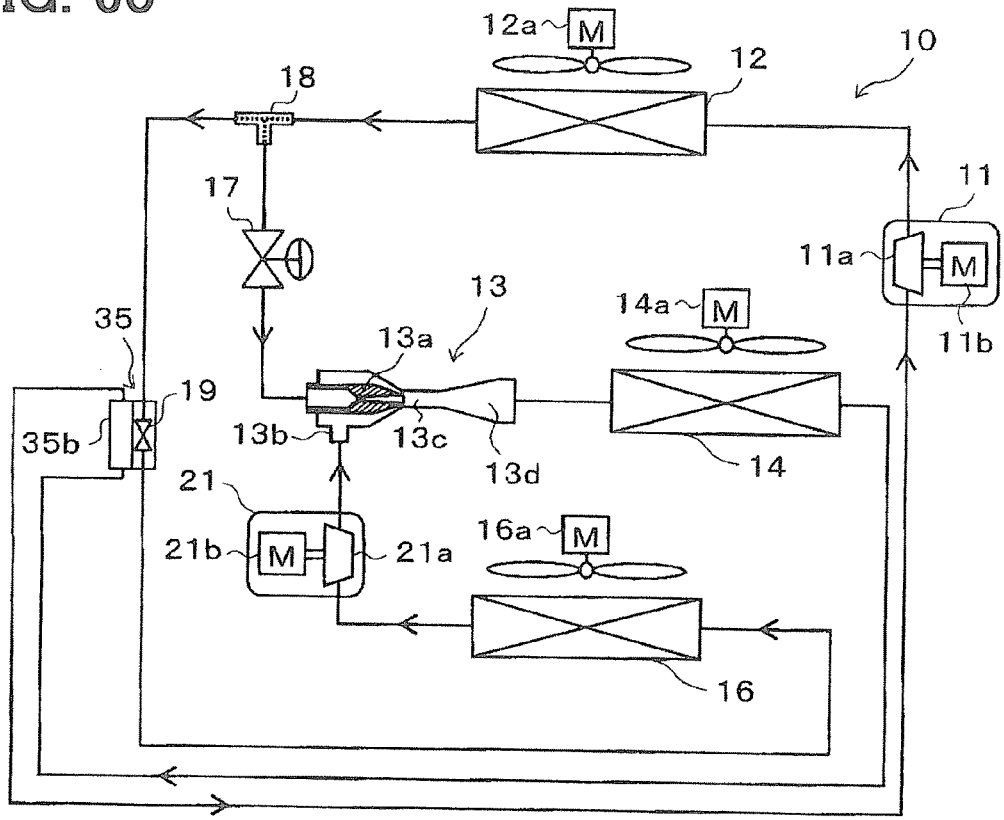
FIG. 60 is an entire schematic diagram of an ejector-type refrigeration cycle device of 33rd embodiment.

In the present embodiment, as in the entire schematic diagram of FIG. 60, an inner heat exchanger 35 is added with respect to the ejector-type refrigeration cycle device 10 of the 12th embodiment. Other configurations in the present embodiment are similar to those of the 12th embodiment.

Figure 61:
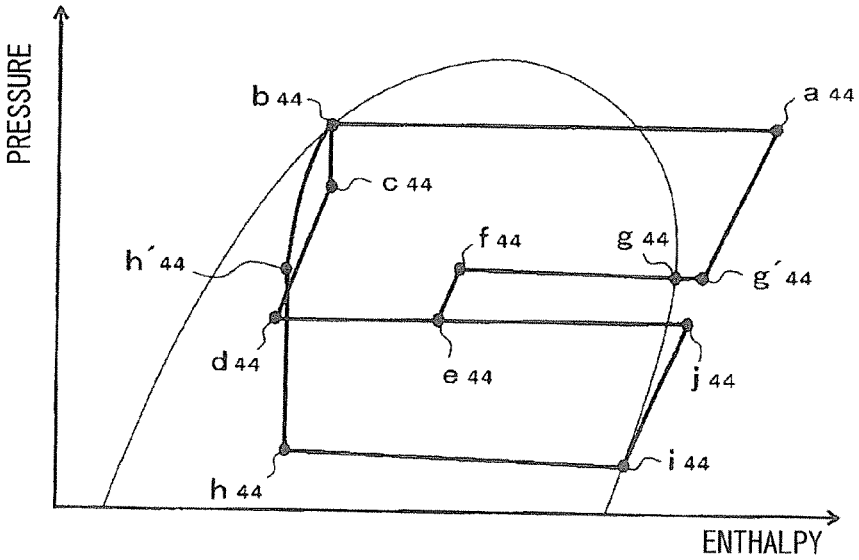
FIG. 61 is a Mollier diagram showing a refrigerant state of the ejector-type refrigeration cycle device of the 33rd embodiment.

When the ejector-type refrigeration cycle device 10 of the present embodiment is operated, as in the Mollier diagram of FIG. 61, the enthalpy of the suction side refrigerant of the first compression mechanism 11*a* is increased (point g44→point g'44 in FIG. 61), and the enthalpy of the refrigerant of the decompression and expansion stage in the fixed throttle 19 is decreased (point b44→point h'44 in FIG. 61), by the operation of the inner heat exchanger 35.

Therefore, in the ejector-type refrigeration cycle device 10 of the present embodiment, the enthalpy of the refrigerant flowing into the discharge side evaporator 14 and the suction side evaporator 16 can be decreased with respect to the 12th embodiment. Other operation is similar to that of the 12th embodiment. Thus, even in the structure of the present embodiment, the same effects as in the 32nd embodiment can be obtained. Furthermore, improvement in the COP can be obtained similarly to the 12th embodiment.

(34th Embodiment)

Figure 62:
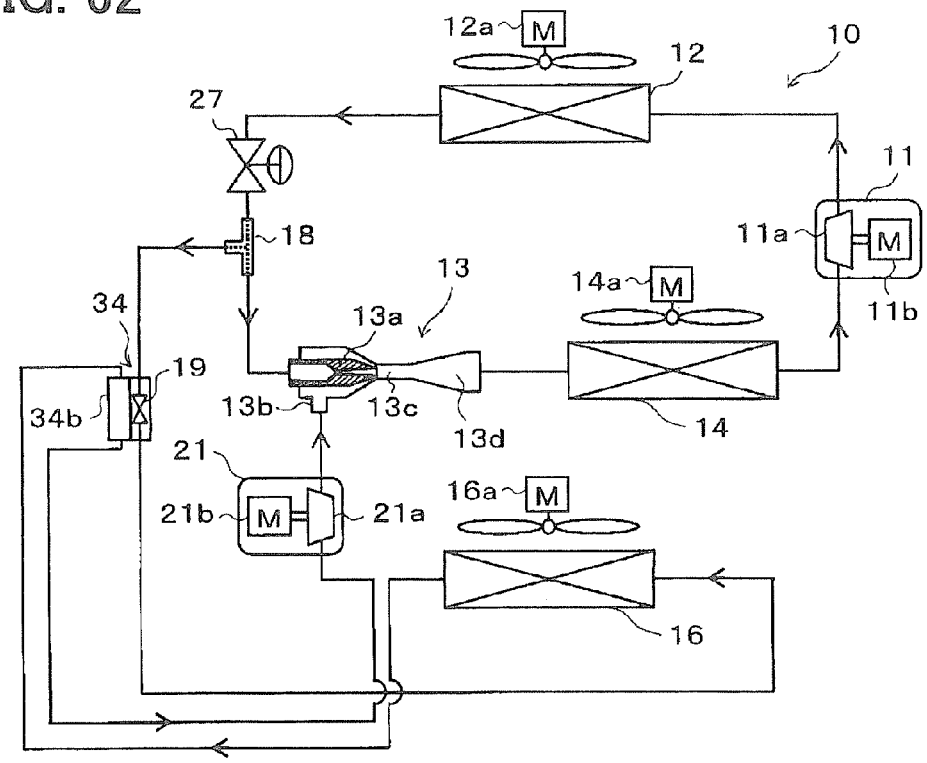
FIG. 62 is an entire schematic diagram of an ejector-type refrigeration cycle device of 34th embodiment.

In the present embodiment, as in the entire schematic diagram of FIG. 62, the thermal expansion valve 17 is removed and a pressure control valve 27 is used with respect to the ejector-type refrigeration cycle device 10 of the 30th embodiment, and carbon dioxide is used as the refrigerant similarly to the 16th embodiment thereby configuring a super-critical refrigerant cycle.

The pressure control valve 27 is a high-pressure side decompression means for decompressing and expanding high-pressure refrigerant flowing out of the radiator 12, and is a pressure control means for.adjusting a valve open degree (throttle open degree) using a mechanical mechanism so that the high-pressure side refrigerant pressure becomes in a target high pressure.

More specifically, the pressure control valve 27 has a temperature sensing portion located at a refrigerant outlet side of the radiator 12, and is configured to generate a pressure corresponding to the temperature of the high-pressure refrigerant at the refrigerant outlet side of the radiator 12 within the temperature sensing portion, so as to adjust the valve open degree by the balance between the inner pressure of the temperature sensing portion and the refrigerant pressure at the refrigerant outlet side of the radiator 12. The target high pressure is a value determined such that the COP becomes approximately in maximum based on the refrigerant temperature at the refrigerant outlet side of the radiator 12.

Next, operation of the ejector-type refrigeration cycle device 10 of the present embodiment will be described with reference to the Mollier diagram of FIG. 63. When the ejector-type refrigeration cycle device 10 of the present embodiment is operated, the refrigerant discharged from the first compressor 11 is cooled in the radiator 12. At this time, the refrigerant passing through the radiator 12 is cooled in a super-critical state without being condensed (point a46→point b46 of FIG. 63)

Figure 63:
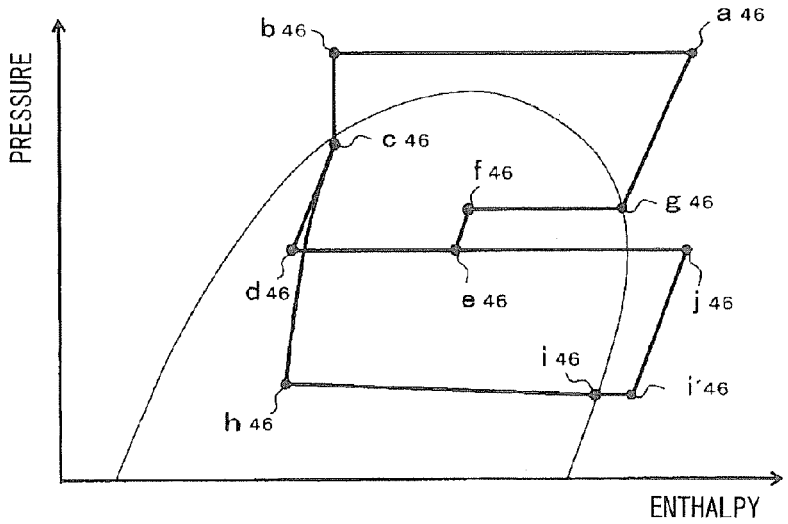
FIG. 63 is a Mollier diagram showing a refrigerant state of the ejector-type refrigeration cycle device of the 34th embodiment.

Furthermore, the refrigerant flowing out of the radiator 12 flows into the pressure control valve 27, and is decompressed and expanded in iso-enthalpy to become in a gas-liquid two-phase state (point b46→point c46 in FIG. 63). The high-pressure side refrigerant pressure is adjusted by the pressure control valve 27, to be approached to the target high pressure that is determined such that the COP becomes approximately in maximum.

The refrigerant flowing into the nozzle portion 13*a* of the ejector 13 from the branch portion 18 is decompressed and expanded by the nozzle portion 13*a* in iso-entropy (point c46→point d46 in FIG. 63). On the other hand, high-pressure refrigerant flowing from the branch portion 18 toward the side of the refrigerant suction port 13*b* reduces its enthalpy while being decompressed and expanded by the fixed throttle 19 (point c46→point h46 in FIG. 63). Other operation is similar to that of the 30th embodiment.

Thus, even in the structure of the present embodiment, the same effects as in (A) to (F) of the 11th embodiment can be obtained. Furthermore, improvement in the COP, due to the inner heat exchanger 34, can be obtained similarly to 30th embodiment. In the present embodiment, the pressure control valve 27 may be arranged in a refrigerant passage from the refrigerant outlet side of the branch portion 18 to the refrigerant inlet of the nozzle portion 13*a*.

(35th Embodiment)

Figure 64:
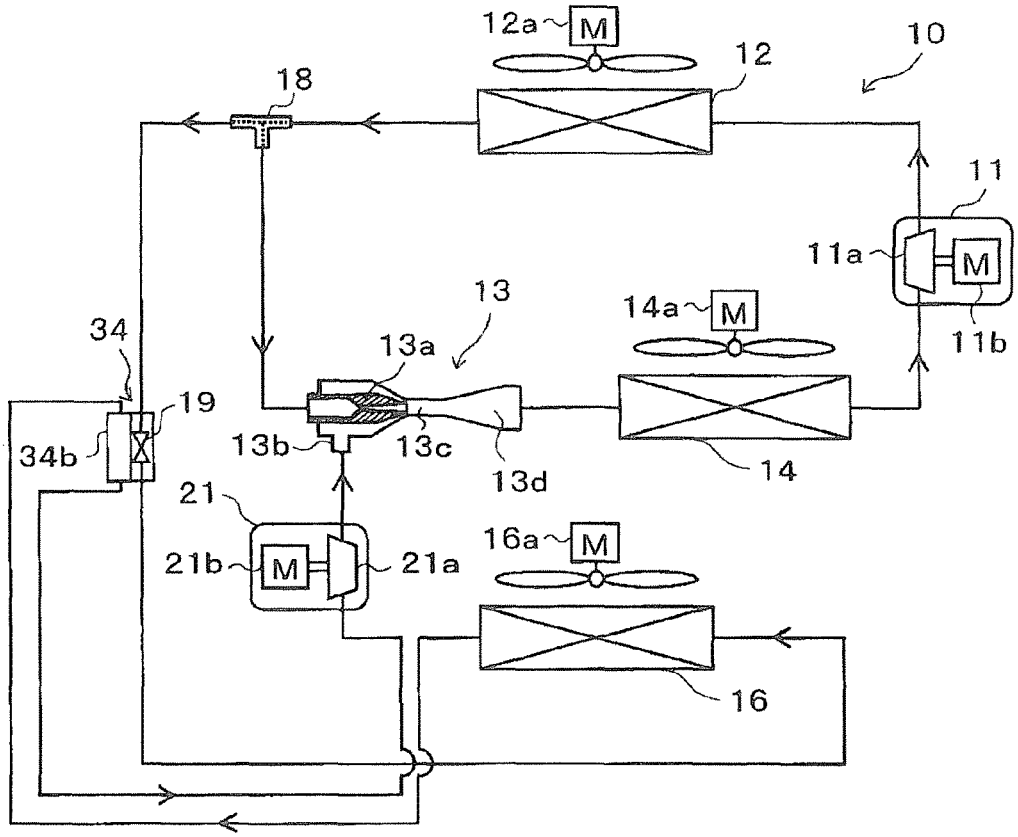
FIG. 64 is an entire schematic diagram of an ejector-type refrigeration cycle device of 35th embodiment.

In the present embodiment, as in the entire schematic diagram of FIG. 64, the pressure control valve 27 is removed with respect to the ejector-type refrigeration cycle device 10 of the 34th embodiment. Other configurations in the present embodiment are similar to those of the 34th embodiment. In the ejector-type refrigeration cycle device 10 of the present embodiment, the super-critical refrigerant radiated in the radiator 12 is branched in the branch portion 18 (point b48 in FIG. 65), as in the Mollier diagram of FIG. 65.

Figure 65:
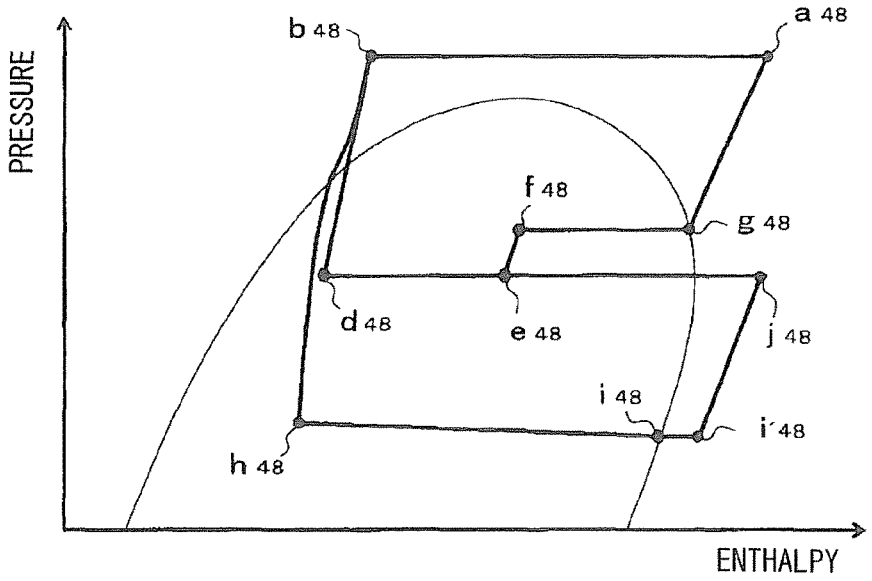
FIG. 65 is a Mollier diagram showing a refrigerant state of the ejector-type refrigeration cycle device of the 35th embodiment.

The high-pressure refrigerant flowing into the nozzle portion 13*a* of the ejector 13 from the branch portion 18 is decompressed and expanded by the nozzle portion 13*a* in iso-entropy (point b48→point d48 in FIG. 65). On the other hand, high-pressure refrigerant flowing from the branch portion 18 toward the side of the refrigerant suction port 13*b* reduces its enthalpy while being decompressed and expanded by the fixed throttle 19 (point b48→point h48 in FIG. 65). Other operation is similar to that of the 30th embodiment.

Thus, even in the structure of the present embodiment, the same effects as in (A) to (D) of the 11th embodiment can be obtained. Furthermore, improvement in the COP, due to the inner heat exchanger 34, can be obtained similarly to 30th embodiment.

(36th Embodiment)

Figure 66:
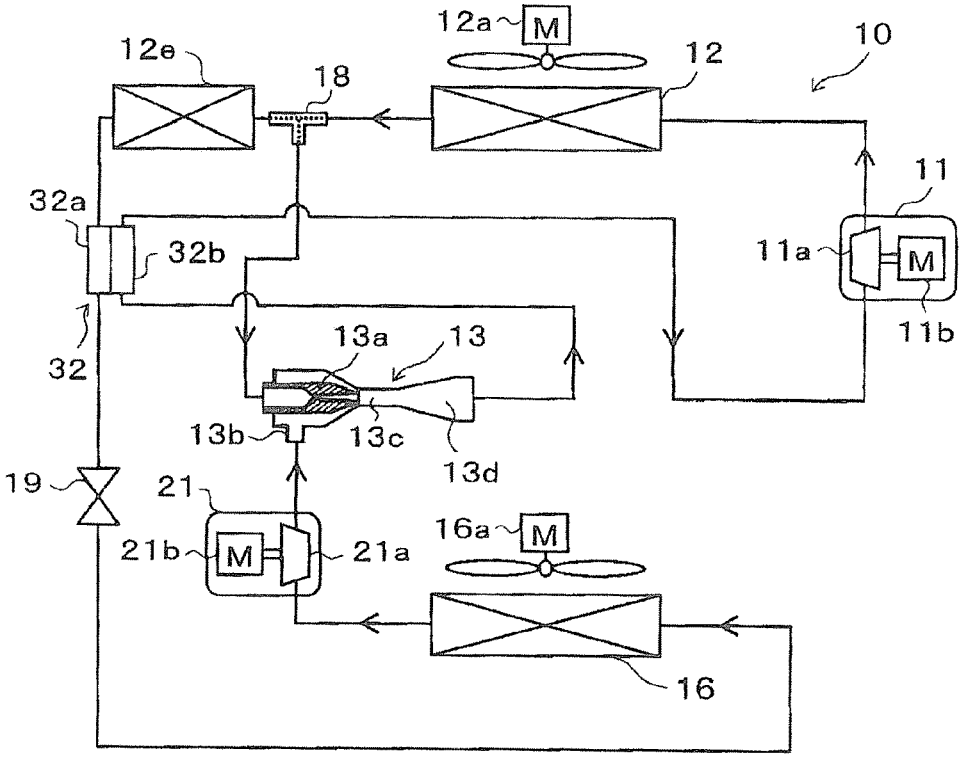
FIG. 66 is an entire schematic diagram of an ejector-type refrigeration cycle device of 36th embodiment.

In the present embodiment, as in the entire schematic diagram of FIG. 66, an inner heat exchanger 32 similar to the 19th embodiment is added, and the discharge side evaporator 14 and the blower fan 14*a* are removed, with respect to the ejector-typerefrigeration cycle device 10 of the 23rd embodiment.

The inner heat exchanger 32 is adapted to perform heat exchange between the refrigerant flowing in a refrigerant passage from the refrigerant outlet side of the auxiliary radiator 12*e* to the inlet side of the fixed throttle 19 among the high-pressure side refrigerant flowing through a refrigerant passage from the outlet side of the branch portion 18 to the refrigerant inlet side of the fixed throttle 19, and the refrigerant flowing out of the diffuser portion 13*d* to be drawn to the first compression mechanism 11*a*. Other configurations in the present embodiment are similar to those of the 23rd embodiment.

Figure 67:
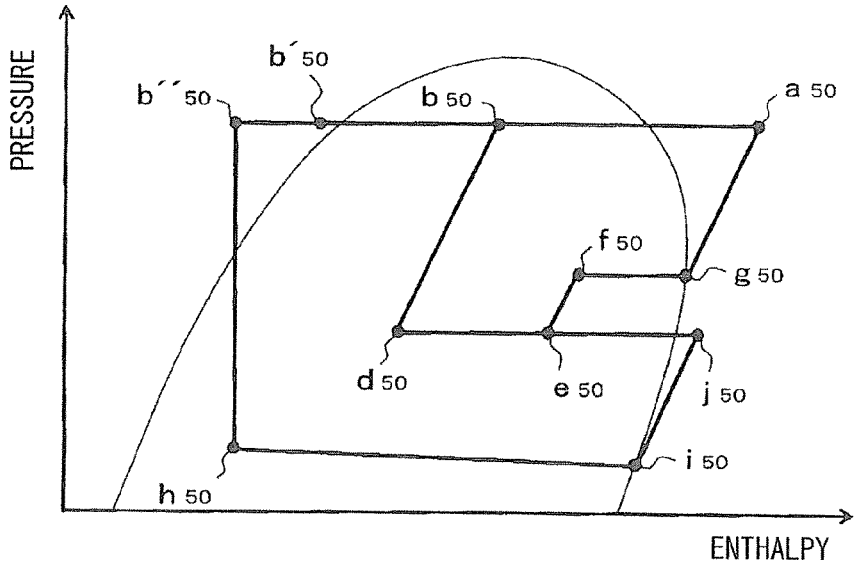
FIG. 67 is a Mollier diagram showing a refrigerant state of the ejector-type refrigeration cycle device of the 36th embodiment.

When the ejector-type refrigeration cycle device 10 of the present embodiment is operated, the refrigerant flowing out of the diffuser portion 13*d* is evaporated in the low-pressure side refrigerant passage 32*b* of the inner heat exchanger 32, and the enthalpy of the suction side refrigerant of the first compression mechanism 11*a* is increased (point f50→point g50 in FIG. 67), by the operation of the inner heat exchanger 32, as in the Mollier diagram of FIG. 67. Furthermore, the enthalpy of the refrigerant flowing out of the auxiliary radiator 12*e* decreases (point b'50→point b"50 in FIG. 67).

Other operation is similar to that of the 23rd embodiment. Thus, in the present embodiment, cooling action can exist in the suction side evaporator 16, and the same effects as in (B)-(D) in the 11th embodiment can be obtained.

Thus, similarly to the 23rd embodiment, the enthalpy of the refrigerant flowing into the nozzle portion 13*a* is not unnecessary reduced, and thereby the COP improvement can be obtained. Furthermore, the COP can be further improved by reducing the enthalpy of the refrigerant flowing into the suction side evaporator 16. Furthermore, improvement in the COP, due to the inner heat exchanger 32, can be obtained similarly to 19th embodiment.

(37th Embodiment)

Figure 68:
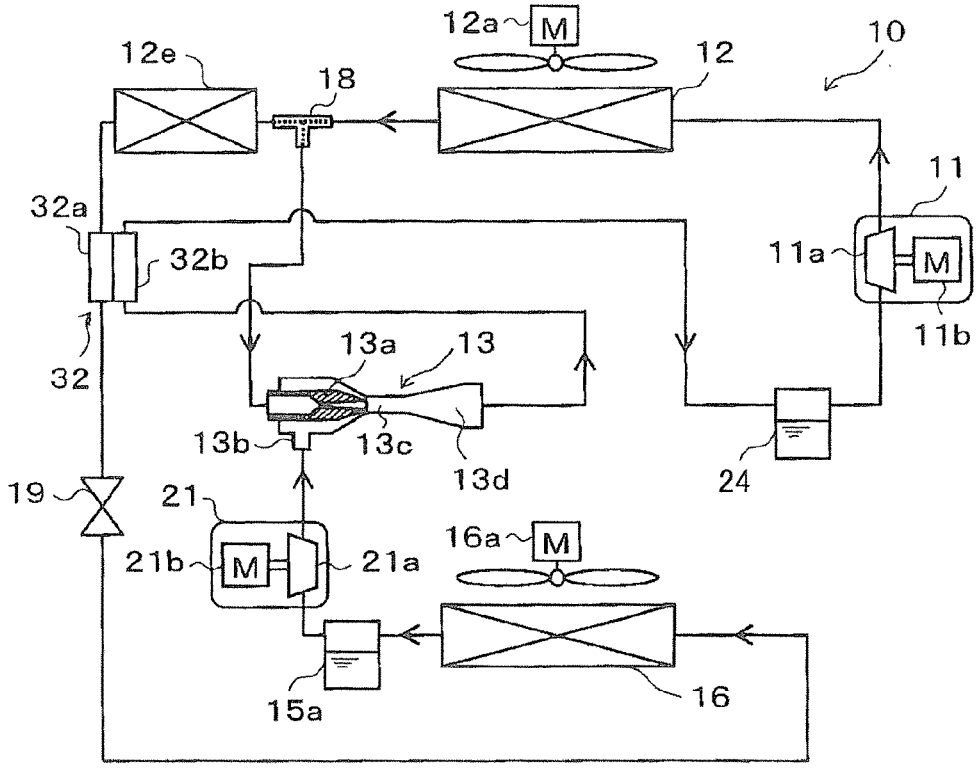
FIG. 68 is an entire schematic diagram of an ejector-type refrigeration cycle device of 37th embodiment.

In the present embodiment, as in the entire schematic diagram of FIG. 68, an accumulator 24 and a suction-side gas-liquid separator 15*a* similar to the 17th embodiment are added with respect to the ejector-type refrigeration cycle device 10 of the 36th embodiment.

The suction-side gas-liquid separator 15*a* is a gas-liquid separator in which the refrigerant flowing out of the suction side evaporator 16 is separated into gas refrigerant and liquid refrigerant, and surplus liquid refrigerant in the cycle is stored therein. A refrigerant suction port of the second compressor 21 is connected to a gas- refrigerant outlet of the suction-side gas-liquid separator 15*a*. Other configurations in the present embodiment are similar to those of the 36th embodiment.

Thus, when the ejector-type refrigeration cycle device 10 of the present embodiment is operated, it is operated similarly to the 36th embodiment so that cooling action can be obtained in the suction side evaporator 16, and thereby the same effects as in (B) and (C) of the 11th embodiment can be obtained and the COP can be improved similarly to the 36th embodiment.

Furthermore, it can prevent the problem of the liquid compression in both the first compressor 11 and the second compressor 21, by the action of the accumulator 24 and the suction-side gas-liquid separator 15*a*. In the present embodiment, both the accumulator 24 and the suction-side gas-liquid separator 15*a* are provided; however, any one of the accumulator 24 and the suction-side gas-liquid separator 15*a* may be provided.

(38th Embodiment)

Figure 69:
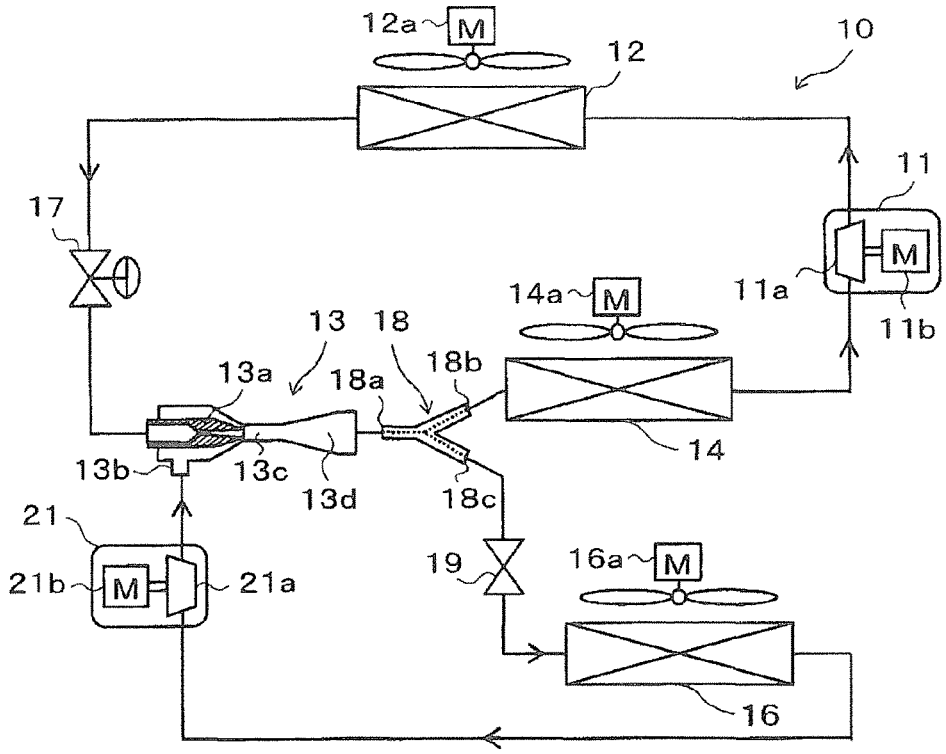
FIG. 69 is an entire schematic diagram of an ejector-type refrigeration cycle device of 38th embodiment.

An ejector-type refrigeration cycle device of the present invention adapted to a freezing/refrigeration device will be described with reference to FIGS. 69 and 70. The freezing/refrigeration device is for cooling a refrigerating room that is a space to be cooled, to a low temperature such as in a range between 0° C. and 10° C., and is for cooling a freezing room that is another space to be cooled, to an extremely low temperature such as in a range between −30° C. and −10° C. FIG. 69 is an entire schematic diagram of the ejector-type refrigeration cycle device 10 of the present embodiment.

In the ejector-type refrigeration cycle device 10, the first compressor 11 is configured to draw refrigerant, to compress the drawn refrigerant, and to discharge the compressed refrigerant. For example, the first compressor 11 is an electrical compressor in which the first compression mechanism 11*a* having a fixed displacement is driven by the first electrical motor 11*b*. As the first compression mechanism 11*a*, various compression mechanisms such as a scroll type compression mechanism, a vane type compression mechanism and the like can be used, for example.

The operation (e.g., rotational speed) of the first electrical motor 11*b* is controlled by using control signals output from a control device described later. As the first electrical motor 11*b*, an AC motor or a DC motor may be used. By controlling the rotational speed of the first electrical motor 11*b*, the refrigerant discharge capacity of the first compression mechanism 11*a* can be changed. Thus, in the present embodiment, the first electrical motor 11*b* can be used as a first discharge capacity changing means for changing the discharge capacity of the refrigerant of the first compression mechanism 11*a*.

The refrigerant radiator 12 is disposed on the refrigerant discharge side of the first compressor 11. The radiator 12 exchanges heat between high-pressure refrigerant discharged from the first compressor 11 and outside air (i.e., air outside the room) blown by the cooling fan 12*a* to cool the high-pressure refrigerant. The rotation speed of the cooling fan 12*a* is controlled by a control voltage output from the control device so as to control an air blowing amount from the cooling fan 12*a*.

In the present embodiment, a flon-based refrigerant is used as the refrigerant for a refrigerant cycle of the ejector-type refrigeration cycle device 10 to form a vapor-compression subcritical refrigerant cycle in which a refrigerant pressure on the high-pressure side does not exceed the critical pressure of the refrigerant. Thus, the radiator 12 serves as a condenser for cooling and condensing the refrigerant.

A receiver (i.e., liquid receiver) may be provided at a refrigerant outlet side of the radiator 12, to be used as a high-pressure side gas-liquid separator in which the refrigerant flowing out of the radiator 12 is separated into gas refrigerant and liquid refrigerant, and liquid refrigerant is stored as surplus refrigerant. Furthermore, the saturated liquid refrigerant separated from the receiver is introduced to a downstream side.

The thermal expansion valve 17 is connected to a refrigerant outlet side of the radiator 12, as a high-pressure side decompression means for decompressing and expanding high-pressure refrigerant flowing out of the radiator 12.

The thermal expansion valve 17 has a temperature sensing portion (not shown) arranged in a refrigerant passage at a refrigerant outlet side of a discharge side evaporator 14. The thermal expansion valve 17 is a variable throttle mechanism, in which a super-heat degree of the refrigerant at the refrigerant outlet side of the discharge side evaporator 14 is detected based on temperature and pressure of the refrigerant at the refrigerant outlet side of the discharge side evaporator 14, and its valve-open degree (refrigerant flow amount) is adjusted by using a mechanical mechanism so that the super-heat degree of the refrigerant at the refrigerant outlet side of the discharge side evaporator 14 is approached to a predetermined value.

The refrigerant outlet side of the thermal expansion valve 17 is connected to a refrigerant inlet side of the nozzle portion 13*a* of the ejector 13. The ejector 13 is used as a refrigerant decompression means for decompressing and expanding the refrigerant, and as a refrigerant circulation means for circulating the refrigerant by the suction action of a high-speed refrigerant flow jetted from the nozzle portion 13*a*.

More specifically, the ejector 13 includes the nozzle portion 13*a*, in which the passage sectional area is throttled so that middle pressure refrigerant flowing out of the thermal expansion valve 17 is decompressed and expanded in isoentropy in the nozzle portion 13*a*. The refrigerant suction port 13*b* is provided to communicate with a space in the ejector 13, where the refrigerant jet port of the nozzle portion 13*a* is provided, so as to draw the refrigerant discharged from the second compressor 21 described latter.

The mixing portion 13*c* is provided in the ejector 13 on a downstream side of the nozzle portion 13*a* and the refrigerant suction port 13*b* in the refrigerant flow, so as to mix the high-velocity refrigerant flow jetted from the nozzle portion 13*a* with the suction refrigerant drawn from the refrigerant suction port 13*b*. The diffuser portion 13*d* is provided in the ejector 13 downstream of the mixing portion 13*c* in a refrigerant flow so as to increase the refrigerant pressure in the diffuser portion 13*d*.

The diffuser portion 13*d* is formed in such a shape to gradually increase the passage sectional area of the refrigerant, and has an effect of reducing the velocity of the refrigerant flow so as to increase the refrigerant pressure. That is, the diffuser portion 13*d* has an effect of converting the speed energy of the refrigerant to the pressure energy of the refrigerant. A branch portion 18 for branching the flow of the refrigerant flowing out of the diffuser portion 13*d* is connected to the outlet side of the diffuser portion 13*d*.

For example, the branch portion 18 is a three-way joint member having three ports that are used as one refrigerant inlet 18*a* and two refrigerant outlets 18*b*, 18*c*. The three-way joint member used as the branch portion 18 may be configured by bonding pipes having different pipe diameters, or may be configured by providing plural refrigerant passages in a metal block member or a resin block member.

The branch portion 18 of the present embodiment is formed approximately into a Y-shape, such that a flow direction of the refrigerant flowing from one refrigerant outlet 18*b* toward the discharge side evaporator 14 and a flow direction of the refrigerant flowing from the other refrigerant outlet 18*c* toward the fixed throttle 19 are symmetric with respect to the flow direction of the refrigerant flowing from the outlet side of the diffuser portion 13*d* to the refrigerant inlet 18*a*, and are joined with each other by an acute angle.

Thus, when the refrigerant flowing into the branch portion 18 is branched therein, the refrigerant flows out of the branch portion 18 without indecisively reducing the flow speed of the refrigerant. Therefore, the flow velocity (dynamic pressure) of the refrigerant flowing out of the ejector 13 can be maintained in the branch portion 18. The branch portion 18 is not limited to the above shape, and may be formed approximately into a T-shape or the like.

The discharge side evaporator 14 is a heat-absorbing heat exchanger, in which refrigerant flowing out of the diffuser portion 13*d* of the ejector 13 is evaporated by heat-exchanging with air inside the refrigerating room, blown by the blower fan 14*a*, so as to provide heat-absorbing action. Thus, a fluid to be heat-exchanged with the refrigerant in the discharge side evaporator 14 is the air in the refrigerating room of the freezing/refrigerating device.

The blower fan 14*a* is an electrical blower, in which rotation speed (air blowing amount) of the blower fan 14*a* is controlled by a control voltage output from the control device. A refrigerant suction port of the first compressor 11 is connected to a refrigerant outlet side of the discharge side evaporator 14.

Furthermore, the suction side evaporator 16 is connected to the refrigerant outlet 18*c* of the branch portion 18 via a fixed throttle 19. The fixed throttle 19 is a suction side decompression means adapted to decompress and expand a middle-pressure refrigerant flowing out of the branch portion 18. As the fixed throttle 19, a capillary tube, an orifice or the like can be used.

The suction side evaporator 16 is configured to perform heat exchange between low-pressure refrigerant decompressed and expanded at the fixed throttle 19 and interior air of the freezing room blown by the blower fan 16*a*, and is used as a heat-absorbing heat exchanger in which low-pressure refrigerant is evaporated so as to exert heat-absorbing action. Thus, a fluid to be heat-exchanged with the refrigerant in the suction side evaporator 16 is the air in the refrigerating room. The blower fan 16*a* is an electrical blower, in which rotation speed (air blowing amount) of the blower fan 16*a* is controlled by a control voltage output from the control device.

A refrigerant suction port of the second compressor 21 is connected to a refrigerant outlet side of the suction side evaporator 16. The basic structure of the second compressor 21 is similar to that of the first compressor 11. Thus, the second compressor 21 is an electrical compressor, in which a fixed-displacement type second compression mechanism 21*a* is driven by a second electrical motor 21*b*. The second electrical motor 21*b* of the present embodiment is used as a second discharge capacity changing means for changing a refrigerant discharge capacity of the second compression mechanism 21*a*.

The refrigerant suction port 13*b* of the ejector 13 is connected to a refrigerant discharge port of the second compressor 21.

The control device (not shown) is constructed of a generally-known microcomputer including CPU, ROM and RAM and the like, and its circumferential circuits. The control device performs various calculations and processes based on a control program stored in the ROM, and controls operation of various electrical actuators 11*b*, 12*b*, 14*a*, 16*a*, 21*a* or the like.

The control device includes a function portion as the first discharge-capacity control means which controls the operation of the first electrical motor 11*b* that is a first discharge capacity changing means, and a function portion as the second discharge-capacity control means which controls the operation of the second electrical motor 21*b* that is a second discharge capacity changing means. The first discharge-capacity control means and the second discharge-capacity control means may be configured by different control devices, respectively.

Into the control device, detection values from a sensor group (not shown) including an outside air sensor for detecting an outside air temperature, an inside temperature sensor for detecting an interior temperature of the refrigerating room and an interior temperature of the freezing room, and various operation signals from an operation panel (not shown) in which an operation switch for operating the refrigerator and the like are provided are input.

Next, operation of the present embodiment with the above structure will be described based on the Mollier diagram shown in FIG. 70. When the operation switch of the operation panel is turned on, the control device causes the first and second electrical motors 11*b*, 21*b*, the cooling fan 12*a*, the blower fans 14*a*, 16*a* to be operated. Thus, the first compressor 11 draws refrigerant, compresses the drawn refrigerant, and discharges the compressed refrigerant. The state of the refrigerant at this time is point a2 of FIG. 70.

Figure 70:
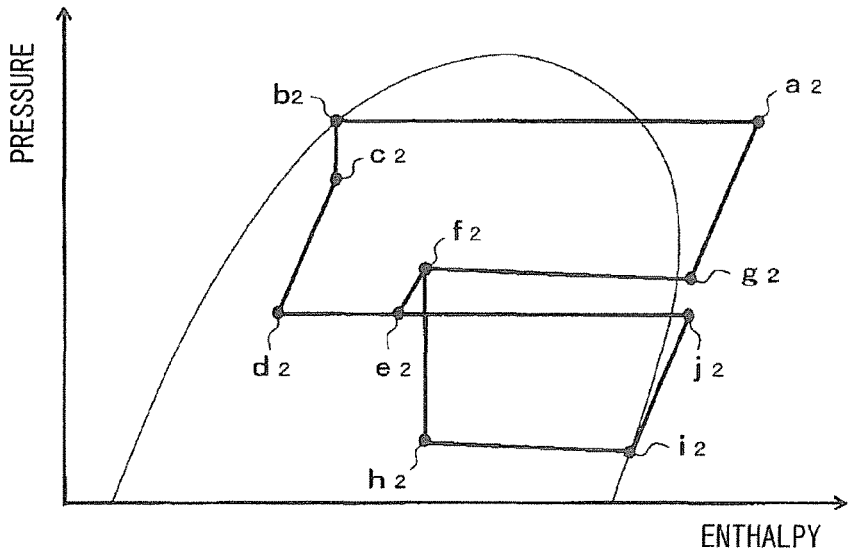
FIG. 70 is a Mollier diagram showing a refrigerant state of the ejector-type refrigeration cycle device of the 38th embodiment.

High-temperature and high-pressure refrigerant discharged from the first compressor 11 flows into the radiator 12, and is heat-exchanged with the blown air (outside air)

blown by the cooling fan 12*a* to be radiated and condensed (point a2→point b2 in FIG. 70). Furthermore, the refrigerant flowing out of the radiator 12 flows into the thermal expansion valve 17, and is decompressed and expanded in iso-enthalpy to become in a gas-liquid two-phase state (point b2→point c2 in FIG. 70).

At this time, the valve open degree of the thermal expansion valve 17 is adjusted so that a super heat degree (point g2 in FIG. 70) of the refrigerant at the refrigerant outlet side of the discharge side evaporator 14 becomes a predetermined value. The middle refrigerant flowing out of the thermal expansion valve 17 flows into the nozzle portion 13*a* of the ejector 13, and is decompressed and expanded by the nozzle portion 13*a* in iso-entropy (point c2→point d2 in FIG. 70).

In the decompression and expansion of the nozzle portion 13*a*, the pressure energy of the refrigerant is converted to the speed energy of the refrigerant, and the refrigerant is jetted with a high speed from the refrigerant jet port of the nozzle portion 13*a*. Thus, the refrigerant discharged from the second compressor 21 is drawn into the ejector 13 from the refrigerant suction port 13*b* of the ejector 13, by the refrigerant suction action of the jet refrigerant (point j2→point e2 in FIG. 70).

Furthermore, the jet refrigerant jetted from the nozzle portion 13*a* and the suction refrigerant drawn from the refrigerant suction port 13*b* are mixed in the mixing portion 13*c* of the ejector 13, and flows into the diffuser portion 13*d* of the ejector 13 (point d2→point e2 in FIG. 70). That is, passage sectional area is enlarged in the diffuser portion 13*d* as toward downstream so that the speed energy of the refrigerant is converted to the pressure energy thereof, thereby increasing the pressure of the refrigerant (point e2→point f2 in FIG. 70).

The refrigerant flowing out of the diffuser portion 13*d* flows into the branch portion 18, and is branched by the branch portion 18 into a flow of the refrigerant flowing toward the discharge side evaporator 14 and a flow of the refrigerant flowing toward the fixed throttle 19. In the present embodiment, the refrigerant passage area of the refrigerant outlet 18*b* of the branch portion 18 is set larger than the refrigerant passage area of the refrigerant outlet 18*c*, so that a refrigerant flow amount G1 flowing into the discharge side evaporator 14 becomes larger than a refrigerant flow amount G2 flowing into the fixed throttle 19.

The refrigerant flowing from the branch portion 18 into the discharge side evaporator 14 is evaporated by absorbing heat from air inside of the refrigerating room, blown by the blower fan 14*a* (point f2→point g2 in FIG. 70). Thus, the air blown into the interior of the refrigerating room is cooled. The gas refrigerant flowing out of the discharge side evaporator 14 is drawn into the first compressor 11, and is compressed again (point g2→point a2 in FIG. 70).

On the other hand, the refrigerant flowing from the branch portion 18 into the fixed throttle 19 is decompressed and expanded in iso-enthalpy at the fixed throttle 19, thereby reducing the refrigerant pressure (point c2→point h2 in FIG. 70). The refrigerant decompressed and expanded at the fixed throttle 19 flows into the suction side evaporator 16, and is evaporated by absorbing heat from air inside of the freezing room, blown by the blower fan 16*a* (point h2→point i2 in FIG. 70). Thus, the air blown into the interior of the freezing room is cooled.

The gas refrigerant flowing out of the suction side evaporator 16 is drawn into the second compressor 21, and is compressed (point i2→point j2 in FIG. 70). At this time, the control device controls operation of the first and second electrical motors 11*b*, 21*b* such that COP in the entire cycle of the ejector-type refrigeration cycle device is approached approximately to the maximum value. Specifically, pressure increasing amounts in the first and second compression mechanisms 11*a*, 21*a* are controlled to be approximately equal, in order to improve the compression efficiency in the first and second compression mechanisms 11*a*, 21*a*.

When an increase amount of the enthalpy of the refrigerant is ΔH1 in a case where the refrigerant is compressed in iso-entropy in the first and second compressors 11, 21, and when an increase amount of the enthalpy of the refrigerant actually pressurized in the first and second compressors 11, 21 is ΔH2, the compression efficiency is a ratio of ΔH1 to ΔH2.

For example, when the rotation speed or the pressure increasing amount of the first and second compressors 11, 21 is increased, the temperature of the refrigerant is increased by fraction heat of the refrigerant, thereby increasing the actual increase amount ΔH2 of the enthalpy. In this case, the compression efficiency is decreased in the first and second compressors 11, 21.

The refrigerant flowing out of the second compressor 21 is drawn into the ejector 13 from the refrigerant suction port 13*b* (point j2→point e2 in FIG. 70).

The ejector-type refrigeration cycle device 10 of the present embodiment is operated above, and thereby the following excellent effects can be obtained.

(A) Because the flow of the refrigerant is branched in the branch portion 18 so that the refrigerant can be supplied to both the discharge side evaporator 14 and the suction side evaporator 16. Therefore, cooling action can be obtained simultaneously in both the discharge side evaporator 14 and the suction side evaporator 16. At this time, the refrigerant evaporation pressure of the discharge side evaporator 14 becomes in a pressure pressurized by the diffuser portion 13*d*. On the other hand, the refrigerant evaporation pressure of the suction side evaporator 16 is a pressure decompressed by the fixed throttle 19 after being pressurized in the diffuser portion 13*d*.

Thus, the refrigerant evaporation pressure (refrigerant evaporation temperature) of the suction side evaporator 16 can be made lower than the refrigerant evaporation pressure (the refrigerant evaporation temperature) of the discharge side evaporator 14. As a result, the discharge side evaporator 14 can be adapted for cooling the refrigerating room having a low temperature, and the suction side evaporator 16 can be adapted for cooling the freezing room having an extremely low temperature.

(B) In the present embodiment, the second compressor 21 (second compression mechanism 21*a*) is provided. Therefore, for example, even in an operation condition in which a pressure difference between a high-pressure refrigerant and a low pressure refrigerant is decreased thereby decreasing the flow amount of the drive flow of the ejector 13, that is, even in an operation condition in which the suction capacity of the ejector 13 is decreased, the suction capacity of the ejector 13 can be supplemented by the operation of the second compression mechanism 21*a*.

Furthermore, the refrigerant pressure is increased by the pressurizing action in the first and second compression mechanisms 11*a*, 21*a* and in the diffuser portion 13*d* of the ejector 13. Thus, as compared with a case where the refrigerant is pressurized by a single compression mechanism, the driving power of the first and second compression mechanisms 11*a*, 21*a* is reduced thereby improving the COP.

Furthermore, by the pressurizing action of the diffuser portion 13*d*, the suction pressure of the first compression mechanism 11*a* can be increased, thereby reducing the driving power in the first compression mechanism 11*a*. In addition, because the pressure difference between the suction pressure and the discharge pressure in the respective first and second compression mechanisms 11*a*, 21*a* can be reduced, the compression efficiency in the respective first and second compression mechanisms 11*a*, 21*a* can be improved.

In the present embodiment, the refrigerant discharge capacities of the first and second compression mechanisms 11*a*, 21*a* can be respectively independently changed by the first and second electrical motors 11*b*, 21*b*. Thus, the compression efficiency in the first and second compression mechanisms 11*a*, 21*a* can be effectively improved.

As a result, even when a variation in the flow amount of the drive flow is caused thereby reducing the pressurizing capacity of the diffuser portion 13*d*, the ejector-type refrigeration cycle device can be stably operated with a high COP.

Therefore, in a refrigeration cycle device in which the pressure difference between the high pressure refrigerant and the low pressure refrigerant is large, for example, in a refrigeration cycle device in which the refrigerant evaporation temperature of the suction side evaporator 16 is reduced to a very low temperature such as −30° C.--10° C., the effect of the present invention is extremely effective.

(C) In the ejector-type refrigeration cycle device 10 of the present embodiment, the refrigerant flow amount G1 flowing from the branch portion 18 into the discharge side evaporator 14 becomes larger than the refrigerant flow amount G2 flowing from the branch portion 18 into the fixed throttle 19. Therefore, a radiation amount of the refrigerant in the radiator 12 can be increased. Thus, a heat absorbing amount of the refrigerant in the entire cycle, that is, a cooling capacity of the cycle can be enlarged.

(D) As compared with the ejector-type refrigeration cycle device of the patent document 1, an accumulator as a discharge-side gas-liquid separator can be removed from the refrigerant suction side of the first compressor 11. Thus, the product cost in the entire of the ejector-type refrigeration cycle device 10 can be reduced.

(E) In addition, in the present embodiment, because the thermal expansion valve 17 that is a variable throttle mechanism is used as the high-pressure side decompression means, the refrigerant flow amount flowing into the nozzle portion 13*a* of the ejector 13 can be varied in accordance with a load variation in the refrigerant cycle. As a result, even if load fluctuation arises, the ejector-type refrigeration cycle device can be operated while having a high COP.

(F) Because the refrigerant decompressed by the thermal expansion valve 17 is in the gas-liquid two-phase state (point c2 in FIG. 70), gas-liquid two-phase refrigerant can flow into the nozzle portion 13*a* of the ejector 13.

Thus, it is compared with a case where the liquid refrigerant flows into the nozzle portion 13*a*, boiling of the refrigerant in the nozzle portion 13*a* can be facilitated, thereby improving the nozzle efficiency. Thus, the recovery energy amount in the nozzle portion 13*a* is increased, and a pressure increasing amount is increased in the diffuser portion 13*d*, thereby improving the COP.

Furthermore, it is compared with the case where the liquid refrigerant flows into the nozzle portion 13*a*, the refrigerant passage area of the nozzle portion 13*a* can be enlarged, and thereby the processing of the nozzle portion 13*a* can be made easy. As a result, the product cost of the ejector 13 can be decreased, thereby reducing the product cost in the entire of the ejector-type refrigeration cycle device 10.

(39th Embodiment)

Figure 71:
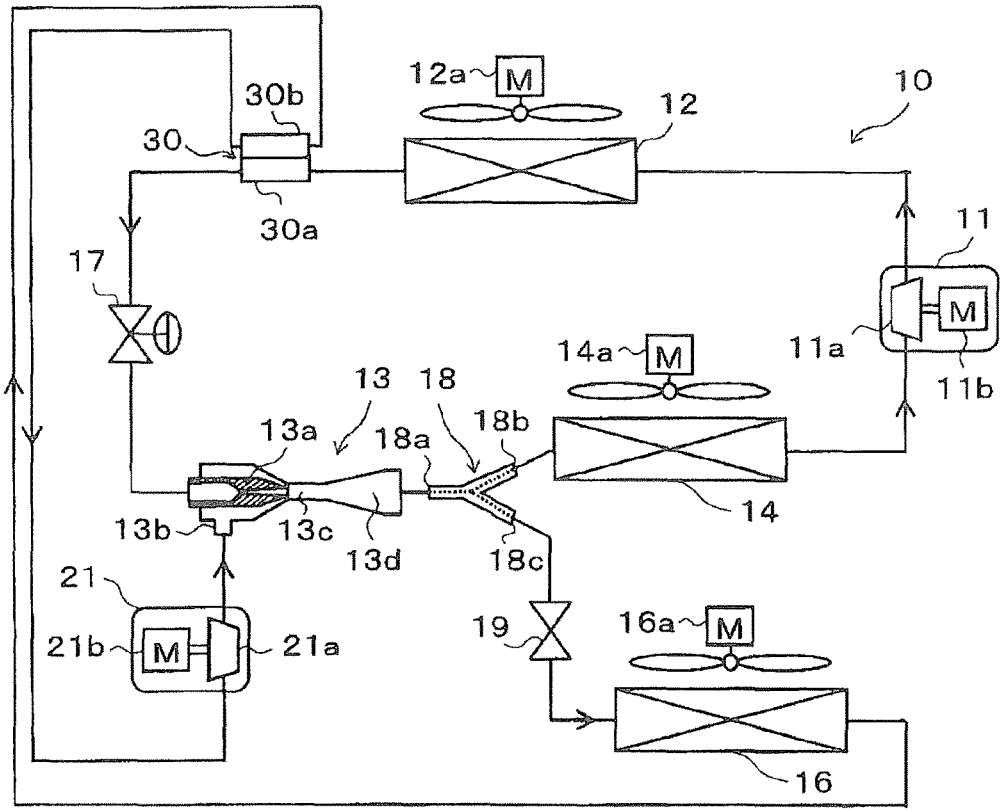
FIG. 71 is an entire schematic diagram of an ejector-type refrigeration cycle device of 39th embodiment.

In the present embodiment, as in the entire schematic diagram of FIG. 71, an inner heat exchanger 30, in which the refrigerant flowing out of the radiator 12 and a low-pressure side refrigerant in the cycle are heat exchanged, is added with respect to the ejector-type refrigeration cycle device 10 of the 38th embodiment. In FIG. 71, parts similar to or corresponding to those of the 38th embodiment are indicated by the same reference numbers. This is the same also in the following drawings.

The inner heat exchanger 30 is for performing heat exchange between refrigerant flowing through a high-pressure side refrigerant passage 30*a* from the radiator 12, and a low-pressure side refrigerant flowing through a low-pressure side refrigerant passage 30*b*. More specifically, the low-pressure side refrigerant in the cycle of the present embodiment is the refrigerant to be drawn into the second compression mechanism 21*a*.

As a special structure of the inner heat exchanger 30, a double-pipe heat exchange structure may be used, in which an inner pipe forming a low-pressure side refrigerant passage 30*b* is provided inside of an outer pipe forming a high-pressure side refrigerant passage 30*a*. The high-pressure side refrigerant passage 30*a* may be provided as the inner pipe, and the low-pressure side refrigerant passage 30*b* may be provided as the outer pipe.

Furthermore, refrigerant pipes for defining the high-pressure side refrigerant passage 30*a* and the low-pressure side refrigerant passage 30*b* maybe bonded by brazing to have a heat exchange structure. Other configurations in the present embodiment are similar to those of the 38th embodiment.

Figure 72:
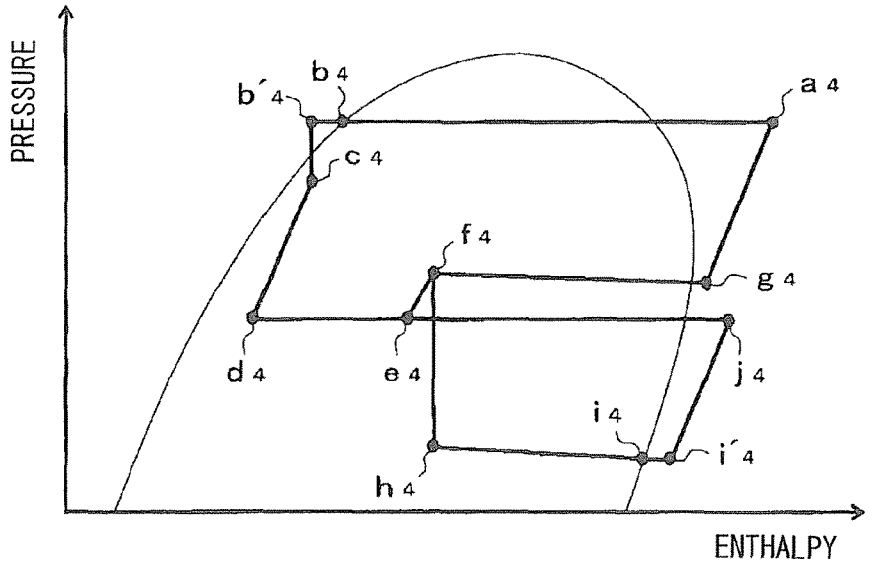
FIG. 72 is a Mollier diagram showing a refrigerant state of the ejector-type refrigeration cycle device of the 39th embodiment.

Next, operation of the ejector-type refrigeration cycle device 10 of the present embodiment will be described with reference to the Mollier diagram of FIG. 72. Regarding the signs indicating the refrigerant states in FIG. 72, the same refrigerant states as in FIG. 70 are indicated by using the same alphabets, but the additional signs behind the alphabets are only changed. The same is adapted for the Mollier diagrams in the following embodiments.

When the ejector-type refrigeration cycle device 10 of the present embodiment is operated, by the operation of the inner heat exchanger 30, the enthalpy of the suction side refrigerant of the second compression mechanism 21*a* is increased (point i4→i'4 in FIG. 72), and the enthalpy of the refrigerant flowing into the thermal expansion valve 17 is decreased (point b4→point b'4 in FIG. 72), with respect to the 38th embodiment. Other operation is similar to that of the 38th embodiment.

Thus, even in the structure of the present embodiment, the same effects as in (A) to (F) of the 38th embodiment can be obtained. Therefore, by the operation of the inner heat exchanger 30, the enthalpy of the refrigerant flowing into the discharge side evaporator 14 and the suction side evaporator 16 can be decreased with respect to the 38th embodiment.

As a result, the enthalpy difference between the enthalpies of the refrigerant at the refrigerant inlet side and the refrigerant outlet side can be enlarged in the discharge side evaporator 14 and in the suction side evaporator 16, thereby further improving the COP.

(40th Embodiment)

Figure 73:
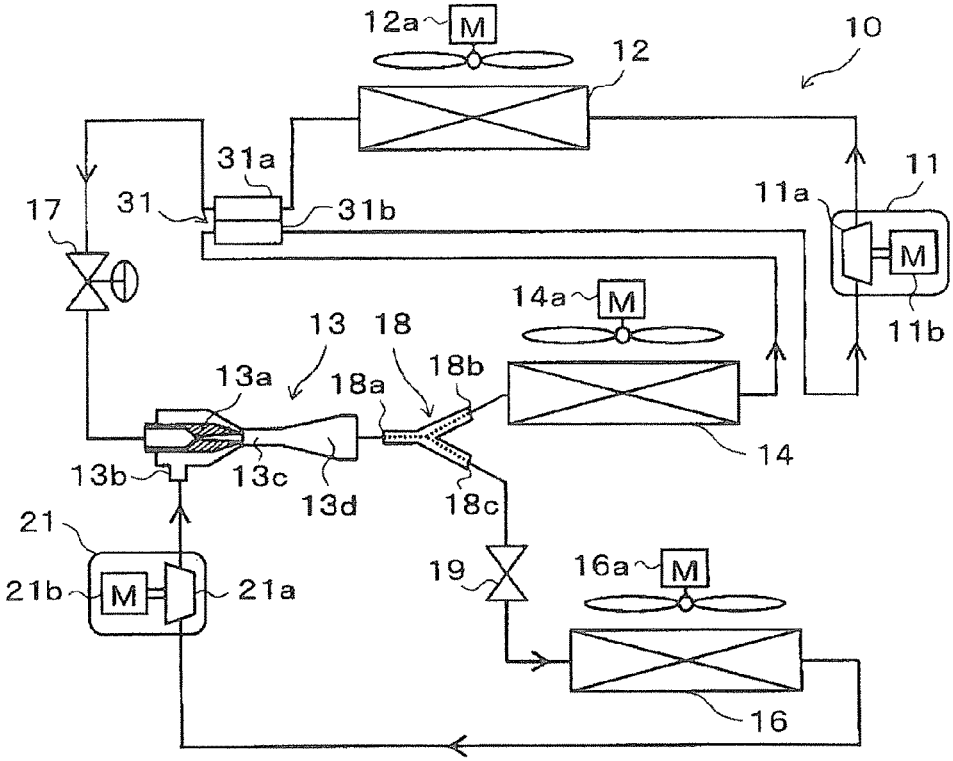
FIG. 73 is an entire schematic diagram of an ejector-type refrigeration cycle device of 40th embodiment.

In the present embodiment, as in the entire schematic diagram of FIG. 73, an inner heat exchanger 31, in which the refrigerant flowing out of the radiator 12 and a low-pressure side refrigerant in the cycle are heat exchanged, is added with respect to the ejector-type refrigeration cycle device 10 of the 38th embodiment.

The inner heat exchanger 31 is for performing heat exchange between refrigerant flowing through a high-pressure side refrigerant passage 31*a* from the radiator 12, and a low-pressure side refrigerant flowing through a low-pressure side refrigerant passage 31*b*. More specifically, the low-pressure side refrigerant in the cycle of the present embodiment is the refrigerant to be drawn into the first compression mechanism 11*a*. The basic structure of the inner heat exchanger 31 is similar to the inner heat exchanger 30 of the 39th embodiment.

Figure 74:
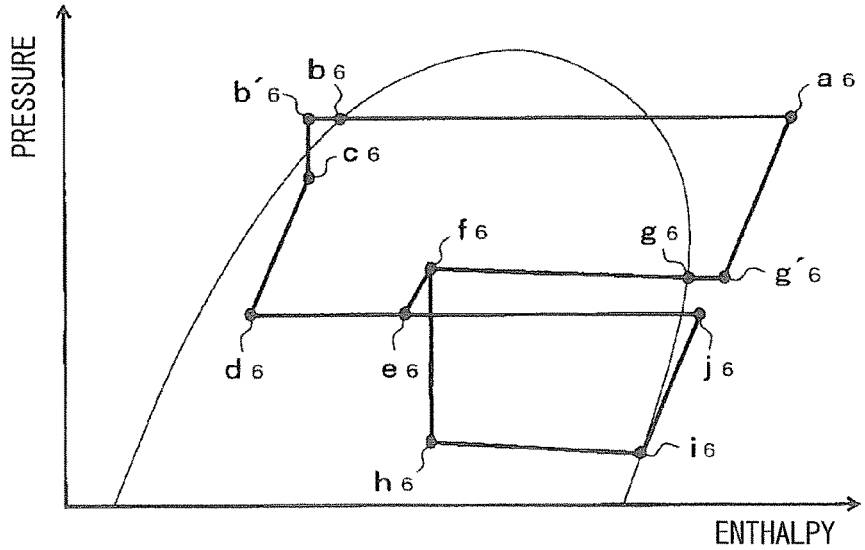
FIG. 74 is a Mollier diagram showing a refrigerant state of the ejector-type refrigeration cycle device of the 40th embodiment.

Next, operation of the ejector-type refrigeration cycle device 10 of the present embodiment will be described with reference to the Mollier diagram of FIG. 74. When the ejector-type refrigeration cycle device 10 of the present embodiment is operated, by the operation of the inner heat exchanger 31, the enthalpy of the suction side refrigerant of the first compression mechanism 11*a* is increased (point g6→point g'6 in FIG. 74), and the enthalpy of the refrigerant flowing into the thermal expansion valve 17 is decreased (point b6→point b'6 in FIG. 74), with respect to the 38th embodiment. Other operation is similar to that of the 38th embodiment.

Thus, even in the structure of the present embodiment, the same effects as in (A) to (F) of the 38th embodiment can be obtained. Furthermore, similarly to the 39th embodiment, the enthalpy difference between the enthalpies of the refrigerant at the refrigerant inlet side and the refrigerant outlet side can be enlarged in the discharge side evaporator 14 and in the suction side evaporator 16, thereby further improving the COR (41st Embodiment)

Figure 75:
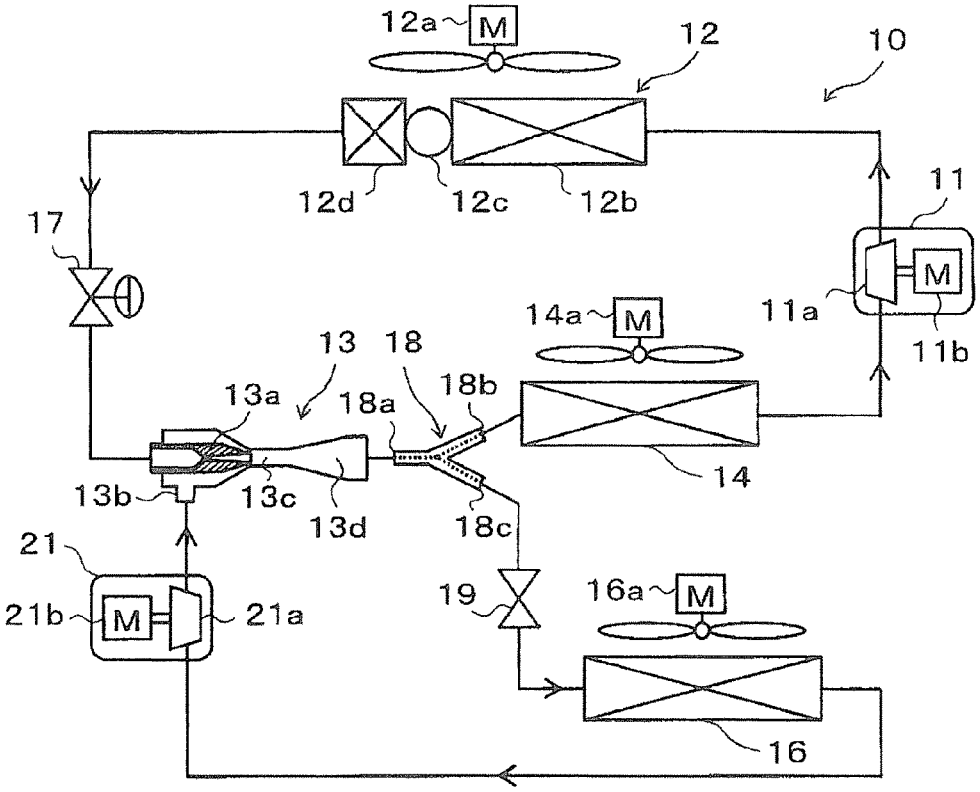
FIG. 75 is an entire schematic diagram of an ejector-type refrigeration cycle device of 41st embodiment.

In the present embodiment, as in the entire schematic diagram of FIG. 75, a structure of the radiator 12 is changed with respect to the ejector-type refrigeration cycle device 10 of the 38th embodiment.

Specifically, the radiator 12 of the present embodiment is configured as a sub-cool type condenser, which includes a condensation portion 12*b*, a gas-liquid separation portion 12*c* (receiver portion) and a super-cooling portion 12*d*. The condensation portion 12*b* condenses the refrigerant, the gas-liquid separation portion 12*c* separates the refrigerant flowing out of the condensation portion 12*b* into gas refrigerant and liquid refrigerant, and the super-cooling portion 12*d* super-cools the liquid refrigerant flowing out of the gas-liquid separation portion 12*c*. Other configurations in the present embodiment are similar to those of the 38th embodiment.

Figure 76:
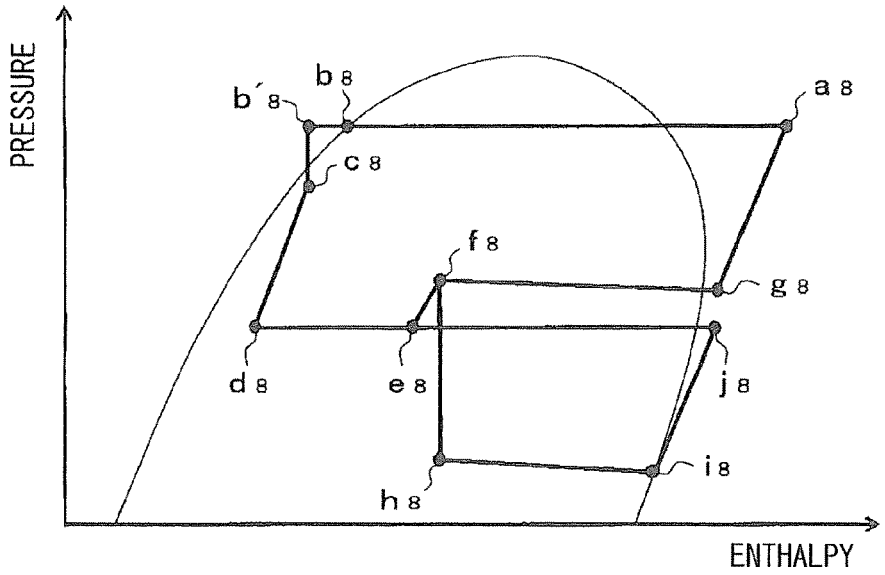
FIG. 76 is a Mollier diagram showing a refrigerant state of the ejector-type refrigeration cycle device of the 41st embodiment.

When the ejector-type refrigeration cycle device 10 of the present embodiment is operated, the refrigerant condensed in the condensation portion 12*b* of the radiator 12 is separated into gas refrigerant and liquid refrigerant in the gas-liquid separation portion 12*c*, as in the Mollier diagram of FIG. 76. Furthermore, the saturated liquid refrigerant separated in the gas-liquid separation portion 12*c* is super-cooled in the supercooling portion 12*d* (point b8→point b'8 in FIG. 76).

Therefore, in the ejector-type refrigeration cycle device 10 of the present embodiment, the enthalpy of the refrigerant flowing into the discharge side evaporator 14 and the suction side evaporator 16 can be decreased. Other operation is similar to that of the 38th embodiment.

Thus, even in the structure of the present embodiment, the same effects as in (A) to (F) of the 38th embodiment can be obtained. Furthermore, the enthalpy difference between the enthalpies of the refrigerant at the refrigerant inlet side and the refrigerant outlet side can be enlarged in the discharge side evaporator 14 and in the suction side evaporator 16, thereby increasing the cooling capacity.

At this time, it can prevent the enthalpy of the suction side refrigerant (i.e., low-pressure side refrigerant in the cycle) of the second compression mechanism 21*a* from being unnecessary increased (point i8 in FIG. 76), unlike a case where the inner heat exchanger 30 of the 39th embodiment is used. Thus, it can prevent the density of the suction refrigerant of the second compression mechanism 21*a* from being lowered, and thereby it is possible to reduce the refrigerant evaporation pressure (refrigerant evaporation temperature) in the suction side evaporator 16, with respect to the 39th embodiment.

(42nd Embodiment)

Figure 77:
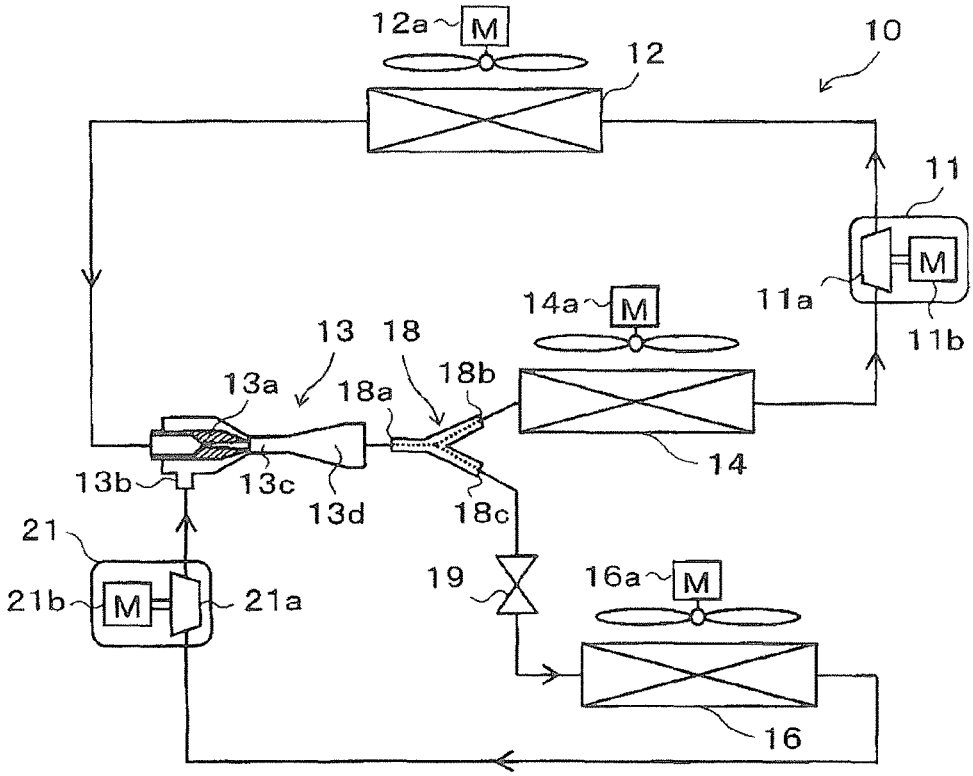
FIG. 77 is an entire schematic diagram of an ejector-type refrigeration cycle device of 42nd embodiment.

In the above embodiments, a flon-based refrigerant is used as the refrigerant to form a subcritical refrigerant cycle. However, in the present embodiment, carbon dioxide is used as the refrigerant to form a super-critical refrigerant cycle in which a refrigerant pressure discharged from the first compressor 11 exceeds the critical pressure of the refrigerant. In the present embodiment, as in the entire schematic diagram of FIG. 77, the thermal expansion valve 17 is removed from the ejector-type refrigeration cycle device 10 of the 38th embodiment. Other configurations in the present embodiment are similar to those of the 38th embodiment.

Next, operation of the ejector-type refrigeration cycle device 10 of the present embodiment will be described with reference to the Mollier diagram of FIG. 78. When the ejector-type refrigeration cycle device 10 of the present embodiment is operated, the refrigerant discharged from the first compressor 11 is cooled in the radiator 12. At this time, the refrigerant passing through the radiator 12 is cooled in a super-critical state without being condensed (point a10→point b10 of FIG. 78)

Figure 78:
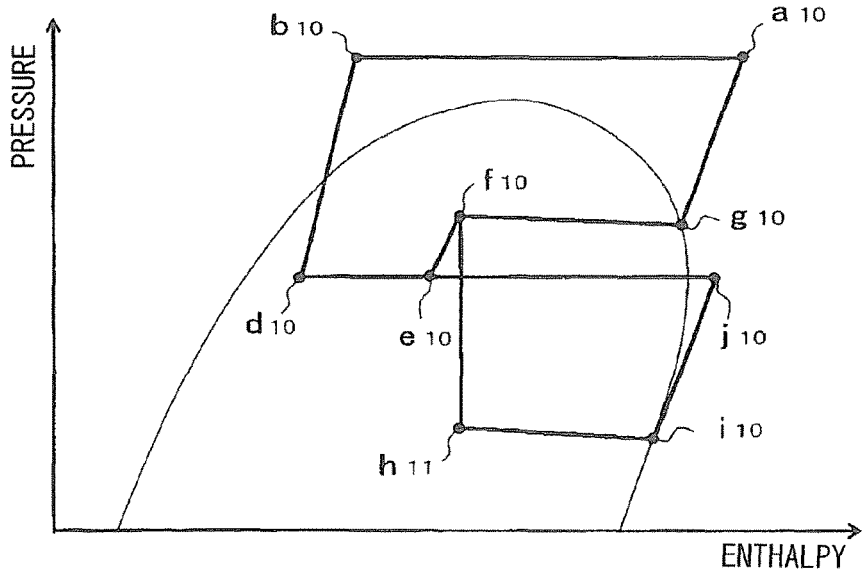
FIG. 78 is a Mollier diagram showing a refrigerant state of the ejector-type refrigeration cycle device of the 42nd embodiment.

The super-critical high-pressure refrigerant flowing into the nozzle portion 13*a* of the ejector 13 from the radiator 12 is decompressed and expanded by the nozzle portion 13*a* in iso-entropy (point b10→point d10 in FIG. 78). Other operation is similar to that of the 38th embodiment. Thus, even in the structure of the present embodiment, the same effects as in (A) to (D) of the 38th embodiment can be obtained.

Furthermore, in the super-critical refrigerant cycle, the high-pressure side refrigerant pressure becomes higher than that in the sub-critical refrigerant cycle. Therefore, the pressure difference between the high pressure side and the low pressure side in the cycle can be enlarged (point b10→point d10 of FIG. 78), thereby increasing the decompression amount in the nozzle portion 13*a* of the ejector 13. Furthermore, the enthalpy difference (recovery energy amount) between the enthalpies of the refrigerant at the refrigerant inlet side of the nozzle portion 13*a* and the refrigerant at the refrigerant outlet side of the nozzle portion 13*a* can be enlarged, thereby further improving the COP.

(43rd Embodiment)

Figure 79:
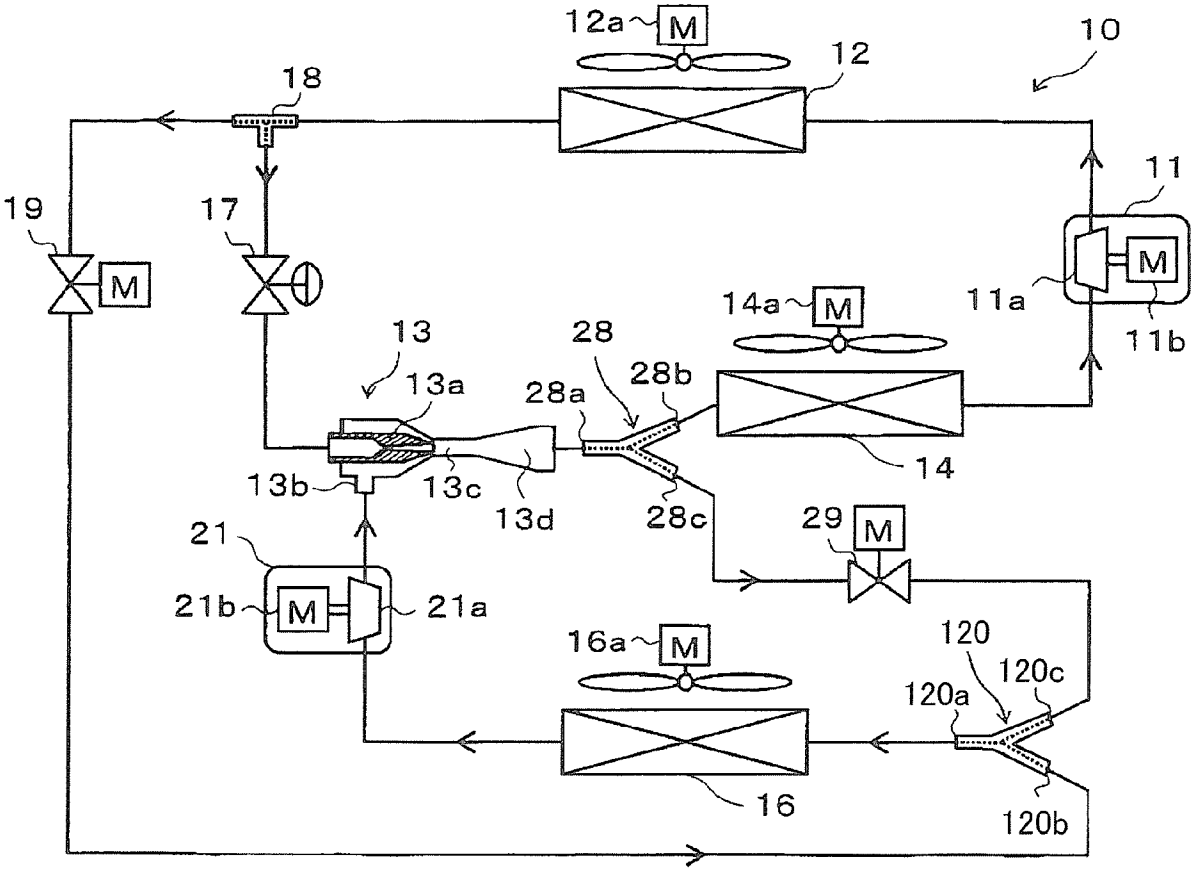
FIG. 79 is an entire schematic diagram of an ejector-type refrigeration cycle device of 43rd embodiment.

An ejector-type refrigeration cycle device 10 of the present invention used for a freezing/refrigeration device will be described with reference to FIGS. 79 and 80. The freezing/refrigeration device is for cooling a refrigerating room that is a space to be cooled, to a low temperature such as in a range between 0° C. and 10° C., and is for cooling a freezing room that is another space to be cooled, to an extremely low temperature such as in a range between −30° C. and −10° C. FIG. 79 is an entire schematic diagram of the ejector-type refrigeration cycle device 10 of the present embodiment.

In the ejector-type refrigeration cycle device 10, the first compressor 11 is configured to draw refrigerant, to compress the drawn refrigerant, and to discharge the compressed refrigerant. For example, the first compressor 11 is an electrical compressor in which the first compression mechanism 11*a* having a fixed displacement is driven by the first electrical motor 11*b*. As the first compression mechanism 11*a*, various compression mechanisms such as a scroll type compression mechanism, a vane type compression mechanism and the like can be used, for example.

The operation (e.g., rotational speed) of the first electrical motor 11*b* is controlled by using control signals output from a control device described later. As the first electrical motor 11*b*, an AC motor or a DC motor may be used. By controlling the rotational speed of the first electrical motor 11*b*, the refrigerant discharge capacity of the first compression mechanism 11*a* can be changed. Thus, in the present embodiment, the first electrical motor 11*b* can be used as a first discharge capacity changing means for changing the discharge capacity of the refrigerant of the first compression mechanism 11*a*.

The refrigerant radiator 12 is disposed on the refrigerant discharge side of the first compressor 11. The radiator 12 exchanges heat between high-pressure refrigerant discharged from the first compressor 11 and outside air (i.e., air outside the room) blown by the cooling fan 12*a* to cool the high-pressure refrigerant. The rotation speed of the cooling fan 12*a* is controlled by a control voltage output from the control device so as to control an air blowing amount from the cooling fan 12*a*.

In the present embodiment, a flon-based refrigerant is used as the refrigerant for a refrigerant cycle of the ejector-type refrigeration cycle device 10 to form a vapor-compression subcritical refrigerant cycle in which a refrigerant pressure on the high-pressure side does not exceed the critical pressure of the refrigerant. Thus, the radiator 12 serves as a condenser for cooling and condensing the refrigerant. Furthermore, a refrigerator oil is mixed to the refrigerant in order to lubricate the first compression mechanism 11*a* and the second compression mechanism 21*a*, so that the refrigerator oil is circulated in the refrigerant cycle together with the refrigerant.

A receiver (i.e., liquid receiver) may be provided at a refrigerant outlet side of the radiator 12, to be used as a high-pressure side gas-liquid separator in which the refrigerant flowing out of the radiator 12 is separated into gas refrigerant and liquid refrigerant, and liquid refrigerant is stored as surplus refrigerant. Furthermore, the saturated liquid refrigerant separated from the receiver is introduced to a downstream side.

A first branch portion 18 is connected to a refrigerant outlet side of the radiator 12, to branch the flow of the high-pressure refrigerant flowing out of the radiator 12. For example, the first branch portion 18 is a three-way joint member having three ports that are used as one refrigerant inlet and two refrigerant outlets. The three-way joint member used as the first branch portion 18 may be configured by bonding pipes having different pipe diameters, or may be configured by providing plural refrigerant passages in a metal block member or a resin block member.

One of the two refrigerant outlets of the first branch portion 18 is connected to a thermal expansion valve 17 used as a high-pressure side decompression portion, and the other one of the two refrigerant outlets of the first branch portion 18 is connected to a first electrical expansion valve 19 as a first suction-side decompression means described later.

The thermal expansion valve 17 has a temperature sensing portion (not shown) arranged in a refrigerant passage at a refrigerant outlet side of the discharge side evaporator 14. The thermal expansion valve 17 is a variable throttle mechanism, in which a super-heat degree of the refrigerant at the refrigerant outlet side of the discharge side evaporator 14 is detected based on temperature and pressure of the refrigerant at the refrigerant outlet side of the discharge side evaporator 14, and the valve-open degree (refrigerant flow amount) of the thermal expansion valve 17 is adjusted by using a mechanical mechanism so that the super-heat degree of the refrigerant at the refrigerant outlet side of the discharge side evaporator 14 is approached to a predetermined value.

The refrigerant outlet side of the thermal expansion valve 17 is connected to a refrigerant inlet side of the nozzle portion 13*a* of the ejector 13. The ejector 13 is used as a refrigerant decompression means for decompressing and expanding the refrigerant, and as a refrigerant circulation means for circulating the refrigerant by the suction action of a high-speed refrigerant flow jetted from the nozzle portion 13*a*.

The ejector 13 is configured to have the nozzle portion 13*a* and the refrigerant suction port 13*b* and the like. The refrigerant passage sectional area of the nozzle portion 13*a* is throttled in the refrigerant flow direction so that a middle pressure refrigerant from the one stream branched at the first branch portion 18 is decompressed and expanded in isoentropy by the nozzle portion 13*a*. The refrigerant suction port 13*b* is provided to communicate with a space in the ejector 13, where the jet port of the nozzle portion 13*a* is provided, so as to draw the refrigerant discharged from the second compressor 21 described later.

The mixing portion 13*c* is provided in the ejector 13 on a downstream side of the nozzle portion 13*a* and the refrigerant suction port 13*b* in the refrigerant flow, so as to mix the high-velocity refrigerant flow jetted from the nozzle portion 13*a* with the suction refrigerant drawn from the refrigerant suction port 13*b*. The diffuser portion 13*d* is provided in the ejector 13 downstream of the mixing portion 13*c* in a refrigerant flow so as to increase the refrigerant pressure in the diffuser portion 13*d*.

The diffuser portion 13*d* is formed in such a shape to gradually increase the passage sectional area of the refrigerant, and has an effect of reducing the velocity of the refrigerant flow so as to increase the refrigerant pressure. That is, the diffuser portion 13*d* has an effect of converting the speed energy of the refrigerant to the pressure energy of the refrigerant. A refrigerant inlet 28*a* of a second branch portion 28 is connected to the outlet side of the diffuser portion 13*d*.

The basic structure of the second branch portion 28 is similar to the first branch portion 18. A refrigerant outlet 28*b* of the second branch portion 28 is connected to the discharge side evaporator 14, and a refrigerant outlet 28*c* of the second branch portion 28 is connected to a second electrical expansion valve 19 as a second suction-side decompression means described later.

The second branch portion 28 of the present embodiment is formed approximately into a Y-shape, such that a flow direction of the refrigerant flowing from one refrigerant outlet 28*b* toward the discharge side evaporator 14 and a flow direction of the refrigerant flowing from the other refrigerant outlet 28*c* toward the second electrical expansion valve 29 are symmetric with respect to the flow direction of the refrigerant flowing from the outlet side of the diffuser portion 13*d* to the refrigerant inlet 28*a*, and are joined with each other by an acute angle.

Thus, when the refrigerant flowing into the second branch portion 28 is branched therein, the refrigerant flows out of the second branch portion 28 without indecisively reducing the flow speed of the refrigerant. Therefore, the flow velocity (dynamic pressure) of the refrigerant flowing out of the ejector 13 can be maintained in the second branch portion 28. The second branch portion 28 is not limited to the above shape, and may be formed approximately into a T-shape or the like.

The discharge side evaporator 14 is a heat-absorbing heat exchanger, in which refrigerant flowing out of the refrigerant outlet 28*b* of the second branch portion 28 is evaporated by heat-exchanging with air inside the refrigerating room, blown by the blower fan 14*a*, so as to provide heat-absorbing action. Thus, a fluid to be heat-exchanged with the refrigerant in the discharge side evaporator 14 is the air in the refrigerating room of the freezing/refrigerating device.

The blower fan 14*a* is an electrical blower, in which rotation speed (air blowing amount) of the blower fan 14*a* is controlled by a control voltage output from the control device. A refrigerant suction port of the first compressor 11 is connected to a refrigerant outlet side of the discharge side evaporator 14.

The second electrical expansion valve 29 is for decompressing and expanding the refrigerant flowing out of the refrigerant outlet 28*c* of the second branch portion 28. More specifically, the second electrical expansion valve 29 is a variable throttle mechanism, which is configured to have a valve body with a variable throttle open degree, and a stepping motor for changing the throttle open degree of the valve body.

Furthermore, the second electrical expansion valve 29 of the present embodiment is made to fully close the throttle passage. Thus, when the throttle passage of the second electrical expansion valve 29 is fully closed, all the refrigerant flowing out of the diffuser portion 13*d* flows into the discharge side evaporator 14, without being branched in the second branch portion 28. The operation of the second electrical expansion valve 29 is controlled by a control signal output from the control device.

The first electrical expansion valve 19 is connected to the other refrigerant outlet of the first branch portion 18, as described above. The basic structure of the first electrical expansion valve 19 is similar to that in the second electrical expansion valve 29. Thus, when the throttle passage of the first electrical expansion valve 19 is fully closed, all the refrigerant flowing out of the radiator 12 flows into the thermal expansion valve 17, without being branched in the first branch portion 18.

A join portion 120 is connected to refrigerant outlet sides of the first and second electrical expansion valves 19, 20, to join the refrigerants respectively flowing out of the first and second electrical expansion valves 19, 29. The basic structure of the join portion 120 is similar to that of the second branch portion 28. The join portion 120 is provided with two refrigerant inlets 120*b*, 120*c* and one refrigerant outlet 120*a*, in the three ports 120*a*-120*c* of the three-way joint member.

The join portion 120 of the present embodiment is formed approximately into a Y-shape, such that a flow direction of the refrigerant flowing from the first electrical expansion valve 19 into the refrigerant inlet 120*b* and a flow direction of the refrigerant flowing from the second electrical expansion valve 29 to the other refrigerant inlet 120*c* are symmetric with respect to the flow direction of the refrigerant flowing out the refrigerant outlet 120*a* of the join portion 120, and are joined with each other by an acute angle.

Thus, when the refrigerants are joined in the join portion 120, the refrigerant flows out of the join portion 120 without indecisively reducing the flow speed of the refrigerant. Therefore, the flow velocity (dynamic pressure) of the refrigerant flowing out of the first and second electrical expansion valves 19, 29 can be maintained in the join portion 120.

Furthermore, the suction side evaporator 16 is connected to the refrigerant outlet 120*a* of the join portion 120. The suction side evaporator 16 is a heat-absorbing heat exchanger configured to perform heat exchange between the refrigerant flowing out of the join portion 120 and air of the freezing room, blown and circulated by the blower fan 16*a*, thereby evaporating low-pressure refrigerant so as to exert heat-absorbing action.

Thus, a fluid to be heat-exchanged with the refrigerant in the suction side evaporator 16 is the air in the freezing room. The blower fan 16*a* is an electrical blower, in which rotation speed (air blowing amount) of the blower fan 16*a* is controlled by a control voltage output from the control device.

The refrigerant suction port of the second compressor 21 is connected to a refrigerant outlet side of the suction side evaporator 16. The basic structure of the second compressor 21 is similar to that of the first compressor 11. Thus, the second compressor 21 is an electrical compressor, in which a fixed-displacement type second compression mechanism 21*a* is driven by the second electrical motor 21*b*. The second electrical motor 21*b* of the present embodiment is used as a second discharge capacity changing means for changing a refrigerant discharge capacity of the second compression mechanism 21*a*.

The refrigerant suction port 13*b* of the ejector 13 is connected to a refrigerant discharge port of the second compressor 21.

The control device (not shown) is constructed of a generally-known microcomputer including CPU, ROM and RAM and the like, and its circumferential circuits. The control device performs various calculations and processes based on a control program stored in the ROM, and controls operation of various electrical actuators 11*b*, 12*b*, 14*a*, 16*a*, 19, 21*a*, 29 or the like.

The control device includes a function portion as the first discharge-capacity control means which controls the operation of the first electrical motor 11*b* that is a first discharge capacity changing means, and a function portion as the second discharge-capacity control means which controls the operation of the second electrical motor 21*b* that is a second discharge capacity changing means. The first discharge-capacity control means and the second discharge-capacity control means may be configured by different control devices, respectively.

Into the control device, detection values from a sensor group (not shown) including an outside air sensor for detecting an outside air temperature, an inside temperature sensor for detecting an interior temperature of the refrigerating room and an interior temperature of the freezing room, and various operation signals from an operation panel (not shown) in which an operation switch for operating the refrigerator and the like are provided are input.

Next, operation of the present embodiment with the above structure will be described based on the Mollier diagram shown in FIG. 80. When the operation switch of the operation panel is turned on, the control device causes the first and second electrical motors 11*b*, 21*b*, the cooling fan 12*a*, the blower fans 14*a*, 16*a* and the electrical expansion valves 19, 29 to be operated. The control device controls the first and second electrical expansion valves 19, 29 to be in a throttle state or a fully-open state, thereby setting cycle configurations of three kinds.

When the control device causes the first electrical expansion valve 19 to be in a fully closed sate and causes the second electrical expansion valve 29 to be in a throttle state, a cycle configuration can be formed in which a refrigerant flow is branched only at the second branch portion 28 (hereinafter, the operation mode at the cycle configuration is called as "low-pressure branch operation mode").

When the control device causes the first electrical expansion valve 19 to be in a throttle sate and causes the second electrical expansion valve 29 to be in a fully closed state, a cycle configuration can be formed in which a refrigerant flow is branched only at the first branch portion 18 (hereinafter, the operation mode at the cycle configuration is called as "high-pressure branch operation mode").

When the control device causes both the first and second electrical expansion valves 19, 29 to be in a throttle sate, a cycle configuration can be formed in which a refrigerant flow is branched simultaneously both at the first branch portion 18 and the second branch portion 28 (hereinafter, the operation mode at the cycle configuration is called as "simultaneous-branch operation mode").

The low-pressure branch operation mode, the high-pressure branch operation mode or the simultaneous-branch operation mode can be selectively switched, based on the cooling capacity required in the cycle and the outside air temperature. In the present embodiment, during a general operation where a general cooling capacity is required, the low-pressure branch operation mode is switched. In a high-load operation where a high cooling capacity is required than the general operation mode and the refrigerant flow amount circulating in the cycle is increased than the general operation, the high-pressure branch operation mode is switched.

The simultaneous-branch operation mode is switched, in a low load operation in which the cooling capacity lower than that of the general operation is required and the refrigerant flow amount circulating in the cycle is lower than that in the general operation, or in a case where the outside air temperature is lower than a predetermined standard temperature so that a pressure difference between the high-pressure side and the low-pressure side becomes smaller than a predetermined pressure difference.

Figure 80:
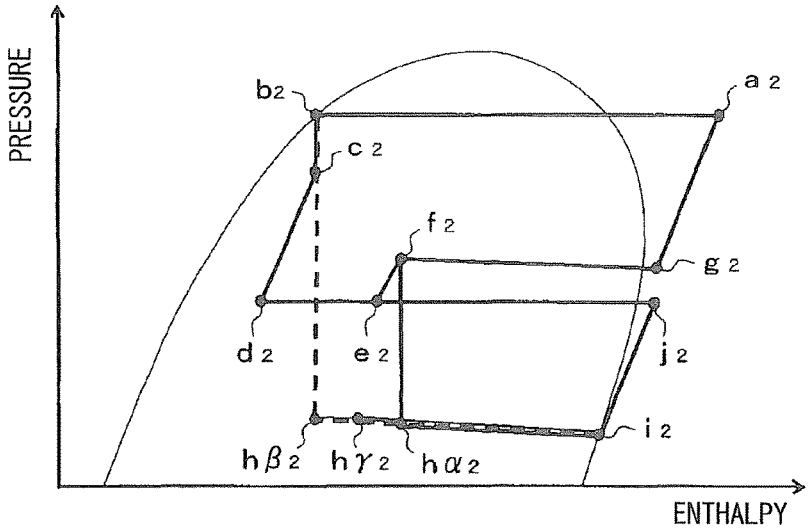
FIG. 80 is a Mollier diagram showing a refrigerant state of the ejector-type refrigeration cycle device of the 43rd embodiment.

In the low-pressure branch operation mode, high-temperature and high-pressure refrigerant (a2 in FIG. 80) discharged from the first compressor 11 flows into the radiator 12, and is heat-exchanged with the blown air (outside air) blown by the cooling fan 12*a* to be radiated and condensed (point a2→point b2 in FIG. 80). The refrigerant flowing out of the radiator 12 flows into the first branch portion 18.

At this time, because the first electrical expansion valve 19 is fully closed, all the refrigerant flowing out of the radiator 12 flows into the thermal expansion valve 17 via the first branch portion 18, without being branched in the first branch portion 18. The refrigerant flowing into the thermal expansion valve 17 is decompressed and expanded in iso-enthalpy, and becomes in a gas-liquid two-phase state (point b2→point c2 in FIG. 80). At this time, the valve open degree of the thermal expansion valve 17 is adjusted so that a super heat degree (point g2 in FIG. 80) of the refrigerant at the refrigerant outlet side of the discharge side evaporator 14 becomes in a predetermined value.

The middle refrigerant flowing out of the thermal expansion valve 17 flows into the nozzle portion 13*a* of the ejector 13, and is decompressed and expanded by the nozzle portion 13*a* in iso-entropy (point c2→point d2 in FIG. 80). In the decompression and expansion of the nozzle portion 13*a*, the pressure energy of the refrigerant is converted to the speed energy of the refrigerant, and the refrigerant is jetted with a high speed from the refrigerant jet port of the nozzle portion 13*a*. Thus, the refrigerant discharged from the second compressor 21 is drawn into the ejector 13 from the refrigerant suction port 13*b* of the ejector 13, by the refrigerant suction action of the jet refrigerant (point j2→point e2 in FIG. 80).

Furthermore, the jet refrigerant jetted from the nozzle portion 13*a* and the suction refrigerant drawn from the refrigerant suction port 13*b* are mixed in the mixing portion 13*c* of the ejector 13, and flows into the diffuser portion 13*d* of the ejector 13 (point d2→point e2 in FIG. 80). That is, passage sectional area is enlarged in the diffuser portion 13*d* as toward downstream so that the speed energy of the refrigerant is converted to the pressure energy thereof, thereby increasing the pressure of the refrigerant (point e2→point f2 in FIG. 80).

The refrigerant flowing out of the diffuser portion 13*d* flows into the second branch portion 28, and is branched by the second branch portion 28 into a flow of the refrigerant flowing toward the discharge side evaporator 14 and a flow of the refrigerant flowing toward the second electrical expansion valve 29. The control device adjusts the throttle open degree of the second electrical expansion valve 29, so that the refrigerant flow amount G1 flowing into the discharge side evaporator 14 is made larger than the refrigerant flow amount G2 flowing into the second electrical expansion valve 29, and the refrigerant evaporation temperature in the suction side evaporator 16 becomes in a predetermined temperature.

The refrigerant flowing from the second branch portion 28 into the discharge side evaporator 14 is evaporated by absorbing heat from air inside of the refrigerating room, blown by the blower fan 14*a* (point f2→point g2 in FIG. 80). Thus, the air blown into the interior of the refrigerating room is cooled. The gas refrigerant flowing out of the discharge side evaporator 14 is drawn into the first compressor 11, and is compressed again (point g2→point a2 in FIG. 80).

On the other hand, the refrigerant flowing from the second branch portion 28 into the second electrical expansion valve 29 is decompressed and expanded in iso-enthalpy at the second electrical expansion valve 29, thereby reducing the refrigerant pressure (point f2→point ha2 in FIG. 80). The refrigerant decompressed and expanded at the second electrical expansion valve 29 flows into the suction side evaporator 16, and is evaporated by absorbing heat from air inside of the refrigerating room, blown by the blower fan 16*a* (point ha2→point i2 in FIG. 80). Thus, the air blown into the interior of the freezing room is cooled.

The gas refrigerant flowing out of the suction side evaporator 16 is drawn into the second compressor 21, and is compressed (point i2→point j2 in FIG. 80). At this time, the control device controls operation of the first and second electrical motors 11*b*, 21*b* such that COP in the entire cycle of the ejector-type refrigeration cycle device is approached approximately to the maximum value. Specifically, pressure increasing amounts in the first and second compression mechanisms 11*a*, 21*a* are controlled to be approximately equal, in order to improve the compression efficiency in the first and second compression mechanisms 11*a*, 21*a*.

When an increase amount of the enthalpy of the refrigerant is ΔH1 in a case where the refrigerant is compressed in iso-entropy in the first and second compressors 11, 21, and when an increase amount of the enthalpy of the refrigerant actually pressurized in the first and second compressors 11, 21 is ΔH2, the compression efficiency is a ratio of ΔH1 to ΔH2.

For example, when the rotation speed or the pressure increasing amount of the first and second compressors 11, 21 is increased, the temperature of the refrigerant is increased by fraction heat of the refrigerant, thereby increasing the actual increase amount ΔH2 of the enthalpy. In this case, the compression efficiency is decreased in the first and second compressors 11, 21.

The refrigerant discharged from the second compressor 21 is drawn into the ejector 13 from the refrigerant suction port 13*b* (point j2→point e2 in FIG. 80).

Next, in the high-pressure branch operation mode, the refrigerant discharged from the first compressor 11 is cooled and condensed in the radiator 12, similarly to the low-pressure branch operation mode (point a2→point b2 in FIG. 80). The refrigerant flowing out of radiator 12 is branched at the first branch portion 18.

Furthermore, the high-pressure refrigerant flowing from the first branch portion 18 into the thermal expansion valve 17 is decompressed and expanded by the thermal expansion valve 17 in iso-enthalpy to become in a gas-liquid two-phase state (point b2→point c2 in FIG. 80). The middle refrigerant flowing out of the thermal expansion valve 17 flows in this order of the nozzle portion 13*a* of the ejector 13→the diffuser portion 13*d*→the second branch portion 28 the discharge side evaporator 14 (point c2→point d2→point e2→point f2 in FIG. 80).

At this time, because the second electrical expansion valve 29 is fully closed, all the refrigerant flowing out of the diffuser portion 13*d* flows into the discharge side evaporator 14 via the second branch portion 28, without being branched in the second branch portion 28. The refrigerant flowing into the discharge side evaporator 14 from the second branch portion 28 is evaporated by absorbing heat from air inside the refrigerating room (point f2→point g2 in FIG. 80), and is drawn into the first compressor 11 to be compressed again (point g2→point a2 in FIG. 80).

On the other hand, the high-pressure refrigerant flowing from the first branch portion 18 into the first electrical expansion valve 19 is decompressed and expanded in iso-enthalpy at the first electrical expansion valve 19, thereby reducing the refrigerant pressure (point b2→point hβ2, shown by chain line in FIG. 80).

In the present embodiment, the valve open degree (throttle open degree) of the first electrical expansion valve 19 is adjusted, such that a flow ratio Gnoz/Ge can be set at an optimal ratio at which a high COP can be obtained in the entire cycle. Here, the flow ratio Gnoz/Ge is a ratio of a refrigerant flow amount Gnoz flowing to the nozzle portion 13*a* to a refrigerant flow amount Ge flowing toward the refrigerant suction port 13*b*. The refrigerant decompressed and expanded at the first electrical expansion valve 19 flows into the join portion 120.

The refrigerant flowing from the join portion 120 into the suction side evaporator 16 is evaporated by absorbing heat from air inside of the freezing room, blown by the blower fan 16*a* (point hβ2→point i2 in FIG. 80). Thus, the air blown into the interior of the freezing room is cooled. The refrigerant flowing out of the suction side evaporator 16 is drawn into the second compressor 21 to be compressed again (point i2→point j2 in FIG. 80), and then is drawn into the refrigerant suction port 13*b* of the ejector 13 (point j2→point e2 in FIG. 80), similarly to the low-pressure branch operation mode.

In the simultaneous-branch operation mode, the refrigerant flowing out of radiator 12 is branched at the first branch portion 18 similarly to the high-pressure branch operation mode. The refrigerant flowing from the first branch portion 18 to the thermal expansion valve 17 flows in this order of the thermal expansion valve 17 the nozzle portion 13*a* of the ejector 13→the diffuser portion 13*d*→the second branch portion 28 (point b2→point c2→point d2→point e2→point f2 in FIG. 80).

In the simultaneous-branch operation mode, the refrigerant flowing out of the diffuser portion 13*d* is branched at the second branch portion 28, similarly to the low-pressure branch operation mode. The refrigerant flowing from the second branch portion 28 toward the discharge side evaporator 14 flows in this order of the discharge side evaporator 14→the first compressor 11, so as to cool air inside of the refrigerating room (point f2→point g2 in FIG. 80).

On the other hand, the refrigerant flowing from the second branch portion 28 toward the second electrical expansion valve 29 flows in this order of the second electrical expansion valve 29→the join portion 120 (point c2→point hβ2, shown by chain line in FIG. 80). Furthermore, the refrigerant flowing from the first branch portion 18 toward the first electrical expansion valve 19 flows in this order of the first electrical expansion valve 19→the join portion 120 (point f2→point ha2 in FIG. 80).

Then, the flow of the refrigerant flowing out of the second electrical expansion valve 29 and the flow of the refrigerant flowing out of the first electrical expansion valve 19 are joined at the join portion 120 (point hβ2→point hγ2, point ha2→point hγ2, in FIG. 80). The refrigerant flowing out of the join portion 120 flows into the suction side evaporator 16 and is evaporated, so as to cool the air inside the freezing room, similarly to the low-pressure branch operation mode and the high-pressure branch operation mode.

The refrigerant flowing out of the suction side evaporator 16 is drawn into the second compressor 21 to be compressed, and then is drawn into the refrigerant suction port 13*b* of the ejector 13 (point hγ2→point i2→point j2→point e2 in FIG. 80).

The ejector-type refrigeration cycle device 10 of the present embodiment is operated above, and thereby the following excellent effects can be obtained.

(A) In any operation mode, because the flow of the refrigerant is branched by at least one of the first branch portion 18 and the second branch portion 28, the refrigerant can be suitably supplied to both the discharge side evaporator 14 and the suction side evaporator 16. Thus, cooling action can be exerted in both the discharge side evaporator 14 and the suction side evaporator 16, at the same time.

At this time, the refrigerant evaporation pressure of the discharge side evaporator 14 becomes in a pressure pressurized by the second compressor 21 and the diffuser portion 13*d*. On the other hand, the refrigerant evaporation pressure of the suction side evaporator 16 is a pressure decompressed by the second electrical expansion valve 29 after being pressurized in the diffuser portion 13*d*.

Thus, the refrigerant evaporation pressure (refrigerant evaporation temperature) of the suction side evaporator 16 can be made lower than the refrigerant evaporation pressure (the refrigerant evaporation temperature) of the discharge side evaporator 14. As a result, the discharge side evaporator 14 can be adapted for cooling the refrigerating room having a low temperature, and the suction side evaporator 16 can be adapted for cooling the freezing room having an extremely low temperature.

(B) Because the second compressor 21 (second compression mechanism 21*a*) is provided, the suction capacity of the ejector 13 can be supplemented by the operation of the second compression mechanism 21*a* in any one operation mode. Therefore, for example, even in an operation condition in which a pressure difference between a high-pressure refrigerant and a low pressure refrigerant is decreased thereby decreasing the flow amount of the drive flow of the ejector 13 such as in a case of a low outside-air temperature, that is, even in an operation condition in which the suction capacity of the ejector 13 is decreased, refrigerant can be surely supplied to the suction side evaporator 16.

Furthermore, the refrigerant pressure is increased by the pressurizing action in the first and second compression mechanisms 11*a*, 21*a* and in the diffuser portion 13*d* of the ejector 13. Thus, as compared with a case where the refrigerant is pressurized by a single compression mechanism, the driving power of the first and second compression mechanisms 11*a*, 21*a* is reduced thereby improving the COP.

Furthermore, by the pressurizing action of the diffuser portion 13*d*, the suction pressure of the first compression mechanism 11*a* can be increased, thereby reducing the driving power in the first compression mechanism 11*a*. In addition, because the pressure difference between the suction pressure and the discharge pressure in the respective first and second compression mechanisms 11*a*, 21*a* can be reduced, the compression efficiency in the respective first and second compression mechanisms 11*a*, 21*a* can be improved.

In the present embodiment, the refrigerant discharge capacities of the first and second compression mechanisms 11*a*, 21*a* can be respectively independently changed by the first and second electrical motors 11*b*, 21*b*. Thus, the compression efficiency in the first and second compression mechanisms 11*a*, 21*a* can be effectively improved.

As a result, even when a variation in the flow amount of the drive flow is caused thereby reducing the pressurizing capacity of the diffuser portion 13*d*, the ejector-type refrigeration cycle device can be stably operated with a high COR Therefore, in a refrigeration cycle device in which the pressure difference between the high pressure refrigerant and the low pressure refrigerant is large, for example, in a refrigeration cycle device in which the refrigerant evaporation temperature of the suction side evaporator 16 is reduced to a very low temperature such as −30° C.--10° C., the effect of the present invention is extremely effective.

(C) In the low-pressure branch operation mode, the refrigerant flow amount G1 flowing from the second branch portion 28 into the discharge side evaporator 14 is made larger than the refrigerant flow amount G2 flowing from the second branch portion 18 into the second thermal expansion valve 29. Therefore, a radiation amount of the refrigerant in the radiator 12 can be increased. Thus, a heat absorbing amount of the refrigerant in the entire cycle, that is, a cooling capacity of the cycle can be enlarged.

(D) Thus, in the high-pressure branch operation mode and the simultaneous branch operation mode, refrigerant flows in this order of the first compressor 11→the radiator 12→the first branch portion 18→the ejector 13→the second branch portion 28→the discharge side evaporator 14→the first compressor 11. At the same time, refrigerant flows in this order of the first compressor 11→the radiator 12→the first branch portion 18→the first electrical expansion valve 19→the join portion 120→the suction side evaporator 16→the second compressor 21→the ejector 13→the second branch portion 28→the discharge side evaporator 14→the first compressor 11.

That is, because the flow of the refrigerant passing through the evaporator such as the discharge side evaporator 14 and the suction side evaporator 16 becomes in circular, even when a lubrication oil (refrigerator oil) for the first and second compressors 11, 21 is mixed in the refrigerant, it can prevent the oil from staying in the discharge side evaporator 14 and in the suction side evaporator 16.

(E) in the simultaneous-branch operation mode, a cycle is configured such that the refrigerant flowing out of both the first electrical expansion valve 19 and the second electrical expansion valve 29 is supplied to the suction side evaporator 16. Thus, in the simultaneous-branch operation mode, the refrigerant flow amount supplied to the suction side evaporator 16 can be easily increased, as compared with a cycle structure in which the refrigerant flowing out of any one of the first electrical expansion valve 19 and the second electrical expansion valve 29 is supplied to the suction side evaporator 16.

(F) As compared with the ejector-type refrigeration cycle device of the patent document 1, an accumulator as a discharge-side gas-liquid separator can be removed from the suction side of the first compressor 11. Thus, the product cost in the entire of the ejector-type refrigeration cycle device 10 can be reduced.

(G) In addition, in the present embodiment, because the thermal expansion valve 17 that is a variable throttle mechanism is used as the high-pressure side decompression means, the refrigerant flow amount flowing into the nozzle portion 13*a* of the ejector 13 can be varied in accordance with a load variation in the refrigerant cycle. As a result, even if load fluctuation arises, the ejector-type refrigeration cycle device can be operated while having a high COP.

(H) Because the refrigerant decompressed by the thermal expansion valve 17 is in the gas-liquid two-phase state (point c2 in FIG. 80), gas-liquid two-phase refrigerant can flow into the nozzle portion 13*a* of the ejector 13.

Thus, it is compared with a case where the liquid refrigerant flows into the nozzle portion 13*a*, boiling of the refrigerant in the nozzle portion 13*a* can be facilitated, thereby improving the nozzle efficiency. Thus, the recovery energy amount of the nozzle portion 13 is increased, and a pressure increasing amount is increased in the diffuser portion 13*d*, thereby improving the COP.

Furthermore, it is compared with the case where the liquid refrigerant flows into the nozzle portion 13*a*, the refrigerant passage area of the nozzle portion 13*a* can be enlarged, and thereby the processing of the nozzle portion 13*a* can be made easy. As a result, the product cost of the ejector 13 can be decreased, thereby reducing the product cost in the entire of the ejector-type refrigeration cycle device 10.

(44th Embodiment)

Figure 81:
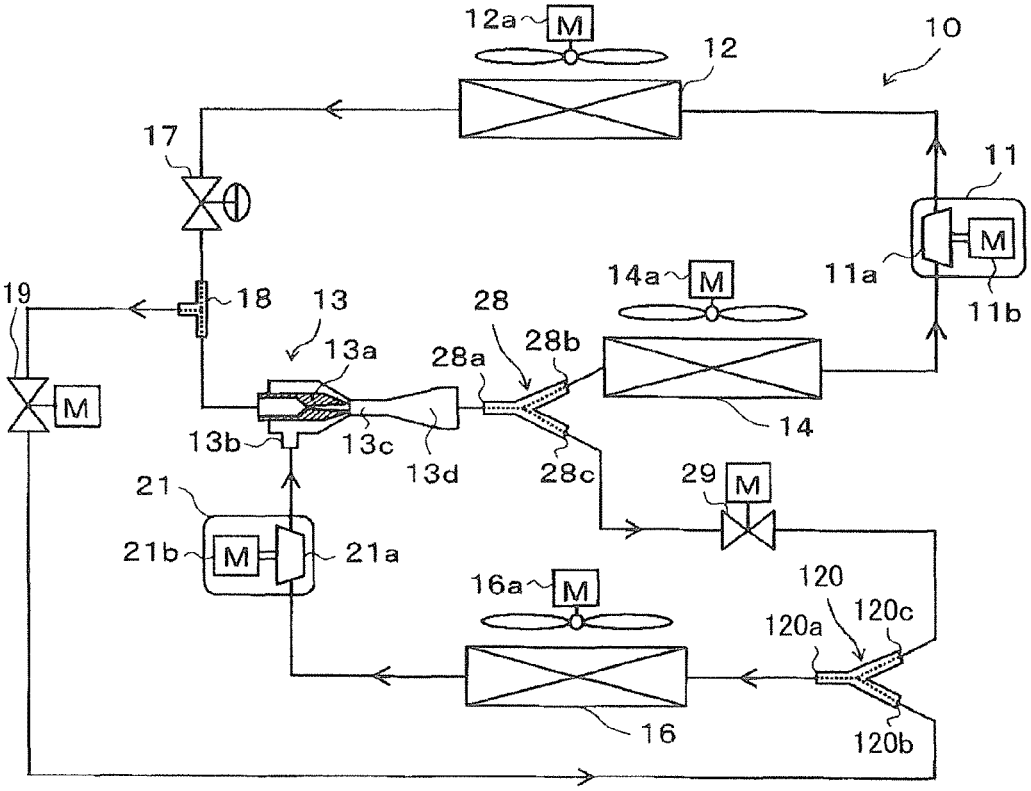
FIG. 81 is an entire schematic diagram of an ejector-type refrigeration cycle device of 44th embodiment.

In the present embodiment, as in the entire schematic diagram of FIG. 81, the arrangement of the thermal expansion valve 17 is changed with respect to the 43rd embodiment. That is, in the present embodiment, the thermal expansion valve 17 is arranged in a refrigerant passage from the refrigerant outlet side of the radiator 12 to the inlet side of the first branch portion 18. In FIG. 81, parts similar to or corresponding to those of the 43rd embodiment are indicated by the same reference numbers. This is the same also in the following drawings. Other configurations in the present embodiment are similar to those of the 43rd embodiment.

Next, operation of the ejector-type refrigeration cycle device 10 of the present embodiment will be described with reference to the Mollier diagram of FIG. 82. Regarding the signs indicating the refrigerant states in FIG. 82, the same refrigerant states as in FIG. 80 are indicated by using the same alphabets, but the additional signs behind the alphabets are only changed. The same is adapted for the Mollier diagrams in the following embodiments.

When the ejector-type refrigerant cycle device 10 of the present embodiment is operated, the refrigerant flowing out of the radiator 12 flows into the thermal expansion valve 17, and is decompressed and expanded in iso-enthalpy to become in a gas-liquid two-phase state (point b4→point c4 in FIG. 82), in any one operation mode.

Figure 82:
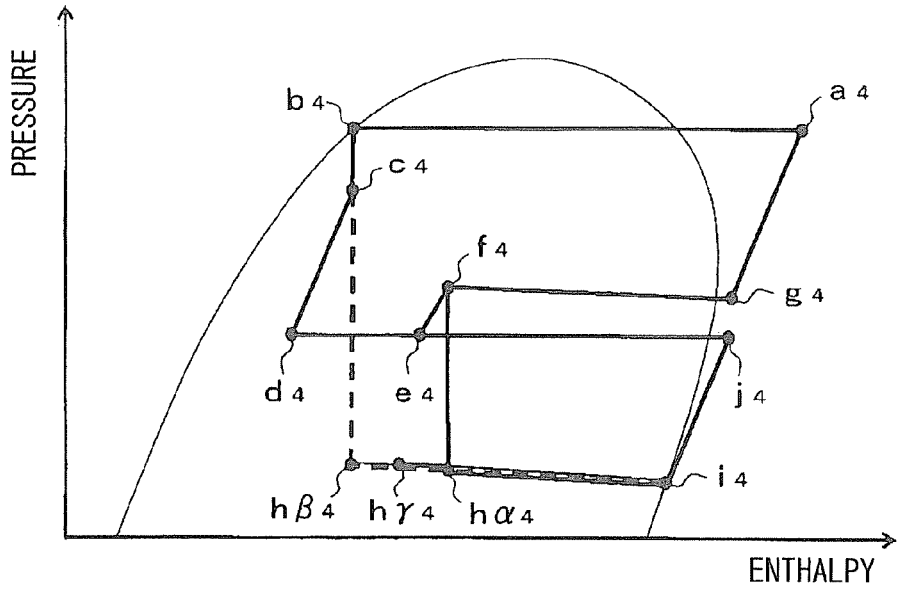
FIG. 82 is a Mollier diagram showing a refrigerant state of the ejector-type refrigeration cycle device of the 44th embodiment.

On the other hand, in the high-pressure branch operation mode and the simultaneous operation mode, the high-pressure refrigerant flowing from the first branch portion 18 into the first electrical expansion valve 19 is decompressed and expanded in iso-enthalpy at the first electrical expansion valve 19, thereby reducing the refrigerant pressure (point c4→point hβ4, shown by chain line in FIG. 82). Other operation is similar to that of the 43rd embodiment.

Thus, even in the structure of the present embodiment, the same effects as in (A) to (H) of the 43rd embodiment can be obtained.

(45th Embodiment)

Figure 83:
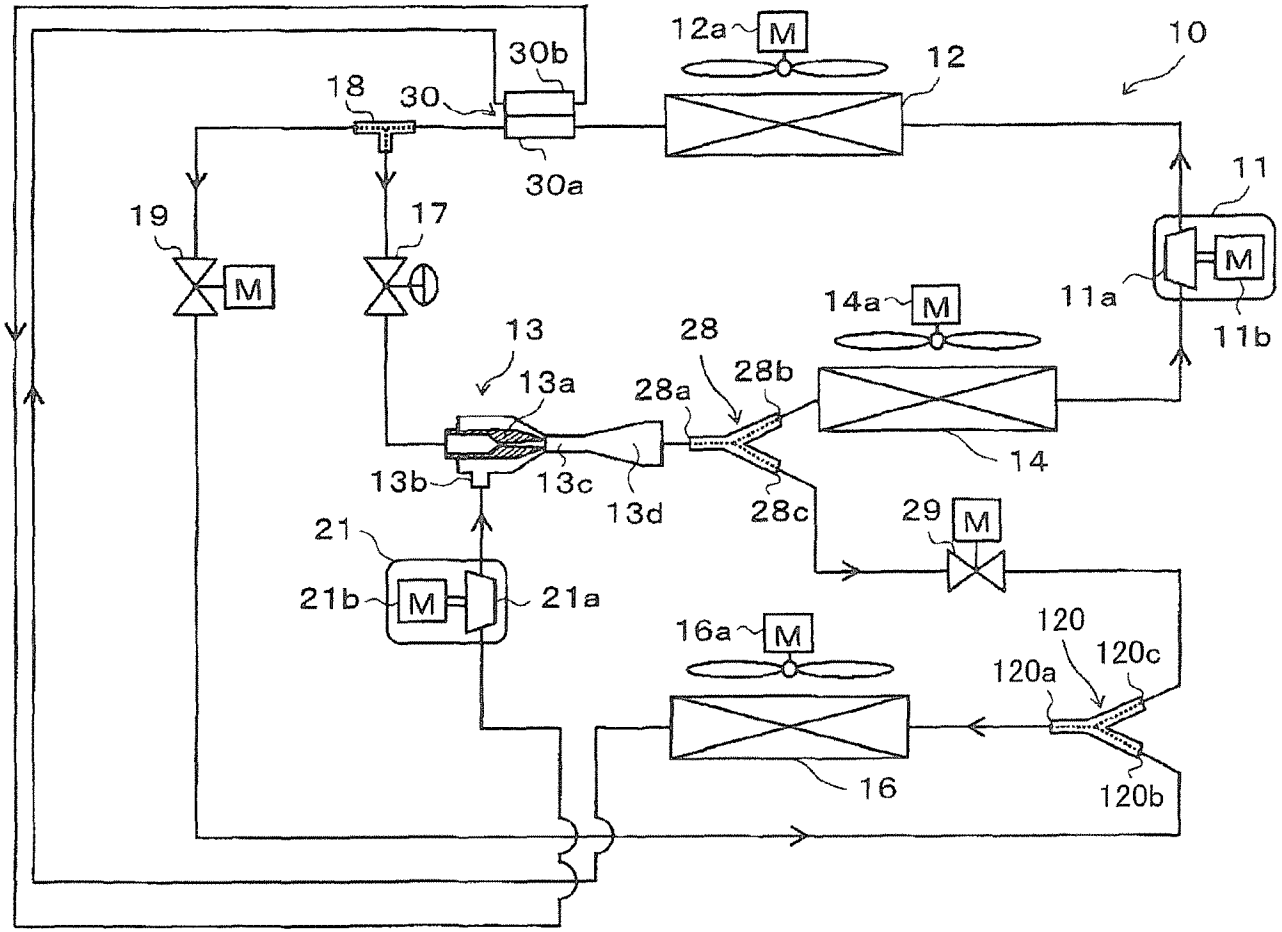
FIG. 83 is an entire schematic diagram of an ejector-type refrigeration cycle device of 45th embodiment.

In the present embodiment, as in the entire schematic diagram of FIG. 83, an inner heat exchanger 30, in which the refrigerant flowing out of the radiator 12 and a low-pressure side refrigerant in the cycle are heat exchanged, is added with respect to the ejector-type refrigeration cycle device 10 of the 43rd embodiment.

The inner heat exchanger 30 is for performing heat exchange between refrigerant flowing through a high-pressure side refrigerant passage 30*a* from a refrigerant outlet side of the radiator 12, and a low-pressure side refrigerant flowing through a low-pressure side refrigerant passage 30*b*. More specifically, in the present embodiment, the refrigerant flowing out of the radiator 12 is the refrigerant passing through a refrigerant passage from the refrigerant outlet side of the radiator 12 toward the inlet port of the first branch portion 18. In contrast, the low-pressure side refrigerant in the cycle of the present embodiment is the refrigerant to be drawn into the second compression mechanism 21*a*.

As a special structure of the inner heat exchanger 30, a double-pipe heat exchange structure may be used, in which an inner pipe forming a low-pressure side refrigerant passage 30*b* is provided inside of an outer pipe forming a high-pressure side refrigerant passage 30*a*. The high-pressure side refrigerant passage 30*a* may be provided as the inner pipe, and the low-pressure side refrigerant passage 30*b* may be provided as the outer pipe.

Furthermore, refrigerant pipes for defining the high-pressure side refrigerant passage 30*a* and the low-pressure side refrigerant passage 30*b* maybe bonded by brazing to have a heat exchange structure. Other configurations in the present embodiment are similar to those of the 43rd embodiment.

Figure 84:
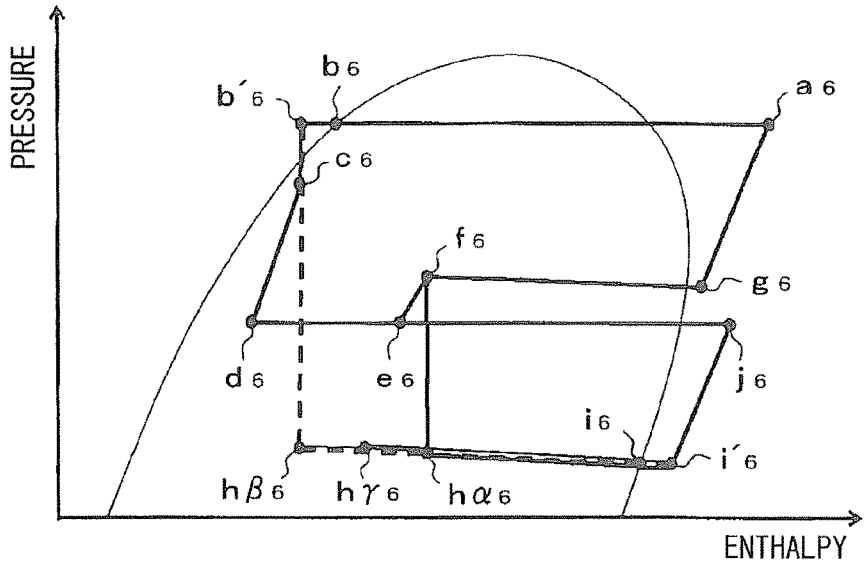
FIG. 84 is a Mollier diagram showing a refrigerant state of the ejector-type refrigeration cycle device of the 45th embodiment.

When the ejector-type refrigeration cycle device 10 of the present embodiment is operated, the enthalpy of the suction side refrigerant of the second compression mechanism 21*a* is increased (point i6→i'6 in FIG. 84), and the enthalpy of the refrigerant flowing into the first branch portion 18 is decreased (point b6→point b'6 in FIG. 84), by the operation of the inner heat exchanger 30, in any one operation mode, as in the Mollier diagram of FIG. 84. Other operation in any one operation mode is similar to that of the 43rd embodiment.

Thus, even in the structure of the present embodiment, the same effects as in (A) to (H) of the 43rd embodiment can be obtained. Therefore, by the operation of the inner heat exchanger 30, the enthalpy of the refrigerant flowing into the discharge side evaporator 14 and the suction side evaporator 16 can be decreased in any operation mode, with respect to the 43rd embodiment.

As a result, the enthalpy difference between the enthalpies of the refrigerant at the refrigerant inlet side and the refrigerant outlet side can be enlarged in the discharge side evaporator 14 and in the suction side evaporator 16, thereby further improving the COP.

(46th Embodiment)

Figure 85:
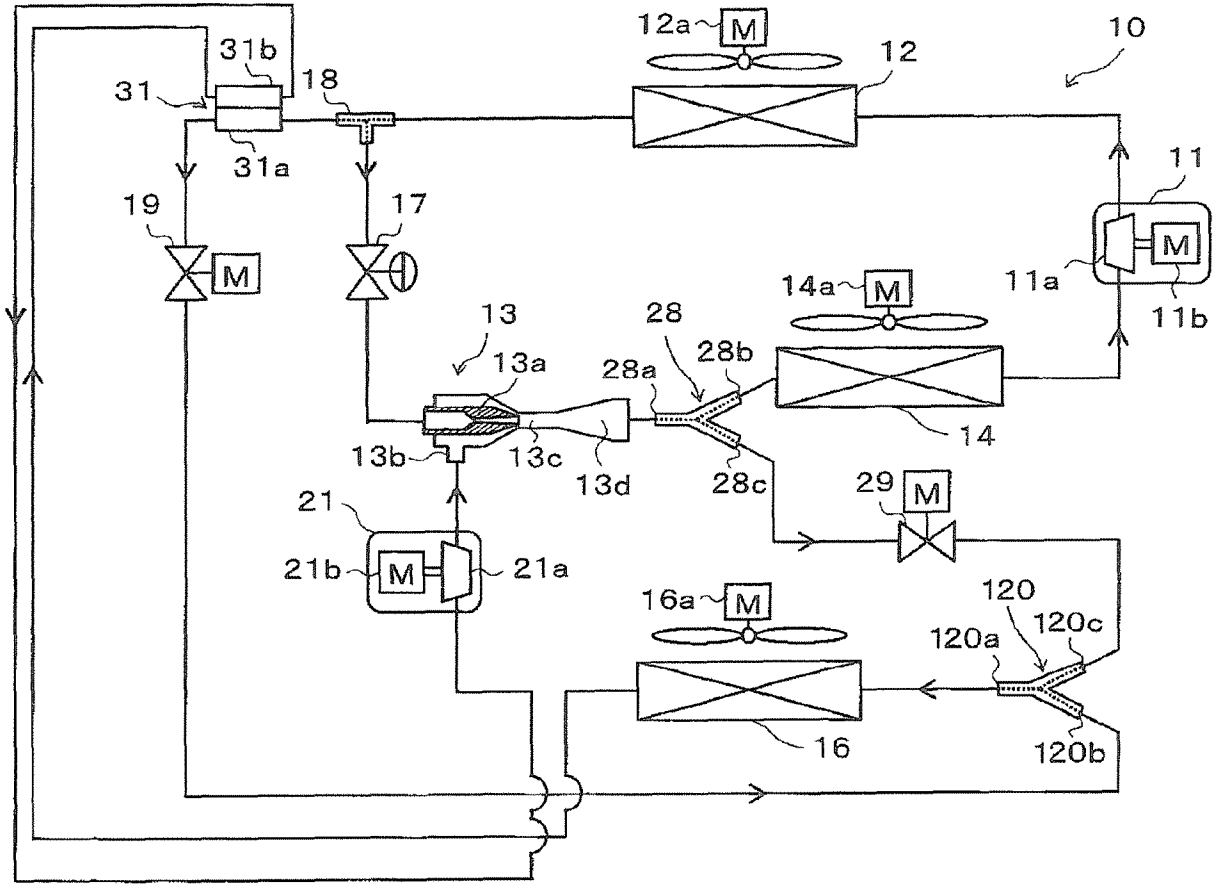
FIG. 85 is an entire schematic diagram of an ejector-type refrigeration cycle device of 46th embodiment.

In the present embodiment, as in the entire schematic diagram of FIG. 85, an inner heat exchanger 31, in which the refrigerant flowing out of the radiator 12 and a low-pressure side refrigerant in the cycle are heat exchanged, is added with respect to the ejector-type refrigeration cycle device 10 of the 43rd embodiment.

The inner heat exchanger 31 is for performing heat exchange between refrigerant flowing through a high-pressure side refrigerant passage 31*a* from a refrigerant outlet side of the radiator 12, and a low-pressure side refrigerant flowing through a low-pressure side refrigerant passage 31*b*. The basic structure of the inner heat exchanger 31 is similar to the inner heat exchanger 30 of the 45th embodiment.

More specifically, in the present embodiment, the refrigerant flowing out of the radiator 12 is the refrigerant passing through a refrigerant passage from the refrigerant outlet side of the first branch portion 18 to the refrigerant inlet side of the first electrical expansion valve 19. In contrast, the low-pressure side refrigerant in the cycle of the present embodiment is the refrigerant to be drawn into the second compression mechanism 21*a*. Other configurations in the present embodiment are similar to those of the 43rd embodiment.

Figure 86:
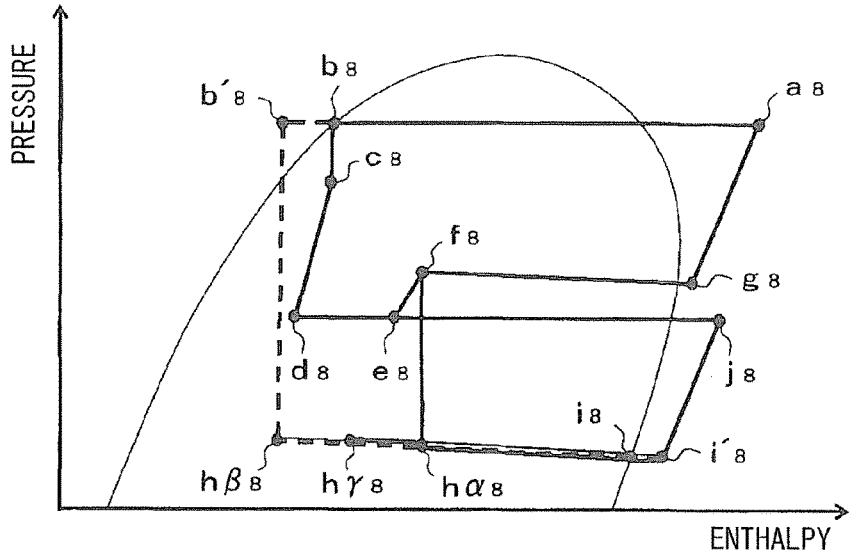
FIG. 86 is a Mollier diagram showing a refrigerant state of the ejector-type refrigeration cycle device of the 46th embodiment.

When the ejector-type refrigeration cycle device 10 of the present embodiment is operated, the enthalpy of the suction side refrigerant and the discharge side refrigerant of the second compression mechanism 21*a* is increased (point i8→point i'8→j8 in FIG. 86), and the enthalpy of the refrigerant flowing into the first electrical expansion valve 19 is decreased (point b8→point b'8 in FIG. 86), in the high-pressure branch operation mode and the simultaneous-branch operation mode, by the operation of the inner heat exchanger 31, as in the Mollier diagram of FIG. 86. Other operation is similar to that of the 43rd embodiment.

Thus, even in the structure of the present embodiment, the same effects as in (A) to (H) of the 43rd embodiment can be obtained. Furthermore, similarly to the 44th embodiment, the enthalpy difference between the enthalpies of the refrigerant at the refrigerant inlet side and the refrigerant outlet side can be enlarged in the discharge side evaporator 14 and in the suction side evaporator 16, thereby further improving the COP.

In the present embodiment, the high-pressure refrigerant flowing in a refrigerant passage from the refrigerant outlet side of the first branch portion 18 to the inlet side of the first electrical expansion valve 19 is heat-exchanged with a low-pressure refrigerant to be drawn to the second compression mechanism 21*a*. Therefore, it can prevent the enthalpy of the refrigerant flowing from the first branch portion 18 to the nozzle portion 13*a* from being unnecessary reduced.

Therefore, further improvement in the COP can be obtained. Because the enthalpy of the refrigerant flowing to the nozzle portion 13*a* is not reduced unnecessary, the recovery energy amount in the nozzle portion 13*a* can be increased.

The detail will be described. The tilt of the iso-enthalpy line in the nozzle portion 13*a* becomes more smooth in accordance with an increase of the enthalpy of the refrigerant flowing into the nozzle portion 13*a*. Therefore, in a case where the refrigerant is expanded in iso-entropy by an equal pressure in the nozzle portion 13*a*, the difference (recovery energy amount) between the enthalpy of the inlet side refrigerant of the nozzle portion 13*a* and the enthalpy of the outlet side refrigerant of the nozzle portion 13*a* becomes larger as the enthalpy of the inlet side refrigerant of the nozzle portion 13*a* becomes higher.

Thus, the recovery energy amount in the nozzle portion 13*a* can be increased in accordance with increase of the enthalpy of the refrigerant flowing into the nozzle portion 13*a*. Thus, in accordance with an increase of the recovery energy amount, a pressure increasing amount in the diffuser portion 13*d* can be increased, thereby further improving the COP.

(47th Embodiment)

Figure 87:
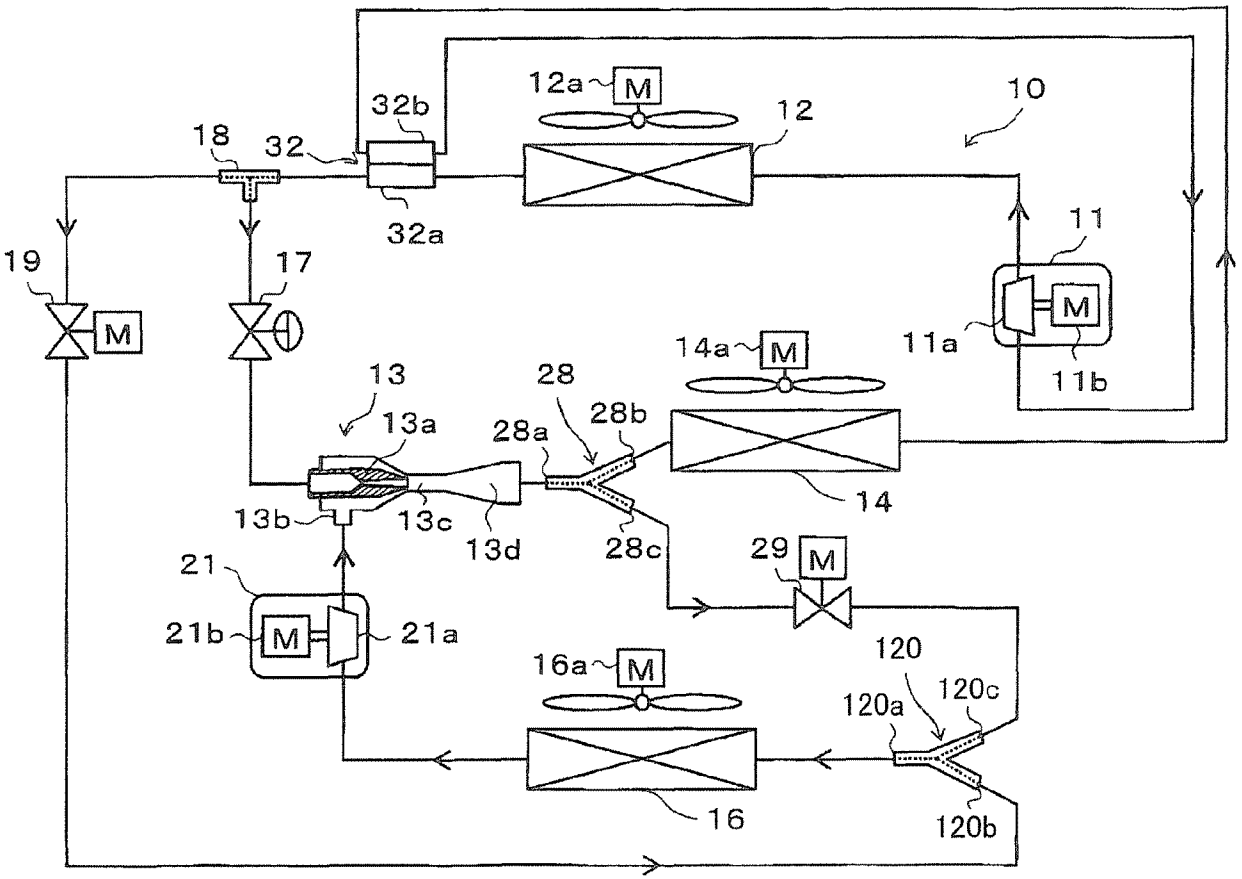
FIG. 87 is an entire schematic diagram of an ejector-type refrigeration cycle device of 47th embodiment.

In the present embodiment, as in the entire schematic diagram of FIG. 87, an inner heat exchanger 32, in which the refrigerant flowing out of the radiator 12 and a low-pressure side refrigerant in the cycle are heat exchanged, is added with respect to the ejector-type refrigeration cycle device 10 of the 43rd embodiment.

The inner heat exchanger 32 is for performing heat exchange between refrigerant flowing through a high-pressure side refrigerant passage 32*a* from a refrigerant outlet side of the radiator 12, and a low-pressure side refrigerant flowing through a low-pressure side refrigerant passage 32*b*. The basic structure of the inner heat exchanger 32 is similar to the inner heat exchanger 30 of the 45th embodiment.

More specifically, in the present embodiment, the refrigerant flowing out of the radiator 12 is the refrigerant passing through a refrigerant passage from the refrigerant outlet side of the radiator 12 toward the inlet port of the first branch portion 18. In contrast, the low-pressure side refrigerant in the cycle of the present embodiment is the refrigerant to be drawn into the first compression mechanism 11*a*. Other configurations in the present embodiment are similar to those of the 43rd embodiment.

Figure 88:
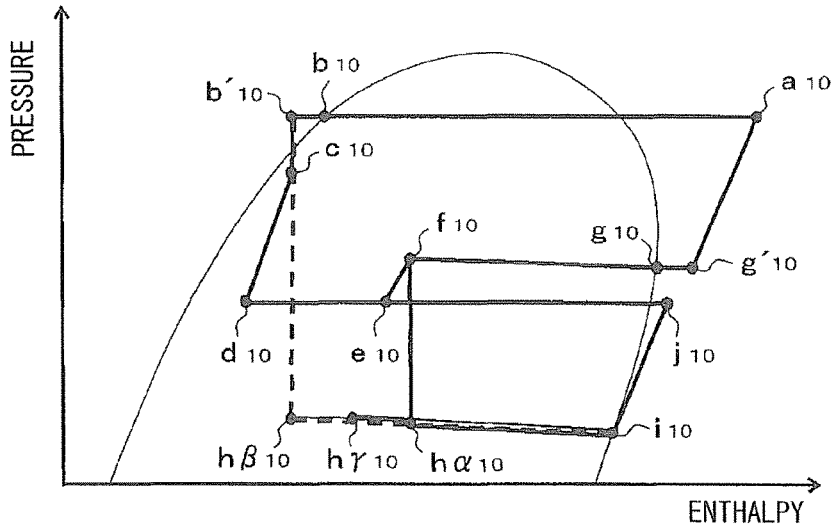
FIG. 88 is a Mollier diagram showing a refrigerant state of the ejector-type refrigeration cycle device of the 47th embodiment.

When the ejector-type refrigeration cycle device 10 of the present embodiment is operated, the enthalpy of the suction side refrigerant of the first compression mechanism 11*a* is increased (point g10→point g'10 in FIG. 88), and the enthalpy of the refrigerant flowing into the first branch portion 18 is decreased (point b10→point b'10 in FIG. 88), by the operation of the inner heat exchanger 32, in any one operation mode, as in the Mollier diagram of FIG. 88. Other operation is similar to that of the 43rd embodiment.

Thus, even in the structure of the present embodiment, the same effects as in (A) to (H) of the 43rd embodiment can be obtained. Furthermore, similarly to the 44th embodiment, the enthalpy difference between the enthalpies of the refrigerant at the refrigerant inlet side and the refrigerant outlet side can be enlarged in the discharge side evaporator 14 and in the suction side evaporator 16, thereby further improving the COP.

(48th Embodiment)

Figure 89:
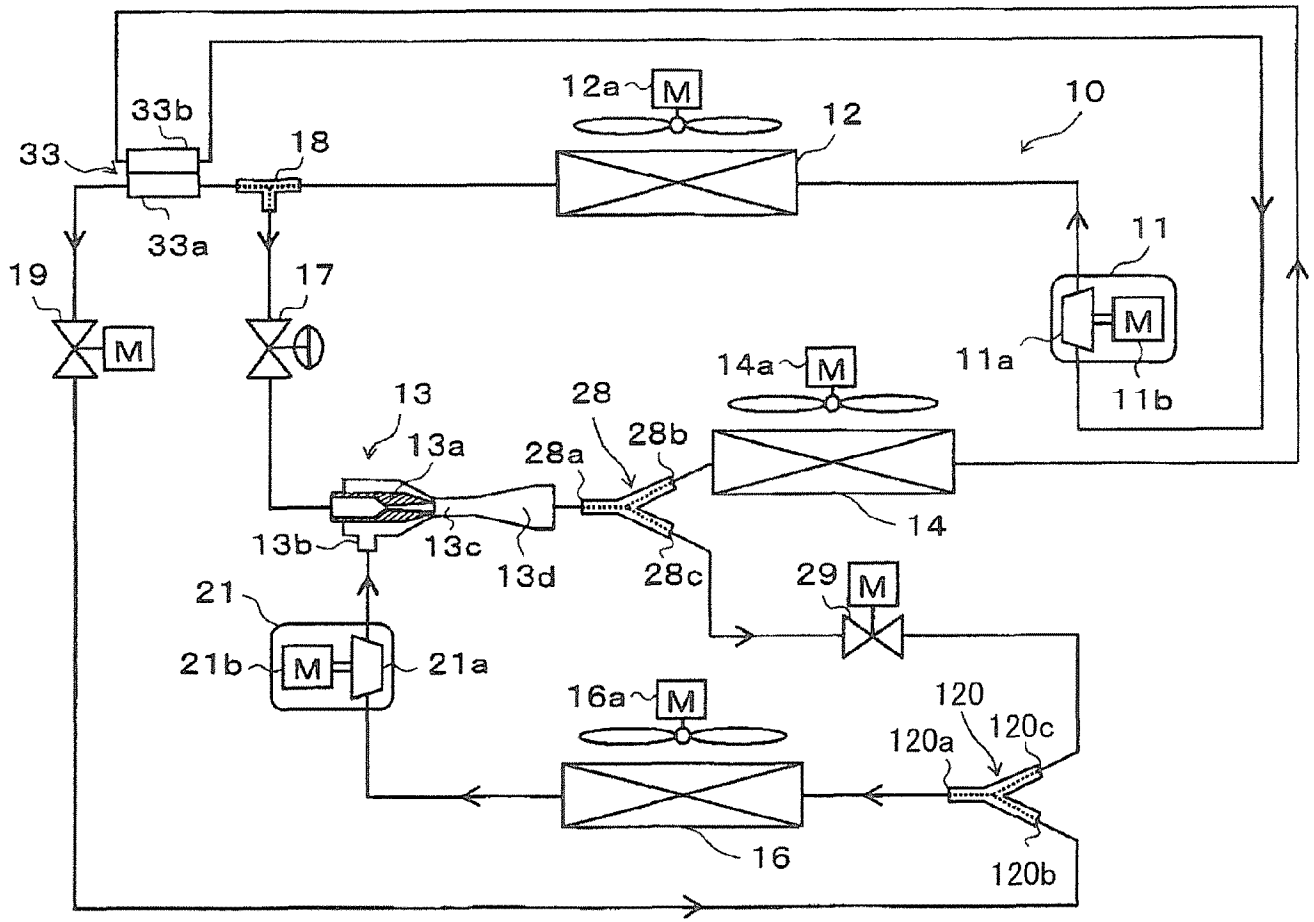
FIG. 89 is an entire schematic diagram of an ejector-type refrigeration cycle device of 48th embodiment.

In the present embodiment, as in the entire schematic diagram of FIG. 89, an inner heat exchanger 33, in which the refrigerant flowing out of the radiator 12 and a low-pressure side refrigerant in the cycle are heat exchanged, is added with respect to the ejector-type refrigeration cycle device 10 of the 43rd embodiment.

The inner heat exchanger 33 is for performing heat exchange between refrigerant flowing through a high-pressure side refrigerant passage 33*a* from a refrigerant outlet side of the radiator 12, and a low-pressure side refrigerant flowing through a low-pressure side refrigerant passage 33*b*. The basic structure of the inner heat exchanger 33 is similar to the inner heat exchanger 30 of the 45th embodiment.

More specifically, in the present embodiment, the refrigerant flowing out of the radiator 12 is the refrigerant passing through a refrigerant passage from the refrigerant outlet side of the first branch portion 18 to the refrigerant inlet side of the first electrical expansion valve 19. In contrast, the low-pressure side refrigerant in the cycle of the present embodiment is the refrigerant to be drawn into the first compression mechanism 11*a*. Other configurations in the present embodiment are similar to those of the 43rd embodiment.

Figure 90:
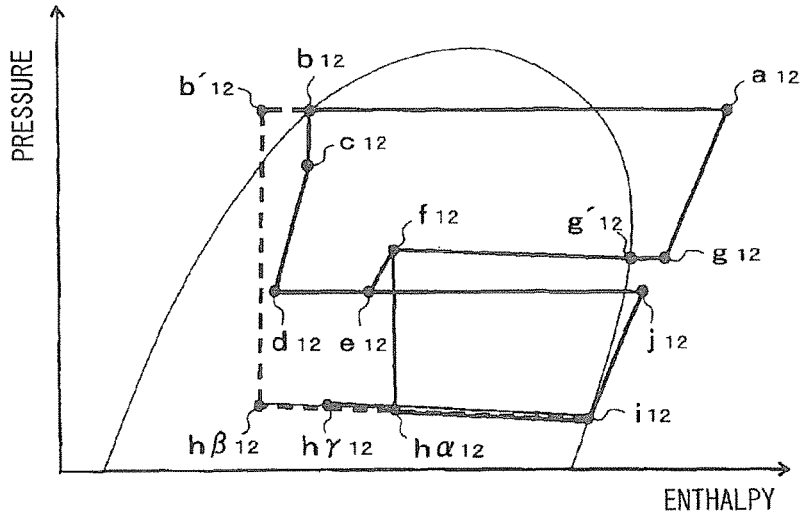
FIG. 90 is a Mollier diagram showing a refrigerant state of the ejector-type refrigeration cycle device of the 48th embodiment.

When the ejector-type refrigeration cycle device 10 of the present embodiment is operated, the enthalpy of the suction side refrigerant of the first compression mechanism 11*a* is increased (point g'12→point g12 in FIG. 90), and the enthalpy of the refrigerant flowing into the first electrical expansion valve 19 is decreased (point b12→point b'12 in FIG. 90), in the high-pressure branch operation mode and the simultaneous-branch operation mode, by the operation of the inner heat exchanger 33, as in the Mollier diagram of FIG. 90. Other operation is similar to that of the 43rd embodiment.

Thus, even in the structure of the present embodiment, the same effects as in (A) to (H) of the 43rd embodiment can be obtained. Furthermore, improvement in the COP can be obtained similarly to the 46th embodiment.

(49th Embodiment)

Figure 91:
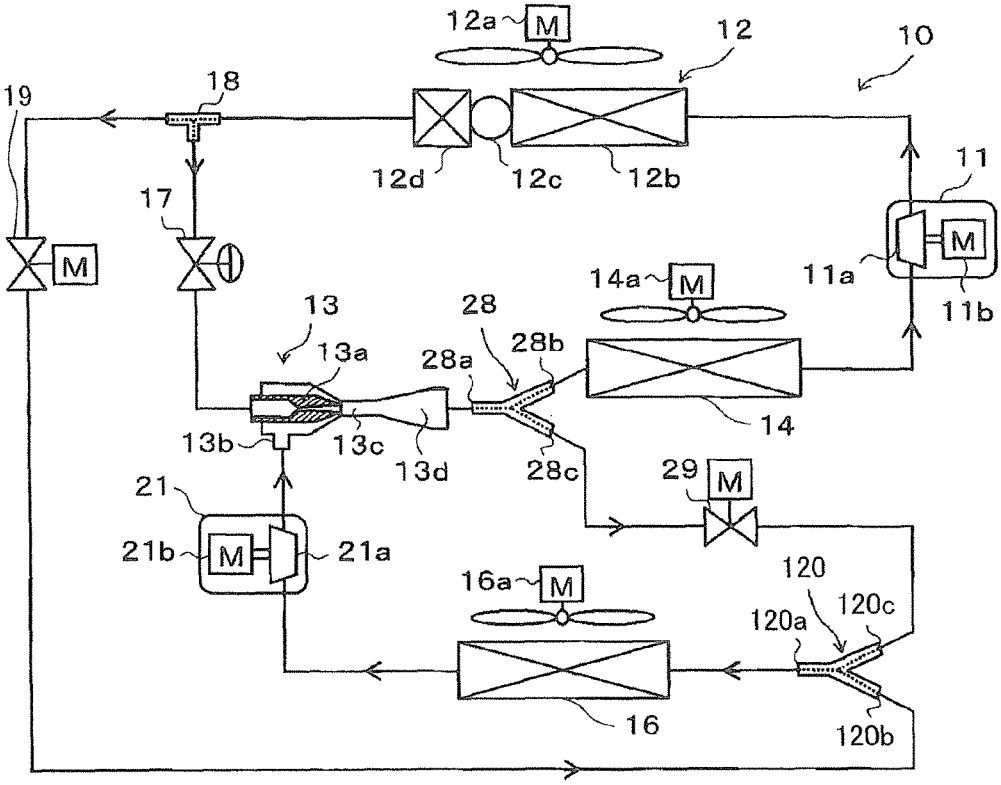
FIG. 91 is an entire schematic diagram of an ejector-type refrigeration cycle device of 49th embodiment.

In the present embodiment, as in the entire schematic diagram of FIG. 91, a structure of the radiator 12 is changed with respect to the ejector-type refrigeration cycle device 10 of the 43rd embodiment.

Specifically, the radiator 12 of the present embodiment is configured as a sub-cool type condenser, which includes a condensation portion 12*b*, a gas-liquid separation portion 12*c* (receiver portion) and a super-cooling portion 12*d*. The condensation portion 12*b* condenses the refrigerant, the gas-liquid separation portion 12*c* separates the refrigerant flowing out of the condensation portion 12*b* into gas refrigerant and liquid refrigerant, and the super-cooling portion 12*d* super-cools the liquid refrigerant flowing out of the gas-liquid separation portion 12*c*. Other configurations in the present embodiment are similar to those of the 43rd embodiment.

Figure 92:
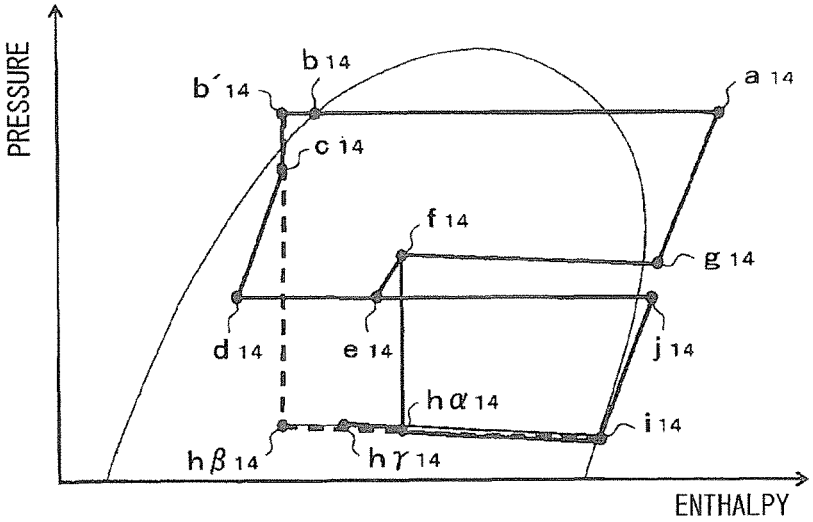
FIG. 92 is a Mollier diagram showing a refrigerant state of the ejector-type refrigeration cycle device of the 49th embodiment.

When the ejector-type refrigeration cycle device 10 of the present embodiment is operated, the refrigerant condensed in the condensation portion 12*b* of the radiator 12 is separated into gas refrigerant and liquid refrigerant in the gas-liquid separation portion 12*c*, in any one operation mode, as in the Mollier diagram of FIG. 92. Furthermore, the saturated liquid refrigerant separated in the gas-liquid separation portion 12*c* is super-cooled in the supercooling portion 12*d* (point b14→point b'14 in FIG. 92). Other operation is similar to that of the 43rd embodiment.

Thus, even in the structure of the present embodiment, the same effects as in (A) to (H) of the 43rd embodiment can be obtained. Therefore, in any one operation mode, the enthalpy of the refrigerant flowing into the discharge side evaporator 14 and the suction side evaporator 16 can be decreased, with respect to the 43rd embodiment.

As a result, the enthalpy difference between the enthalpies of the refrigerant at the refrigerant inlet side and the refrigerant outlet side can be enlarged in the discharge side evaporator 14 and in the suction side evaporator 16, thereby further improving the COP.

At this time, it can prevent the enthalpy of the suction side refrigerant (i.e., low-pressure side refrigerant in the cycle) of the second compression mechanism 21*a* from being unnecessary increased (point i14 in FIG. 92), unlike a case where the inner heat exchanger 30 of the 45th embodiment is used. Thus, it can prevent the density of the suction refrigerant of the second compression mechanism 21*a* from being lowered, and thereby it is possible to reduce the refrigerant evaporation pressure (refrigerant evaporation temperature) in the suction side evaporator 16, with respect to the 45th embodiment.

(50th Embodiment)

Figure 93:
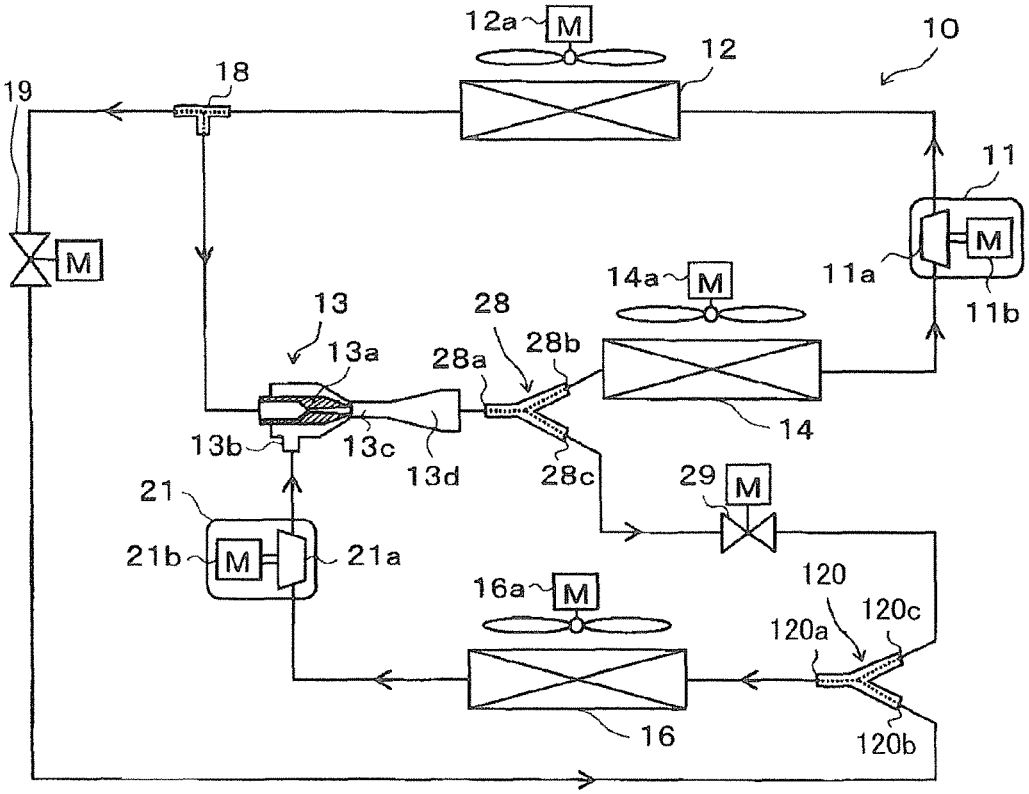
FIG. 93 is an entire schematic diagram of an ejector-type refrigeration cycle device of 50th embodiment.

In the above respective 43rd to 49th embodiments, a flon-based refrigerant is used as the refrigerant for a refrigerant cycle of the ejector-type refrigeration cycle device 10 to form a subcritical refrigerant cycle. However, in the present embodiment, carbon dioxide is used as the refrigerant to form a super-critical refrigerant cycle in which a refrigerant pressure discharged from the first compressor 11 exceeds the critical pressure of the refrigerant. In the present embodiment, as in the entire schematic diagram of FIG. 93, the thermal expansion valve 17 is removed from the ejector-type refrigeration cycle device 10 of the 43rd embodiment. Other configurations in the present embodiment are similar to those of the 43rd embodiment.

Next, operation of an ejector-type refrigeration cycle device 10 of the present embodiment will be described with reference to the Mollier diagram of FIG. 94. When the ejector-type refrigeration cycle device 10 of the present embodiment is operated, the refrigerant discharged from the first compressor 11 is cooled in the radiator 12. At this time, the refrigerant passing through the radiator 12 is cooled in a super-critical state without being condensed (point a16→point b16 of FIG. 94).

The refrigerant flowing out of the radiator 12 flows into the first branch portion 18, and is branched by the branch portion 18 into a flow of the refrigerant flowing toward the nozzle portion 13*a* of the ejector 13 and a flow of the refrigerant flowing toward the first thermal expansion valve 19 (point b16 of FIG. 94), in the high-pressure branch operation mode and the simultaneous-branch operation mode. The super-critical high-pressure refrigerant flowing into the nozzle portion 13*a* of the ejector 13 from the first branch portion 18 is decompressed and expanded by the nozzle portion 13*a* in iso-entropy (point b16→point d16 in FIG. 94).

Figure 94:
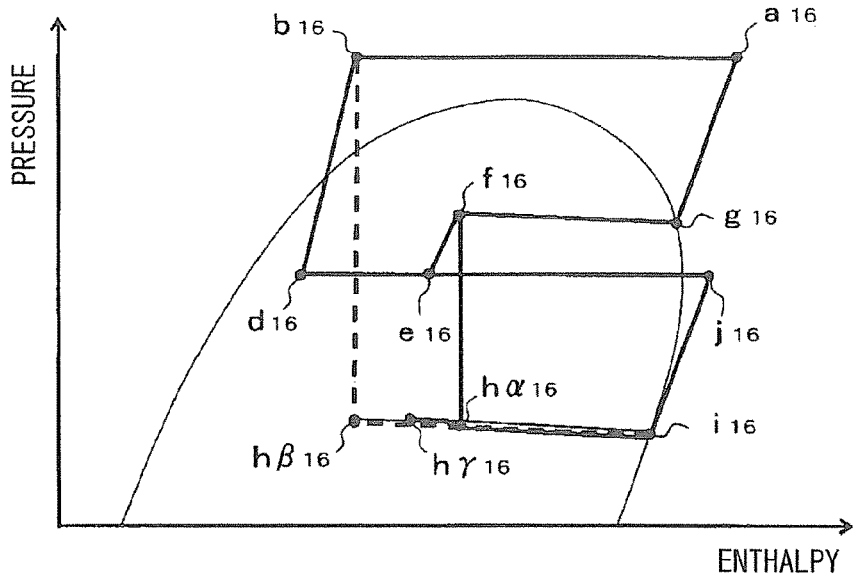
FIG. 94 is a Mollier diagram showing a refrigerant state of the ejector-type refrigeration cycle device of the 50th embodiment.

On the other hand, in the high-pressure branch operation mode and the simultaneous operation mode, the high-pressure refrigerant flowing from the first branch portion 18 into the first thermal expansion valve 19 is decompressed and expanded in iso-enthalpy at the first thermal expansion valve 19, thereby reducing the refrigerant pressure (point b16→point hβ16, shown by chain line in FIG. 94).

Other operation is similar to that of the 43rd embodiment. Thus, even in the structure of the present embodiment, the same effects as in (A) to (F) of the 43rd embodiment can be obtained.

Furthermore, in the super-critical refrigerant cycle, the high-pressure side refrigerant pressure becomes higher than that in the sub-critical refrigerant cycle. Therefore, the pressure difference between the high pressure side and the low pressure side in the cycle can be enlarged (point b16→point d16 of FIG. 94), thereby increasing the decompression amount in the nozzle portion 13*a* of the ejector 13. Furthermore, the enthalpy difference (recovery energy amount) between the enthalpies of the refrigerant at the refrigerant inlet side of the nozzle portion 13*a* and the refrigerant at the refrigerant outlet side of the nozzle portion 13*a* can be enlarged, thereby further improving the COR (51st Embodiment)

Figure 95:
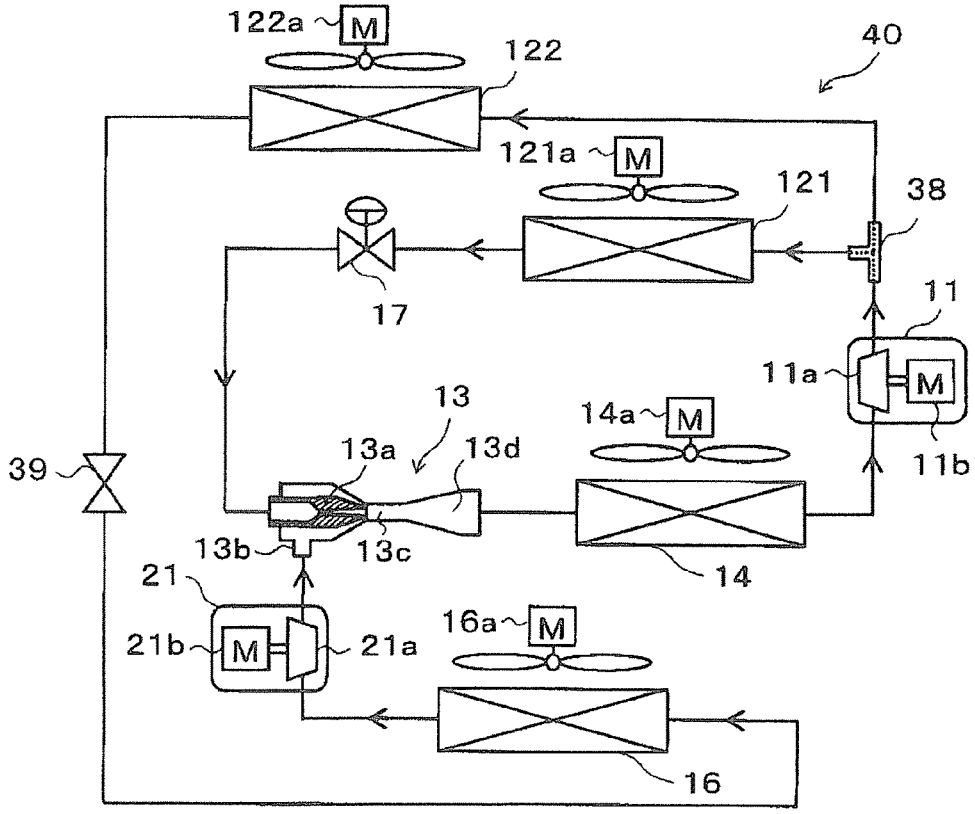
FIG. 95 is an entire schematic diagram of an ejector-type refrigeration cycle device of 51st embodiment.

As in the entire schematic diagram of FIG. 95, an ejector-type refrigeration cycle device 40 of the present embodiment is provided with a third branch portion 38 that has a structure similar to the first branch portion 18 of the 43rd embodiment and is arranged at a refrigerant discharge side of the first compressor 11. One refrigerant outlet of the third branch portion 38 is connected to a first radiator 121, and the other refrigerant outlet of the third branch portion 38 is connected to a second radiator 122.

The first radiator 121 is a heat-radiation heat exchanger that exchanges heat between high-pressure refrigerant flowing out of the one refrigerant outlet of the third branch portion 38 and outside air (i.e., air outside the room) blown by a cooling fan 121*a*, so as to cool the high-pressure refrigerant. The second radiator 122 is a heat-radiation heat exchanger that exchanges heat between high-pressure refrigerant flowing out of the other refrigerant outlet of the third branch portion 38 and outside air (i.e., air outside the room) blown by a cooling fan 122*a*, so as to cool the high-pressure refrigerant.

In the ejector-type refrigeration cycle device 40 of the present embodiment, the heat exchange area of the first radiator 121 is reduced with respect to the second radiator 122, so that the heat-exchanging capacity (heat radiating performance) of the first radiator 121 is made lower than the heat-exchanging capacity of the second radiator 122. The cooling fans 121*a*, 122*a* are electrical blowers in which its rotational speed (air blowing amount) is controlled by a control voltage output from the control device.

A receiver (i.e., liquid receiver) may be provided at a refrigerant outlet side of the first or second radiator 121, 122, to be used as a high-pressure side gas-liquid separator in which the refrigerant flowing out of the first or second radiator 121, 122 is separated into gas refrigerant and liquid refrigerant, and the liquid refrigerant is stored as surplus refrigerant. Furthermore, the saturated liquid refrigerant separated from the receiver is introduced to a downstream side.

The thermal expansion valve 17 is connected to a refrigerant outlet side of the first radiator 121, as a high-pressure side decompression means similarly to the 43rd embodiment. The refrigerant outlet side of the thermal expansion valve 17 is connected to a refrigerant inlet side of the nozzle portion 13*a* of the ejector 13, similarly to 43rd embodiment. The discharge side evaporator 14 is connected to the outlet side of the diffuser portion 13*d* of the ejector 13.

A fixed throttle 39 as a suction side decompression means is connected to a refrigerant outlet side of the second radiator 122. As the fixed throttle 39, a capillary tube, an orifice or the like can be used. The suction side evaporator 16 is connected to a refrigerant outlet side of the fixed throttle 39, similarly to the 43rd embodiment. In the present embodiment, the other configurations are similar to the ejector-type refrigeration cycle device 10 of the 43rd embodiment.

Next, operation of the present embodiment with the above structure will be described based on the Mollier diagram shown in FIG. 96. When the operation switch of the operation panel is turned on, the control device causes the first and second electrical motors 11*b*, 21*b*, the cooling fans 121*a*, 122*a*, the blower fans 14*a*, 16*a* to be operated. Thus, the first compressor 11 draws refrigerant, compresses the drawn refrigerant, and discharges the compressed refrigerant. The state of the refrigerant at this time is point a18 of FIG. 96.

Figure 96:
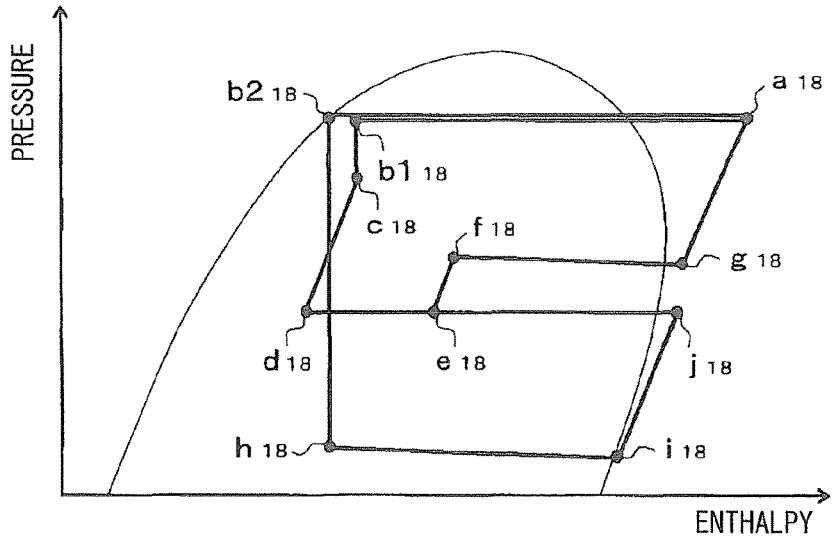
FIG. 96 is a Mollier diagram showing a refrigerant state of the ejector-type refrigeration cycle device of the 51st embodiment.

High-temperature and high-pressure gas refrigerant discharged from the first compressor 11 flows into the third branch portion 38, and is branched by the branch portion 38 into a flow of the refrigerant flowing toward the first radiator 121 and a flow of the refrigerant flowing toward the second radiator 122 (point a18 of FIG. 96).

In the present embodiment, passage areas (pressure loss characteristics) of respective passages in the third branch portion 38 are determined, such that a flow ratio Gr1/Gr2 can be set at an optimal ratio at which a high COP can be obtained in the entire cycle. Here, the flow ratio Gr1/Gr2 is a ratio of a refrigerant flow amount Gr1 flowing to the first radiator 121 to a refrigerant flow amount Gr2 flowing toward the second radiator 122.

The refrigerant flowing into the first radiator 121 is heat-exchanged with the blown air (outside air) blown by the cooling fan 121*a* to be radiated and condensed (point a18→point b118 in FIG. 96). On the other hand, the refrigerant flowing into the second radiator 122 is heat-exchanged with the blown air (outside air) blown by the cooling fan 122*a* to be radiated and condensed (point a18→point b218 in FIG. 96).

Because the heat exchanging capacity of the first radiator 121 is set lower than the heat exchanging capacity of the second radiator 122, the enthalpy of the refrigerant flowing out of the first radiator 121 can become higher than the enthalpy of the refrigerant flowing out of the second radiator 122.

Furthermore, the refrigerant flowing out of the first radiator 121 flows into the thermal expansion valve 17, and is decompressed and expanded in iso-enthalpy to become in a gas-liquid two-phase state (point b118→point c18 in FIG. 96). At this time, the valve open degree of the thermal expansion valve 17 is adjusted so that a super heat degree (point g18 in FIG. 96) of the refrigerant at the refrigerant outlet side of the discharge side evaporator 14 becomes a predetermined value.

The middle-pressure refrigerant flowing out of the thermal expansion valve 17 is decompressed and expanded by the nozzle portion 13*a* in iso-entropy (point c18→point d18 in FIG. 96). Furthermore, the jet refrigerant jetted from the nozzle portion 13*a* and the suction refrigerant drawn from the refrigerant suction port 13*b* are mixed in the mixing portion 13*c* of the ejector 13 (point d18→point e18 in FIG. 96), and is pressurized in the diffuser portion 13*d* of the ejector 13 (point e18→point f18 in FIG. 96).

The refrigerant flowing out of the diffuser portion 13*c* flows into the discharge side evaporator 14, and is evaporated by absorbing heat from air inside of the refrigerating room, blown by the blower fan 14*a* (point f18→point g18 in FIG. 96). Thus, the air blown into the interior of the refrigerating room is cooled. The gas refrigerant flowing out of the discharge side evaporator 14 is drawn into the first compressor 11, and is compressed again (point g18→point a18 in FIG. 96).

On the other hand, liquid refrigerant flowing out of the second radiator 122 is decompressed and expanded in iso-enthalpy at the fixed throttle 39, thereby reducing the refrigerant pressure (point b218→point h18 in FIG. 96). The refrigerant decompressed and expanded at the fixed throttle 39 flows into the suction side evaporator 16, and is evaporated by absorbing heat from air inside of the freezing room, blown by the blower fan 16*a* (point h18→point i18 in FIG. 96). Thus, the air blown into the interior of the room is cooled.

The refrigerant flowing out of the suction side evaporator 16 is drawn into the second compressor 21 to be compressed again (point i18→point j18 in FIG. 96), and then is drawn into the refrigerant suction port 13*b* of the ejector 13 (point j18→point e18 in FIG. 96). The other operation such as the control of the pressurizing amount in the first and second compression mechanisms 11*a*, 21*a* is similar to that of the 43rd embodiment.

The ejector-type refrigeration cycle device 40 of the present embodiment is operated above, and thereby the effects (A), (B), (D), (F)-(H) of the 43rd embodiment can be obtained.

Furthermore, the heat radiation capacity of the first radiator 121 and the heat radiation capacity of the second radiator 122 can be changed independently. Therefore, the heat radiation capacity of the second radiator 122 can be easily suited to the heat absorbing capacity of the suction side evaporator 16, and the heat radiation capacity of the first and second radiators 121, 122 can be easily suited to the heat absorbing capacity of the discharge side evaporator 14. Therefore, it is easy to stabilize the operation of a cycle.

Furthermore, in the present embodiment, because the heat exchanging capacity of the first radiator 121 is reduced than that of the second radiator 122, it can prevent the enthalpy of the refrigerant flowing to the nozzle portion 13*a* of the ejector 13 from being unnecessary reduced. Therefore, the recovery energy in the nozzle portion 13*a* can be increased, and improvement in the COP can be obtained similarly to the 46th embodiment.

(52nd Embodiment)

Figure 97:
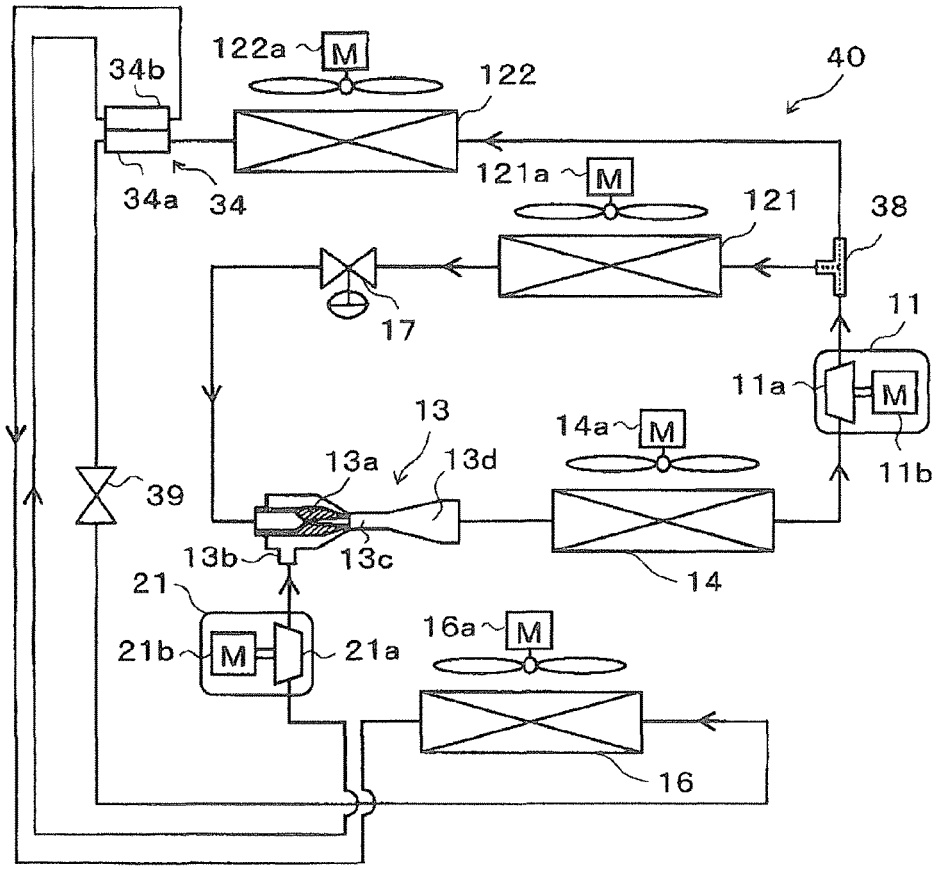
FIG. 97 is an entire schematic diagram of an ejector-type refrigeration cycle device of 52nd embodiment.

In the present embodiment, as in the entire schematic diagram of FIG. 97, an inner heat exchanger 34, in which the refrigerant flowing out of the second radiator 122 and a low-pressure side refrigerant in the cycle are heat exchanged, is added with respect to the ejector-type refrigeration cycle device 40 of the 51st embodiment.

The inner heat exchanger 34 is for performing heat exchange between refrigerant flowing through a high-pressure side refrigerant passage 34*a* from a refrigerant outlet side of the second radiator 122, and a low-pressure side refrigerant flowing through a low-pressure side refrigerant passage 34*b*. The basic structure of the inner heat exchanger 34 is similar to the inner heat exchanger 30 of the 45th embodiment. More specifically, the low-pressure side refrigerant in the cycle of the present embodiment is the refrigerant to be drawn into the second compression mechanism 21*a*. Other configurations in the present embodiment are similar to those of the 51st embodiment.

Figure 98:
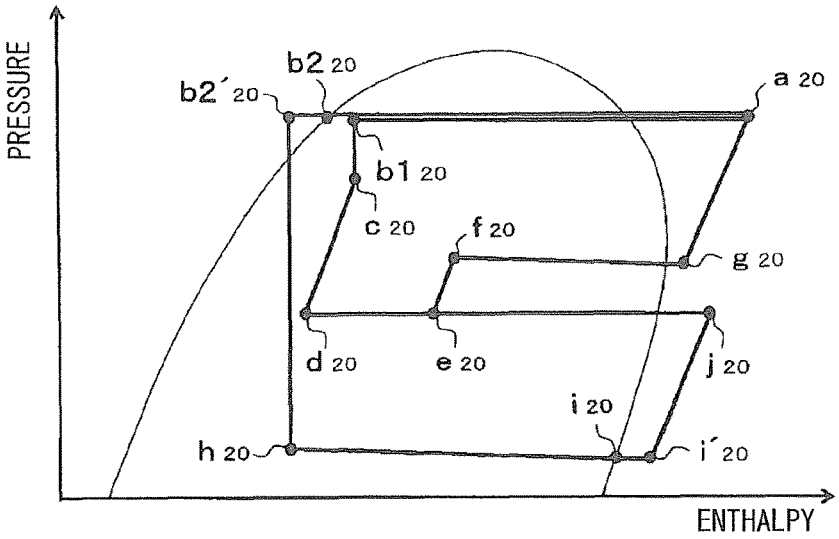
FIG. 98 is a Mollier diagram showing a refrigerant state of the ejector-type refrigeration cycle device of the 52nd embodiment.

When the ejector-type refrigeration cycle device 40 of the present embodiment is operated, as in the Mollier diagram of FIG. 98, the enthalpy of the suction side refrigerant of the second compression mechanism 21*a* is increased (point i20→point i'20 in FIG. 98), and the enthalpy of the refrigerant flowing into the fixed throttle 39 is decreased (point b220→point 2'20 in FIG. 98), by the operation of the inner heat exchanger 34. Other operation is similar to that of the 51st embodiment.

Thus, even in the structure of the present embodiment, the same effects as in the 51st embodiment can be obtained. Therefore, the enthalpy of the refrigerant flowing into the suction side evaporator 16 can be decreased by the action of the inner heat exchanger 34. Thus, the enthalpy difference between the enthalpies of the refrigerant at the refrigerant inlet side and the refrigerant outlet side can be enlarged in the suction side evaporator 16, thereby further improving the COP.

(53rd Embodiment)

Figure 99:
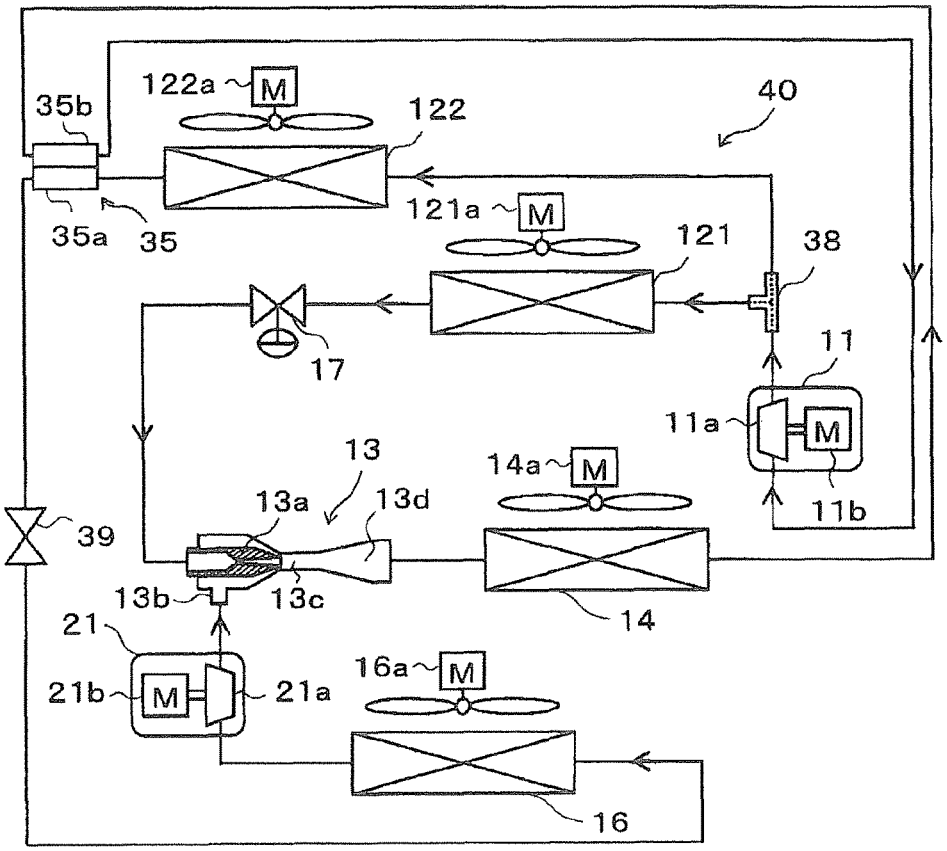
FIG. 99 is an entire schematic diagram of an ejector-type refrigeration cycle device of 53rd embodiment.

In the present embodiment, as in the entire schematic diagram of FIG. 99, an inner heat exchanger 35, in which the refrigerant flowing out of the second radiator 122 and a low-pressure side refrigerant in the cycle are heat exchanged, is added with respect to the ejector-type refrigeration cycle device 40 of the 51st embodiment.

The inner heat exchanger 35 is for performing heat exchange between refrigerant flowing through a high-pressure side refrigerant passage 35*a* from a refrigerant outlet side of the second radiator 122, and a low-pressure side refrigerant flowing through a low-pressure side refrigerant passage 35*b*. The basic structure of the inner heat exchanger 35 is similar to the inner heat exchanger 30 of the 45th embodiment. More specifically, the low-pressure side refrigerant in the cycle of the present embodiment is the refrigerant to be drawn into the first compression mechanism 11*a*. Other configurations in the present embodiment are similar to those of the 51st embodiment.

Figure 100:
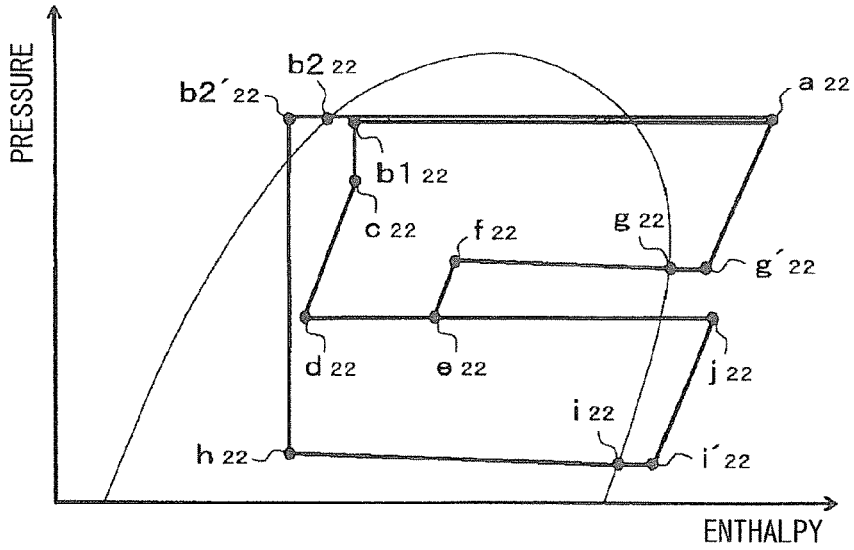
FIG. 100 is a Mollier diagram showing a refrigerant state of the ejector-type refrigeration cycle device of the 53rd embodiment.

When the ejector-type refrigeration cycle device 40 of the present embodiment is operated, as in the Mollier diagram of FIG. 100, the enthalpy of the suction side refrigerant of the first compression mechanism 11*a* is increased (point g22→point g'22 in FIG. 100), and the enthalpy of the refrigerant flowing into the fixed throttle 39 is decreased (point b222→point 2'22 in FIG. 100), by the operation of the inner heat exchanger 35. Other operation is similar to that of the 51st embodiment.

Thus, even in the structure of the present embodiment, the same effects as in the 51st embodiment can be obtained. Furthermore, by the operation of the inner heat exchanger 35, the enthalpy difference between the enthalpies of the refrigerant at the refrigerant inlet side and the refrigerant outlet side can be enlarged in the suction side evaporator 16, thereby increasing the cooling capacity and further improving the COP.

(54th Embodiment)

Figure 101:
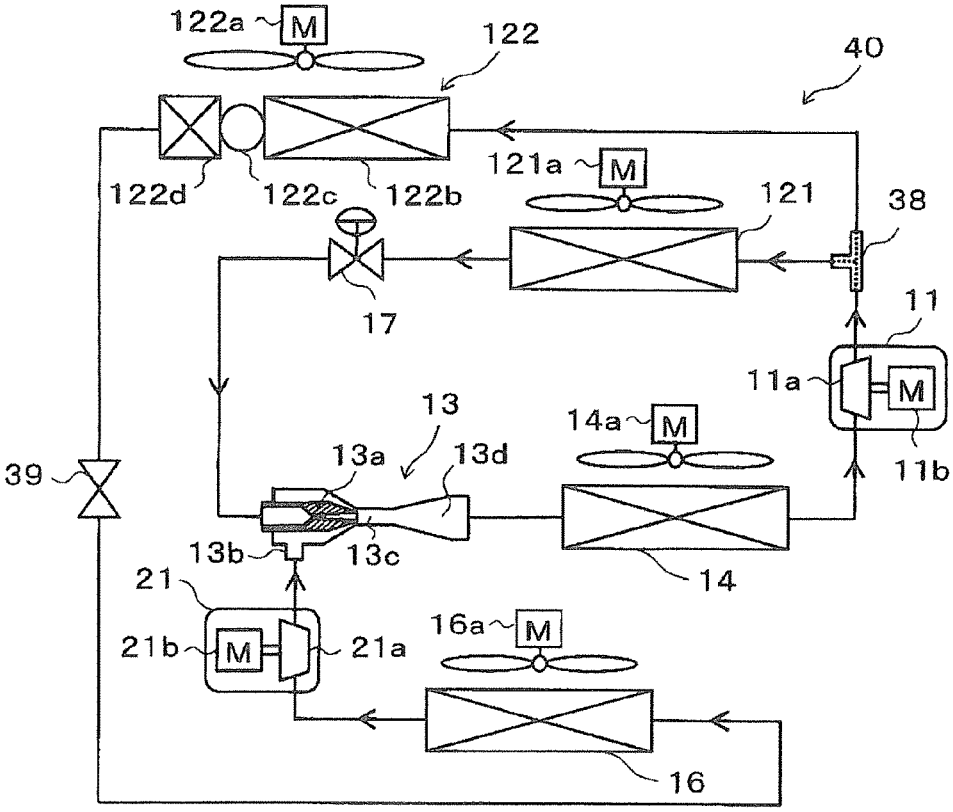
FIG. 101 is an entire schematic diagram of an ejector-type refrigeration cycle device of 54th embodiment.

In the present embodiment, as in the entire schematic diagram of FIG. 101, a structure of the second radiator 122 is changed with respect to the ejector-type refrigeration cycle device 40 of the 51st embodiment.

The basic structure of the second radiator 122 of the present embodiment is similar to the radiator 12 of the 49th embodiment. Therefore, the second radiator 122 of the present embodiment is a sub-cool type condenser that includes a condensation portion 122*b*, a gas-liquid separation portion 122*c* (receiver portion), and a super-cooling portion 122*d*. Other configurations in the present embodiment are similar to those of the 51st embodiment.

Figure 102:
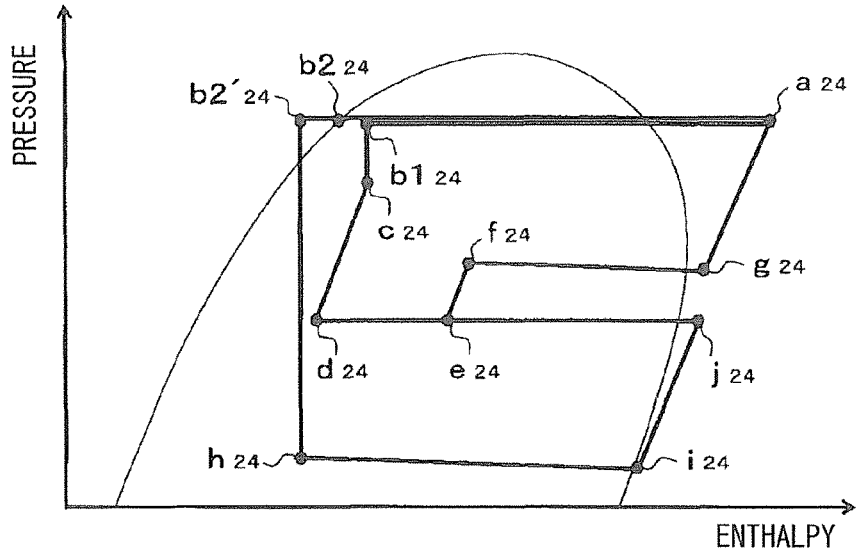
FIG. 102 is a Mollier diagram showing a refrigerant state of the ejector-type refrigeration cycle device of the 54th embodiment.

When the ejector-type refrigeration cycle device 40 of the present embodiment is operated, the refrigerant condensed in the condensation portion 122*b* of the second radiator 122 is separated into gas refrigerant and liquid refrigerant in the gas-liquid separation portion 122*c*, as in the Mollier diagram of FIG. 102. Furthermore, the saturated liquid refrigerant separated in the gas-liquid separation portion 122*c* is supercooled in the supercooling portion 122*d* (point b224→point b2'24 in FIG. 102). Other operation is similar to that of the 51st embodiment.

Thus, even in the structure of the present embodiment, the same effects as in the 51st embodiment can be obtained. Furthermore, because the enthalpy of the refrigerant flowing into the suction side evaporator 16 can be reduced, the enthalpy difference between the enthalpies of the refrigerant at the refrigerant inlet side and the refrigerant outlet side can be enlarged in the suction side evaporator 16, thereby increasing the cooling capacity and further improving the COP.

Thus, similarly to 49th embodiment, it is possible to reduce the refrigerant evaporation pressure (refrigerant evaporation temperature) in the suction side evaporator 16, with respect to the 52nd embodiment.

(55th Embodiment)

Figure 103:
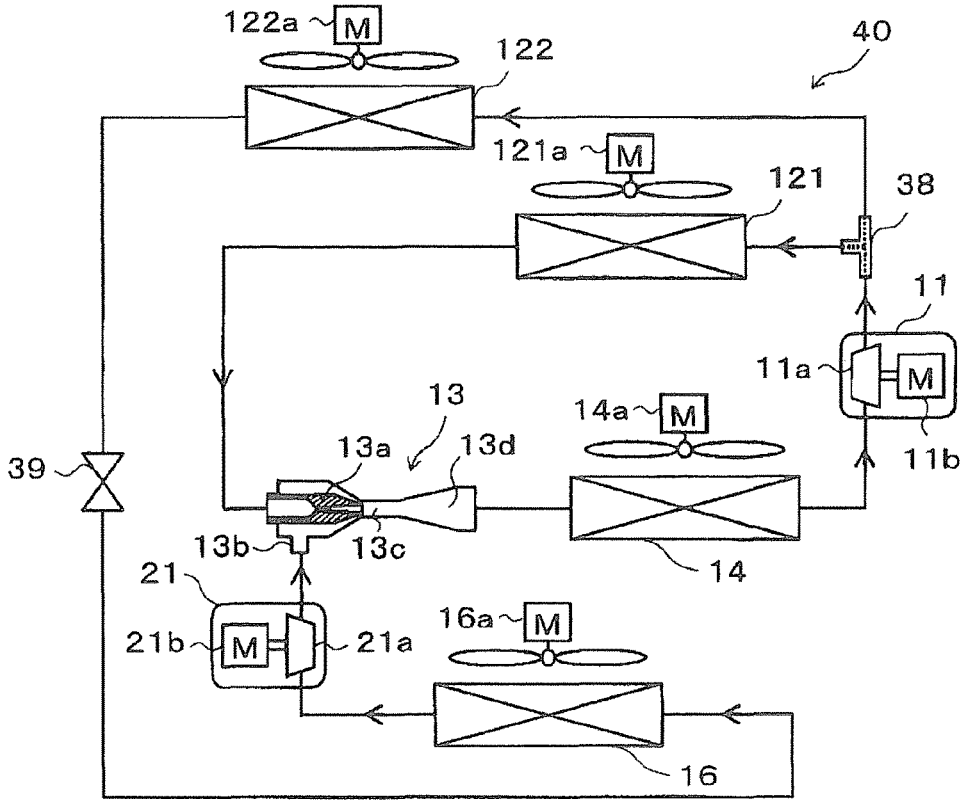
FIG. 103 is an entire schematic diagram of an ejector-type refrigeration cycle device of 55th embodiment.

In the present embodiment, as in the entire schematic diagram of FIG. 103, the thermal expansion valve 17 is removed with respect to the 51st embodiment, and carbon dioxide is used as the refrigerant similarly to the 50th embodiment thereby configuring a super-critical refrigerant cycle. Other configurations in the present embodiment are similar to those of the 51st embodiment.

Figure 104:
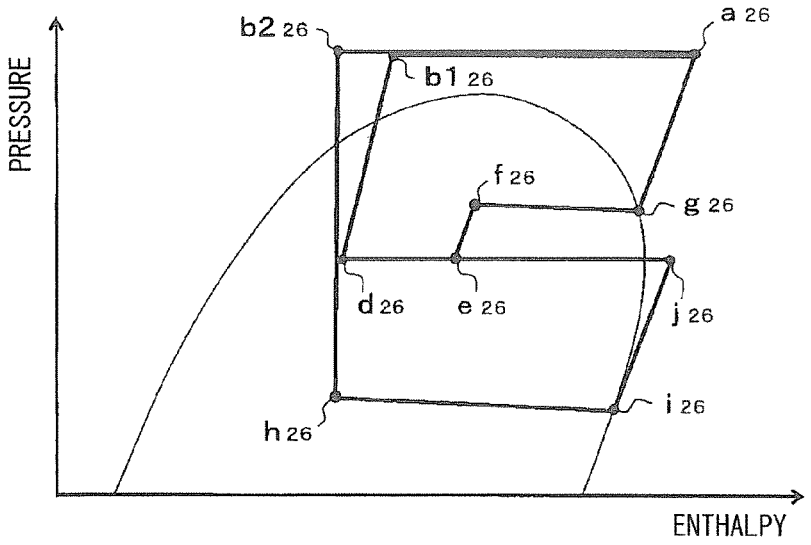
FIG. 104 is a Monier diagram showing a refrigerant state of the ejector-type refrigeration cycle device of the 55th embodiment.

When the ejector-type refrigeration cycle device 40 of the present embodiment is operated, the refrigerant discharged from the first compressor 21 is branched at the third branch portion 38, and is respectively cooled in the first and second radiators 121, 122, as in the Mollier diagram of FIG. 104. At this time, the refrigerant passing through the first and second radiators 121, 122 is cooled in a super-critical state without being condensed (point a26→point b126, point a26→point b226 of FIG. 104).

The super-critical high-pressure refrigerant flowing into the nozzle portion 13*a* of the ejector 13 from the first radiator 121 is decompressed and expanded by the nozzle portion 13*a* in iso-entropy (point b126→point d26 in FIG. 104). On the other hand, the super-critical high-pressure refrigerant flowing out of the second radiator 122 is decompressed and expanded in iso-enthalpy at the fixed throttle 39, thereby reducing the refrigerant pressure (point b226→point h26 in FIG. 104). Other operation is similar to that of the 51st embodiment.

Thus, even in the structure of the present embodiment, the same effects as in (A), (B), (D), (F) of the 43rd embodiment can be obtained. Furthermore, improvement in the COP, due to the recovery energy amount in the nozzle portion 13*a*, can be obtained similarly to 50th embodiment.

(56th Embodiment)

Figure 105:
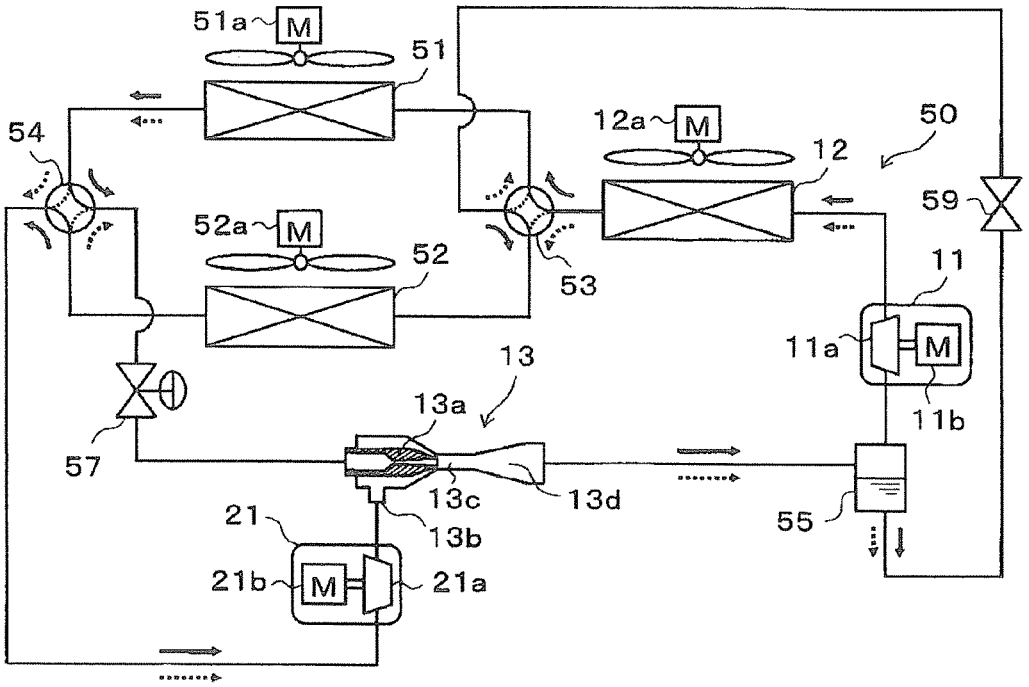
FIG. 105 is an entire schematic diagram of an ejector-type refrigeration cycle device of 56th embodiment.

In the present embodiment, an ejector-type refrigeration cycle device 50 of the present invention is used for a refrigeration device. FIG. 105 is an entire schematic diagram of the ejector-type refrigeration cycle device 50 of the present embodiment.

The ejector-type refrigeration cycle device 50 is provided with first and second heat exchangers 51, 52. The first and second heat exchangers 51, 52 are configured to be capable of switching between a first operation mode for cooling air (fluid to be heat-exchanged) to be blown into a room by using the first heat exchanger 51, and a second operation mode for heating air to be blown into the room by using the second heat exchanger 52. The solid line arrows in FIG. 105 show the flow of the refrigerant in the first operation mode, and the chain line arrows in FIG. 105 show the flow of the refrigerant in the second operation mode.

Refrigerant passages of the ejector-type refrigeration cycle dev ice 50 are switched by first and second electrical four-way valves 53, 54 that are refrigerant passage switching means, thereby switching between the first operation mode and the second operation mode. The operation of the first and second electrical four-way valves 53, 54 is respectively controlled by control signals output from the control device.

The first electrical four-way valve 53 is connected to a refrigerant outlet side of a radiator 12, similarly to the 43rd embodiment. The first electrical four-way valve 53 is adapted to switch between a refrigerant passage (i.e., the circuit shown by the solid line arrows in FIG. 105) in which a refrigerant outlet side of the radiator 12 and a refrigerant inlet side of the first heat exchanger 51 are connected, and at the same time, a liquid refrigerant outlet side of an accumulator 55 and a refrigerant inlet side of the second heat exchanger 52 are connected; and a refrigerant passage (i.e., the circuit shown by the chain line arrows in FIG. 105) in which the refrigerant outlet side of the radiator 12 and the refrigerant inlet side of the second heat exchanger 52 are connected, and at the same time, the liquid refrigerant outlet side of the accumulator 55 and the refrigerant inlet side of the first heat exchanger 51 are connected.

The accumulator 55 is a discharge-side gas-liquid separator, in which the refrigerant flowing out of the diffuser portion 13*d* of the ejector 13 is separated into gas refrigerant and liquid refrigerant, and surplus liquid refrigerant in the cycle is stored therein. In the present embodiment, a fixed throttle 59 is arranged between the liquid-refrigerant outlet side of the accumulator 55 and the first electrical four-way valve 53, so as to decompress and expand the refrigerant flowing toward the first electrical four-way valve 53. The basic structure of the fixed throttle 59 is similar to the fixed throttle 39 of the 51st embodiment.

The second electrical four-way valve 54 is connected to refrigerant outlet sides of the first and second heat exchangers 51, 52. Specifically, the second electrical four-way valve 54 is configured to switch between a refrigerant passage (i.e., the circuit shown by the solid line arrows in FIG. 105) in which the refrigerant outlet side of the first heat exchanger 51 and the inlet side of the nozzle portion 13*a* of the ejector 13 are connected, and at the same time, the refrigerant outlet side of the second heat exchanger 52 and the refrigerant suction side of the second compressor 21 are connected; and a refrigerant passage (i.e., the circuit shown by the chain line arrows in FIG. 105) in which the refrigerant outlet side of the second heat exchanger 52 and the inlet side of the nozzle portion 13*a* of the ejector 13 are connected, and at the same time, the refrigerant outlet side of the first heat exchanger 51 and the refrigerant suction side of the second compressor 21 are connected.

Furthermore, in the present embodiment, a thermal expansion valve 57 is arranged between the second electrical four-way valve 54 and the nozzle portion 13*a* of the ejector 13, as a high-pressure side decompressing means for decompressing and expanding the refrigerant flowing into the nozzle portion 13*a*.

The thermal expansion valve 57 has a temperature sensing portion (not shown) provided in a refrigerant passage at the refrigerant suction side of the second compressor 21. The thermal expansion valve 57 is a variable throttle mechanism, in which a super-heat degree of the refrigerant at the refrigerant suction side of the second compressor 21 is detected based on temperature and pressure of the refrigerant at the refrigerant suction side of the second compressor 21, and the valve-open degree (refrigerant flow amount) of the thermal expansion valve 57 is adjusted by using a mechanical mechanism so that the super-heat degree at the refrigerant suction side of the second compressor 21 is approached to a predetermined value.

The first heat exchanger 51 is a using-side heat exchanger, in which the refrigerant passing therein is heat-exchanged with inside air blown and circulated by a blower fan 51*a*. The second heat exchanger 52 is a using-side heat exchanger, in which the refrigerant passing therein is heat-exchanged with inside air blown and circulated by a blower fan 52*a*. The first and second blower fans 51*a*, 52*a* are electrical blowers in which its rotational speed (air blowing amount) is controlled by a control voltage output from the control device.

The accumulator 55 is a discharge-side gas-liquid separator, in which the refrigerant flowing out of the diffuser portion 13*d* of the ejector 13 is separated into gas refrigerant and liquid refrigerant, and surplus liquid refrigerant in the cycle is stored therein. Furthermore, a refrigerant suction port of the first compressor 11 is connected to a gas-refrigerant outlet of the accumulator 55. Other configurations in the present embodiment are similar to those of the 43rd embodiment.

Next, the operation of the present embodiment with the above configurations will be described with reference to the Mollier diagram of FIG. 106. In the ejector-type refrigeration cycle device 10 of the present embodiment, the first operation mode and the second operation mode are switched every a predetermined time, thereby continuously cooling the interior of the room.

(a) First Operation Mode

In the first operation mode, the control device causes the first and second electrical motors 11*b*, 21*b*, the cooling fan 12*a*, and the blower fans 51*a*, 52*a* to be operated.

In addition, the control device causes the first electrical four-way valve 53 to be switched such that the refrigerant discharge side of the radiator 12 and the refrigerant inlet side of the first heat exchanger 51 are connected, and at the same time, the liquid refrigerant outlet side of the accumulator 55 and the refrigerant inlet side of the second heat exchanger 52 are connected; and causes the second electrical four-way valve 54 to be switched such that the refrigerant outlet side of the first heat exchanger 51 and the inlet side of the nozzle portion 13*a* of the ejector 13 are connected, and at the same time, the refrigerant outlet side of the second heat exchanger 52 and the refrigerant suction side of the second compressor 21 are connected.

Thus, as shown in the solid line arrows of FIG. 105, refrigerant circulates in this order of the first compressor 11→the radiator 12 (→the first electrical four-way valve 53)→the first heat exchanger 51 (→the second electrical four-way valve 54)→the thermal expansion valve 57→the nozzle portion 13*a* of the ejector 13→the gas-refrigerant outlet of the accumulator 55→first compressor 11. At the same time, refrigerant circulates in this order of the liquid refrigerant outlet of the accumulator 55→the fixed throttle 59 (→first electrical four-way valve 53)→the second heat exchanger 52 (→the second electrical four-way valve 54)→the second compressor 21→the refrigerant suction port 13*b* of the ejector 13→the accumulator 55.

Figure 106:
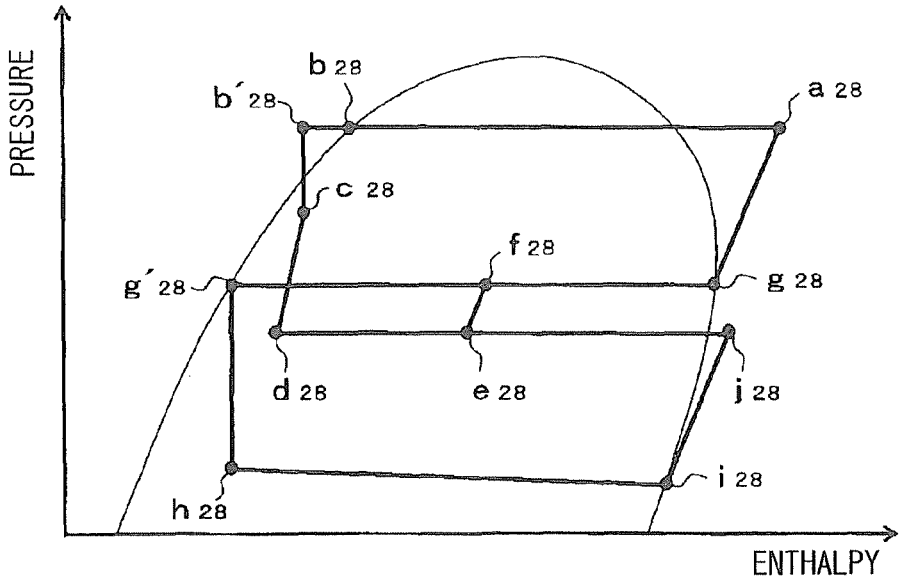
FIG. 106 is a Mollier diagram showing a refrigerant state of the ejector-type refrigeration cycle device of the 56th embodiment.

Thus, the refrigerant (point a28 in FIG. 106) compressed by the first compression mechanism 11*a* is cooled in the radiator 12 by heat exchange with outside air blown by the blower fan 12*a* (point a28→b28 in FIG. 106). Then, the refrigerant flowing out of the radiator 12 flows into the first heat exchanger 51 via the first electrical four-way valve 53.

The refrigerant flowing into the first heat exchanger 51 is heat-exchanged with air inside the room, blown and circulated by the first blower fan 51*a*, and is cooled (point b28→point b'28 in FIG. 106). Thus, defrosting of the first heat exchanger 51 can be performed.

The refrigerant flowing out of the first heat exchanger 51 flows into the thermal expansion valve 57 via the second electrical four-way valve 54. The refrigerant flowing into the thermal expansion valve 57 is decompressed and expanded in iso-enthalpy, and becomes in a gas-liquid two-phase state (point b'28 →point c28 in FIG. 106). At this time, the valve open degree of the thermal expansion valve 57 is adjusted so that a super heat degree (point g28 in FIG. 106) of the refrigerant at the refrigerant suction side of the first compressor 11 becomes a predetermined value.

A middle refrigerant flowing out of the thermal expansion valve 57 flows into the nozzle portion 13*a* of the ejector 13, and is decompressed and expanded by the nozzle portion 13*a* in iso-entropy to be jetted therefrom (point c28→point d28 in FIG. 106). Thus, the refrigerant discharged from the second compression mechanism 21*a* is drawn into the ejector 13 from the refrigerant suction port 13*b* of the ejector 13, by the refrigerant suction action of the jet refrigerant (point j28→point e28 in FIG. 106).

Furthermore, the jet refrigerant jetted from the nozzle portion 13*a* and the suction refrigerant drawn from the refrigerant suction port 13*b* are mixed in the mixing portion 13*c* of the ejector 13, and is pressurized in the diffuser portion 13*d* of the ejector 13 (point e28→point f28 in FIG. 106).

The refrigerant flowing out of the diffuser portion 13*d* is separated into gas refrigerant and liquid refrigerant in the accumulator 55 (point f28→point g28, point f28→point g'28 in FIG. 106), and the gas refrigerant flowing out of the gas refrigerant outlet of the accumulator 55 is drawn into the first compression mechanism 11*a* to be compressed again (point g28→point a28 in FIG. 106).

On the other hand, liquid refrigerant flowing out of the liquid refrigerant outlet of the accumulator 55 is further decompressed and expanded in iso-enthalpy at the fixed throttle 59 (point g'28→point h28 in FIG. 106). The refrigerant from the fixed throttle 59 flows into the second heat exchanger 52 via the first electrical four-way valve 53. The refrigerant flowing into the second heat exchanger 52 is evaporated by absorbing heat from air inside of the room, blown and circulated by the second blower fan 52*a* (point h28→point i28 in FIG. 106). Thus, the air blown into the interior of the room is cooled.

The refrigerant flowing out of the second heat exchanger 52 is drawn into the second compression mechanism 21*a* via the electrical four-way valve 54, and is compressed in the second compression mechanism 21*a*. At this time, the control device controls operation of the first and second electrical motors 11*b*, 21*b* such that COP in the entire cycle of the ejector-type refrigeration cycle device 50 is approached approximately to the maximum value, similarly to the 43rd embodiment.

Thus, in the first operation mode of the present embodiment, the refrigerant passage is switched, such that the refrigerant discharged from the first compression mechanism 11*a* is radiated in both the radiator 12 and the first heat exchanger 51, and the refrigerant is evaporated in the second heat exchanger 52. Thus, in the first operation mode of the present embodiment, air to be blown into the room can be cooled by the second heat exchanger 52, while the first heat exchanger 51 is defrosted.

(b) Second Operation Mode

In the second operation mode, the control device causes the first electrical four-way valve 53 to be switched such that the refrigerant discharge side of the radiator 12 and the refrigerant inlet side of the second heat exchanger 52 are connected, and at the same time, the liquid refrigerant outlet side of the accumulator 55 and the refrigerant inlet side of the first heat exchanger 51 are connected; and causes the second electrical four-way valve 54 to be switched such that the refrigerant outlet side of the second heat exchanger 52 and the inlet side of the nozzle portion 13*a* of the ejector 13 are connected, and at the same time, the refrigerant outlet side of the first heat exchanger 51 and the refrigerant suction side of the second compressor 21 are connected.

Thus, as shown in the chain line arrows of FIG. 105, refrigerant circulates in this order of the first compressor 11→the radiator 12 (→the first electrical four-way valve 53)→the second heat exchanger 52 (→the second electrical four-way valve 54)→the thermal expansion valve 57→the nozzle portion 13*a* of the ejector 13→the gas-refrigerant outlet of the accumulator 55→the first compressor 11. At the same time, refrigerant circulates in this order of the liquid refrigerant outlet of the accumulator 55→the fixed throttle 59 (→first electrical four-way valve 53)→the first heat exchanger 51 (→the second electrical four-way valve 54)→the second compressor 21→the refrigerant suction port 13*b* of the ejector 13→the accumulator 55.

Thus, in the second operation mode of the present embodiment, the refrigerant passage is switched reversely from the first operation mode, such that the refrigerant discharged from the first compression mechanism 11*a* is radiated in the radiator 12 and the second heat exchanger 52, and the refrigerant is evaporated in the first heat exchanger 51. The states of the refrigerant in the second operation mode are similar to the Mollier diagram of FIG. 106. Thus, in the second operation mode of the present embodiment, air to be blown into the room can be cooled by the first heat exchanger 51, while the second heat exchanger 52 is defrosted.

The ejector-type refrigeration cycle device 50 of the present embodiment is operated above, and thereby the effects (B), (G), (H) of the 43rd embodiment can be obtained. Because the first operation mode and the second operation mode can be alternatively switched, even when any one of the first and second heat exchangers 51, 52 is defrosted, the other one of the first and second heat exchangers 51, 52 can be used to cool the room. Therefore, in the ejector-type refrigeration cycle device 50 of the present embodiment, continuously stable cooling capacity can be obtained.

(57th Embodiment)

Figure 107:
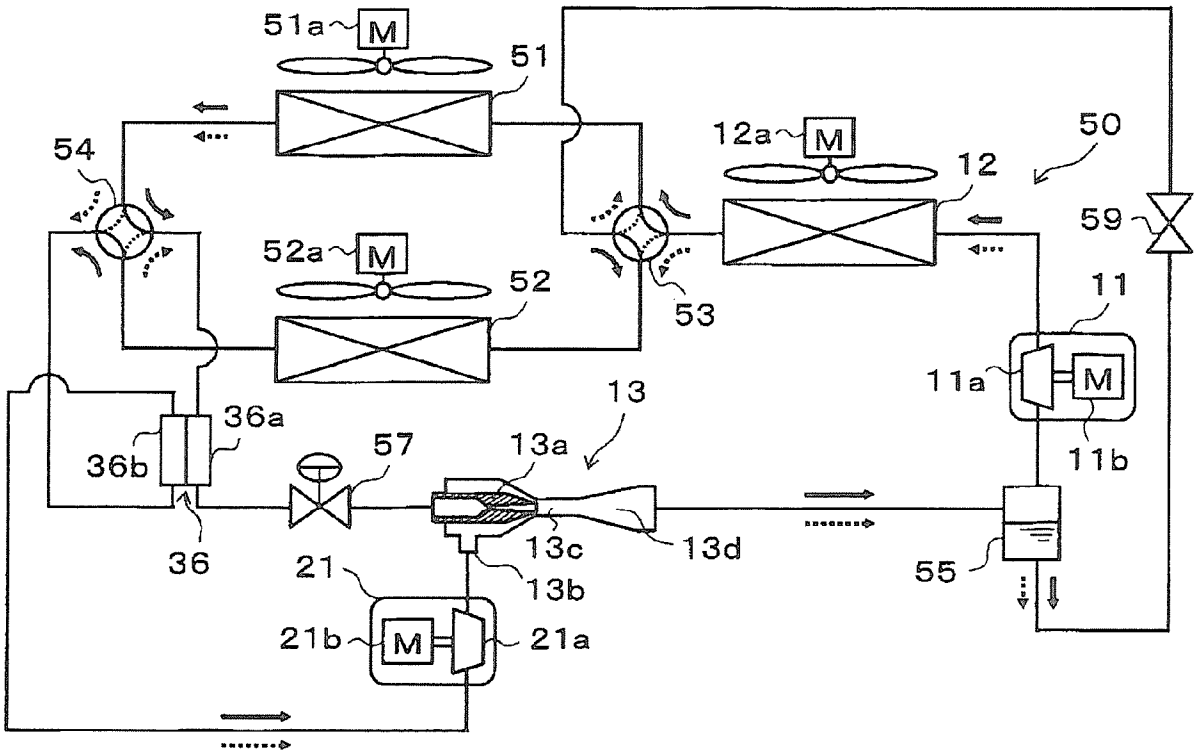
FIG. 107 is an entire schematic diagram of an ejector-type refrigeration cycle device of 57th embodiment.

In the present embodiment, as in the entire schematic diagram of FIG. 107, an inner heat exchanger 36, in which high-pressure refrigerant at an upstream side of the nozzle portion 13*a* and a low-pressure side refrigerant in the cycle are heat exchanged, is added with respect to the ejector-type refrigeration cycle device 50 of the 56th embodiment. The inner heat exchanger 36 is for performing heat exchange between refrigerant flowing through a high-pressure side refrigerant passage 36*a* at an upstream side of the nozzle portion 13*a*, and a low-pressure side refrigerant flowing through a low-pressure side refrigerant passage 36*b*.

The basic structure of the inner heat exchanger 36 is similar to the inner heat exchanger 30 of the 45th embodiment. More specifically, in the present embodiment, the high-pressure refrigerant at the upstream side of the nozzle portion 13*a* is the refrigerant flowing through a refrigerant passage from the second electrical four-way valve 54 to the thermal expansion valve 57. In contrast, the low-pressure side refrigerant in the cycle of the present embodiment is the refrigerant to be drawn into the second compression mechanism 21*a*. Other configurations in the present embodiment are similar to those of the 56th embodiment.

Figure 108:
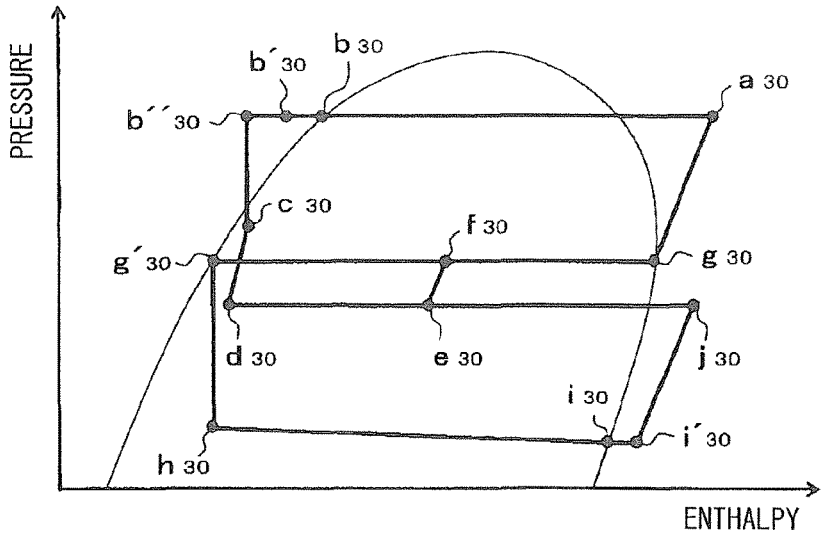
FIG. 108 is a Mollier diagram showing a refrigerant state of the ejector-type refrigeration cycle device of the 57th embodiment.

When the ejector-type refrigeration cycle device 50 of the present embodiment is operated, as in the Mollier diagram of FIG. 108, by the operation of the inner heat exchanger 36, the enthalpy of the suction side refrigerant of the second compression mechanism 21*a* is increased (point i30→point i'30 in FIG. 108), and the enthalpy of the refrigerant flowing into the thermal expansion valve 57 is decreased (point b'30→point b"30 in FIG. 108), with respect to 56th embodiment. Other operation is similar to that of the 56th embodiment.

Thus, even in the structure of the present embodiment, the same effects as in the 56th embodiment can be obtained. Furthermore, by the operation of the inner heat exchanger 36, the enthalpy of the refrigerant flowing into a heat exchanger used as the evaporator among the first and second heat exchangers 51, 52 can be decreased, in any operation mode.

Thus, the enthalpy difference between the enthalpies of the refrigerant at the refrigerant inlet side and the refrigerant outlet side can be enlarged in the heat exchanger used as the evaporator, thereby further improving the COP.

(58th Embodiment)

Figure 109:
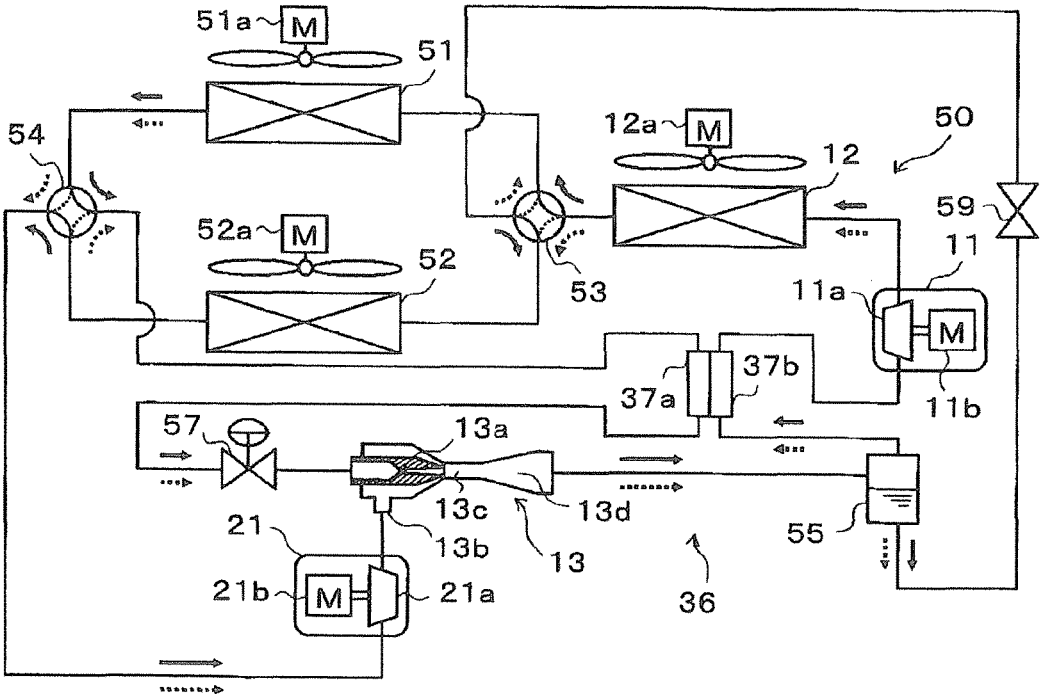
FIG. 109 is an entire schematic diagram of an ejector-type refrigeration cycle device of 58th embodiment.

In the present embodiment, as in the entire schematic diagram of FIG. 109, an inner heat exchanger 37, in which high-pressure refrigerant at an upstream side of the nozzle portion 13*a* and a low-pressure side refrigerant in the cycle are heat exchanged, is added with respect to the ejector-type refrigeration cycle device 50 of the 56th embodiment. The inner heat exchanger 37 is for performing heat exchange between refrigerant flowing through a high-pressure side refrigerant passage 37*a* at an upstream side of the nozzle portion 13*a,* and a low-pressure side refrigerant flowing through a low-pressure side refrigerant passage 37*b*.

The basic structure of the inner heat exchanger 37 is similar to the inner heat exchanger 30 of the 45th embodiment. More specifically, in the present embodiment, the high-pressure refrigerant at the upstream side of the nozzle portion 13*a* is the refrigerant flowing through a refrigerant passage from the second electrical four-way valve 54 to the thermal expansion valve 57. In contrast, the low-pressure side refrigerant in the cycle of the present embodiment is the refrigerant to be drawn into the first compression mechanism 11*a*. Other configurations in the present embodiment are similar to those of the 56th embodiment.

Figure 110:
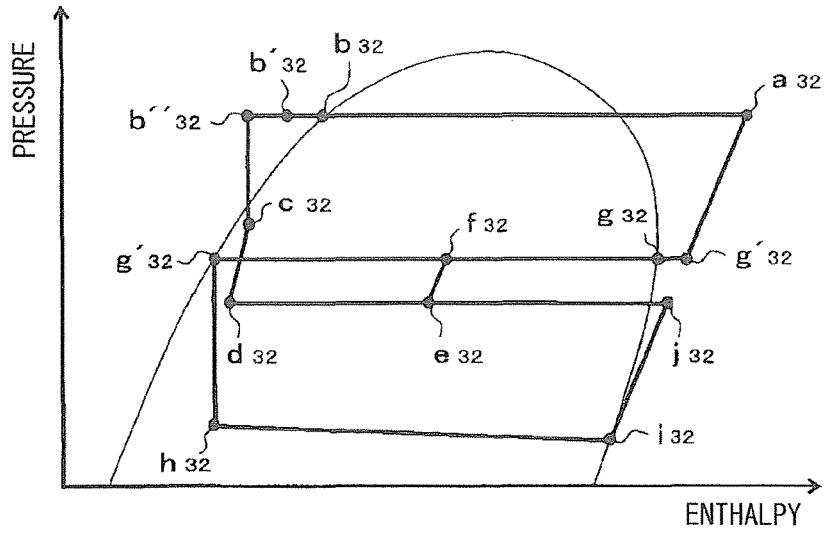
FIG. 110 is a Mollier diagram showing a refrigerant state of the ejector-type refrigeration cycle device of the 58th embodiment.

When the ejector-type refrigeration cycle device 50 of the present embodiment is operated, as in the Mollier diagram of FIG. 110, by the operation of the inner heat exchanger 37, the enthalpy of the suction side refrigerant of the first compression mechanism 11*a* is increased (point g32→point g'32 in FIG. 110), and the enthalpy of the refrigerant flowing into the thermal expansion valve 57 is decreased (point b'32→point b"32 in FIG. 110), with respect to 56th embodiment. Other operation is similar to that of the 56th embodiment.

Thus, even in the structure of the present embodiment, the same effects as in the 56th embodiment can be obtained. Furthermore, by the operation of the inner heat exchanger 37, the enthalpy difference between the enthalpies of the refrigerant at the refrigerant inlet side and the refrigerant outlet side can be enlarged in the heat exchanger used as an evaporator in any operation mode, thereby further improving the COP.

(59th Embodiment)

Figure 111:
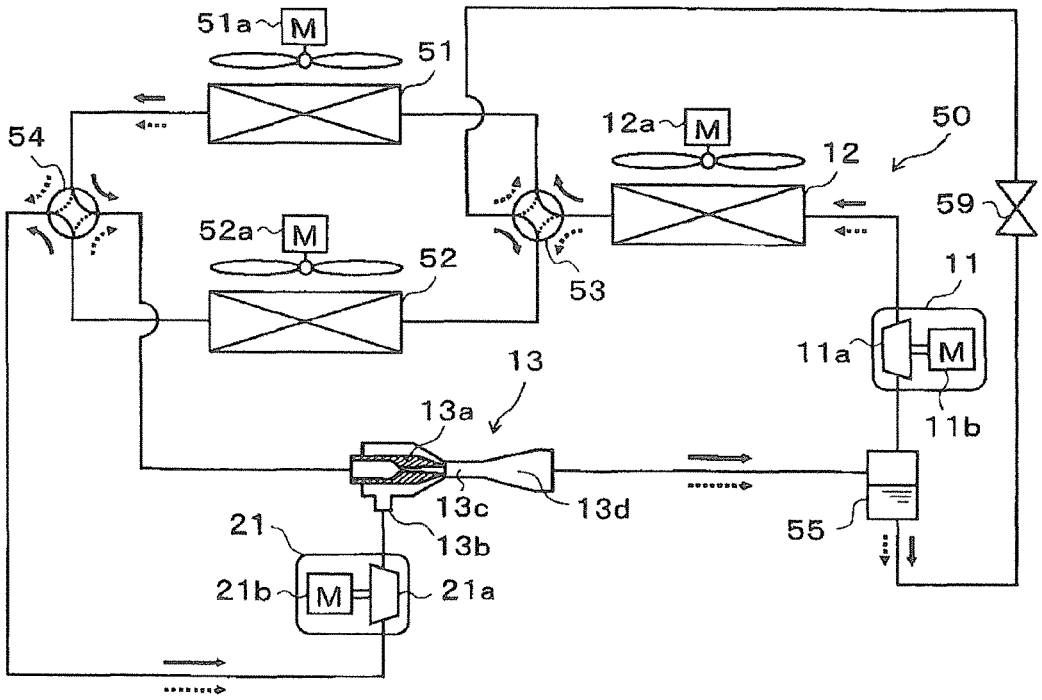
FIG. 111 is an entire schematic diagram of an ejector-type refrigeration cycle device of 59th embodiment.

In the present embodiment, as in the entire schematic diagram of FIG. 111, the thermal expansion valve 57 is removed with respect to the 56th embodiment, and carbon dioxide is used as the refrigerant similarly to the 50th embodiment, thereby configuring a super-critical refrigerant cycle. Other configurations in the present embodiment are similar to those of the 56th embodiment.

Figure 112:
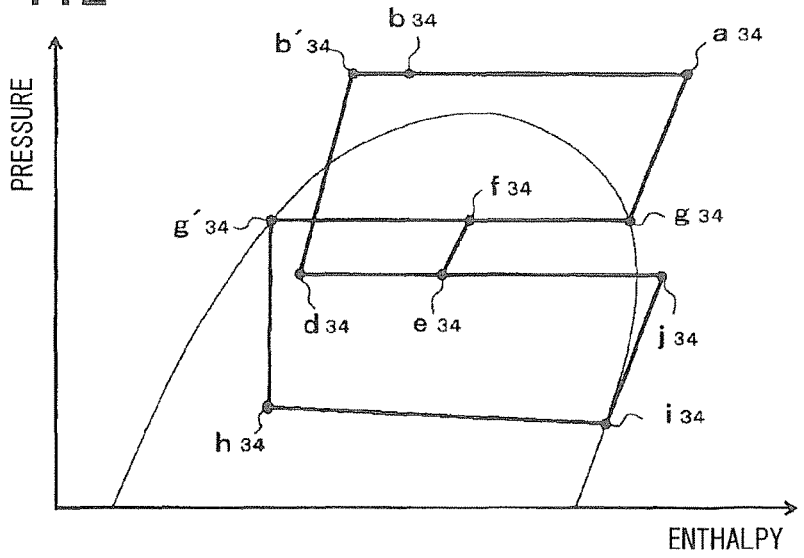
FIG. 112 is a Mollier diagram showing a refrigerant state of the ejector-type refrigeration cycle device of the 59th embodiment.

When the ejector-type refrigeration cycle device 50 of the present embodiment is operated, the refrigerant discharged from the first compressor 11 is cooled in the radiator 12 and a heat exchanger used as a radiator in the first and second heat exchangers 51, 52, as in the Mollier diagram of FIG. 112. At this time, the refrigerant passing through the radiator 12 and the heat exchanger as a radiator is cooled in a super-critical state without being condensed (point a34→point b34→point b'34 of FIG. 112)

The refrigerant flowing out of the heat exchanger used as the radiator in the first and second heat exchangers 51, 52 flows into the nozzle portion 13*a* of the ejector 13 via the second electrical four-way valve 54. The refrigerant flowing into the nozzle portion 13*a* is decompressed and expanded at the nozzle portion 13*a* in iso-entropy (point b'34→point d34 in FIG. 112). Other operation is similar to that of the 56th embodiment.

Thus, even in the structure of the present embodiment, the same effects as in the 56th embodiment can be obtained. Furthermore, improvement in the COP, due to the recovery energy amount in the nozzle portion 13*a,* can be obtained similarly to 50th embodiment.

(60th Embodiment)

Figure 113:
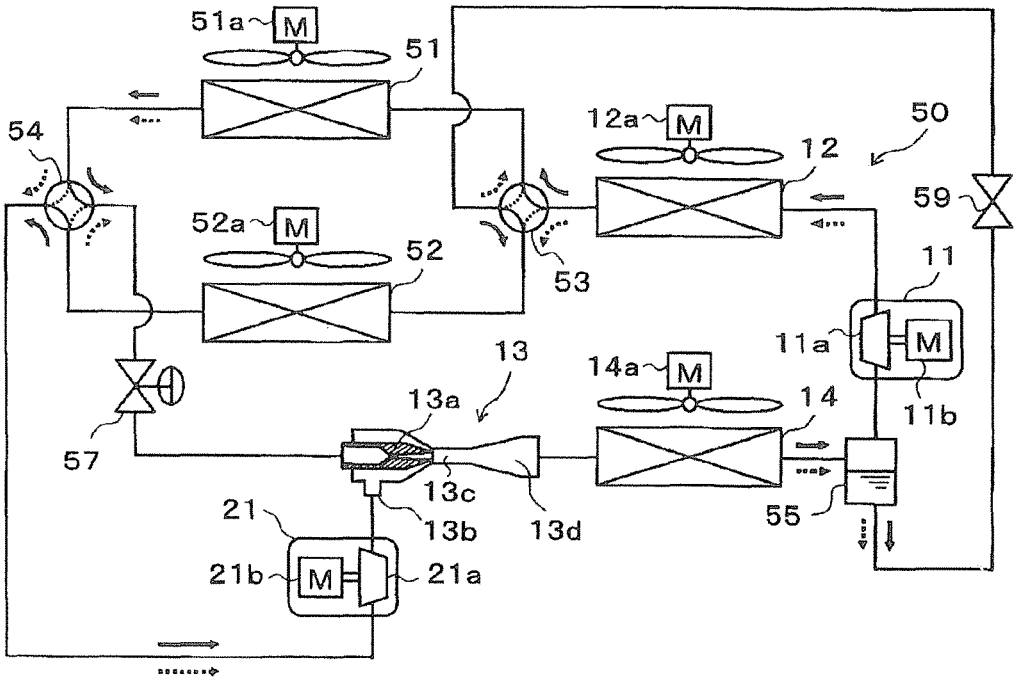
FIG. 113 is an entire schematic diagram of an ejector-type refrigeration cycle device of 60th embodiment.
Figure 114:
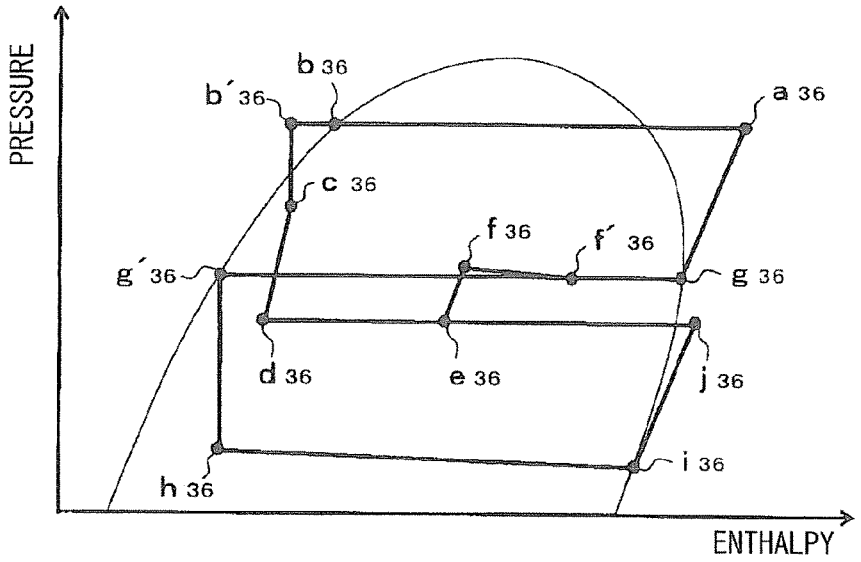
FIG. 114 is a Mollier diagram showing a refrigerant state of the ejector-type refrigeration cycle device of the 60th embodiment.

In the present embodiment, as in the entire schematic diagram of FIG. 113 and the Mollier diagram of FIG. 114, a discharge side evaporator 14 is arranged at a downstream side of the diffuser portion 13*d* of the ejector 13 and at an upstream side of the accumulator 55, with respect to the ejector-type refrigeration cycle device 50 of the 56th embodiment. Other configurations in the present embodiment are similar to those of the 56th embodiment.

When the ejector-type refrigeration cycle device 50 of the present embodiment is operated, the cycle device 50 of the present embodiment is operated similarly to the 56th embodiment. Furthermore, as in the Mollier diagram of FIG. 114, the liquid refrigerant is evaporated at the discharge side evaporator 14 in the refrigerant state from point f36 to point f'36, thereby obtaining heat absorbing action. Therefore, air blown by the blower fan 14*a* can also be cooled by the discharge side evaporator 14.

The refrigerant is evaporated in the discharge side evaporator 14 at a temperature higher than the refrigerant evaporation temperature in the heat exchanger used as the evaporator in the first and second heat exchangers 51, 52. That is, in the discharge side evaporator 14 and the heat exchanger used as the evaporator within the first and second heat exchangers 51, 52, refrigerant evaporates in a different temperature zone.

Thus, in the present embodiment, air in the room of the refrigerator, where food, a drink, etc. are saved at a low temperature (0° C.-10° C.), can be also cooled at the discharge side evaporator 14, for example, while the same effects as in the 43rd embodiment can be obtained. In the ejector-type refrigeration cycle device 50 of any one of 56th-59th embodiments, the discharge side evaporator 14 may be added.

(61st Embodiment)

Figure 115:
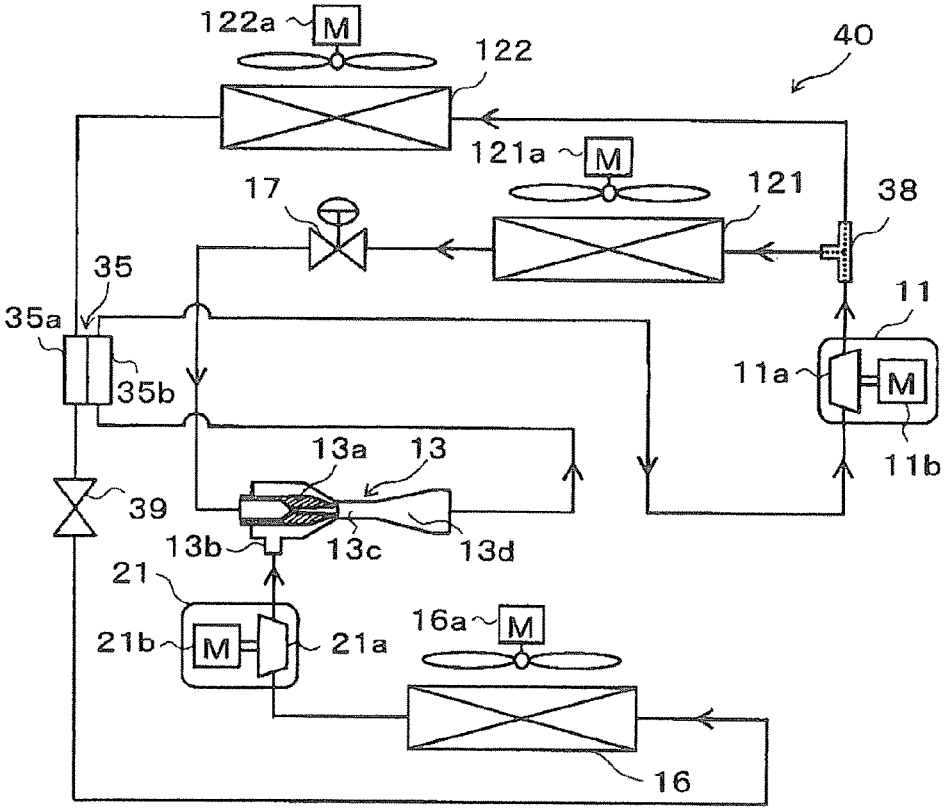
FIG. 115 is an entire schematic diagram of an ejector-type refrigeration cycle device of 61st embodiment.

In the present embodiment, as in the entire schematic diagram of FIG. 115, an inner heat exchanger 35 similar to the 53rd embodiment is added, and the discharge side evaporator 14 and the blower fan 14*a* are removed, with respect to the ejector-type refrigeration cycle device 40 of the 51st embodiment.

The inner heat exchanger 35 of the present embodiment is adapted to perform heat exchange between high-pressure refrigerant flowing in a refrigerant passage from the refrigerant outlet side of the second radiator 122 to the inlet side of the fixed throttle 39, and the refrigerant to be drawn to the first compression mechanism 11*a*. Other configurations in the present embodiment are similar to those of the 51st embodiment.

Figure 116:
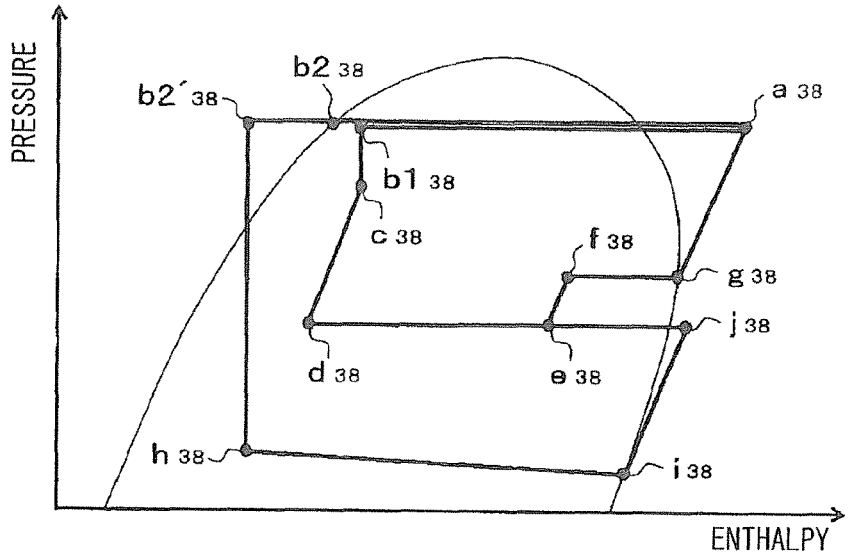
FIG. 116 is a Mollier diagram showing a refrigerant state of the ejector-type refrigeration cycle device of the 61st embodiment.

When the ejector-type refrigeration cycle device 40 of the present embodiment is operated, the refrigerant flowing out of the diffuser portion 13*d* is evaporated in the low-pressure side refrigerant passage 35*b* of the inner heat exchanger 35, and the enthalpy of the suction side refrigerant of the first compression mechanism 11*a* is increased (point f38→point g38 in FIG. 116), by the operation of the inner heat exchanger 35, as in the Mollier diagram of FIG. 116. Furthermore, the enthalpy of the refrigerant flowing out of the second radiator 122 decreases (point b238→point b2'38 in FIG. 116).

Other operation is similar to that of the 51st embodiment. Thus, in the present embodiment, cooling action can exist in the suction side evaporator 16, and the same effects as in (B), (D), (F)-(H) in the 43rd embodiment can be obtained.

Thus, similarly to the 51st embodiment, the enthalpy of the refrigerant flowing into the nozzle portion 13*a* is not unnecessary reduced, and thereby the COP improvement can be obtained. Furthermore, improvement in the COP, due to the inner heat exchanger 32, can be obtained similarly to 53rd embodiment.

(62nd Embodiment)

Figure 117:
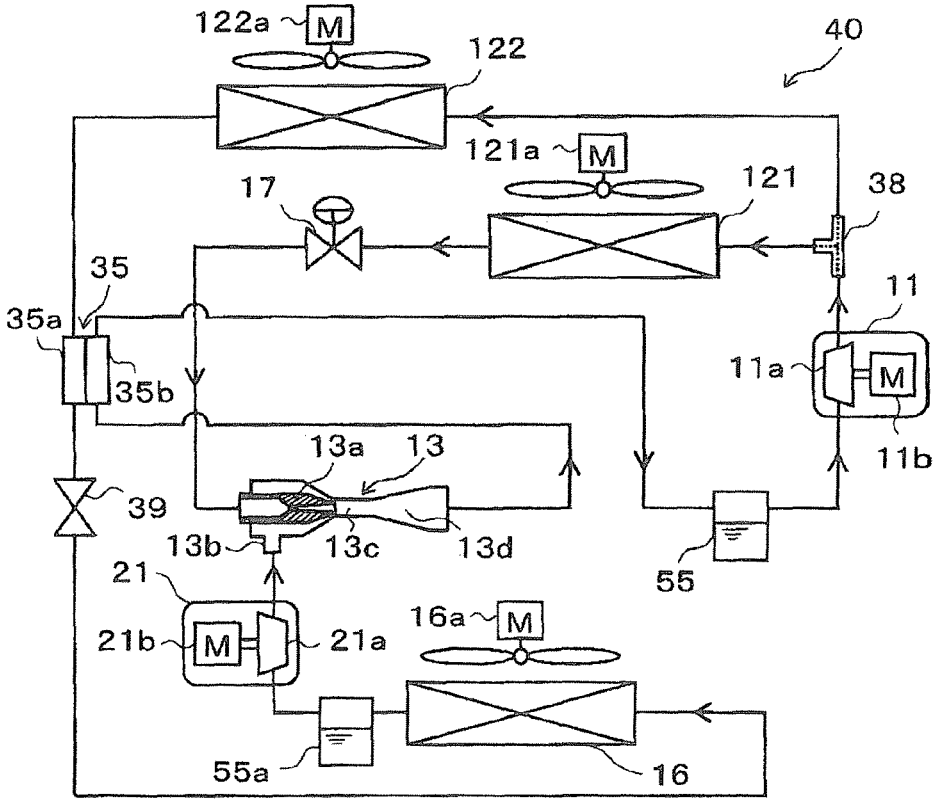
FIG. 117 is an entire schematic diagram of an ejector-type refrigeration cycle device of 62nd embodiment.
Figure 118:
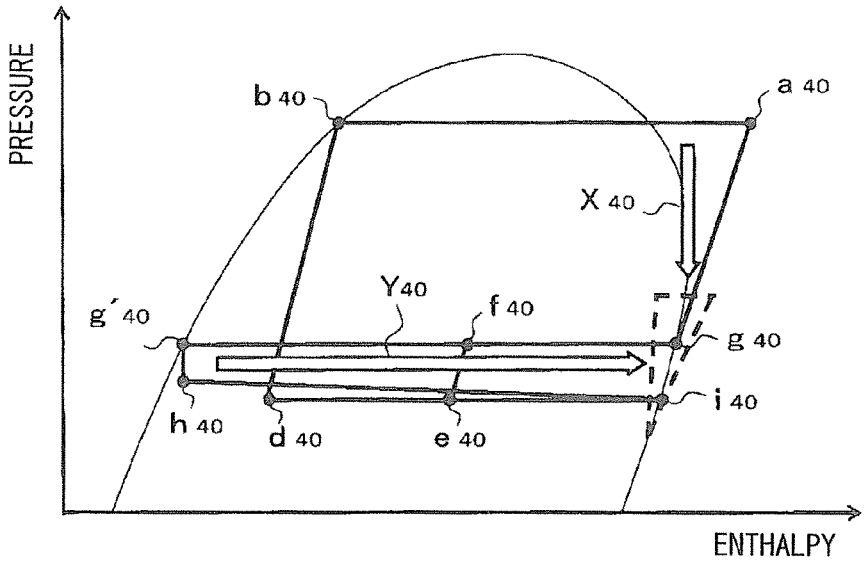
FIG. 118 is a Mollier diagram showing a refrigerant state of an ejector-type refrigeration cycle device of a prior art.

In the present embodiment, as in the entire schematic diagram of FIG. 117, an accumulator 55 and a suction-side gas-liquid separator 55*a* similar to the 56th embodiment are added with respect to the ejector-type refrigeration cycle device 50 of the 61st embodiment.

The suction-side gas-liquid separator 55*a* is a gas-liquid separator in which the refrigerant flowing out of the suction side evaporator 16 is separated into gas refrigerant and liquid refrigerant, and surplus liquid refrigerant in the cycle is stored therein. A refrigerant suction port of the second compressor 21 is connected to a gas- refrigerant outlet of the suction-side gas-liquid separator 55*a*. Other configurations in the present embodiment are similar to those of the 61st embodiment.

Thus, when the ejector-type refrigeration cycle device 40 of the present embodiment is operated, it is operated similarly to the 61st embodiment so that cooling action can be obtained in the suction side evaporator 16, and thereby the same effects as in (B), (F)-(H) of the 43rd embodiment can be obtained and the COP can be improved similarly to the 26th embodiment.

Furthermore, it can prevent the problem of the liquid compression in both the first compressor 11 and the second compressor 21, by the action of the accumulator 55 and the suction-side gas-liquid separator 55. In the present embodiment, both the accumulator 55 and the suction-side gas-liquid separator 55*a* are provided; however, any one of the accumulator 55 and the suction-side gas-liquid separator 55*a* may be provided.

(The Other Embodiments)

The present invention is not limited to the above-described embodiments, and the following various deformations are possible.

(1) In the above-described respective embodiments, the first and second compressors 11, 21 are used as compressors configured respectively separately. However, the first and second compression mechanisms 11*a*, 21*a* and the first and second electrical motors 11*b*, 21*b* may be constituted integrally.

For example, the first and second compression mechanisms 11*a* and 21*a* and the first and second electrical motors 11*b* and 21*b* may be accommodated in the same housing, and may be constituted integrally. In this case, the first and second compression mechanisms 11*a*, 21*a* may be configured to have a common rotation shaft, so as to drive both the first and second compression mechanisms 11*a*, 21*a* by using a driving force supplied from a common drive source.

As a result, the size of the first and second compression mechanisms 11*a*, 21*a* can be made small, thereby reducing the size of the entire ejector-type refrigeration cycle device.

(2) In the above-described embodiments, an electrical compressor is adapted respectively as the first and second compressors 11, 21. However, the formation of the first and second compressors 11, 21 is not limited to it.

For example, a displacement variable compressor may be adapted to adjust the refrigerant discharge capacity by variation in its discharge capacity, using an engine or the like as a driving source. In this case, the discharge capacity changing means is configured by the displacement variable compressor. Alternatively, a fixed-displacement compressor may be used to adjust the refrigerant discharge capacity by interruptingly changing the connection with a driving source, using interruption of an electromagnetic clutch. In this case, the electromagnetic clutch serves as a discharge capacity changing means.

The same-type compression mechanism or different-type compression mechanisms may be used as the first and second compressors 11, 21.

(3) In the present embodiment, an ejector-type refrigeration cycle device of the present invention is used for a refrigeration device or a freezing/refrigerating device. However, the present invention is not limited to it. For example, the ejector-type refrigeration cycle device 10 of the present invention may be used for an air conditioner for indoor air-conditioning or an air conditioner for a vehicle. The ejector-type refrigeration cycle device may be used for a water heater for heating water that is a fluid to be heat-exchanged in a heating operation mode.

(4) In the above-described embodiments, a fixed ejector, in which a throttle passage area of the nozzle portion 13*a* is fixed, is used as the ejector 13. However, as the ejector 13, a variable ejector, in which the throttle passage area of the nozzle 13*a* is variable, may be adapted. Similarly, as the fixed throttle 15 or the second fixed throttle 53, a variable throttle mechanism may be used.

(5) In the above some embodiments, a flon-based refrigerant is used as the refrigerant for a refrigerant cycle. However, the kind of the refrigerant is not limited to it. For example, hydrocarbon-based refrigerant, carbon dioxide, etc. may be used. Furthermore, the ejector-type refrigeration cycle device of the present invention may be configured to form a vapor-compression super-critical refrigerant cycle in which a refrigerant pressure on the high-pressure side exceeds the critical pressure of the refrigerant.

For example, if the ejector-type refrigeration cycle device without having a high-pressure side decompression means similarly to the 1st embodiment is constituted as a super-critical refrigerant cycle, the refrigerant pressure on the high-pressure side becomes higher, thereby enlarging the pressure difference between the pressure of the refrigerant at the refrigerant inlet side of the nozzle portion 13*a* of the ejector 13 and the pressure of the refrigerant at the refrigerant outlet side of the nozzle portion 13*a* of the ejector 13. Thus, the enthalpy difference between the enthalpies of the refrigerant at the refrigerant inlet side of the nozzle portion 13*a* and the refrigerant at the refrigerant outlet side of the nozzle portion 13*a* can be enlarged, thereby increasing the recovery energy amount.

Furthermore, when the super-critical refrigerant cycle is configured in the ejector-type refrigeration cycle device, a pressure control valve may be used as a high-pressure side decompression means. In this case, the pressure control valve adjusts a high-pressure side refrigerant pressure to a target high pressure, based on a high-pressure side refrigerant temperature at the refrigerant outlet side of the radiator 12. Here, the target high pressure is a value determined such that the COP becomes approximately in maximum.

The pressure control valve may be configured to have a temperature sensing portion located at a refrigerant outlet side of the radiator 12, and may be configured to generate a pressure corresponding to the temperature of the high-pressure refrigerant at the refrigerant outlet side of the radiator 12 within the temperature sensing portion, so as to adjust the valve open degree by the balance between the inner pressure of the temperature sensing portion and the refrigerant pressure at the refrigerant outlet side of the radiator 12.

(6) Furthermore, the above-described 1st to 10th embodiments describe regarding the ejector-type refrigeration cycle device, in which the accumulator 24 is arranged at the downstream side of the diffuser portion 13*d* of the ejector 13. However, the configuration of the ejector-type refrigeration cycle device is not limited to it. The second compression mechanism 21*a* may be arranged between the refrigerant outlet side of the suction side evaporator and the refrigerant suction port of the ejector, thereby forming another cycle. Even in this case, the ejector-type refrigeration cycle device can be stably operated.

In the above-described embodiments, there are described regarding the ejector-type refrigeration cycle device 10, 40 that is provided with only the first and second compression mechanisms 11*a*, 21*a*. However, additional compression mechanism may be provided. For example, an additional evaporator may be arranged in parallel with the suction side evaporator 16 of the 1st embodiment, and an additional compression mechanism may be provided to draw only the refrigerant flowing out of the additional evaporator.

(7) In the above-described 1st to 7th embodiments, the suction side evaporator 16 is used as the using-side heat exchanger, and the radiator 12 is used as the exterior heat exchanger for radiating heat to the atmosphere. On the contrary, a heat pump cycle may be configured, such that the suction side heat exchanger 16 may be configured as the exterior heat exchanger, and the radiator 12 may be configured as the interior heat exchanger for heating the refrigerant that is used to heat air or water to be heated.

(8) In the above-described 7th to 9th embodiments, the thermal expansion valve 17 is used as a high-pressure side decompression means. However, an electrical expansion valve may be adopted for adjusting a throttle opening degree (valve opening degree) with an electric control signal from the outside. Alternatively, a fixed throttle mechanism having the same structure as the fixed throttle 15 may be adopted, without using a variable throttle mechanism as the decompression means.

Alternatively, an expansion unit may be used as the high-pressure side decompression means or the low-pressure side decompression means (fixed throttle 15). In the expansion unit, the volume is expanded so as to decompress the refrigerant, and the pressure energy of the refrigerant is converted to the mechanical energy thereof. As the expansion unit, various displacement-variable compression mechanisms such as a scroll type compression mechanism, a vane type compression mechanism, a rotary piston type compression mechanism or the like can be used, for example.

In the expansion unit, when the refrigerant reversely flows with respect to the refrigerant flow in a case where the displacement-variable compression mechanism is used as the compression mechanism, the mechanical energy can be output while refrigerant is decompressed by expending the volume. For example, a rotation-type displacement-variable compression mechanism may be used as the expansion unit. In this case, the rotation energy recovered in the expansion unit can be output as the mechanical energy.

For example, the mechanical energy output from the expansion unit may be used as a supplemental power source of the first and second compression mechanisms. In this case, the energy efficiency in the entire ejector-type refrigeration cycle device can be improved. The mechanical energy output from the expansion unit may be used as a driving source of an exterior machine.

For example, electrical energy can be obtained if a generator is used as the exterior machine. For example, a flywheel may be used as the exterior machine. In this case, the mechanical energy output from the expansion unit can be stored as a kinetic energy. Moreover, a spring device (spiral spring) may be used as the exterior machine. In this case, the mechanical energy recovered in the expansion unit can be stored as an elastic energy.

(9) With respect to the 1st to 7th embodiments, a suction-side gas-liquid separator 24*a* may be added, similarly to the 8th embodiment. In this case, only gas refrigerant separated at the suction-side gas-liquid separator 24*a* can be supplied to the second compression mechanism 21*a*, thereby preventing a liquid refrigerant compression in the second compression mechanism 21*a*.

(10) In the inner heat exchangers 30-32 of some embodiments described above, there are described regarding the refrigerant flow direction in the high-pressure side refrigerant passage and the refrigerant flow direction in the low-pressure side refrigerant passage. The refrigerant flow direction in the high-pressure side refrigerant passage and the refrigerant flow direction in the low-pressure side refrigerant passage may be arranged in the same direction. Alternatively, the refrigerant flow direction in the high-pressure side refrigerant passage and the refrigerant flow direction in the low-pressure side refrigerant passage may be arranged in different directions.

(11) In the above-described 11th to 37th embodiments, the thermal expansion valve 17 is used as the high-pressure side decompression means, so that a super heat degree of the refrigerant at the refrigerant outlet side of the discharge side evaporator 14 becomes a predetermined value. However, a thermal expansion valve may be adopted so that the super heat degree of the refrigerant at the refrigerant outlet side of the suction side evaporator 16 becomes a predetermined value.

Furthermore, as the high-pressure side decompression means, an electrical expansion valve may be adopted for adjusting a throttle opening degree (valve opening degree) with an electric control signal from the outside. Alternatively, a fixed throttle mechanism having the same structure as the fixed throttle 19 may be adopted, without using a variable throttle mechanism as the decompression means.

Moreover, a high-pressure side decompression means may be removed from the refrigeration cycle device as in the 16th, 22nd, 28th, 35th, 36th, and 37th embodiments. Furthermore, the pressure control valve 27 described in the 34th embodiment may be added in other embodiments (for example, the 16th, 22nd, 28th embodiment).

(12) In the above-described 13 embodiment, the expansion unit 20 is used as an example of a suction side decompression means. However, also in other embodiments, an expansion unit may be used as the suction side decompression means. Similarly, the expansion unit may be used as the high-pressure side decompression means.

(13) In the above-described 17th, 18th, 21st and 22nd embodiments, the accumulator 24 is arranged as the discharge-side gas-liquid separator in the ejector-type refrigeration cycle device. However, in other embodiments, the accumulator 24 may be arranged at a refrigerant suction side of the first compression mechanism 11*a*. In this case, the gas refrigerant separated at the accumulator 24 can be supplied to the first compression mechanism 11*a*, thereby preventing a liquid refrigerant compression in the first compression mechanism 11*a*.

Similarly, in the above-described 37th embodiment, there is described regarding the ejector-type refrigeration cycle device, in which the suction-side gas-liquid separator 15*a* is arranged. However, in other embodiments, a suction-side gas-liquid separator may be arranged at a refrigerant suction side of the second compression mechanism 21*a*. Thus, only gas refrigerant separated at the suction-side gas-liquid separator can be supplied to the second compression mechanism 21*a*, thereby preventing a liquid refrigerant compression in the second compression mechanism 21*a*.

Moreover, an accumulator 24 may be removed from the cycle in the 17th, 18th, 21st, 22nd, and 37th embodiments.

(14) In the above-mentioned 11th-the 16th, the 23rd-the 35th embodiments described above, the discharge side evaporator 14 and the suction side evaporator 16 are provided to cool different spaces to be cooled (e.g., the space of the refrigerating room, the space of the freezing room). However, the discharge side evaporator 14 and the suction side evaporator 16 may be provided to cool the same space to be cooled. In this case, it is desirable to integrally assemble the discharge side evaporator 14 and the suction side evaporator 16, and is desirable for air blown by a blower fan to pass the discharge side evaporator 14 and the suction side evaporator 16 in this order.

The reason is that the refrigerant evaporation pressure (refrigerant evaporation temperature) of the suction side evaporator 16 becomes lower than the refrigerant evaporation pressure (the refrigerant evaporation temperature) of the discharge side evaporator 14, as in described above. That is, because the air blown by the blower fan passes through the discharge side evaporator 14 and the suction side evaporator 16 as described above, a temperature difference between the blown air and the refrigerant evaporation temperature can be secured in both the discharge side evaporator 14 and the suction side evaporator 16, thereby effectively cooling the blown air.

When the discharge side evaporator 14 and the suction side evaporator 16 are integrally formed, the components of both the evaporators 14, 16 may be made of aluminum, and may be bonded integrally by using bonding means such as brazing. Alternatively, the components of both the evaporators may be connected integrally by using a mechanical engagement means such as a bolt-fastening.

A heat exchanger of a fin and tube type may be used as the discharge side evaporator 14 and the suction side evaporator 16. In this case, fins may be used in common in both the discharge side heat exchanger 14 and the suction side heat exchanger 16, and a tube-pass structure (tube passage structure) in which refrigerant passes may be configured to be separated in two evaporators.

When both the discharge side evaporator 14 and the suction side evaporator 16 are configured to cool the same room in a refrigerator, the refrigerant evaporation temperature of the suction side evaporator 16 arranged at a downstream air side becomes in a temperature (0° C. or less) at which frost is caused. Thus, by adjusting the refrigerant evaporation temperature in the discharge side evaporator 14, the humidity of air blown into the suction side evaporator 16 can be decreased.

Thereby, generating of the frost in the suction side evaporator 16 can be controlled. Furthermore, because the air flow is not blocked by the frost, it is possible to reduce the fin pinch of the suction side evaporator 16, thereby reducing the size of the suction side evaporator 16.

(15) In the above-described embodiments, there are described regarding the ejector-type refrigeration cycle device 10 that is provided with only the first and second compression mechanisms 11*a*, 21*a*. However, additional compression mechanism may be provided. For example, an additional evaporator may be arranged in parallel with the suction side evaporator 16 of the 11th embodiment, and an additional compression mechanism may be provided to draw only the refrigerant flowing out of the additional evaporator.

In the above-described 11th to 37th embodiments, an ejector-type refrigeration cycle device of the present invention is used for a freezing/refrigerating device. However, the present invention is not limited to it. For example, the ejector-type refrigeration cycle device of the present invention may be used for a refrigeration cycle device for indoor air-conditioning or an air conditioner for a vehicle.

(17) In the above-described some embodiments, the suction side evaporator 16 is used as the using-side heat exchanger, and the radiator 12 is used as the exterior heat exchanger for radiating heat to the atmosphere. On the contrary, a heat pump cycle may be configured, such that the suction side heat exchanger 16 may be configured as the exterior heat exchanger, and the radiator 12 may be configured as the interior heat exchanger for heating a fluid to be heated, such as air or water.

(18) In the inner heat exchangers 30-35 of above-described embodiments, the refrigerant flow direction in the high-pressure side refrigerant passage and the refrigerant flow direction in the low-pressure side refrigerant passage are not described. The refrigerant flow direction in the high-side refrigerant passage and the refrigerant flow direction in the low-pressure side refrigerant passage may be arranged in the same direction. Alternatively, the refrigerant flow direction in the high-side refrigerant passage and the refrigerant flow direction in the low-pressure side refrigerant passage may be arranged in different directions. Furthermore, in the above-described 36th, 37th embodiment, the low-pressure side refrigerant in the cycle may be the refrigerant to be drawn into the second compression mechanism 21*a*.

(19) In the above-described 38th to 42nd embodiments, the thermal expansion valve 17 is used as the high-pressure side decompression means, so that a super heat degree of the refrigerant at the refrigerant outlet side of the discharge side evaporator 14 becomes in a predetermined value. However, a thermal expansion valve may be adopted so that the super heat degree of the refrigerant at the refrigerant outlet side of the suction side evaporator 16 becomes a predetermined value.

Furthermore, as a high-pressure side decompression means, an electrical expansion valve may be adopted for adjusting a throttle opening degree (valve opening degree) with an electric control signal from the outside. Alternatively, a fixed throttle mechanism having the same structure as the fixed throttle 19 may be adopted, without using a variable throttle mechanism as the high-pressure side decompression means. Moreover, a high-pressure side decompression means may be removed from the refrigeration cycle device in the 38th-41st embodiments.

Furthermore, when the super-critical refrigerant cycle is configured in the ejector-type refrigeration cycle device as in the 42nd embodiment, a pressure control valve may be used as a high-pressure side decompression means. In this case, the pressure control valve adjusts a high-pressure side refrigerant pressure to a target high pressure, based on a high-pressure side refrigerant temperature at the refrigerant outlet side of the radiator 12. Here, the target high pressure is a value determined such that the COP becomes approximately in maximum.

The pressure control valve may be configured to have a temperature sensing portion located at a refrigerant outlet side of the radiator 12, and may be configured to generate a pressure corresponding to the temperature of the high-pressure refrigerant at the refrigerant outlet side of the radiator 12 within the temperature sensing portion, so as to adjust the valve open degree by the balance between the inner pressure of the temperature sensing portion and the refrigerant pressure at the refrigerant outlet side of the radiator 12.

(20) An expansion unit may be used as the high-pressure side decompression means or the low-pressure side decompression means in the above described embodiments. In the expansion unit, the volume is expanded so as to decompress the refrigerant, and the pressure energy of the refrigerant is converted to the mechanical energy thereof. As the expansion unit, various displacement variable-compression mechanisms such as a scroll type compression mechanism, a vane type compression mechanism, a rotary piston type compression mechanism or the like can be used, for example.

In the expansion unit, when the refrigerant reversely flows with respect to the refrigerant flow in a case where the displacement variable compression mechanism is used as the compression mechanism, the mechanical energy can be output while refrigerant is decompressed by expending the volume. For example, a rotation-type displacement variable compression mechanism may be used as the expansion unit. In this case, the rotation energy recovered in the expansion unit can be output as the mechanical energy.

For example, the mechanical energy output from the expansion unit may be used as a supplemental power source of the first and second compression mechanisms. In this case, the energy efficiency in the entire ejector-type refrigeration cycle device can be improved. The mechanical energy output from the expansion unit may be used as a driving source of an exterior machine.

For example, electrical energy can be obtained if a generator is used as the exterior machine. For example, a flywheel may be used as the exterior machine. In this case, the mechanical energy output from the expansion unit can be stored as a kinetic energy. Moreover, a spring device (spiral spring) may be used as an exterior machine. In this case, the mechanical energy recovered in the expansion unit can be stored as an elastic energy.

(21) In the above-described some embodiments, an accumulator as a discharge-side gas-liquid separator may be provided at the refrigerant suction side of the first compressor 11, so as to separate the refrigerant to be drawn into the first compressor 11 into gas refrigerant and liquid refrigerant and to store the liquid refrigerant as surplus refrigerant of the cycle. In this case, the gas refrigerant separated at the accumulator can be supplied to the first compression mechanism 11*a*, thereby preventing a liquid refrigerant compression in the first compression mechanism 11*a*.

Similarly, a suction-side gas-liquid separator having the same structure as the accumulator may be arranged at the refrigerant suction side of the second compression mechanism 21*a*. In this case, only gas refrigerant separated at the suction-side gas-liquid separator can be supplied to the second compression mechanism 21*a*, thereby preventing a liquid refrigerant compression in the second compression mechanism 21*a*.

(22) In the above-mentioned 38th-the 42nd embodiments, the discharge side evaporator 14 and the suction side evaporator 16 are provided to cool different spaces to be cooled (e.g., the space of the refrigerating room, the space of the freezing room). However, the discharge side evaporator 14 and the suction side evaporator 16 may be provided to cool the same space to be cooled. In this case, it is desirable to integrally assemble the discharge side evaporator 14 and the suction side evaporator 16, and is desirable for air blown by a blower fan to pass the discharge side evaporator 14 and the suction side evaporator 16 in this order.

Thus, as described above, the refrigerant evaporation pressure (refrigerant evaporation temperature) of the suction side evaporator 16 can be made lower than the refrigerant evaporation pressure (the refrigerant evaporation temperature) of the discharge side evaporator 14. That is, because the air blown by the blower fan passes through the discharge side evaporator 14 and the suction side evaporator 16 as described above, a temperature difference between the blown air and the refrigerant evaporation temperature can be secured in both the discharge side evaporator 14 and the suction side evaporator 16, thereby effectively cooling the blown air.

When the discharge side evaporator 14 and the suction side evaporator 16 are integrally formed, the components of both the evaporators 14, 16 may be made of aluminum, and may be bonded integrally by using bonding means such as brazing. Alternatively, the components of both the evaporators 14, 16 may be connected integrally by using a mechanical engagement means such as a bolt-fastening.

A heat exchanger of a fin and tube type may be used as the discharge side evaporator 14 and the suction side evaporator 16. In this case, fins may be used in common in both the discharge side heat exchanger 14 and the suction side heat exchanger 16, and a tube-pass structure (tube passage structure) in which refrigerant passes may be configured to be separated in two evaporators.

When both the discharge side evaporator 14 and the suction side evaporator 16 are configured to cool the same room in a refrigerator, the refrigerant evaporation temperature of the suction side evaporator 16 arranged at a downstream air side becomes in a temperature (0° C. or less) at which frost is caused. Thus, by adjusting the refrigerant evaporation temperature in the discharge side evaporator 14, the humidity of air blown into the suction side evaporator 16 can be decreased.

Thereby, generating of the frost in the suction side evaporator 16 can be controlled. Furthermore, because the air flow is not blocked by the frost, it is possible to reduce the fin pinch of the suction side evaporator 16, thereby reducing the size of the suction side evaporator 16.

(23) In the above-described 38th-42nd embodiments, there are described regarding the ejector-type refrigeration cycle device that is provided with only the first and second compression mechanisms 11*a*, 21*a*. However, additional compression mechanism may be provided. For example, an additional evaporator may be arranged in parallel with the suction side evaporator 16 of the 38th embodiment, and an additional compression mechanism may be provided to draw only the refrigerant flowing out of the additional evaporator.

(24) In the above-described 38th to 42nd embodiments, an ejector-type refrigeration cycle device of the present invention is used for a freezing/refrigerating device. However, the present invention is not limited to it. For example, the ejector-type refrigeration cycle device of the present invention may be used for a refrigeration cycle device for indoor air-conditioning or an air conditioner for a vehicle.

(25) In the above-described some embodiments, the suction side evaporator 16 is used as the using-side heat exchanger, and the radiator 12 is used as the exterior heat exchanger for radiating heat to the atmosphere. On the contrary, a heat pump cycle may be configured, such that the suction side heat exchanger 16 may be configured as the exterior heat exchanger, and the radiator 12 may be configured as the interior heat exchanger for heating the refrigerant that is used to heat air or water to be heated.

(26) In the inner heat exchangers 30 and 31 of each above-described embodiments, the refrigerant flow direction in the high-pressure side refrigerant passage and the refrigerant flow direction in the low-pressure side refrigerant passage are not described. The refrigerant flow direction in the high-side refrigerant passage and the refrigerant flow direction in the low-pressure side refrigerant passage may be arranged in the same direction. Alternatively, the refrigerant flow direction in the high-side refrigerant passage and the refrigerant flow direction in the low-pressure side refrigerant passage may be arranged in different directions.

(27) In the above-described 43rd to 49th, 51st to 54th embodiments, the thermal expansion valve 17 is used as the high-pressure side decompression means, so that a super heat degree of the refrigerant at the refrigerant outlet side of the discharge side evaporator 14 becomes a predetermined value. However, a thermal expansion valve may be adopted so that the super heat degree of the refrigerant at the refrigerant outlet side of the suction side evaporator 16 becomes a predetermined value.

Furthermore, as a high-pressure side decompression means, an electrical expansion valve may be adopted for adjusting a throttle opening degree (valve opening degree) with an electric control signal from the outside. Alternatively, a fixed throttle mechanism having the same structure as the fixed throttle 39, 59 may be adopted, without using a variable throttle mechanism as the high-pressure side decompression means. Moreover, a high-pressure side decompression means may be removed from the refrigeration cycle device in the 43rd-49th, 51st-54th, 56th-58th, 60th-62nd embodiments.

Furthermore, when the super-critical refrigerant cycle is configured in the ejector-type refrigeration cycle device as in the 50th, 55th, 59th embodiments, a pressure control valve may be used as a high-pressure side decompression means. In this case, the pressure control valve adjusts a high-pressure side refrigerant pressure to a target high pressure, based on a high-pressure side refrigerant temperature at the refrigerant outlet side of the radiator 121 and the heat exchanger used as the radiator in the first and second heat exchangers. Here, the target high pressure is a value determined such that the COP becomes approximately in maximum.

The pressure control valve may be configured to have a temperature sensing portion located at a refrigerant outlet side of the heat exchanger used as the radiator, and may be configured to generate a pressure corresponding to the temperature of the high-pressure refrigerant at the refrigerant outlet side of the heat exchanger used as the radiator within the temperature sensing portion, so as to adjust the valve open degree by the balance between the inner pressure of the temperature sensing portion and the refrigerant pressure at the refrigerant outlet side of the heat exchanger used as the radiator.

(28) An expansion unit may be used as the high-pressure side decompression means or the low-pressure side decompression means in the above described 43rd-62nd embodiments. In the expansion unit, the volume is expanded so as to decompress the refrigerant, and the pressure energy of the refrigerant is converted to the mechanical energy thereof. As the expansion unit, various displacement-variable compression mechanisms such as a scroll type compression mechanism, a vane type compression mechanism, a rotary piston type compression mechanism or the like can be used, for example.

In the expansion unit, when the refrigerant reversely flows with respect to the refrigerant flow in a case where the displacement variable compression mechanism is used as the compression mechanism, the mechanical energy can be output while refrigerant is decompressed by expending the volume. For example, a rotation-type displacement variable compression mechanism may be used as the expansion unit. In this case, the rotation energy recovered in the expansion unit can be output as the mechanical energy.

For example, the mechanical energy output from the expansion unit may be used as a supplemental power source of the first and second compression mechanisms. In this case, the energy efficiency in the entire ejector-type refrigeration cycle device can be improved. The mechanical energy output from the expansion unit may be used as a driving source of an exterior machine.

For example, electrical energy can be obtained if a generator is used as the exterior machine. For example, a flywheel may be used as the exterior machine. In this case, the mechanical energy output from the expansion unit can be stored as a kinetic energy. Moreover, a spring device (spiral spring) may be used as an exterior machine. In this case, the mechanical energy recovered in the expansion unit can be stored as an elastic energy.

(29) In the above-described 43rd to 55th embodiments, the accumulator 55 as a discharge-side gas-liquid separator may be provided at the refrigerant suction side of the first compressor 11, similarly to 56th to 60th embodiments. In this case, the gas refrigerant separated at the accumulator can be supplied to the first compression mechanism 11*a*, thereby preventing a liquid refrigerant compression in the first compression mechanism 11*a*.

With respect to the 1st to 60th embodiments, a suction-side gas-liquid separator 55*a* may be arranged, similarly to the 62nd embodiment. In this case, only gas refrigerant separated at the suction-side gas-liquid separator can be supplied to the second compression mechanism 21*a*, thereby preventing a liquid refrigerant compression in the second compression mechanism 21*a*.

(30) In the above-mentioned 43rd-the 55th embodiments, the discharge side evaporator 14 and the suction side evaporator 16 are provided to cool different spaces to be cooled (e.g., the space of the refrigerating room, the space of the freezing room). However, the discharge side evaporator 14 and the suction side evaporator 16 may be provided to cool the same space to be cooled. In this case, it is desirable to integrally assemble the discharge side evaporator 14 and the suction side evaporator 16, and is desirable for air blown by a blower fan to pass the discharge side evaporator 14 and the suction side evaporator 16 in this order.

Thus, as described above, the refrigerant evaporation pressure (refrigerant evaporation temperature) of the suction side evaporator 16 can be made lower than the refrigerant evaporation pressure (the refrigerant evaporation temperature) of the discharge side evaporator 14. That is, because the air blown by the blower fan passes through the discharge side evaporator 14 and the suction side evaporator 16 as described above, a temperature difference between the blown air and the refrigerant evaporation temperature can be secured in both the discharge side evaporator 14 and the suction side evaporator 16, thereby effectively cooling the blown air.

When the discharge side evaporator 14 and the suction side evaporator 16 are integrally formed, the components of both the evaporators 14, 16 may be made of aluminum, and may be bonded integrally by using bonding means such as brazing. Alternatively, the components of both the evaporators 14, 16 may be connected integrally by, using a mechanical engagement means such as a bolt-fastening.

A heat exchanger of a fin and tube type may be used as the discharge side evaporator 14 and the suction side evaporator 16. In this case, fins may be used in common in both the discharge side heat exchanger 14 and the suction side heat exchanger 16, and a tube-pass structure (tube passage structure) in which refrigerant passes may be configured to be separated into two evaporators.

When both the discharge side evaporator 14 and the suction side evaporator 16 are configured to cool the same room in a refrigerator, the refrigerant evaporation temperature of the suction side evaporator 16 arranged at a downstream air side becomes in a temperature (0° C. or less) at which frost is caused. Thus, by adjusting the refrigerant evaporation temperature in the discharge side evaporator 14, the humidity of air blown into the suction side evaporator 16 can be decreased.

Thereby, generating of the frost in the suction side evaporator 16 can be controlled. Furthermore, because the air flow is not blocked by the frost, it is possible to reduce the fin pinch of the suction side evaporator 16, thereby reducing the size of the suction side evaporator 16. This is the same also in the 60th embodiment.

(31) In the above-described 43rd to 50th embodiments, the high-pressure branch operation mode is switched in a high load operation, the low-pressure branch operation mode is switched in a general operation, and the simultaneous branch operation mode is switched in a low load operation. However, the switching of the respective operation modes is not limited to it.

For example, the high-pressure branch operation mode may be switched in a high load operation, the simultaneous branch operation mode may be switched in a general operation, and the low-pressure branch operation mode may be switched in a low load operation in the cycle. That is, when the ejector-type refrigeration cycle device is operated, the operation modes may be switched such that the highest cycle efficiency can be obtained in any operation mode.

Moreover, the cycle may be configured such that high-pressure branch operation mode and the low-pressure branch operation mode can be selectively switched without setting the simultaneous branch operation mode. In this case, the first and second branch portions 18 and 28 may be constituted from a three-way valve, thereby switching a refrigerant passage.

Furthermore, a fixed throttle mechanism similarly to the fixed throttle 39, 59 may be used as first and second suction-side decompression means. In this case, an electromagnetic valve (opening/closing valve) may be provided between the first, second branch portion 18, 28 and the first, second suction-side decompression means, or in a refrigerant passage downstream of the first, second suction-side decompression means.

(32) In the inner heat exchanger 30-37 of the respective above-described embodiments, the refrigerant flow direction in the high-pressure side refrigerant passage and the refrigerant flow direction in the low-pressure side refrigerant passage are not described. The refrigerant flow direction in the high-side refrigerant passage and the refrigerant flow direction in the low-pressure side refrigerant passage may be arranged in the same direction. Alternatively, the refrigerant flow direction in the high-side refrigerant passage and the refrigerant flow direction in the low-pressure side refrigerant passage may be arranged in different directions. Furthermore, in the above-described 58th, 59th embodiment, the low-pressure side refrigerant in the cycle may be the refrigerant to be drawn into the second compressor 21.

(33) In the above-described embodiments, there are described regarding the ejector-type refrigeration cycle device 10, 40, 50 that is provided with only the first and second compression mechanisms 11*a*, 21*a*. However, additional compression mechanism may be provided. For example, an additional evaporator may be arranged in parallel with the suction side evaporator 16 of the 43rd embodiment, and an additional compression mechanism may be provided to draw only the refrigerant flowing out of the additional evaporator.

(34) In the above-described 43rd to 62nd embodiments, an ejector-type refrigeration cycle device of the present invention is used for a freezing/refrigerating device or a refrigerator. However, the present invention is not limited to it. For example, the ejector-type refrigeration cycle device of the present invention may be used for a refrigeration cycle device for indoor air-conditioning or an air conditioner for a vehicle.

(35) In the above-described 43rd to 62nd embodiments, the suction side evaporator 16 is used as the using-side heat exchanger, and the radiator 12 is used as the exterior heat exchanger for radiating heat to the atmosphere. On the contrary, a heat pump cycle may be configured, such that the suction side heat exchanger 16 is configured as the exterior heat exchanger, and the radiator 12 is configured as the interior heat exchanger for heating the refrigerant that is used to heat air or water to be heated.

What is claimed is:

1. An ejector-type refrigeration cycle device comprising:

a first compression mechanism configured to compress and discharge refrigerant;

a radiator configured to cool high-pressure refrigerant discharged from the first compression mechanism;

a branch portion provided to branch a flow of the refrigerant flowing out of the radiator;

an ejector including a nozzle portion adapted to decompress and expand the refrigerant of one stream branched at the branch portion, a refrigerant suction port adapted to draw the refrigerant by a high-speed flow of the refrigerant jetted from the nozzle portion, and a diffuser portion adapted to pressurize mix-refrigerant of the jet refrigerant and the refrigerant drawn from the refrigerant suction port;

a suction side throttle decompressing and expanding the refrigerant of other stream branched at the branch portion;

a suction side evaporator configured to evaporate the refrigerant decompressed by the suction side throttle and to cause the evaporated refrigerant to flow toward the refrigerant suction port of the ejector;

a second compression mechanism disposed between the suction side evaporator and the refrigerant suction port of the ejector to draw the refrigerant flowing out of the suction side evaporator, to compress the drawn refrigerant and then to discharge the compressed refrigerant directly to the suction port of the ejector, wherein the first compression mechanism and the second compression mechanism are compressors;

a first discharge capacity changing unit changing a refrigerant discharge capacity of the first compression mechanism;

a second discharge capacity changing unit changing a refrigerant discharge capacity of the second compression mechanism; and a controller which controls the first discharge capacity changing unit and the second discharge capacity changing unit, wherein the first discharge capacity changing unit and the second discharge capacity changing unit respectively independently change the refrigerant discharge capacities of the first compression mechanism and the second compression mechanism, and wherein the first discharge capacity changing unit and the second discharge capacity changing unit are each one of an electrical motor or a clutch, and wherein the controller controls a pressure increasing amount in the first compression mechanism and a pressure increasing amount in the second compression mechanism to be approximately equal so as to increase refrigerant pressure in a gas state in both the first and second compression mechanisms in series; and a refrigerant discharge side of the second compression mechanism is connected to the refrigerant suction port such that the compressed refrigerant discharged from the second compression mechanism is drawn into the ejector from the refrigerant suction port.

2. An ejector-type refrigeration cycle device comprising:

a first compression mechanism configured to compress and discharge refrigerant;

a radiator configured to cool high-pressure refrigerant discharged from the first compression mechanism;

a branch portion provided to branch a flow of the refrigerant flowing out of the radiator;

an ejector including a nozzle portion adapted to decompress and expand the refrigerant of one stream branched at the branch portion, a refrigerant suction port adapted to draw the refrigerant by a high-speed flow of the refrigerant jetted from the nozzle portion, and a diffuser portion adapted to pressurize mix-refrigerant of the jet refrigerant and the refrigerant drawn from the refrigerant suction port;

a suction side throttle decompressing and expanding the refrigerant of other stream branched at the branch portion;

a suction side evaporator configured to evaporate the refrigerant decompressed by the suction side throttle and to cause the evaporated refrigerant to flow toward the refrigerant suction port of the ejector;

a second compression mechanism disposed between the suction side evaporator and the refrigerant suction port of the ejector to draw the refrigerant flowing out of the suction side evaporator, to compress the drawn refrigerant and to discharge the compressed refrigerant, wherein the first compression mechanism and the second compression mechanism are compressors;

a discharge side evaporator configured to evaporate the refrigerant flowing out of the diffuser portion of the ejector and to discharge the evaporated refrigerant directly to the first compression mechanism;

a first discharge capacity changing unit changing a refrigerant discharge capacity of the first compression mechanism;

a second discharge capacity changing unit changing a refrigerant discharge capacity of the second compression mechanism; and a controller which controls the first discharge capacity changing unit and the second discharge capacity changing unit, wherein the first discharge capacity changing unit and the second discharge capacity changing unit respectively independently change the refrigerant discharge capacities of the first compression mechanism and the second compression mechanism, and wherein the first discharge capacity changing unit and the second discharge capacity changing unit are each one of an electrical motor or a clutch, and wherein the controller controls a pressure increasing amount in the first compression mechanism and a pressure increasing amount in the second compression mechanism to be approximately equal so as to increase refrigerant pressure in a gas state in both the first and second compression mechanisms in series; and a refrigerant discharge side of the second compression mechanism is connected to the refrigerant suction port such that the compressed refrigerant discharged from the second compression mechanism is drawn into the ejector from the refrigerant suction port.

3. The ejector-type refrigeration cycle device according to claim 1, further comprising a high-pressure side throttle arranged in a refrigerant passage from a refrigerant outlet side of the radiator to a refrigerant inlet side of the nozzle portion, the high-pressure side throttle decompressing and expanding the refrigerant flowing out of the radiator.

4. The ejector-type refrigeration cycle device according to claim 3, wherein the high-pressure side throttle is arranged in a refrigerant passage from a refrigerant outlet side of the radiator and a refrigerant inlet side of the branch portion.

5. The ejector-type refrigeration cycle device according to claim 3, wherein the high-pressure side throttle is arranged in a refrigerant passage from a refrigerant outlet side of the branch portion to a refrigerant inlet side of the nozzle portion.

6. The ejector-type refrigeration cycle device according to claim 1, further comprising an inner heat exchanger adapted to perform heat exchange between the refrigerant flowing out of the radiator and a low-pressure side refrigerant in a cycle.

7. The ejector-type refrigeration cycle device according to claim 6, wherein the refrigerant flowing out of the radiator is the refrigerant in a refrigerant passage from a refrigerant outlet side of the radiator to a refrigerant inlet side of the branch portion.

8. The ejector-type refrigeration cycle device according to claim 6, wherein the refrigerant flowing out of the radiator is the refrigerant in a refrigerant passage from a refrigerant outlet side of the branch portion to a refrigerant inlet side of the suction side throttle.

9. The ejector-type refrigeration cycle device according to claim 1, further comprising an inner heat exchanger adapted to perform heat exchange between the refrigerant in a decompression and expansion stage at the suction side throttle, and a low-pressure side refrigerant in a cycle.

10. The ejector-type refrigeration cycle device according to claim 6, wherein the low-pressure side refrigerant in the cycle is the refrigerant to be drawn to the first compression mechanism.

11. The ejector-type refrigeration cycle device according to claim 6, wherein the low-pressure side refrigerant in the cycle is the refrigerant to be drawn to the second compression mechanism.

12. The ejector-type refrigeration cycle device according to claim 1, wherein the radiator includes a condensation portion provided to condense the refrigerant, a gas-liquid separator provided to separate the refrigerant flowing out of the condensation portion into gas refrigerant and liquid refrigerant, and a super-cooling portion provided to super-cool the liquid refrigerant flowing out of the gas-liquid separator.

13. The ejector-type refrigeration cycle device according to claim 1, further comprising an auxiliary radiator arranged at a refrigerant downstream side of the branch portion, to cool the refrigerant flowing into the suction side throttle.

14. The ejector-type refrigeration cycle device according to claim 1, wherein the first compression mechanism and the second compression mechanism are received in a single housing to be integrally configured.

15. The ejector-type refrigeration cycle device according to claim 1, wherein the first compression mechanism is configured to pressurize the refrigerant to be equal to or more than a critical pressure of the refrigerant.

16. The ejector-type refrigeration cycle device according to claim 3, wherein the high-pressure side throttle, in which the refrigerant is decompressed by expanding a volume, and pressure energy of the refrigerant is converted to mechanical energy to be output.

17. The ejector-type refrigeration cycle device according to claim 1, further comprising a first throttle disposed between the branch portion and the ejector and a second throttle disposed between the branch portion and the suction side evaporator.

18. The ejector-type refrigerant cycle device according to claim 1, wherein the diffuser portion pressurizes the mix-refrigerant of the jet refrigerant and the refrigerant drawn from the refrigerant suction port of the ejector, in a gas-liquid two-phase state.

19. The ejector-type refrigerant cycle device according to claim 2, wherein the diffuser portion pressurizes the mix-refrigerant of the jet refrigerant and the refrigerant drawn from the refrigerant suction port of the ejector, in a gas-liquid two-phase state.

20. The ejector-type refrigerant cycle device according to claim 1, wherein the second compression mechanism draws the refrigerant flowing out of the suction side evaporator directly from the suction side evaporator.

21. The ejector-type refrigerant cycle device according to claim 2, wherein the second compression mechanism draws the refrigerant flowing out of the suction side evaporator directly from the suction side evaporator and discharges the compressed refrigerant directly to the suction port of the ejector.

22. An ejector-type refrigeration cycle device comprising:

a first compression mechanism configured to compress and discharge a refrigerant in a gas state;

a radiator configured to cool high-pressure refrigerant discharged from the first compression mechanism;

a branch portion provided to branch a flow of the refrigerant flowing out of the radiator into a first stream and a second stream;

an ejector including a nozzle portion adapted to decompress and expand the refrigerant of the first stream branched at the branch portion, a refrigerant suction port adapted to draw the refrigerant by a high-speed flow of the refrigerant jetted from the nozzle portion, and a diffuser portion adapted to pressurize mix-refrigerant of the jet refrigerant and the refrigerant drawn from the refrigerant suction port;

a suction side throttle decompressing and expanding the refrigerant of the second stream branched at the branch portion;

a suction side evaporator configured to evaporate the refrigerant decompressed by the suction side decompression means;

a second compression mechanism disposed between the suction side evaporator and the refrigerant suction port of the ejector to draw the refrigerant flowing out of the suction side evaporator, to compress the drawn refrigerant and to discharge the compressed refrigerant directly to the suction port of the ejector in a gas state, wherein the first compression mechanism and the second compression mechanism are compressors;

a first discharge capacity changing unit changing a refrigerant discharge capacity of the first compression mechanism;

a second discharge capacity changing unit changing a refrigerant discharge capacity of the second compression mechanism; and a controller which controls the first discharge capacity changing unit and the second discharge capacity changing unit, wherein the first discharge capacity changing unit and the second discharge capacity changing unit respectively independently change the refrigerant discharge capacities of the first compression mechanism and the second compression mechanism, such that a pressure increasing amount in the first compression mechanism and a pressure increasing amount in the second compression mechanism are controlled to be approximately equal, and wherein the first discharge capacity changing unit and the second discharge capacity changing unit are each one of an electrical motor or a clutch, wherein the second compression mechanism, the diffuser portion of the ejector and the first compression mechanism are arranged to pressurize the refrigerant in this order.

23. The ejector-type refrigeration cycle device according to claim 22, wherein the refrigerant from the second compression mechanism flows directly to the refrigerant suction port of the ejector, the refrigerant from the ejection flows directly to a discharge side evaporator, the refrigerant from the discharge side evaporator flows directly to the first compression mechanism and the refrigerant from the first compression mechanism flows directly to the radiator.

24. The ejector-type refrigeration cycle device according to claim 22, wherein the refrigerant from the suction side evaporator flows directly to the second compression mechanism.

25. The ejector-type refrigeration cycle device according to claim 22, further comprising a pressure side throttle disposed directly between the radiator and the branch portion.

26. The ejector-type refrigeration cycle device according to claim 25, wherein the refrigerant from the second compression mechanism flows directly to the refrigerant suction port of the ejector, the refrigerant from the ejection flows directly to a discharge side evaporator, the refrigerant from the discharge side evaporator flows directly to the first compression mechanism and the refrigerant from the first compression mechanism flows directly to the radiator.

27. The ejector-type refrigeration cycle device according to claim 25, wherein the refrigerant from the suction side evaporator flows directly to the second compression mechanism.

* * * * *